United States Patent [19]

Suzuki et al.

[11] 4,351,214

[45] Sep. 28, 1982

[54] ELECTRONIC MUSICAL INSTRUMENT WITH PERFORMANCE MODE SELECTION

[75] Inventors: Hideo Suzuki, Kamimura; Makoto Kaneko, Hamakita, both of Japan

[73] Assignee: Nippon Gakki Seizo Kabushiki Kaisha, Hamamatsu, Japan

[21] Appl. No.: 228,782

[22] Filed: Jan. 27, 1981

[30] Foreign Application Priority Data

Jan. 28, 1980 [JP] Japan ..... 55-8607

[51] Int. Cl.[3] ..... G10H 1/36; G10H 5/00; G10H 7/00

[52] U.S. Cl. ..... 84/1.03; 84/1.17; 84/DIG. 2; 84/DIG. 22

[58] Field of Search ..... 84/1.01, 1.03, 1.17, 84/1.24, DIG. 2, DIG. 12, DIG. 22

[56] References Cited

U.S. PATENT DOCUMENTS 4,192,211 3/1980 Yamaga et al. ..... 84/1.01
4,192,212 3/1980 Yamaga et al. ..... 84/1.03

*Primary Examiner*—S. J. Witkowski
*Attorney, Agent, or Firm*—Spensley, Horn, Jubas & Lubitz

[57] ABSTRACT

This electronic musical instrument comprises means for selecting one of a plurality of performance modes and musical tone production means having tone production channels less than the number of keys. Tones are produced through said channels based on the time division multiplex key data which are set according to the depressed status of all key in the different manner according to the selected performance mode of the mode selecting means.

23 Claims, 32 Drawing Figures

| TIME SLOTS | 1 | 2 | 3 | 4 | 5 | 6 | 7 | 8 | 9 | 10 | 11 | 12 | 13 | 14 | 15 | 16 | 17 | 18 | 19 | 20 | 21 | 22 |
|---|---|---|---|---|---|---|---|---|---|---|---|---|---|---|---|---|---|---|---|---|---|---|
| KG1 | "1" | NG | B1 | N1 | B1 | N1 | | | | | | | | | B1 | N1 | | | | | B1 | N1 |
| KG2 | "1" | ABC | B2 | N2 | B2 | N2 | " | " | " | " | " | " | " | " | B2 | N2 | " | " | " | " | B2 | N2 |
| KG3 | "1" | 4.5M | B3 | N3 | B3 | N3 | | | | | | | | | B3 | N3 | | | | | B3 | N3 |
| KG4 | "1" | — | KO1' | N4 | KO1' | N4 | | | | | | | | | KO1 | N4 | | | | | KO1 | N4 |
| KEY RANGE | | | L | | L | | L | L | L | | A | | P | | U | | U | U | U | | U | |
| CHANNEL | 1 | | 3 | | 5 | | 7 | | 9 | | 11 | | 2 | | 4 | | 6 | | 8 | | 10 | |

ELECTRONIC MUSICAL INSTRUMENT WITH PERFORMANCE MODE SELECTION

BACKGROUND OF THE INVENTION

The invention relates to electronic musical instruments, and more particularly to electronic musical instruments provided with a plurality of tone production channels less than the number of keys.

In an electronic musical instrument having an upper keyboard generally often used for melody performance and a lower keyboard generally often used for accompaniment performance, the tones produced by the upper keyboard and lower keyboard are usually different tone colors from each other, with the result that a plurality of the upper keyboard production channels and a plurality of the lower keyboard production channels should be independently constructed. One of the known electronic musical instruments of this type is disclosed in U.S. Pat. No. 4,192,211. The number of production channels provided for the upper keyboard and that for the lower keyboard shall be equal the number of the simultaneous maximum tones to be produced, e.g., around 10, since there are cases when performance is made by both hands using only the upper keyboard, or when performance is made by both hands using only the lower keyboard. However, in general practice, melody performance is made by one hand (right hand) using the upper keyboard and accompaniment performance is made by the other hand (left hand) using the lower keyboard. In this case, both the number of the upper keyboard production channels and the number of the lower keyboard production channels are considerably smaller than the total number of channels (around 1 to 3 channels), and many production channels remain unused.

On the other hand, in an electronic musical instrument which has a single keyboard, it is practiced that the keyboard is divided into the higher tone key range for the melody performance and the lower tone key range for the accompaniment performance, in which tones of different tone colors are produced. In this type of electronic musical instruments, a plurality of tone production channels are provided respectively correspondingly to the melody and accompaniment, and the number of channels for each thereof is not usually so large. This is to prevent wastefulness caused by the presence of unused production channels and to reduce the production cost. However, this involves an inconvenience that when a free performance is attempted, e.g., when multiple tones are to be performed simultaneously by the melody tone color, departing from the limit of expected form of performance, e.g., one tone for melody and simultaneous 3 tones for accompaniment, the performance cannot be made by the electronic musical instrument having only a limited number of melody production channels.

To solve the above problem, an electronic musical instrument was proposed by A. Nakada et al in the preceding application U.S. Ser. No. 182,464 "Electronic Musical Instrument with Plural Tone Production Channels" dated Aug. 28, 1980 (assigned to the same assignee as the present case), in which the relationship between the production channel and key range (or key board) was not fixed but made variable according to the performance mode, i.e., all production channels could be set to produce melody tone through the whole keyboard or the production channels could be used divided between the melody tone (specific key range tone) and accompaniment tone (different key range tone). Since the depressed key information indicating the depressed key is a multiple bit key code, the circuit processing the depressed key information tends to be complex. For example, when tones of each key range of a single keyboard are to be assigned to a production channel group dividing, the key code indicating the depressed key should be fed to the comparator circuit or ROM (read only memory) key detector, and the key range should be detected based on the value of the key code. Accordingly, relatively complex circuits, such as the comparting circuit and ROM, are required. In addition, further data such as automatic bass tone should be generated based on the depressed key information depending on the selected performance mode. In such case, the key code for the automatic bass tone is formed based on the arithmetic operation such as addition of subordinate note calculation data to the key code of root note. Accordingly, the arithmetic (operation) circuit of plural bit data is essential thereby making the circuit composition complex.

SUMMARY OF THE INVENTION

Therefore, it is an object of this invention to provide an electronic musical instrument with an efficient utilization of the limited number of production channels according to the designated performance mode so that the relationship between the production channels and key range (or keyboard) and the relationship between those and musical tone production manner may be changed according to the performance mode rather than being fixed, as well as the realization of the above by a simplified circuit configuration.

Another object of this invention is to provide an electronic musical instrument characterized by a further promoted efficient utilization of the musical tone production channels by designing the limited number of tone production channels so that not only keys depressed on the keyboard but also the tone not directly depressed on the keyboard, e.g., automatic accompaniment tone can be utilized.

According to an embodiment of the present invention for accomplishing the above objectives, there is provided an electronic musical instrument which comprises, a plurality of keys, means for forming time division multiplex key data determined by the depressed status of all keys, means for generating key codes corresponding to all keys synchronized with said key data, key code memory means having a plurality of channels less than the total number of keys and receiving outputs of said key code generating means, tone generating means having a plurality of musical tone production channels corresponding to individual channels of said key code memory means, means for selecting one of plural performance modes, and assign channel setting means for storing said key codes applied from said key code generating means based on said key data forming means in different manners according to the selected performance mode in any of the channels of said key code memory.

DESCRIPTION OF THE PREFERRED EMBODIMENTS

General Construction

Figure 1:
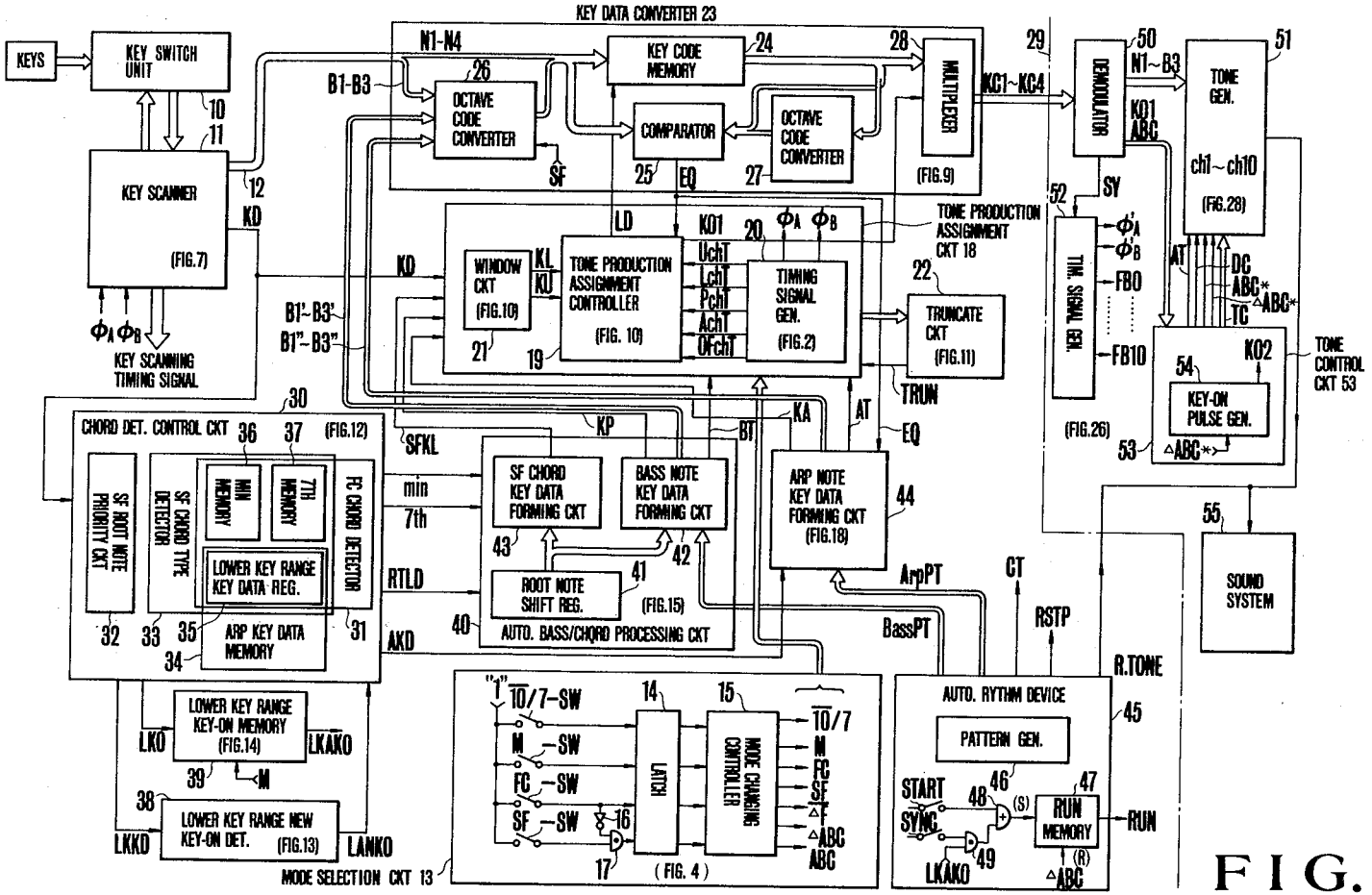
FIG. 1 is a block diagram showing the entire construction of the electronic musical instrument embodying the present invention.

The electronic musical instrument shown in FIG. 1 is of the single stage keyboard type, so that a key switch unit 10 comprises a plurality of key switches corresponding to respective keys of the single stage keyboard and arranged to form a matrix. A key scanner 11 scans the key switches in the key switch unit 10 from the high tone side to the low tone side in order to produce on a single output line a time division multiplex key data KD representing ON/OFF states of a given key depending upon the presence or absence ("1" or "0") of a time slot corresponding to each key. Although the key scanner 11 can scan starting from the key on the low tone side, in the following it is assumed that the key scanner starts to scan from the high tone side.

The key scanner 11 includes a scanning counter, not shown, which produces a key code made up of a plurality of bits and representing a key now being scanned (the key code comprises note codes N1 through N4 and octave codes B1 through B3) and the output is supplied to a scanned key representing line 12. Furthermore, the key scanner 11 is constructed such that it provides a surplus time not corresponding to any keys of the key switch unit 10 and that it does not send out any key data during that time, thus assuring a time margin for forming key informations for various automatic performances in the succeeding circuits. Further the key scanner 11 forms various timing signals related to the key scanning operation and supplied to the other circuit elements. The detail of the timing signals related to the key scanning will be described later in detail.

The electronic musical instrument shown in FIG. 1 has an automatic bass/chord performance ability, and where the automatic base/chord performance is not selected, all tone producing channels are used in common for all keys so as to produce tones of all keys of the keyboard in a first tone production manner (melody performance), whereas when the automatic bass/chord performance is selected, a key range covering a portion of the keyboard is made to correspond to a second tone production manner (automatic bass/chord performance and automatic arpeggio performance, that is the accompaniment performance) while the remaining key range is made to correspond to the first tone production manner (melody performance). Where the keyboard is utilized in two ranges for the first and second tone production manners, a predetermined tone production channel group among all tone production channels is exlusively used for the second tone production manner, while the other tone production channel group is exclusively used for the first tone production manner.

In the key range utilized for the second tone production manner, the accompaniment chord is designated by depressing a key. The automatic bass tone is automatically formed based on the designated accompaniment chord and the bass pattern data. The tone production channel group (accompaniment channel) for the second tone production manner comprises a tone production channel for the chord and a tone production channel exclusively used for the automatic bass tone.

Furthermore, the electronic musical instrument shown in FIG. 1 is provided with an automatic arpeggio performance ability interlocked with the automatic bass/chord performance. Upon selection of the automatic bass/chord performance, the automatic arpeggio performance is also selected in an interlocked relation so as to automatically produce the constituting tones of the accompaniment chord in the form of an arpeggio. For this reason, the tone production channel group for the second tone production manner is provided with a tone production channel for the automatic arpeggio.

Whether the keyboard and the tone production channels of the electronic musical instrument shown in FIG. 1 are used only for the first tone production manner or separately used for the first and second tone production manners is selected by a mode selection circuit 13 which comprises a switch FC-SW for selecting the fingered chord mode of the automatic bass/chord performance, and a switch SF-SW for selecting the single finger mode as the principal elements. In addition, the mode selection circuit 13 comprises a memory function selection switch M-SW for selecting the mode and a channel number selection switch $\overline{10}$/7-SW. There are also provided a latch device 14 which stores the ON/OFF states of respective switches, and a mode changing controller 15 which generates various mode signals $\overline{10}$/7, M, FC, SF and ABC in accordance with the ON/-OFF states of respective switches stored in the latch device 14 and pulses ΔF and ΔABC showing the mode change at the time of switching the mode.

When the fingered code mode selection switch FC-SW or the single finger mode selection switch SF-SW is closed, it means that the automatic bass/-chord performance (as well as the automatic arpeggio performance interlocked therewith) is selected and the keyboard and the tone production channels of the electronic musical instrument are separately used for the first and second tone production manners. At this time, an automatic bass/chord mode signal ABC becomes "1", thus designating the separate use. The output "11" of the switch FC-SW is inverted by an inverter 16 and then applied to one input of an AND gate circuit 17 to block the output of the switch SF-SW, thus giving a priority to the fingered chord mode (FC) with respect to the single finger mode (SF).

When both switches FC-SW and SF-SW are open, it means that the automatic bass/chord performance is selected. In this case, the keyboard and the tone production channels are used only for the first tone production manner. The mode in which the automatic chord performance is not selected is hereinafter termed a normal mode in which an automatic bass/chord mode signal ABC is "0".

The mode changing control circuit 15 produces a mode changing pulse ΔABC for a definite time when the automatic bass/chord mode (the fingered chord mode or the single finger mode) changes to the normal mode or vice versa. The mode changing pulse ΔABC is used to clear the tone production assignment of the tone production channel group utilized by the second tone production manner (automatic bass/chord performance) or to temporarily inhibit the operations of various circuit elements. Since this tone production channel group is seperately utilized by the first and second tone production manners, at the time of the mode changing, the old tone production data (tone production data for either one of the first and second tone production manners) is once cleared by the mode changing pulse ΔABC to prepare for the assignment of a new tone production data (the data for the other one of the first and second tone production manners). Especially when the mode is changed during performance, this mode changing pulse ΔABC is effective to prevent generation of a unwanted transient tone caused by the mode changing.

A memory function selection switch M-SW stores the depressed key data at the time of the automatic bass/chord performance after the depressed key has been released so as to select a memory function which continuously generates the automatic bass tone, chord tones etc. even after the key release.

The channel number selection switch $\overline{10}$/7 selects the total number of the tone production channels to be available. In this embodiment, the switch $\overline{10}$/7 selects either one of 10 channels and 7 channels. When this switch is OFF (open), 10 channels are selected.

A tone production assignment circuit 18 comprises a tone production assignment controller 19 to assign the tone production of a depressed key to either one of the tone production channels in accordance with a time division multiplex key data KD which shows the depressed key depending upon the presence or absence of pulses in respective time slots. The maximum number of the tone production channels is 10 and when the switch $\overline{10}$/7 ON (closed), the maximum number of the tone production channels is reduced to 7. The tone production asignment circuit 18 further comprises a timing signal generator 20 and a window circuit 21.

The timing signal generator 20 produces channel timing signals UchT, LchT, PchT and AchT corresponding to the time division timings of respective tone production channels. Depending upon channel timing signal generated at a given channel time, whether the assigned tone production channel is utilized in a first tone production manner or in the second tone production manner is determined. The timings of generating channel timing signals UchT through AchT are switched in accordance with various mode signals 10/7 through ΔABC given from the mode selection circuit 13. This switching operation controls whether all tone production channels are to be utilized for the first tone production manner or to be separately utilized for the first and second tone production manners.

The window circuit 21 functions to assign the key data KD supplied from the key scanner 11 to either one of the first and second tone production manners depending upon the states of various mode signals given by the mode selection circuit 13. In the case of the normal mode, the key data of all keys are assigned to the first tone production manner, whereas in the case of the automatic bass/chord mode, the key data KD of a predetermined key range is assigned to the first tone production manner and the key data KD of the other key range is assigned to the second tone production manner. The key data KD thus assigned according to respective tone production manners are applied to the tone production assignment controller 19 to be assigned to either one of the channel group designated by the channel timing signals UchT and LchT given from the timing signal generator 20. The off channel timing signal OFchT produced by the timing signal generator 20 is generated in accordance with the mode changing pulse ΔABC to designate the channels to be clear among assigned tone production channels.

The truncate circuit 22 associated with the tone production assignment circuit 18 detects a channel to be truncated whose key has been released at the earliest time, thus producing a truncate channel signal TRUN at timing corresponding to the channel to be truncated. In response to this truncate channel signal TRUN, the tone production assignment controller 19 assigns the tone production of a newly depressed key to correspond to the channel designated by the truncate channel signal TRUN.

When it is determined that the key data from the key scanner 11 is to be newly assigned, the tone production assignment controller 19 produces a load signal LD (assignment instruction) at timing corresponding to the timing of a channel to be assigned. At the same time, the tone production assignment controller 19 stores and produce a key-on signal KO1 corresponding to the channel which has generated the load signal LD.

The key data converter 23 converts the key data KD assigned by the tone production assignment circuit 18 into a key code made up of a plurality of bits and stores the key code. The key data converter 23 includes a key code memory device 24 which stores the key codes of tones assigned to respective tone production channels. The key code memory device 24 is supplied with key codes N1 through N4 and B1 through B3 from the key scanner 11 through a scanned key representing line 12. When supplied with the load signal LD from the tone production assignment controller 19, the key code memory device 24 stores the key codes N1 through B3 applied to its input to correspond to a channel which has produced the load signal LD.

Further, the key data converter 23 includes a comparator 25 which compares a key code representing a scanned key supplied through the scanned key representing line 12 with a key code already assigned and stored in the key code memory device 24 which produces, on the time division basis, the key codes which have been assigned to respective channels in synchronism with the time division time slots of respective channels of the tone production assignment circuit 18. The time division timings of respective channels have higher speed than the key scanning timing so that while one of the key codes N1 through B3 is being outputted to the scanned key representing line 12, the key code memory device 24 would produce key codes of all channels. Upon coincidence of two inputted key codes the comparator 25 produces a coincidence signal EQ which is applied to the tone production assignment controller 19. Depending upon the presence or absence of the coincidence signal EQ, the tone production assignment controller 19 judges that whether the key data KD now being applied has already been assigned or not.

Octave code converters 26 and 27 in the key data converter 23 convert the values of the octave code, B1 through B3 of the key code when executing the processing for the automatic bass/chord performance or the automatic arpeggio performance. A mutliplexer 28 multiplexes the key codes N1 through N4 and B1 through B3 outputted from the key code memory device 24 and assigned to respective channels and the key-on signal KO1 outputted from the tone production assignment controller 19 into data KC1 through KC4 each comprising 4 bits. The reason for multiplexing is to save the number of the connecting pins since portions divided by dot and dash lines 29 are constituted by independent integrated circuits.

The timing signal generator 20 in the tone production assignment circuit 18 also produces clock pulses αA and αB used to set the key scanning time and are supplied to the key scanner 11.

The key data KD produced by the key scanner 11 are also supplied to a chord detection control circuit 30 which is principally used to detect the accompaniment chord of the automatic bass/chord performance but has various other functions. When analyzed functionally, the chord detection control circuit 30 comprises a FC chord detector 31 for the fingered code mode (FC), a SF root note priority circuit 32 for the single finger mode (SF), a SF chord type detector 33 for the single finger mode (SF), and an ARP key data memory device 34 for the arpeggio (ARP). A lower key range key data register 35 is commonly used by the FC chord detector 31, the SF chord type detector 33 and by the ARP key data memory device 34, while a minor chord (min) memory device 36 and a seventh chord (7th) memory device 37 are commonly used by the FC chord detector 31 and the SF chord type detector 33.

The FC chord detector 31 detects an accompaniment chord based on a combination of key data KD corresponding to depressed keys in a key range (hereinafter termed the lower key range) utilized for the second tone production manner among various key data to produce a root note data RTLD representing the root note of the detected chord and data min or 7th representing the type of the chord. The data min is "1" for the minor chord, the data 7th is "1" for the seventh chord, and both data min and 7th are "0" for the major chord. These data min and 7th are stored in the memory devices 36 and 37 respectively.

In the single finger mode SF, one key representing the root note of the chord in the lower key range (that is the accompaniment key range) utilized for the second tone production manner is depressed as a highest tone (or lowest tone), and predetermined keys on the lower (or higher) tone side in the same key range are depressed (or not depressed) for designating the chord type of major, minor and seventh. For this reason in the SF root note priority circuit 32 the depressed key data of the highest (or lowest) tone is preferentially detected among the key data of the lower key range, and the detected key data is outputted as the root note data RTLD. The SF chord type detector 33 detects the chord type from the key data corresponding to the depressed keys other than the highest tone (or the lowest tone) preferentially detected by the circuit 32 and the data thus detected are stored in the memory device 36 or 37. Where a natural or white key other than the root note designation keys is depressed, a 7th chord is produced and where a sharp or black key is depressed a minor chord is produced. When no key other than the root note designation key is depressed, a major chord is produced.

The chord detection control circuit 30 selects a key data in the lower key range among the key data and outputs the selected key data as a lower key range key data LKKD which is supplied to a lower key range new key-on detector 38 so as to cause it to produce a lower key range new key-on signal LANKO when either one of keys in the lower key range is newly depressed.

The chord detection control circuit 30 operates to store the lower key range key data LKKD and produce a lower key range key-on signal LKO which becomes "1" when either one of the keys in the lower key range is depressed. This lower key range key-on signal LKO is stored in a lower key range key-on signal memory device 39 and a lower key range key-on signal LKAKO which becomes "1" when either one of the keys in the lower key range is depressed is outputted from this memory device 39. This lower key range any key-on signal LKAKO is maintained at "1" even after the releasing of the key in the memory mode (M is "1").

The automatic bass/chord processing circuit 40 is constituted by a root note shift register 41 which stores and shifts the root note data RTLD detected by the chord detection control circuit 30, a bass note key data forming circuit 42, and a single finger mode (SF) chord key data forming circuit 43. The root note shift register 41 sequentially shifts the root note data RTLD generated in accordance with the timing of the root note for producing timing data of a tone of a predetermined interval (subordinate tone) with respect to the root note from respective stages of the shift register. The bass note key data forming circuit 42 produces not only the timing data, i.e., the bass note key data KP, of a note corresponding to the interval shown by the bass pattern data Bass PT bassed on the output of the root note shift register 41, the chord type data min and 7th, and the bass pattern data BassPT but also the octave codes B1' through B3' of the bass tone to be produced as well as a bass timing signal BT showing the timing of producing the bass tone in accordance with the timing of generation of the bass pattern data BassPT. The SF chord key data forming circuit 43 produces a timing data (the single finger chord key data SFKL) showing the root note and subordinate notes of a chord (chord constituting tone) according to the output of the root note shift register 41 and the chord type data min and 7th.

The arpeggio (ARP) key data memory device 34 in the chord detection control circuit 30 stores respective key data of the accompaniment chord constituting tones of the fingered chord mode (FC) or single finger chord mode (SF) and applies key data AKD to the arpeggio key data forming circuit 44 in which a tone in the order of tone pitches designated by the arpeggio pattern data ArpPT is searched out from the chord constituting tone key data AKD thus producing an arpeggio key data KA at timing corresponding to the timing of the note searched. The arpeggio note key data forming circuit 44 also produces the octave chords "B1" through B3" of the arpeggio tone and an arpeggio timing signal representing the timing of producing the arpeggio tone corresponding to the timing of producing the arpeggio pattern data ArpPT. To search a tone according to the order of tone pitches designated by the arpeggio pattern data ArpPT, the coincidence signal EQ outputted from the comparator 25 of the key data converter 23 is utilized in the ARP note key forming circuit 44.

The timing of respective notes for the single finger chord key data SFKL, the bass note key data KP and the arpeggio note key data KA coincides with the timing of the key data KD produced by the key scanner 11. These automatically formed key data SFKL, KP and KA are supplied to the tone production assignment circuit 18 to be assigned to the tone production channel group for the second tone production manner. The octave codes B1' through B3' of the bass tone and the octave codes B1" through B3" of the arpeggio are applied to the octave code converter 26 to be supplied to the key code memory device 24 instead of the octave codes B1 through B3 of the scanned key representing line 12. Also in the case of the single finger mode (SF), an independent octave code is formed by the octave code converter 26 based on the single finger mode signal SF and the independent octave code is applied to the key code memory device 24 in lieu of the octave code of the scanned key representing line 12.

The bass pattern data BassPT and the arpeggio pattern data ArpPT are generated from a pattern generator 46 in an automatic rhythm device 45. The automatic rhythm device 45 is provided with a plurality of rhythm selection switches and pattern selection switches (both not shown) for causing the pattern generator 46 to produce predetermined bass pattern data BassPT, the arpeggio pattern data ArpPT and a chord producing timing pattern pulse CT in accordance with a selected rhythm and pattern. Further, a rhythm tone signal R.TONE is produced in accordance with the selected rhythm. The automatic rhythm device 45 produced a rhythm run signal RUN which shown whether the rhythm is running or not. When "1" is set in the RUN memory device 47, the automatic rhythm device 45 is operating so that it can produce the rhythm tone signal R.TONE, the bass pattern data BassPT, the arpeggio pattern data ArpPT and the chord producing timing pattern pulse CT. The rhythm run signal RUN outputted from the RUN memory device 47 at this time is "1". When the RUN memory device 47 is reset, the operatio of the automatic rhythm device 45 is stopped so that the rhythm tone signal R.TONE and the pattern data BassPT, ArpPT and CT are not produced. The RUN memory device 47 is set by a signal "1" from OR gate circuit 48 when the rhythm start switch START is ON (closed) or the synchrostart switch SYNC is ON (closed) and a certain key in the lower key range for the accompainment is ON (closed). The output of the synchrostart switch SYNC is applied to one input of an AND gate circuit 49, while the other input thereof is supplied with the lower key range any key-on signal LKAKO from the lower key range key-on memory device 39. The term "synchrostart" is used herein to mean that a rhythm is started in synchronism with the depression of a key. The pattern data BassPT, ArpPt and CT are not produced by merely setting the RUN memory device 47 unless a certain rhythm is selected.

The RUN memory device 47 is once reset by the mode changing pulse Δ ABC, and when the rhythm start switch START is ON, the RUN memory device 47 is set again when the pulse Δ ABC disappears so that the rhythm and the automatic performance pattern are stopped while the mode switching pulse Δ ABC is being generated. When the synchrostart switch SYNC is ON, the RUN memory device 47 is reset again when a key in the lower key range is depressed after removal of the mode changing pulse Δ ABC. When the RUN memory device 47 is being reset or rhythm is not selected, the automatic rhythm device 45 produces a rhythm stop signal RSTP which is used to control the automatic bass/chord performance.

The multiplexer 28 multiplexes not only the key codes N1 through N3 and the key-on signal KO1 assigned to respective channels, but also the automatic bass/chord mode signal ABC outputted by the mode selection circuit 13, and other control signals.

A demodulator 50 is provided to demodulate data KC1 through KC4 multiplexed by the multiplexer 28 into key codes N1 through B3, a key-on signal KO1, and an automatic bass/chord mode signal ABC which are taken out separately. The key codes N1 through B3 are supplied to a musical tone signal generator 51 comprising tone signal production systems ch1 through ch10 corresponding to respective tone production channels. The key codes of respective channels given by the demodulator 50 are distributed among the tone signal production systems ch1 through ch10 corresponding to respective tone production channels for producing musical tone signals having tone pitches corresponding to the key codes to be distributed. A timing signal generator 52 is used to produce timing pulses $\phi'$A, $\phi$B' and FB0 through FB10 based on a reference pulse SY given by the demodulator 50. The timing pulses FB0 through FB10 are used to distribute the key codes N1 through B3 regarding respective channels outputted from the demodulator 50 among the tone signal production systems ch1 through ch10 of the musical tone signal generator 51. A musical tone control circuit 53 is provided to produce an attack signal AT and a decay signal DC for controlling the musical tone amplitude envelope, an automatic bass/chord mode signal ABC*, a mode switching pulse Δ ABC* and a tone color selection signal TC. Thus, the musical tone signal generator 51 controls the musical tone amplitude envelope and the tone color in accordance with the signals generated by the musical tone control circuit 53. The mode switching pulse Δ ABC* is substantially the same as the mode changing pulse Δ ABC generated by the mode changing control circuit 15. This is made for the purpose of saving the number of wirings. Thus, instead of supplying the pulse Δ ABC to the musical tone signal generator 51, the mode switching pulse Δ ABC* is newly formed.

The musical tone control circuit 53 contains a key-on pulse generator 54 for generating key-on pulses of predetermined width at the built up time of the key-on signal KO1. By generating a attack signal for a short time in response to the key-on pulse KO2, the musical tone signal generator 51 produces a musical tone signal imparted with a percussive type amplitude envelope. The key-on pulse generator 54 operates to inhibit generation of the key-on pulse KO2 while the mode switching pulse Δ ABC* is being generated. When the mode is switched, a tone of a depressed key might often be assigned to another tone production channel so that a false key-on pulse KO2 is generated irrespective of the fact that a key is not actually depressed. The inhibition of the false key-on pulse KO2 is necessary to prevent duplicate production of the musical tones of the percussive type envelope.

The musical tone signals generated by the musical tone signal generator 51 and the rhythm tone signal R.TONE produced by the automatic rhythm device 45 are applied to a sound system 55 to be converted into a musical tone.

FIG. 1 shows general wirings of various circuit elements of a preferred emboldiment of the electronic musical instrument embodying the invention.

Actually, however, many signals are transmitted between various circuit elements. The detail thereof will be described in connection with FIG. 2 and succeeding drawings.

Clock pulses

Figure 2:
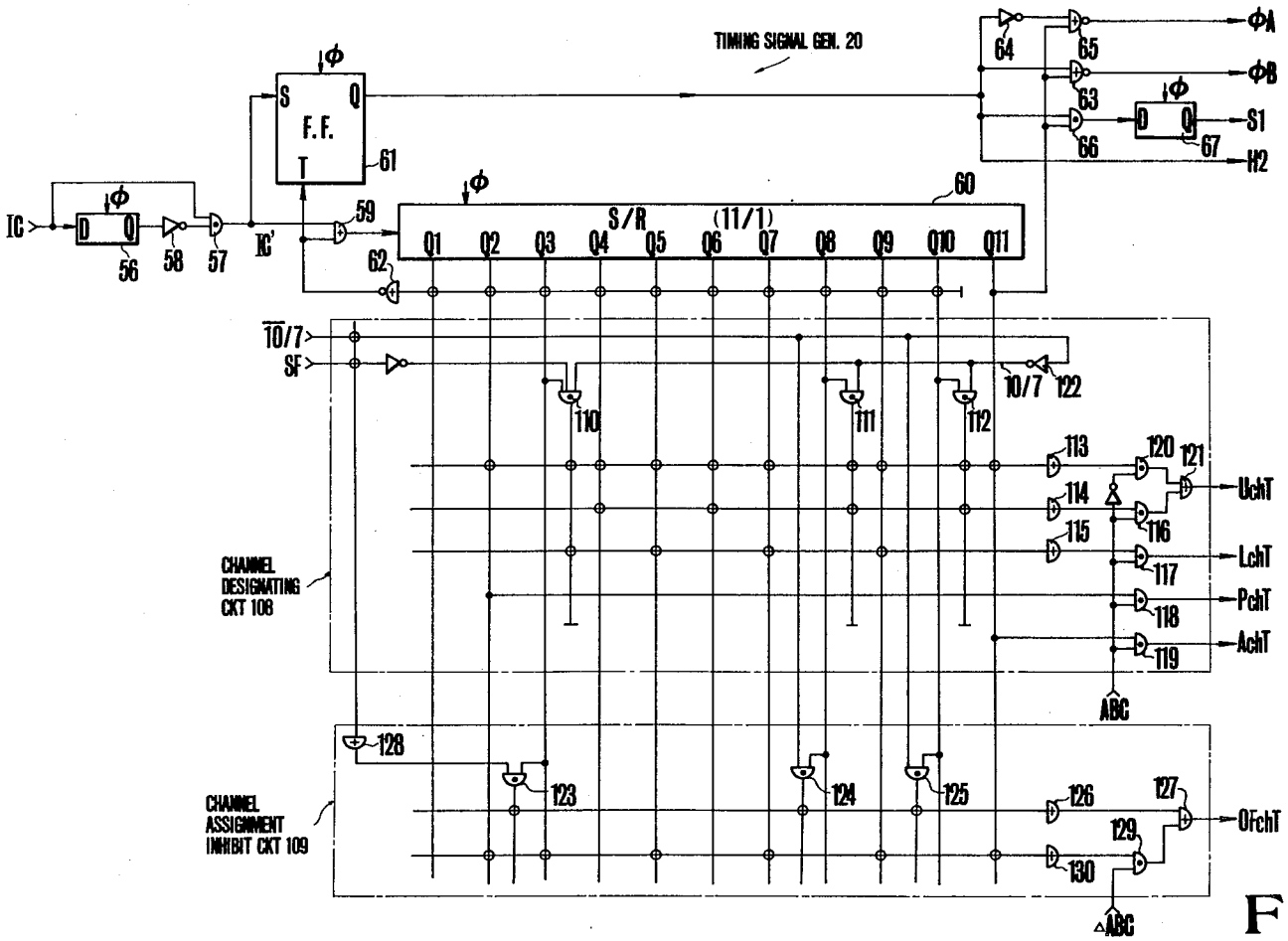
FIG. 2 is a connection diagram showing the detail of a timing signal generator in a tone production assignment circuit.

The detail of one example of the timing signal generator 20 in the tone production assignment circuit 18 is shown in FIG. 2. The timing signal generator 20 generates not only the channel timing signals UchT through AchT but also key scanning clock pulses $\phi$A and $\phi$B.

Figure 3:
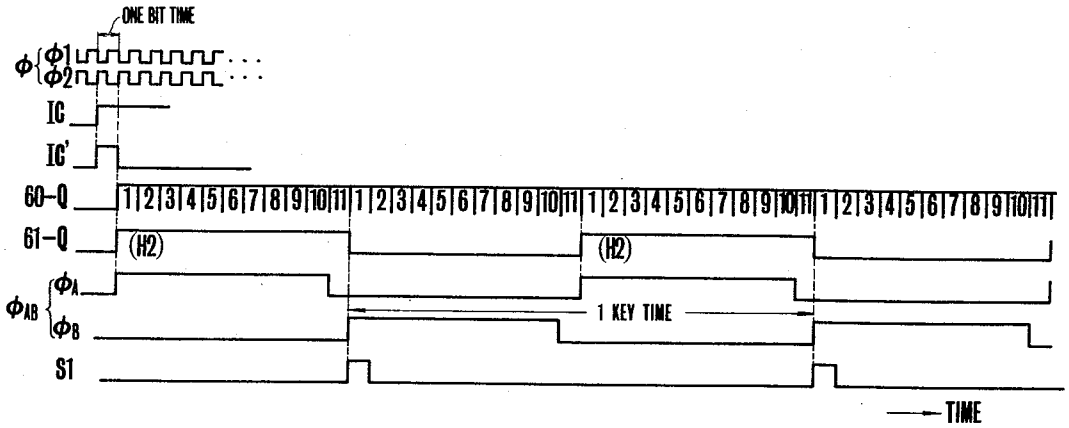
FIG. 3 is a time chart showing one example of generation of control signals of the circuit shown in FIG. 2.

In FIG. 2, an initial clear signal IC is applied to a delay flip-flop circuit 56 and one input of an AND gate circuit 57. The output of the delay flip-flop circuit 56 is applied to the other input of the AND gate circuit 57 via an inverter 58. The initial clear signal IC is maintained at "1" state for a predetermined interval when a source switch, not shown, of the electronic musical instrument is closed. The delay flip-flop circuit 56 is driven by the system clock pulse $\phi$. As shown in FIG. 3, the system clock pulse $\phi$ comprises two phase clock pulses $\phi$1 and $\phi$2 and the timing of data receipt is accomplished by the clock pulse $\phi$1 whereas the outputting of the received data is made by the clock pulse $\phi$2. In the following, an interval of time corresponding to one period of the system clock pulse $\phi$ is called one bit time. The delay flip-flop circuit 56, the AND gate circuit 57 and the inverter 58 constitute a differentiating circuit for producing a pulse IC' having a width of one bit time from the AND gate circuit 57 in response to the generator of the initial clear signal IC, that is the closure of the source switch. (See FIG. 3).

The output pulse IC' of the AND gate circuit 57 is applied to a 11 stages/1 bit shift register 60 via the OR gate circuit 59 and to the set input S of a flip-flop circuit 61 which is driven in synchronism of the system clock pulse $\phi$ to receive a signal supplied to the input S or T at the timing of the clock pulse $\phi$1 and to produce a signal representing a state established by an input signal at the timing of the clock pulse $\phi$2. The output Q of the flip-flop circuit 61 becomes "1" one bit time later than the pulse IC' applied to the set input S (see 61-Q shown in FIG. 3).

Though the above disclosure shows an example in which the present invention is applied to a single keyboard type electronic musical instrument, the invention may also be applied to an electronic musical instrument provided with a plurality of keyboards. For example, the realization can be made almost similar to the example with the upper keyboard taking the place of the upper key range and the lower keyboard taking the place of the lower key range. The tone production assignment circuit is not limited to one in which assignment is made on the time division basis as shown in the example, and it may be one in which assignment is made on a non-time division basis. The depressed key detecting means is not limited to the key scanner as shown in the example in which time division multiplex key data (multiplexed data indicating key depression and key release "1" and "0" respectively), and it may employ an optional circuit configuration.

The shift register 60 sequentially shifts the pulse IC' having a width of one bit time according to the system clock pulse $\phi$. The outputs from the first stage Q1 to the 10th stage Q10 are applied to a NOR gate circuit 62 and its output is returned to the shift register 60 via an OR gate circuit 59 and is also applied to the T input of the flip-flop circuit 61. When "1" is shifted to the last stage Q11 of the shift register 60, the outputs of the preceding stages Q1 through Q10 are all "0" so that the output of the NOR gate circuit 62 becomes "1" which is applied to the first stage Q1 of the shift register 60 and the output of the first stage Q1 becomes "1" at the next timing. Accordingly, the same signal "1" constantly circulates through the shift register 60 and shifted sequentially. The numbers 1 through 11 of the stages Q1 through Q11 of the shift register 60 which produce "1" are shown by 60-Q shown in FIG. 3.

The state of the flip-flop circuit 61 reversed each time "1" is outputted from the NOR gate circuit 62. The output Q (61-Q) of the flip-flop circuit 61 inverts one bit time after the output "1" of the NOR gate circuit 62, that is the output "1" of the 11th stage Q11 of the shift register 60. Thus, the output Q of the flip-flop circuit 61 is a repetitive pulse having a duty of ½ as shown by 61-Q in FIG. 3. The output Q of the flip-flop circuit 61 is applied to one input of an NOR gate circuit 63, while a signal obtained by inverting the output Q with an inverter 64 is applied to one input of an NOR gate circuit 65. The other inputs of the NOR gate circuits 63 and 65 are supplied with the output of the 11th stage Q11 of the shift register 60. The NOR gate circuit 63 produces a clock pulse $\phi$B having a period of 22 bit times as shown in FIG. 3, whereas the NOR gate circuit 65 produces a clock pulse $\phi$A having a period of 22 bit times. These two phase clock pulse $\phi$A and $\phi$B are utilized as a key scanning clock pulse. When these clock pulses $\phi$A and $\phi$B are used as the two phase clock pulse in a pair, they are designated as $\phi$AB, and the interval of 22 bit times between two adjacent clock pulses is called one key time.

The output Q (61-Q) of the flip-flop circuit 61 is generated by the timing signal generator 20 as a latter half period signal H2 which is maintained at "1" for the latter half 11 bit times of one key time. The output Q of the flip-flop circuit 61 is applied to one input of an AND gate circuit 66, while the output of the 11th stage of the shift register 60 is applied to the other input of the AND gate circuit 66. Accordingly, the AND gate circuit 66 is enabled when the signal 61-Q shown in FIG. 3 is "1" and the signal 60-Q is 11, so that "1" is applied to the delay flip-flop circuit 67 which delays its input signal by one bit time according to the system clock pulse $\phi$, thus outputting the delayed signal as a signal S1. Accordingly, as shown in FIG. 3, the signal S1 is repetitively produced corresponding to the first bit time of one key time.

Mode Selection Circuit 13

Figure 4:
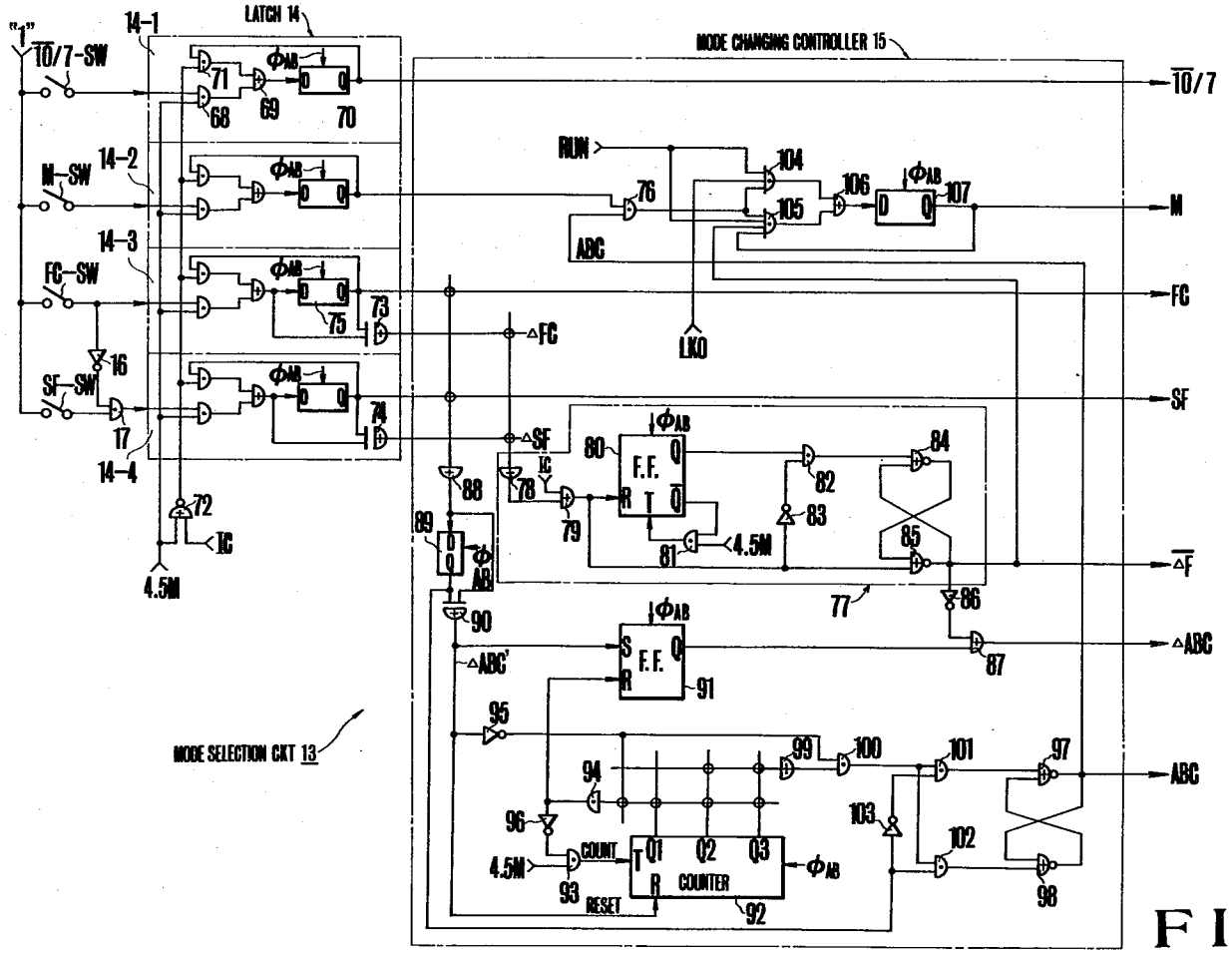
FIG. 4 is a connection diagram showing the detail of the mode selection circuit shown in FIG. 1.

The detail of the mode selection circuit 13 shown in FIG. 1 is shown in FIG. 4 in which the latch device 14 comprises latch circuits 14-1, 14-2, 14-3 and 14-4 corresponding to switches $\overline{10}$/7-SW, M-SW, FC-SW and SF-SW respectively. Since these latch circuits have the same construction, only the latch circuit 14-1 will be described in detail.

In latch circuit 14-1, the output of switch $\overline{10}$/7 is applied to one input of an AND gate circuit 68 and its output is applied to a delay flip-flop circuit 70 through an OR gate circuit 69.

The other input of the AND gate circuit 68 is applied with a scanning cycle pulse 4.5 M having a relatively long period.

As will be described later, this pulse 4.5 M is generated by the key scanner (see FIG. 1) corresponding to one scanning cycle so that its width is equal to one key time and a period of generation of 4.5 milliseconds. The output of the delay flip-flop circuit 70 is fed back to its input through an AND gate circuit 71 and the OR gate circuit 69. To the other input of the AND gate circuit 71 is applied the output of a NOR gate circuit 72, the output thereof becoming "0" when the initial clear signal IC is being generated or when the scanning cycle pulse 4.5 M is generated to prevent the feedback. However, in the other case, the output of the delay flip-flop circuit 70 is fed back and held therein. Accordingly, each time a scanning cycle pulse 4.5 M is generated, the state of the switch $\overline{10}$/7 is stored in the delay flip-flop circuit 70 and held therein until the next scanning cycle pulse 4.5 M is generated. The reason that the output of the switch is latched according to the low speed pulse 4.5 M (of a period of 4.5 ms) is to prevent chattering of the switch.

The latch circuits 14-3 and 14-4 corresponding to switches FC-SW and SF-SW are respectively provided with exclusive OR gate circuits 73 and 74 supplied with input signals and the output signals of a delay flip-flop circuit which latches the output of a switch. These exclusive OR gate circuits 73 and 74 are provided for the purpose of detecting the change of the state of fingered chord mode selection switch FC-SW or the single finger mode selection switch SF-SW from ON to OFF or vice versa. For example, when the switch FC-SW is changed from OFF to ON state, a signal "1" appears on the input side of the delay flip-flop circuit 75 of the latch circuit when the pulse 4.5 M is generated which stores the switch output "1" representing the ON state, so that a signal "0" representing an immediately preceding OFF state appears on the output side of the delay flip-flop circuit 75. For this reason, the output signal $\Delta$FC of the exclusive OR gate circuit 73 becomes "1" for one key time, and vice versa. More particularly, when the switch FC-SW is transferred from ON to OFF state, the input side of the delay flip-flop circuit 75 is "0" and the output side thereof is "1", so that the output signal $\Delta$FC of the exclusive OR gate circuit 73 becomes "1". In the same manner, when the switch SF-SW is transferred from ON to OFF state or vice versa, the output $\Delta$SF of the exclusive OR gate circuit 74 becomes "1" only once corresponding to the generation of the pulse 4.5 M.

The output of the latch circuit 14-1 is produced as a channel mode signal $\overline{10}$/7 representing the ON/OFF states of the channel number selection switch $\overline{10}$/7-SW. When this channel mode signal $\overline{10}$/7 is "0", all 10 channels are utilized for musical tone production, whereas when the channel mode signal $\overline{10}$/7 is "1", predetermined only 7 channels are utilized for musical tone generation.

A signal latched by the delay flip-flop circuit 75 of the latch circuit 14-3 is outputted as a fingered chord mode signal FC which shows that whether the fingered chord mode performance of the automatic bass/chord performance has been selected or not. A signal latched by the delay flip-flop circuit of the latch circuit 14-4 is outputted as a single finger mode signal SF which shows that whether the single finger mode (SF) of the automatic bass/chord performance has been selected or not.

A signal latched by the delay flip-flop circuit of the latch circuit 14-2 is applied to the mode changing cotrol circuit 15 to act as a signal representing the ON/OFF states of the memory function selection switch M-SW. A memory mode signal M is generated based on a signal representig the output of this switch M-SW, the automatic bass/chord mode signal ABC, the rhythm run signal RUN and the lower key range key-on signal LKO.

A circuit 77 in the mode changing control circuit 15 produces a signal $\overline{\Delta F}$ which becomes "0" for a definite time when the change detection signal $\Delta$FC or $\Delta$SF is generated. As above described, when the switch FC-SW or SF-SW is transferred, the change detection signal ΔFC or ΔSF becomes "1" (see FIG. 5) at the time when the pulse 4.5 M is generated. When the change detection signal ΔFC or ΔSF becomes "1", a flip-flop circuit 80 is reset via OR gate circuits 78 and 79. The flip-flop circuit 80 receives the input by the timing action of the clock pulse $\phi$A and its state is determined by the clock pulse $\phi$B. Consequently, the output Q of the flip-flop circuit 80 becomes "0" one key time later than the variation detection signal ΔFC or ΔSF as shown in 80-Q in FIG. 5. At the same time, the inverted output $\overline{Q}$ of the flip-flop circuit 80 becomes "1". This inverted output $\overline{Q}$ is applied to one input of an AND gate circuit 81, the other input thereof being supplied with the scanning cycle pulse 4.5 M. As a consequence, a signal "1" is supplied to the input T of the flip-flop circuit 80 from the AND gate circuit 81 at the time of generating the next scanning cycle pulse 4.5 M, and one key time after, the state of the flip-flop circuit 80 reverses so that the output Q (80-Q shown in FIG. 5) becomes "1". Thereafter, since the inverted output $\overline{Q}$ of the flip-flop circuit 80 becomes "0", the AND gate circuit 81 would not be enabled and the state of the flip-flop circuit 80 would not be changed until it is reset again by the variation detection signal ΔFC or ΔSF.

The output Q of the flip-flop circuit 80 is applied to one input of an AND gate circuit 82 and its output is applied to one input of an NOR gate circuit 84. The output of the OR gate circuit 79 is inverted by an inverter 83 and then applied to the other input of the AND gate circuit 82, and to one input of an NOR gate circuit 85. The NOR gate circuits 84 and 85 constitute a flip-flop circuit so as to produce the output of the NOR gate circuit 85 as a SF/FC mode changing signal $\overline{\Delta F}$. The AND gate circuit 82 is enabled before the signal ΔFC or ΔSF becomes "1" so that the output of the AND gate circuit 82 is "1", that of the NOR gate circuit 84 is "0" and that of the OR gate circuit 79 is "0". Accordingly, the output signal $\overline{\Delta F}$ of the NOR gate circuit 85 is "1".

Figure 5:
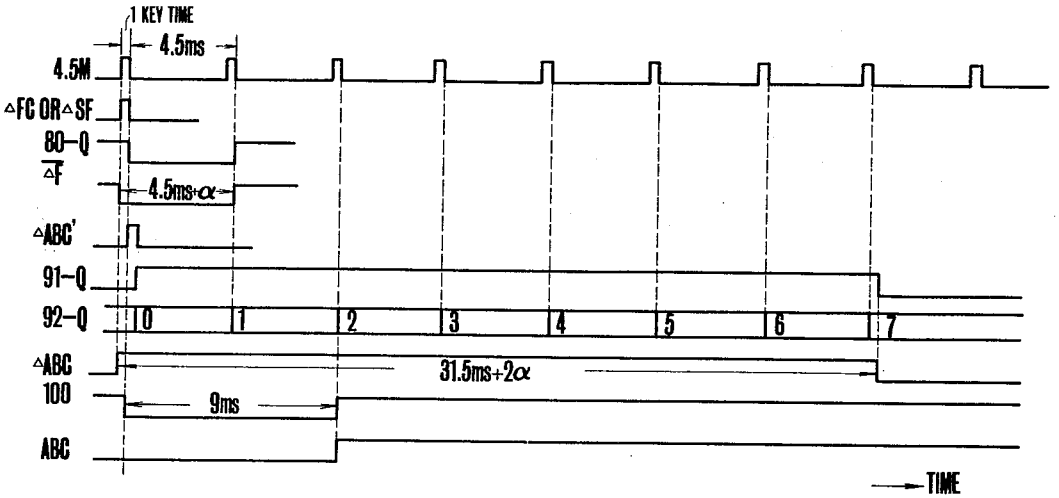
FIG. 5 is a time chart for explaining the operation of the circuit shown in FIG. 4.

When signal ΔFC or ΔSF becomes "1", the input signal of the NOR gate circuit 85 becomes "1" while the output signal $\overline{\Delta F}$ becomes "0". Concurrently with the change of signal ΔFC or SF to "0", the output Q of the flip-flop circuit 80 becomes "0" so that the output of the AND gate circuit 82 is still "0" and the output signal $\overline{\Delta F}$ of the NOR circuit 85 is maintained at "0". When the state of the flip-flop circuit 80 is reversed upon arrival of the next scanning cycle pulse 4.5 M, the output of the AND gate circuit 82 becomes "1" and the output signal $\overline{\Delta F}$ of the NOR gate circuit 85 also becomes "1". Consequently, as shown in FIG. 5, the signal $\overline{\Delta F}$ is "0" for an inteval of (4.5 ms+$\alpha$) where $\alpha$ represents one key time.

This signal $\overline{\Delta F}$ is maintained at "0" for an interval (4.5 ms+$\alpha$) when the signal ΔFC or ΔSF is generated. This corresponds to the following case. More particularly, such case is a case when the mode is changed from the automatic base/chord mode to the normal model (both switches FC-SW and SF-SW are OFF), or in the opposite case (the switch FC-SW or SF-SW is transferred to ON), or when the mode is changed from the fingered chord mode to the single finger mode, or vice versa, at the time of the automatic base/chord mode. The signal $\overline{\Delta F}$ is used to clear the memory of the chord in the chord detection control circuit 30 (FIG. 1). The reason that the signal $\overline{\Delta F}$ changes to "0" not only when the mode is changed from the automatic bass/chord mode to the normal mode (or vice versa) but also when the mode is changed from FC to SF or vice versa in the automatic bass/chord mode, so the chord is not the same in the fingered chord mode and in the single finger mode for the same depressed key state.

After being inverted by an inverter 86, the output of the NOR gate circuit 85 is aplied to one input or an OR gate circuit 87 and the output thereof is utilized as the mode changing pulse ΔABC. Accordingly, as the signal $\overline{\Delta F}$ becomes "0", the mode changing pulse ΔABC is generated with the same pulse width (4.5 ms+$\alpha$) as the signal $\overline{\Delta F}$. However, the pulse ΔABC generated corresponding to this signal $\overline{\Delta F}$ is a much shorter pulse than the inherent mode changing pulse ΔABC, which is generated in the following manner.

The fingered chord mode signal FC or the single finger mode signal SF generated by the latch circuit 14-3 or 14-4 is applied to one input of an OR gate circuit 88, and the output thereof is "1" in the automatic bass/chord mode (either one of FC or SF) and "0" in the normal mode. The output of the OR gate circuit 88 is delayed by one key time by the delay flip-flop circuit 89 and then applied to one input of the exclusive OR gate circuit 90, the other input thereof being connected to directly receive the output of the OR gate circuit 88. Consequently, when the mode is changed from the automatic bass/chord mode to the normal mode (or vice versa), the exclusive OR gate circuit 90 produces a change detection pulse ΔABC' having a width of one key time. As shown in FIG. 5, the timing of generating the change detection pulse ΔABC' is delayed from the scanning cycle pulse 4.5 M by one key time. Because, due to the presence of the delay flip-flop circuits in the latch circuits 14-3 and 14-4, the signal FC or SF changes one key time later than the generation of the pulse 4.5 M.

The change detection pulse ΔABC' outputted from the exclusive OR gate circuit 90 sets a flip-flop circuit 91 and resets a counter 92. In the same manner as in the flip-flop circuit 80 described above, the flip-flop circuit 91 is controlled by the clock pulse $\phi$AB so that there is a one key time delay between its input and output. As shown by 91-Q in FIG. 5, the output Q of the flip-flop circuit 91 becomes "1" one key time later than the generation of the change detection pulse ΔABC' applied to the set input S. The output Q (91-Q) of the flip-flop circuit 91 is produced as the mode changing pulse ΔABC via the OR gate circuit 87.

To the count input T of the counter 92 is applied the scanning cycle pulse 4.5 M via an AND gate circuit 93. Further, the two phase clock pulse $\phi$AB is applied to the counter 92 as a control clock pulse. The counter 92 receives a signal at its count input T at the time of generating the clock pulse oA, and when the received signal is "1", its count is increased by one and the result of counting is outputted by the timing action of the clock pulse $\phi$B. The outputs Q1 through Q3 of the three bit binary counter 92 are applied to one input of an AND gate circuit 94, while the other input thereof is supplied with a signal obtained by inverting the change detection pulse ΔABC' with an inverter 95. The output of the AND gate circuit 94 is applied to the reset input R of the flip-flop circuit 91 and to one input of an AND gate circuit 93 after being inverted by an inverter 96.

Upon generation of the change detection pulse ΔABC', the counter 92 is reset and its count becomes zero as shown by 92-Q in FIG. 5. Thereafter, the count of the counter 92 is increased up each time a scanning cycle pulse 4.5 M is generated, and as the count reaches decimal "7", all binary outputs Q1 through Q3 become all "1", thus enabling the AND gate circuit 94. Consequently, the flip-flop circuit 91 is reset and the AND gate circuit 93 is disenabled to stop the counting operation. Thus, the output Q of the flip-flop circuit 91 becomes "1" for an interval corresponding to 7 periods of the scanning cycle pulse 4.5 M, that is for 4.5 ms×7=31.5 ms. For this reason, the mode changing pulse ΔABC outputted from the OR gate circuit 87 in accordance with the output Q of the flip-flop circuit 91 has a width of at least 31.5 ms. Signal ΔFC or ΔSF is always produced immediately prior to the generation of the change detection pulse ΔABC' from the exclusive OR gate circuit 90 so that signal $\overline{\Delta F}$ becomes "0" two key times before the change of the output Q of the flip-flop circuit 91 to "1". In response to a signal obtained by inverting this signal $\overline{\Delta F}$ with an inverter 86, the output ABC of the OR gate circuit 87 becomes "1". Accordingly, as shown in FIG. 5, the actual mode changing pulse ΔABC is produced two key times before the output Q of the flip-flop circuit 91 so that the width of the pulse ΔABC is equal to 31.5 ms+2α (α represents one key time).

NOR gate circuits 97 and 98 constitute a flip-flop circuit, and the automatic bass/chord mode signal ABC is outputted from the NOR gate circuit 97. The outputs Q2 and Q3 outputted from the second and third bits of the counter 92 are applied to one input of an AND gate circuit 100 via an OR gate circuit 99, whereas the other input of the AND gate circuit 100 is supplied with the output of an inverter 95 which inverts the change detection pulse ΔABC'. The output of the AND gate circuit 100 is applied to AND gate circuits 101 and 102. The output of the delay flip-flop circuit 89 is "1" at the time of the fingered chord mode FC or the single finger mode SF, that is the automatic bass/chord mode and this output "1" is applied to one input of an AND gate circuit 102 and to one input of an AND gate circuit 101 after being inverted by an inverter 103.

When the mode is changed from normal mode to the automatic bass/chord mode, that is when either one of the switches FC-SW and SF-SW is changed to ON state from a state in which both of these switches are OFF, the exclusive OR gate circuit 90 produces a change detection pulse ΔABC' and one time thereafter the output of the delay flip-flop circuit 89 changes to "1". As the pulse ΔABC' becomes "1", the output (see 100 in FIG. 5) of the AND gate circuit 100 becomes "0". When the counter 92 is reset by the pulse ΔABC', the output of the OR gate circuit 99 becomes "0" so that the output of the AND gate circuit 100 is still maintained at "0" even after disappearance of the pulse ΔABC'. When the count of the counter 92 exceeds 2, the output Q2 or Q3 becomes "1" with the result that the output of the AND gate circuit 100 becomes "1". The interval in which the output of the AND gate circuit 100 is "0" corresponds to the time (4.5 ms×2=9 ms) equal to two periods of the pulse 4.5 M. As a consequence, during an interval of 9 ms following the change of the mode, AND gate circuits 101 and 102 are disabled, thus preventing the state from changing of the flip-flop circuits 97 and 98. As the output of the delay flip-flop circuit 89 becomes "1", the AND gate circuit 102 is enabled to apply "1" to the NOR gate circuit 98. But the AND gate circuit 101 is not enabled so that "0" is applied to the NOR gate circuit 97, whereby the output of the NOR gate circuit 97, that is the automatic bass/chord signal ABC becomes "1" (see FIG. 5). The mode change from the automatic bass/chord mode to the normal mode is effected in the same manner, that is after delaying 9 ms, the states of the delay flip-flop circuits 97 and 98 reverse so that signal ABC changes to "0" 9 ms later than the actual switching.

A signal produced by the latch circuit 14-2 and representing the ON/OFF states of the memory function selection switch M-SW is stored in a delay flip-flop circuit 107 via AND gate circuits 76, 104 and 105 and OR gate circuit 106, in which the AND gate circuit 104 is used to receive the signal, while the AND gate circuit 105 is used for self-holding. To the other input of the AND gate circuit 76 is applied the automatic bass/chord mode signal ABC outputted from the NOR gate circuit 97. In addition to the output of the AND gate circuit 76, the rhythm run signal RUN from the automatic rhythm device 45 (shown in FIG. 1) and the lower key range key-on signal LKO from the chord detection control circuit 30 shown in FIG. 1 are supplied to the AND gate circuit 104. The output of the AND gate circuit 104 is applied to the delay flip-flop circuit 107 via the OR gate circuit 106 and the output of the delay flip-flop circuit 107 is fed back to its input via AND gate circuit 105 to be self-held. The output of the delay flip-flop circuit 107 is a memory mode signal M.

When the memory function switch M-SW is ON and the automatic bass/code performance is being selected, the AND gate circuit 76 is enabled. At this time, when the automatic rhythm is performed (i.e., signal RUN is "1") and any one of the keys in the predetermined key range is depressed (i.e., when LKO is "1") the AND gate circuit 104 is enabled and "1" is stored in the delay flip-flop circuit 107 (memory mode signal M becomes "1").

In addition to the output of the delay flip-flop circuit 107, the output of the AND gate circuit 76, the rhythm run signal RUN and the SF/FC mode changing signal $\overline{\Delta F}$ are also applied to the self-holding AND gate circuit 105. Accordingly, when the switch M-SW is OFF, or when the automatic bass/chord mode is not used (signal ABC is "0"), or the automatic rhythm terminates (signal RUN is "0") or the fingered chord mode or the single finger mode is chagned ($\overline{\Delta F}$ is "0"), the AND gate circuit 105 is disabled to clear the memory mode signal M.

Alternative Use of Keyboard and Tone Production Channels

The keyboard utilized in this embodiment includes juxtaposed 61 keys (in one stage) of from key C2 to key C7. The method of alternative use of the key range of this keyboard is shown in the following Table I.

TABLE I

| | Key | |
|---|---|---|
| | Low → | High |
| Mode | C2, C#2 ... F#3, | G3 ... B6, C7 |
| ABC Mode | second musical tone production manner (Lower key range L) | first musical tone production manner (Upper key range U) |
| Normal Mode | first musical tone production manner (Upper key range U) | |

In the case of the normal mode, that is when the automatic bass/chord performance is not selected, all keys C2 to C7 of the keyboard are utilized for the first musical tone production manner (melody performance). The key range for this first musical tone production manner is hereinafter called the upper key range designated by a letter U.

For the automatic bass/chord mode (ABC mode), a 1.5 octave key range on the low tone side comprising keys C2 to F#3 is used for the second musical tone production manner (automatic bass/chord performance and the automatic arpeggio performance, that is the accompaniment performance), while the key range of from key G3 to key C7 on the high tone side is used for the first musical tone production manner (melody performance). A key range including keys C2 to F#3 for the second musical tone production manner comprises the lower key range L. This key range including keys C2 to F#3 operates as the upper key range U for the normal mode, but for the ABC mode as the lower key range L.

The method of alternative use of the tone production channels is as follows:

The tone production assignment circuit 18 shown in FIG. 1 is constructed to process, on the time division basis, the data corresponding to respective tone production channels. There are 11 time division channel timings in the tone production assignment circuit 18, but one of the channel timings does not correspond to the actual tone production channel. The actual number of the tone production channels (musical tone production systems) of the musical tone signal generator 51 (shown in FIG. 1) is 10. The reason for providing a surplus channel timing lies in the convenience for the processing in the multiplexer (FIG. 1). The method of alternative use of the 11 time division channel timings in the tone production assignment circuit 18 is shown in the following Table II.

TABLE II

| Number of Channels | | Time divisioned channel timings | | | | | | | | | | |
|---|---|---|---|---|---|---|---|---|---|---|---|---|
| Use | Mode | 1 | 2 | 3 | 4 | 5 | 6 | 7 | 8 | 9 | 10 | 11 |
| 10 | normal | — | U | U | U | U | U | U | U | U | U | U |
| ($\overline{10}$/7 | FC | — | P | L | U | L | U | L | U | L | U | A |
| is "0") | SF | — | P | X | U | L | U | L | U | L | U | A |
| | ΔABC | — | X | X | U | X | U | X | U | X | U | X |
| 7 | normal | — | U | X | U | U | U | U | X | U | X | U |
| ($\overline{10}$/7 | FC | — | P | X | U | L | U | L | X | L | X | A |
| is "1") | SF | — | P | X | U | L | U | L | X | L | X | A |
| | ΔABC | — | X | X | U | X | U | X | X | X | X | X |

In Table II, the channel timing "1" is the surplus channel timing not corresponding to the actual tone production channel, while channel timings "2" through "11" correspond to 10 tone production channels respectively. A letter U designates the channel assigned with a melody tone produced by the depressed keys in the upper key range, that is the channels utilized for the first musical tone production manner (melody tone). Letters L.P and A designate channels assigned with an accompaniment tone produced by the depressed keys in the lower key range, that is the channels utilized for the second musical tone production manner, wherein letter L shows channels assigned with the chord constituting tones (the depressed key tones in the lower key range L), letter P channels assigned with the automatic bass tone, and letter A channels assigned with the automatic arpeggio tone. Symbol X shows channels which are made to become inoperative (to stop the tone production assignment).

In Table II, where the mode is the normal mode in 10 channel modes (the channel mode signals 10/7 are all "0"), all channels (2–11) are utilized for the first musical tone production manner. At the time of the fingered code mode FC for the automatic bass/chord performance channels 2, 3, 5, 7, 9 and 11 are used for the second musical tone production manner and the remaining channels 4, 6, 8 and 10 are used for the first musical tone production manner. However for the single finger mode SF, channel 3 is not used and the number of channels L for the chord constituting tones is only 3, because in the single finger mode, the number of the chord constituting tones produced as a musical tone are only 3. In a short time of (31.5 ms+2α) in which the mode changing pulse ΔABC is generated, channels 2, 3, 5, 7, 9 and 11 for the second musical tone production manner are cleared. Since the mode changes the musical tone production manner of these channels 2, 3, 5, 7, 9 and 11 (from first to second mode or vice versa), the aforementioned clearing is made to prevent erroneous assignment.

In the case of the 7 channel mode (single $\overline{10}$/7 are all "1"), three channels, 3, 8, 10 are cleared as shown in Table II. The manner of alternative use of the first musical tone production manner, and the second musical tone production manner is the same as that described in connection with the 10 channel mode described above.

The time division channel timings 1 to 11 shown in Table II are set in the shift register 60 (FIG. 2) of the timing signal generator 20 in the tone production assignment circuit 18. The output timings (see 60-Q in FIG. 3) of the first to 11th stages Q1 to Q11 of the shift register 60 correspond to the channel timings 1 to 11 shown in Table II.

In FIG. 2, the outputs of respective stages Q1 to Q11 of the shift register 60 are applied to a channel designating circuit 108 and channel assignment inhibit circuit 109. The channel designating circuit 108 generates channel timing signals UchT, LchT, PchT and AchT according to a predetermined assignment mode (see Table II) corresponding to a selected mode. The upper key range channel timing signal UchT is produced corresponding to the time division timing of the channel U for the first musical tone production manner shown in Table II. The lower key range channel timing signal LchT is produced corresponding to the time division timing of the channel L for the accompaniment chord tone shown in Table II. The bass channel timing signal PchT is produced corresponding to the timing of the automatic bass tone channel P shown in Table II. The arpeggio channel timing signal AchT is produced corresponding to the timing of the channel A for the automatic arpeggio tone shown in Table II. The channel mode signal 10/7, the single finger mode signal SF and the automatic bass/chord mode signal ABC which are generated from the mode selection circuit 13 shown in FIG. 4 are applied to the channel designating circuit 108 to produce channel timing signals UchT through AchT (as shown in Table II) in a predetermined manner according to the states of these mode signals.

The channel designating circuit 108 includes a logic circuit constructed to synthesize the outputs of predetermined stages (Q2 to Q11) of the shift register 60 for producing respective channel timing signals UchT through AchT. AND gate circuits 110, 111 and 112 are provided for selecting the outputs of stages Q3, Q8 and Q10 at the time of the 10 channel mode (i.e., when signal $\overline{10}/7$ is "0"). An OR gate circuit 113 is provided for synthesizing the upper key range channel timing signal UchT for the normal mode ($\overline{ABC}$), and an OR gate circuit 114 is provided for synthesizing the upper key range channel timing signal UchT at the time of the automatic bass/chord mode (ABC). An OR gate circuit 115 is provided for synthesizing the lower key range channel timing signal LchT. In the automatic bass/-chord mode (ABC is "1"), signals UchT, LchT, PchT and AchT are outputted through AND gate circuits 116, 117, 118 and 119. At the time of the normal mode (ABC is "0") only the signal UchT is produced by an AND gate circuit 120 via an OR gate circuit 121.

The logic equations for generating signals UchT through AchT are as follows in which signal 10/7 is obtained by inverting signal $\overline{10}/7$ with an inverter.

$$\begin{aligned}
UchT &= ABC.(Q4 + Q6 + 10/7.Q8 + 10/7.Q10) \\
&\quad + \overline{ABC}.(Q2 + \overline{SF}.10/7.Q3 + Q4 + Q5 + Q6 \\
&\quad + Q7 + 10/7.Q8 + Q9 + 10/7.Q10 + Q11) \\
LchT &= ABC.(\overline{SF}.10/7.Q3 + Q5 + Q7 + Q9) \\
PchT &= ABC.Q2 \\
AchT &= ABC.Q11
\end{aligned}$$

The assignment inhibit circuit 109 produces an off channel timing signal OFchT corresponding to the channel timings marked with X in Table II. At the time of the 7 channel mode (signal $\overline{10}/7$ is "1"), the off channel timing signal OFchT is produced corresponding to the output timings of the stages Q3, Q8 and Q10 via AND gate circuits 123, 124 and 125 and OR gate circuits 126 and 127. Further, in the single finger mode (signal SF is "1"), the signal OFchT is produced corresponding to the output timing of the stage Q3 via an OR gate circuit 128 and the AND gate circuit 123. While the mode changing pulse ΔABC is being produced, an AND gate circuit 129 is enabled to produce the signal OFchT synthesized by an OR gate circuit 130 in response to outputs of stages Q2, Q3, Q5, Q7, Q9 and Q11.

Figure 6:
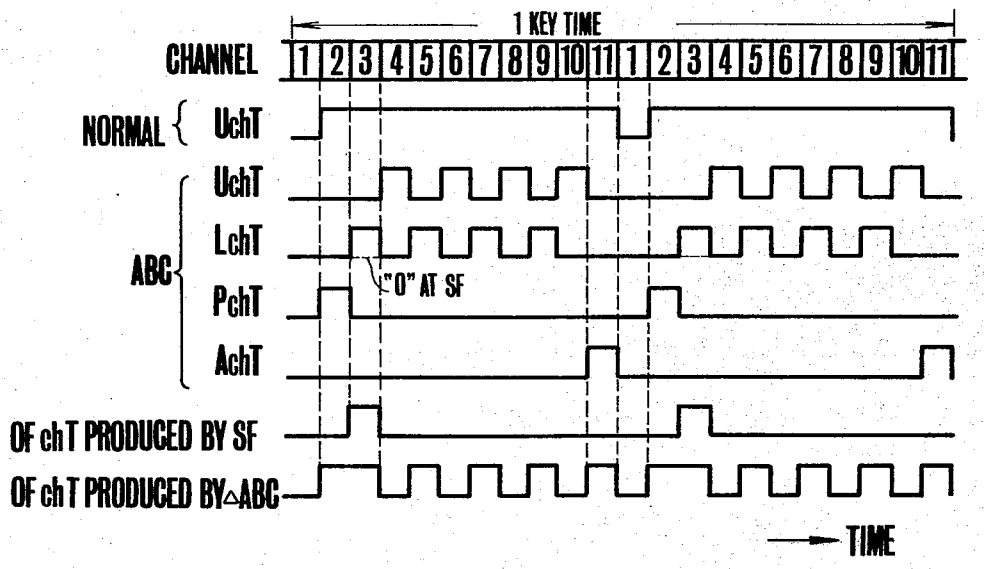
FIG. 6 is a time chart showing one example of generation of channel timing signals generated by the circuit shown in FIG. 2.

FIG. 6 shows one example of generating the channel timing signals UchT, LchT, PchT, AchT and OFchT for the 10 channel mode (signal $\overline{10}/7$ is "0"). In the single finger mode SF, the signal LchT corresponding to channel 3 would not be produced because the AND gate circuit 110 shown in FIG. 2 is disabled. As shown in FIGS. 3 and 6, each channel timing is produced twice during one key time.

Detail of the Key Scanner 11

Figure 7:
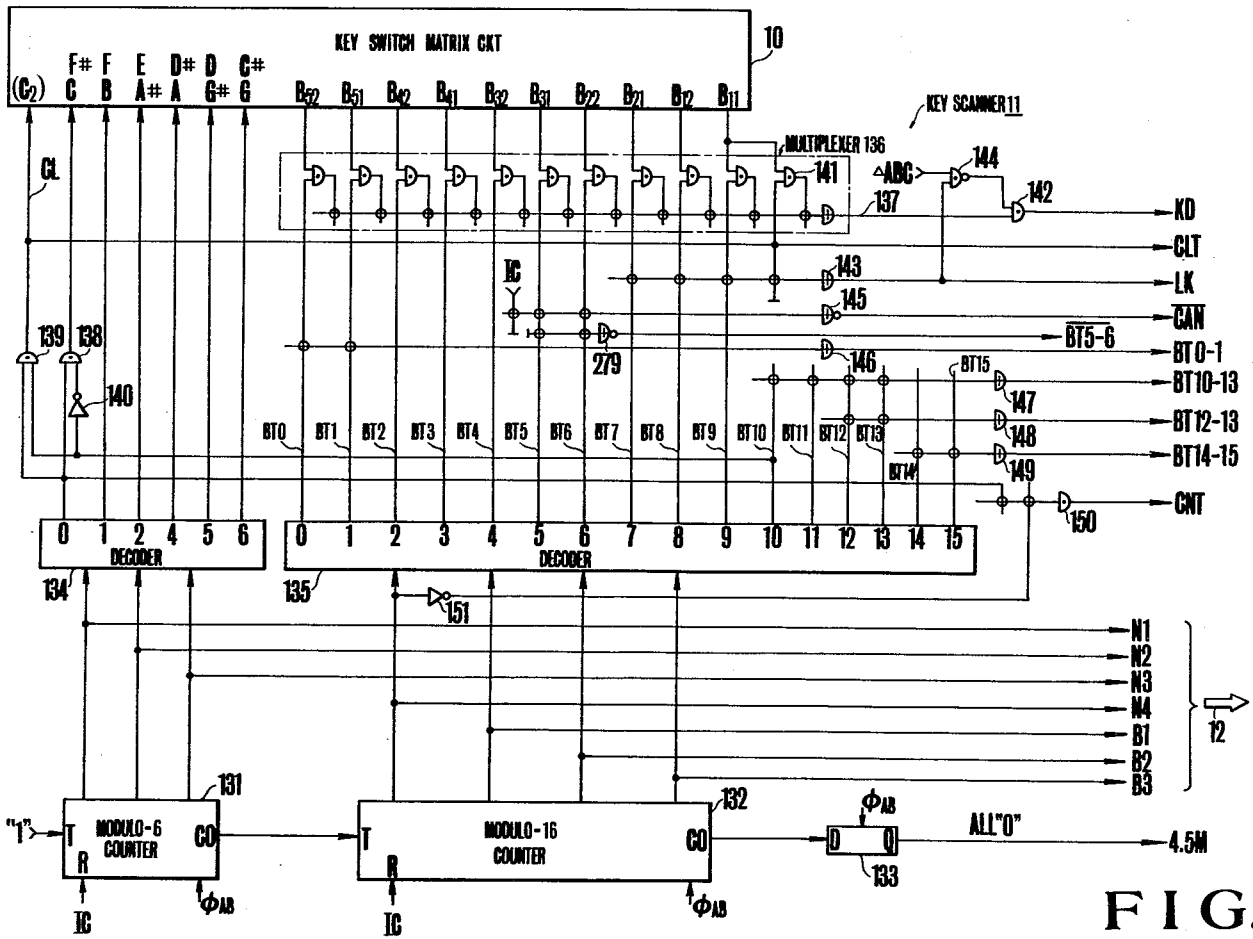
FIG. 7 is a connection diagram showing the detail of the key scanner shown in FIG. 1.

FIG. 7 shows the detail of the key scanner 11 shown in FIG. 1 together with the key switch matrix circuit 10. Key scanning counters 131 and 132 of the key scanner 11 are supplied with a key scanning two phase clock pulse ϕAB (ϕA, ϕB) produced by the timing signal generator 20 (FIG. 2). A modulo-6 counter 131 is provided to repeatedly add a signal "1" applied to its input T by timing action of the clock pulse ϕAB. Thus, the counter 131 counts the number of signal applied to its input T according to the timing action of the clock pulse ϕA to set and output state corresponding to the result of counting effected by the clock pulse ϕB. Thus, the modulo-6 counter 131 counts up according to the clock pulse ϕAB and the state of its output changes each time the clock pulse ϕB is generated, that is at each one key time shown in FIG. 3. The count value of the modulo-6 counter 131 varies according to an order of decimal representations 0, 1, 2, 4, 5 and 6 (according to the binary representation, in the order of "000", "001", "010", "100", "101" and "110", thus jumping the decimal representation "3" (binary "011").

As the count value of the modulo-6 counter 131 returns to "0" from "6" that is from decimal "110" to "000", more particularly, at the time of producing the pulse ϕA immediately before the output of the counter 131 is changed to "0" by the timing action of the clock pulse ϕB, the counter 131 produces a carry signal CO which is supplied to the input T of a modulo-16 counter 132. This counter 132 receives and counts the carry signal CO applied to its input T each time the clock pulse ϕA is generated, thus setting an output state corresponding to its count according to the clock pulse ϕB. Briefly stated, each time the output of the modulo-16 counter 131 becomes "0", the output of the modulo-16 counter 132 varies (counted up by one).

When the count value of the modulo-16 counter 132 changes from "15" ("1111") to "0" ("0000") that is at the time of producing the clock pulse ϕA immediately before the output of the counter 132 changes to "0" in response to the clock pulse ϕB, the counter 132 produces a carry signal CO which is applied to a delay flip-flop circuit 133. This delay flip-flop circuits 133 receives carry signal CO according to the clock pulse ϕA and outputs the carry signal CO by the timing action of the clock pulse ϕB. Consequently, the output of the delay flip-flop circuit 133 becomes "1" corresponding to one key time in which the outputs of the counters 131 and 132 become all "0". The output of the delay flip-flop circuit 133 is applied to various circuit elements to act as the scanning cycle pulse 4.5 M which corresponds to the timing of scanning the highest tone key C7.

The output of the modulo-6 counter 131 is applied to a decoder 134, whereas that of the modulo-16 counter 132 is applied to a decoder 135. The output of the decoder 134 is applied to a note line of the key switch mateix circuit 10. The output "0" of the decoder 134 is applied to lines of the notes C and F#, "1" is applied to lines of notes B and F, "2" is applied to lines of the notes A# and E, "4" is applied to lines of the notes A and D# "5" is applied to lines of the notes G# and D, and "6" is applied to lines of the notes G and C#. Consequently as the count of the modulo-6 counter 131 changes according to an order of "0", "1", "2", "4", "5", "6", "0", "1" . . . . 12 notes are repeatedly scanned starting from the high tone side in the order of notes C, B, A#, A, G#, G, F#, F . . . .

The outputs B52 through B11 of the key switch matrix circuit 10 correspond to groups of half octaves of the keys C7 through C2. These outputs B52 through B11 are applied to multiplexer 136 and selected by the outputs BT0 through BT10 of the decoder 135 corresponding to the count value "0" through "10" of the modulo-16 counter 132, and are gathered together by a single line 137. The following Table III shows the relationship between the key groups corresponding to the outputs B52 through B11 of the key switch matrix circuit 10 and the outputs BT0 through BT10 of the decoder 135 which selects the outputs B52 through B11.

TABLE III

| Matrix Output | Key | Decoder Output | |
|---|---|---|---|
| B52 | C7 through G6 | BT0 | |
| B51 | F#6 through C#6 | BT1 | |
| B42 | C6 through G5 | BT2 | |
| B41 | F#5 through C#5 | BT3 | |
| B32 | C5 through C4 | BT4 | |
| B31 | F#4 through C#4 | BT5 | |
| B22 | C4 through G3 | BT6 | |
| B21 | F#3 through C#3 | BT7 | lower |
| B12 | C3 through G2 | BT8 | key |
| B11 | F#2 through C#2 | BT9 | range |
| B11 | C2 | BT10 | |

The tone signal of the lowest tone key C2 is applied to the same line supplied with the output B11 of the key group F#2 through C#2 of one half octaves described above. For this reason, a scanning input line CL is provided to be exclusively used by the lowest tone key C2. The output "0" of the decoder 134 corresponding to note C is supplied to AND gate circuits 138 and 139. The output BT10 of the decoder 135 for selecting a half octave region to which the lowest tone key C2 belongs is applied to one input of an AND gate circuit 139 and a signal obtained by inverting the output BT10 with an inverter 140 is applied to one input of an AND gate circuit 138 which is enabled while the decoder 135 is producing outputs BT0 through BT9, thus scanning the keys of the notes C7, C6, C5, C4 and C3 of F#6, F#5, F#4, F#3 and F#2 in accordance with the output "0" of the decoder 134. Upon generation of the output BT10 from the decoder 135, the AND gate circuit 139 is enabled to apply a scanning pulse to the lowest tone key C2 over the line CL when the output "0" of the decoder 134 becomes "1". The scanned output of the lowest tone key C2 appears on the output B11 of the key switch matrix circuit 10. The scanning pulse on the line CL is also applied to one input of an AND gate circuit 141 of the multiplexer 136, thereby selecting the scanned output of the lowest tone key C2 applied to the output B11 by the AND gate circuit 141.

When the output of the modulo-16 counter 132 is "0", the output BT0 of the decoder 135 selects the output B52 of the highest half octave C7 through G6. Thereafter, as the count of value the counter 132 increases, the outputs B51 through B11 in the lower key range are sequentially selected. While the output of the decoder 135 is maintained at the same value, the output of the decoder 134 circulates successively starting from the high tone side with the result that the keys of the key switch matrix circuit 10 would be successively scanned from the high tone side (from highest tone C7 toward the lowest tone C2). The output line 137 of the multiplexer 136 is supplied with time division multiplex key data (37 1" represents key-on, and "0" represents key-off) starting from the high tone side. The data on line 137 is outputted as key data KD via an AND gate circuit 142. The width of one time slot (one key data) of the time division multiplex key data is equal to one key time (see FIG. 3).

The outputs of the counters 131 and 132 are supplied to a scanned key representing line 12 (FIG. 1) as the key codes N1 through N4 and B1 through B3 representing the keys now under scanning. The lower order 3 bits N1 through N3 among the note codes N1 through N4 which constitute the key codes are outputted from the modulo-6 counter 131, while the upper order one bit N4 is the lowest order bit output of the modulo-16 counter 132. The octave codes B1 through B3 correspond to upper order 3 bit outputs of the modulo-16 counter 132. Table IV shows the relationship between the values of the note codes N1 through N4 and the notes, while Table V shows the relationship between the values of the octave codes B1 through B3 and the octave key range.

TABLE IV

| Note | N4 | N3 | N2 | N1 | Decimal Representation |
|---|---|---|---|---|---|
| C | 0 | 0 | 0 | 0 | 0 |
| B | 0 | 0 | 0 | 1 | 1 |
| A# | 0 | 0 | 1 | 0 | 2 |
| A | 0 | 1 | 0 | 0 | 4 |
| G# | 0 | 1 | 0 | 1 | 5 |
| G | 0 | 1 | 1 | 0 | 6 |
| F# | 1 | 0 | 0 | 0 | 8 |
| F | 1 | 0 | 0 | 1 | 9 |
| E | 1 | 0 | 1 | 0 | 10 |
| D# | 1 | 1 | 0 | 0 | 12 |
| D | 1 | 1 | 0 | 1 | 13 |
| C# | 1 | 1 | 1 | 0 | 14 |

TABLE V

| Octave | B3 | B2 | B1 | Decimal |
|---|---|---|---|---|
| C7 through C#6 | 0 | 0 | 0 | 0 |
| C6 through C#5 | 0 | 0 | 1 | 1 |
| C5 through C#4 | 0 | 1 | 0 | 2 |
| C4 through C#3 | 0 | 1 | 1 | 3 |
| C3 through C#2 | 1 | 0 | 0 | 4 |
| C2 | 1 | 0 | 0 | 5 |

The octave codes B3, B2 and B1 also have values "110" (decimal 6) and "111" (decimal 7), but these values do not correspond to a keyboard but correspond to the BT 12, 13 and BT 14, 15.

The outputs BT7, BT8 and BT9 (see Table III) of the decoder 135 respectively corresponding to keys F#3 through C#2 are applied to the input of an OR gate circuit 143 which is also supplied with the signal on the scanning line CL of the lowest tone key C2. The output of the OR gate circuit 143 becomes "1" correspondingly to the scanning timing of the keys F#3 through C2 in the lower key range utilized for the automatic bass/chord performance and the output "1" is used as the lower key range scanning timing signal LK which is applied to one input of a NAND gate circuit 144. The other input thereof is supplied with the mode changing pulse ΔABC from the mode selection circuit 13 (FIG. 4) and the output of the NAND gate circuit 144 is applied to one input of an AND gate circuit 142. For this reason, during a short time (31.5 ms+$\alpha$) in which the mode changing pulse ΔABC is generated, the output of the NAND gate circuit 144 becomes "0" at the lower key range scanning timing so that the key data KD of the lower key range (F#3 through C2) is blocked by the AND gate circuit 142. This is done for the purpose of preventing erroneous assignment at the time of mode change.

Figure 8:
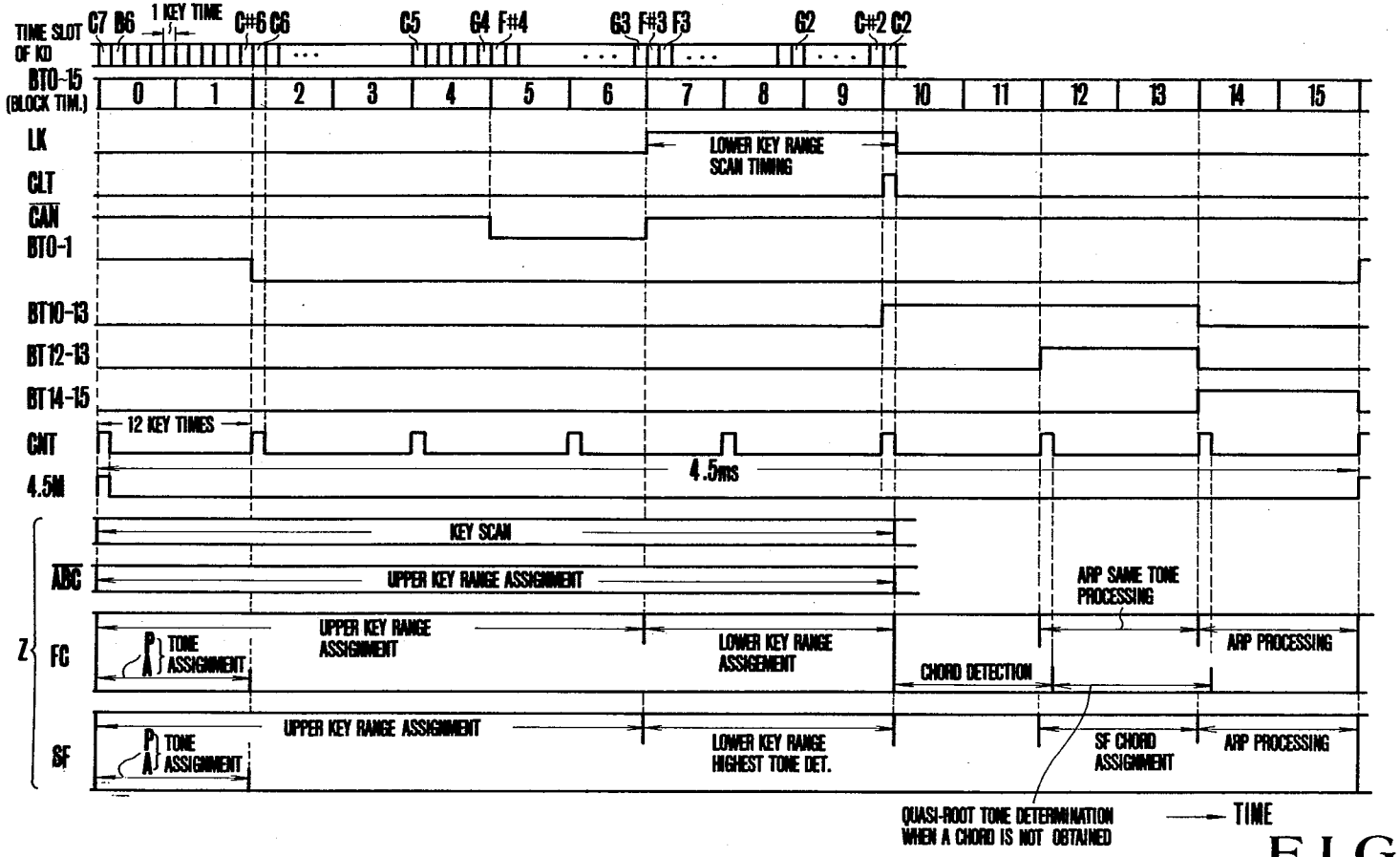
FIG. 8 is a timing chart showing timing signals generated by the key scanner shown in FIG. 7 and the time relations of various processings executed in one scanning cycle controlled by the timing signals.

A portion of the keys C7 through C2 assigned to respective time slots of the key data is shown in FIG. 8. The timing of generation of the outputs BT0 through BT15 of the decoder 135 is shown by BT0 through BT15 in FIG. 8. Hereinafter, the timing of generating the outputs BT0 through BT15 from the decoder 135 is termed a "block timing". One block timing comprises 6 key times. The timing of generation of the lower key range scanning timing signal LK is shown by LK in FIG. 8, and the timing of generation of the scanning timing signal CLT for the lowest tone key C2 is shown by CLT in FIG. 8. This signal CLT is a scanning pulse applied to the lowest tone key scanning line CL.

The outputs BT5 and BT6 of the decoder 135 and the initial clear signal IC are applied to an NOR gate circuit 145, the outputs BT5 and BT6 corresponding to the scanning timing of one octave (F#4 through G3) just before that of the lower key range. The output of the NOR gate circuit 145 becomes "0" at the time of generating the decoder outputs BT5 and BT6 as well as the initial clear signal IC as shown by $\overline{CAN}$ in FIG. 8. The output of the NOR gate circuit 145 is utilized as a cancel signal $\overline{CAN}$ for erasing the memory.

The outputs BT0 and BT1 of the decoder 135 are applied to an OR gate circuit 146 to produce a signal BT0-1 (see FIG. 8). An OR gate circuit 147 inputted with the outputs BT10 through BT13 of the decoder 135 produces signals through BT10 through BT13, and an OR gate circuit 148 supplied with the outputs BT12 and BT3 produces a signal BT12-13, whereas an OR gate circuit 149 inputted with the outputs BT14 and BT15 produces a signal BT14-15. As shown in FIG. 8, these signals BT10 through BT13, BT12-13 and BT14-15 are generated after an actual key scanning. During a surplus scanning time not corresponding to the keys represented by these signals, a processing necessary for the automatic bass/chord performance or automatic arpeggio performance is executed.

A signal corresponding to the output "0" of the decoder 134, that is note C or F#, and a signal formed by inverting the least significant bit N4 of the module-16 counter 132 by inverter 151 are applied to an AND gate circuit 150. A C note timing signal CNT produced thereby becomes "1" when the both note codes N1 through N4 produced by the counters 131 and 132 are "0000", i.e., at the timing of the note C, and this signal CNT is repeatedly generated at every 12 key times as shown in FIG. 8.

When the outputs of the counters 131 and 132 are all "0", the highest tone key C7 is scanned so that the scanning cycle pulse 4.5 M is generated correspondingly to the scanning timing of the highest tone key C7 as shown in FIG. 8. The outputs BT5 and BT6 of the decoder 135 are applied to an NOR gate circuit 279 to produce a signal $\overline{BT5\text{-}6}$.

Time Relation Among Various Processings

Before describing in detail such processings as assignment processing and key data forming processing for the automatic performance, the outline of the timings of executing these processings will be described with reference to Z in FIG. 8 for the purpose of clearly understanding the time relation among the executions of various processings.

The key scanning interval is equal to 61 key times between the scanning timing of the highest tone key C7 and that of the lowest tone key C2. A symbol ABC in a region Z shown in FIG. 8 shows a processing timing in the case of the normal mode in which since all keys are treated as the keys in the upper key range, the assignment processing for the tone production channels in the upper key range is processed correspondingly to the all key scanning timings. The assignment for individually depressed keys is made in one key time in which key data of the keys are being generated.

A symbol FC in the region Z shown in FIG. 8 shows a processing timing in the case of the fingered chord mode in which keys C7 through G3 are in the upper key range, whereas keys F#3 through C2 are in the lower key range. For this reason, during 42 key times between the scanning timing of key C7 and that of key G3, depressed key in the upper key range represented by the key data KD is assigned to a tone production channel for the upper key range. Since in the fingered chord mode, tones corresponding to depressed keys in the lower key range is produced as it is as chord constituting tones at the key scanning interval between the keys F#3 and C2, a depressed key in the lower key range represented by the key data KD is assigned to a tone production channel for the lower key range (a channel represented by the channel timing signal LchT).

The key data KD (more particularly the note timings thereof) generated in a key scanning interval of keys F#3 through C2 in the lower key range are stored in the lower key range key data register 35 (in the chord detection control circuit 30 shown in FIG. 1) and then a judgement is made whether a chord is constructed or not by a combination of the depressed keys in the lower key range during 12 key times immediately following the scanning of the lowest tone key C2. If the chord is not constructed as above described, during the following 12 key times, the note corresponding to the lowest tone key among the depressed keys is set as a quasi-root note.

During 12 key times in which the signal BT12-13 is generated, an arpeggio (ARP) same tone processing is executed in the arpeggio note key data forming circuit 44 (FIG. 1). This processing is made for the purpose of detecting a tone of different octave but having the same note among the tones corresponding to the depressed keys in the lower key range and assigned to the tone production channels for the lower key range. Since in the fingered chord mode (FC) the depressed keys in the lower key range are assigned for tone production as they are, the tone of the different octave but having the same note may be assigned to the other channel. In the arpeggio performance, tones of different octave but having the same note is processed as the same tone (a plurality of tones of different octave but having the the same note are treated as a single tone), so that it is necessary to predetect such tones of different octave but having the same tone. Thereafter, an arpeggio (ARP) processing is executed in 12 key times in which the signal BT14-15 is generated. At this arpeggio (ARP) processing, the number of the tones (tones generated after the same tone processing) of the depressed keys in the lower keyboard is counted according to the value of the arpeggio pattern data ArpPT (FIG. 1).

After completing the chord detection and arpeggio (ARP) processings, a tone production assignment of the automatic bass tone (P) and the automatic arpeggio tone (A) are executed in 12 key times in which the signal BT0-1 is produced. Of course, the tone assignment processings of these automatic performance tones are executed only when the pattern data BassPT and ArpPT are being produced. Although the timing of tone production assignment of the tones (P) and (A) overlaps the timing of the upper key range tone production assignment, there is no trouble at these timing as these automatic performance tones are assigned to respective exclusive channels (channels designated by PchT and AchT).

A symbol SF in range Z shown in FIG. 8 shows the processing timing at the time of the single finger mode in which the lower key range is utilized for designating the chord type and root note instead of designating the chord constituting tones themselves, so that at the time of scanning keys in the lower key range of keys F#3 through C2 no tone production assignment is executed. During the lower key range scanning, the highest tone key among the depressed keys of the lower keyboard is detected based on the key data of the lower key range. The note of the detected key is the root note. Because the keyboard instrument is constructed such that the root note is designated by the highest note, and that a key representing the type of the chord is designated by a key located on the lower tone side than a key corresponding to the root note. The SF chord assignment is executed during 12 key times in which the signal BT12-13 is generated. During SF chord assignment, a key data SFKL of a chord constituting tone automatically formed by the SF key data forming circuit 43 (FIG. 1) based on the root note and the chord type is produced and the assignment to the tone production channels for the lower key range is made by the tone production assignment circuit 18 according to the key data SFKL. In the same manner as the case of the fingered code mode FC, an arpeggio processing is made in 12 key times in which the signal BT14-15 is generated. Further in the 12 key times in which the signal BT0-1 is produced, the tone production assignment of the automatic bass tone (P) and the automatic arpeggio tone (A) is made.

The reason why 12 key times are required for processing of the automatic performance at the time of detecting a chord is that each of 12 notes (C.B . . . D, C#) can be corresponded to each of all the timings (note timings). The notes corresponding to respective key timing (note timings) are shown by note codes N1 through N4 supplied from the key scanner 11 (FIGS. 1 and 7).

Key Data Converter 23

Figure 9:
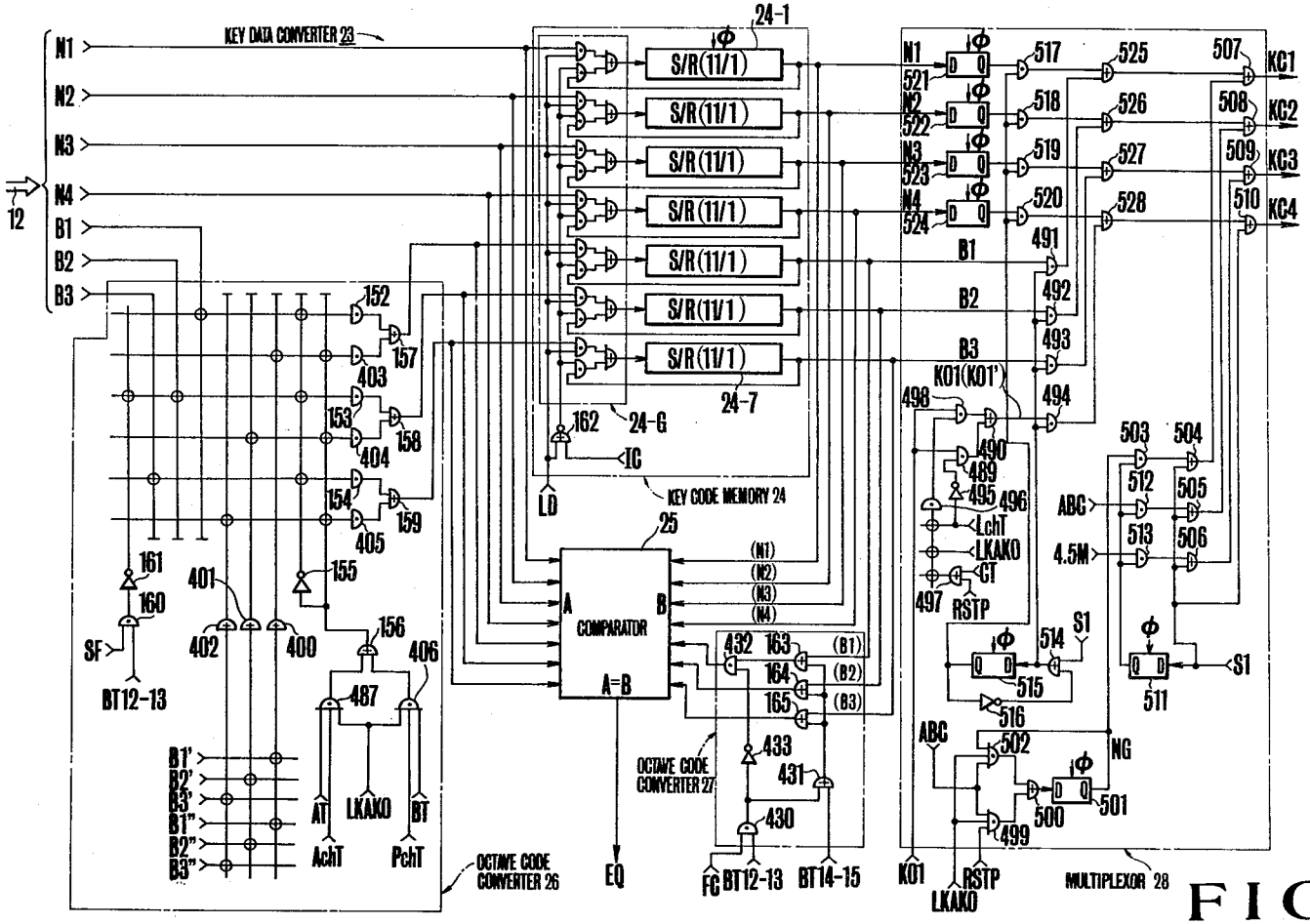
FIG. 9 is a connection diagram showing the detail of the key data converter shown in FIG. 1.

The detail of the key data converter 23 shown in FIG. 1 is shown in FIG. 9 in which the note codes N1 through N4 supplied from the counters 131 and 132 (FIG. 7) of the key scanner 11 are applied to a key code memory device 24 and to one input A of a comparator 25 over a line 12. Octave codes B1 through B3 supplied from the counter 132 through the line 12 are respectively applied to one inputs of AND gate circuits 152, 153 and 154 of the octave code converter 26. The other inputs of the AND gate circuits 152, 153 and 154 are supplied with the output of an inverter 155. The output of an OR gate circuit 156 becomes "1" only when a bass tone or an arpeggio tone is assigned, but in the other cases, the output of the inverter 155 is always "1". Consequently the AND gate circuits 152, 153 and 154 are normally enabled so that the octave codes B1, B2 and B3 supplied from the line 12 pass, as they are, through the AND gate circuits 152, 153 and 154 and OR gate circuits 157, 158 and 159. An AND gate circuit 160 is supplied with the single finger mode signal SF sent from the latch circuit 14-4(FIG. 4) of the mode selection circuit 13, and the signal BT12-13 from the OR gate circuit 148 of the key scanner 11, so that the output of the AND gate circuit 160 changes to "1" at the time of assigning the production of the chord constituting tones in the single finger mode (at the time of generation of signal BT12-13 shown in FIG. 8). This output "1" disables the AND gate circuit 153 through an inverter 161 thus varying the values of the octave codes B1 through B3. The octave codes (usually B1, B2 and B3) outputted from the octave code converter 26 are applied to the key code memory device 24 and to one input A of the converter 25.

The key code memory device 24 comprises seven shift registers 24-1 through 24-7 corresponding to the respective bits of the key codes N1–N3. Each one of these shift registers is provided with 11 stages corresponding to the number of the channel timings (see FIG. 6) and driven by the system clock pulse $\phi$ in synchronism with respective channel timings (1 through 11). Therefore, the channel timings of the inputs and the outputs of the shift registers 24-1 through 24-7 coincide with each other. The outputs of respective shift registers are fed back to their inputs via a gate circuit 24-G to be stored or held. When supplied with a load signal LD at a given channel timing, the gate circuit 24-G applies the note codes N1 through N4 from the line 12 and octave codes B1 through B3 from the octave code converter 26 to the first stages of the shift registers 24-1 through 24-7. At this time, the output of an NOR gate circuit 162 which inverts the load signal LD becomes "0" to cause the gate circuit 24-G to block the output signals of the shift registers 24-1 through 24-7, thus clearing the memory of an old key code which has been stored in same channel that the load signal LD was produced. When the load signal LD is not produced, the output of the NOR gate circuit 162 becomes "1" to feed back the outputs of the shift registers 24-1 through 24-7, thus holding the key codes stored in respective channels. The load signal LD is produced by the tone production assignment controller 19(FIG. 1) correspondingly to a certain channel timing when key codes N1 through N4 supplied to line 12 are to be newly assigned to some of the channels. For this reason, the key code memory device 24 or the shift registers 24-1 through 24-7 store key codes representing the tones assigned to respective channels and such already assigned key codes are outputted in synchronism with respective channel timings on the time division basis.

Four bit note codes (N1 through N4) among the key codes outputted, on the time division bases, from the key code memory device 24 and assigned to respective channels are applied to the other input B of the comparator 25, while the octave codes B1 through B3 are repetitively applied to one inputs of OR gate circuits 163, 164 and 165 of the octave code converter 27. The octave code converter 27 is used to change the values of the octave codes B1 through B3 at the time of processing the automatic arpeggio, and to pass the octave codes B1 through B3 outputted from the key code memory device 24, as they are, to the other input B of the comparator 25 in the other cases.

The comparator 25 produces a coincidence signal EQ when the values of the key codes applied to its two inputs A and B are equal. The key codes N1 through N4 and B1 through B3 applied to one input A correspond to respective key scanning timings and do not change during one key time, whereas the key codes N1 through N4 and B1 through B3 applied to the other input B change at each channel timing (see FIG. 6). Since one key time corresponds to 22 channel timings, during one key time in which the key codes N1 through N3 corresponding to the key scanning times have the same value, comparison of respective key codes N1 through N4 and B1 through B3 assigned to all 11 channels are made twice. More particularly, during the fore half 11 bit times in one key time, a judgement is made whether the key codes having the same values as the key codes N1 through N4 and B1 through B3 corresponding to the key scanning timings have already been assigned to some of the channels.

Tone Production Assignment

Figure 10:
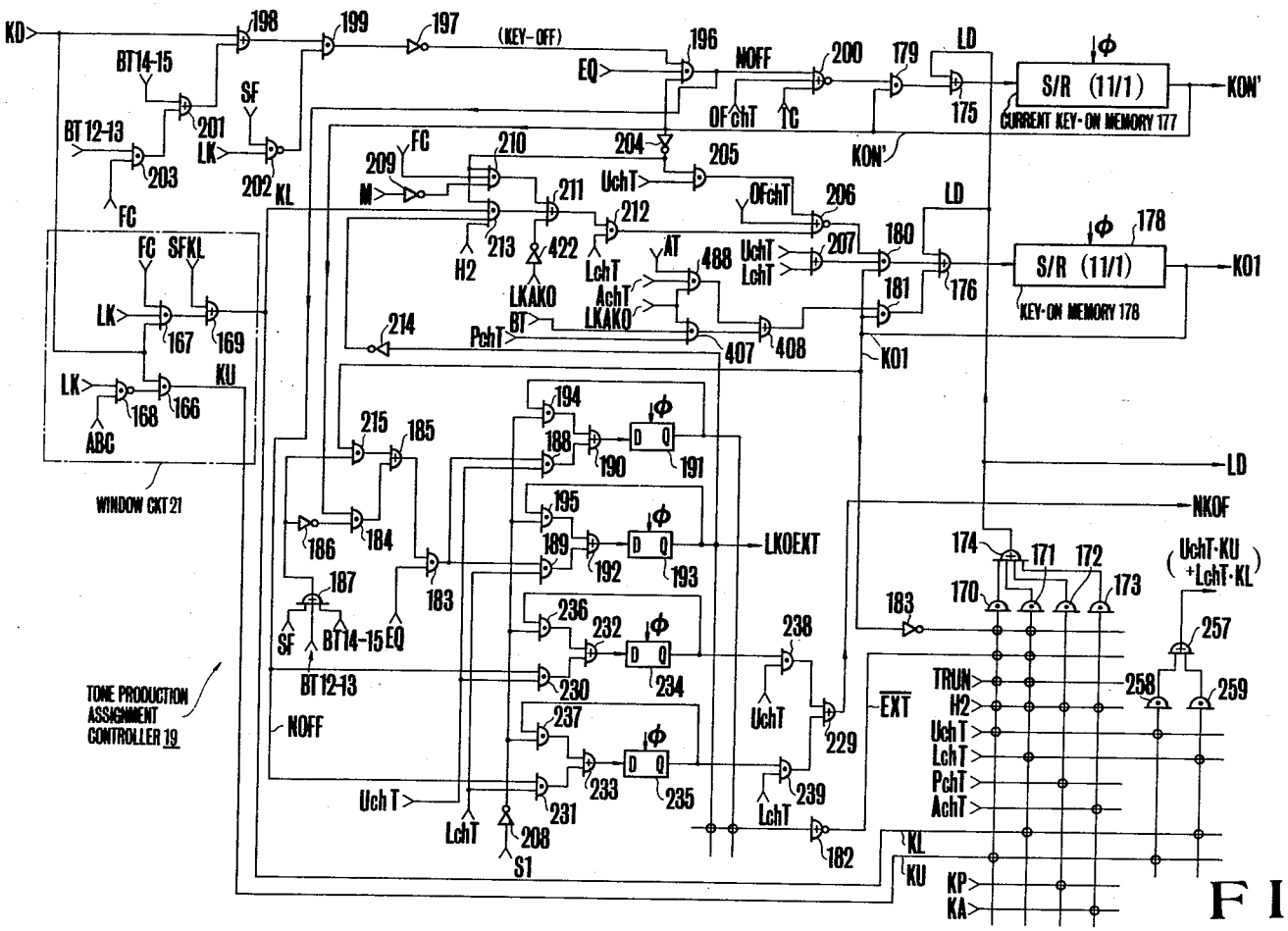
FIG. 10 is a connection diagram showing the detail of the tone production assignment controller and the window circuit shown in FIG. 1.

The details of the tone production assignment circuit 18, the tone production assignment controller 19 and the window circuit 21 are shown in FIG. 10.

The window circuit 21 comprises AND gate circuits 166 and 167 with one inputs supplied with the key data KD outputted from the AND gate circuit 142 (FIG. 7) of the key scanner 11. The window circuit 21 selectively applies the key data KD to either one of the upper key region (first musical tone production manner) and the lower key region (second musical tone production manner) depending upon a selected mode. To the other input of the AND gate circuit 166 is applied the output of an NAND gate circuit 168 which is supplied with the automatic bass chord mode signal ABC from the NOR gate circuit 97 of the mode selection circuit 13, and the lower key range scanning timing signal LK from the OR gate circuit 143 (FIG. 7) of the key scanner 11. In the normal mode, the signal ABC is always "0" so that the output of the NAND gate circuit 168 is always "1". Consequently, the AND gate circuit 166 is always enabled to pass all key data KD from the highest tone key C7 to the lowest tone key C2 for outputting the key data as the upper key range data KU. Accordingly, at the time of the normal mode, all keys are assumed to belong to the upper key range.

For the automatic bass chord, the signal ABC is "1" so that while the lower key range scanning timing signal LK is being generated, the NAND gate circuit 168 is enabled with the result that the output of the NAND gate circuit 168 becomes "0" thus disabling the AND gate circuit 166. Consequently, at the scanning time of the keys F#3 through C2 in lower key range in which the lower key range scanning timing signal LK is "1" (see FIG. 8), the AND gate circuit 166 is disabled so that the key data KD of the keys F#3 through C2 in the lower key range do not act as the upper key range key data KU. However, at the timing of the keys C7 through G3 (FIG. 8), the signal LK is "0" and the output of the NAND gate circuit 168 is "1", so that the key data KD of the keys C7 through G3 pass through the AND gate circuit 166 to be outputted as the upper key range key data KU. Accordingly, in the automatic bass/chord mode, some keys (C7 through G3) are treated as if they belong to the upper key range (the first musical tone production manner).

The other input of the AND gate circuit 167 is applied with the lower key range scanning timing signal LK described above, and the fingered chord mode signal FC outputted from the latch circuit 14-3 (FIG. 4) of the mode selection circuit 13. The output of the AND gate circuit 167 is outputted as the lower key range key data KL via an OR gate circuit 169. Thus, only in the fingered chord mode of the automatic bass/chord (FC is "1"), the AND gate circuit 167 is enabled to select only the key data KD of the keys F#3 through C2 in the lower key range, which are generated when the lower key range scanning timing signal LK is "1" for producing the selected key data KD as the lower key range key data KL.

In the single finger chord mode, the AND gate circuit 167 is not enabled so that the key data KD of the lower key range keys F# through C2 would not act directly as the lower key range key data KL, but instead the key data SFKL of the chord constituting tones automatically formed by the SF chord key data forming circuit 43 (FIG. 1) for the single finger chord mode are produced and these key data SFKL are applied to one input of an OR gate circuit 169 to be produced therefrom as the lower key range key data KL.

In the tone production assignment controller 19, tones corresponding to the upper key range key data KU are assigned to the tone production channels for the upper key range while the tones corresponding to the lower key range key data KL are assigned to the tone production channel for the lower key range based on the upper key range key data KU and lower key range key data selected by the window circuit 21. As the mode changes, the modes of the upper and lower key range channels change as already described. More particularly, the mode of generation of the channel timing signals UchT, LchT, PchT and AchT generated by the timing signal generator 20 (FIG. 2) changes (see FIG. 6). These channel timing signals UchT through AchT are applied to the tone production assignment controller 19 shown in FIG. 10 to control the assignment operation.

In the tone production assignment controller 19, the upper key range key data KU are applied to one input of an AND gate circuit 170, while the lower key range key data KL are applied to one input of an AND gate circuit 171. AND gate circuits 170 through 173 are provided for judging whether a condition that newly assign the tones corresponding to the key data KU, KL, KP and KA to either one of the channels respectively, is satisfied or not. When the condition of assignment is satisfied, the AND gate circuits 170 through 173 produce a load signal LD via an OR gate circuit 174 according to the channel timing to be assigned. The load signal LD is applied to the key code memory device 24 (FIG. 9) and to a current key-on memory device 177 and a key-on memory device 178 via OR gate circuits 175 and 176.

Each of the key-on-memory devices 177 and 178 comprises an 11 stage/one bit shift register shift controlled by the system clock pulse $\phi$. A signal "1" (load signal LD) received in the shift registers 177 and 178 at a certain channel timing is outputted from the last stages of these shift registers after 11 bit times (that is at the same channel timing). The output of the shift register 177 (current key-on memory device) is fed back to its input via AND gate circuit 179 and OR gate circuit 175 so that it is self-held in the shift register 177. In the same manner, the output of the shift register 178 (key-on memory device) is self-held via AND gate circuit 180 or 181 and an OR gate circuit 176.

The key-on memory devices 177 and 178 store, on the time division basis and according to respective channel timings, the result of the judgement whether the keys assigned to respective channels are now being depressed or not, in other words the result of judgement whether the key codes N1 through N4 and B1 through B3 stored in corresponding channels of the key code memory device 24 (FIG. 9) relate to the depressed keys or released keys. When the keys are depressed, the signal "1" stored according to the load signal LD is held so that the output is "1". When the keys are released, self-holding AND gate circuit 179 or 180 and 181 are disabled to erase the memory so that the output becomes "0". The current key-on memory device 177 is adapted to store a key-on signal KON' corresponding the actual ON/OFF states of the key so that when the keys are released, the key-on signal KON' of the channel to which the released keys have been assigned are cleared. The key-on signal KON' representing the actual key ON/OFF states is applied to the truncate circuit 22 (FIG. 1).

The current key-on memory device 177 is not used for the bass tone, arpeggio tone and the lower key range key tones (chord constituting tones) at the time of the single finger mode. The key-on memory device 178 is adapted to store a key-on signal KO1 formed by taking into consideration the memory mode. The key-on signal KO1 thus stored would not be immediately cleared in the memory mode even when the keys in the lower key range are released and the memory is continuously held until a predetermined condition of clear is satisfied. The key-on signal KO1 outputted from the key-on memory device 178 is used as a signal for musical tone production.

Tone Production Assignment in the Case of Normal Mode

As above described, in the case of the normal mode, key data KD regarding all keys C7 through C2 is selected as the upper key range key data KU by the window circuit 21. As shown in FIG. 6, the timing signal generator 20 (FIG. 2) generates the upper key range channel timing signal UchT corresponding to channel timings "2" through "11" except not used channel timing "1", but not other channel timing signals LchT, PchT and AchT. Generation of the channel timing signal UchT for all channel timings "2" through "11" is only for the 10 channel mode ($\overline{10}/7$ is "0") but in the case of the 7 channel mode ($\overline{10}/7$ is "1") the channel modes are different. In the following, the 10 channel mode will be described as a typical example.

Assume now that the key data KD becomes "1" at the scanning time of key C4. At this time the values of the key codes B3, B2, B1, N4, N3, N2 and N1 applied to the key code memory device 24 and the comparator 25 through the line 12 are "0110000" (see Tables IV and V) representing key C4. In FIG. 10, the upper key range key data KU becomes "1" for one key time corresponding to the key data KD of the key C4 and an AND gate circuit 170 inputted with this upper key range key data KU judges whether the assignment condition is satisfied or not. The other input of the AND gate circuit 170 receives the upper key range channel timing signal UchT (FIG. 6), the latter half period signal (61-Q in FIG. 3) produced by the flip-flop circuit 61 (FIG. 2) of the timing signal generator 20, the truncate channel signal TRUN generated by the truncate circuit 22 (FIG. 1), a nonregistration signal $\overline{EXT}$ produced by an NOR gate circuit 182, and a signal produced by inverting with an inverter 183 the key-on signal KO1 outputted from the key-on memory device. The truncate channel signal TRUN becomes "1" according to a channel timing whose key has been released at the earliest time among upper key range channels whose keys have already been released and shows that a key to be newly assigned is to be assigned to this channel. The truncate channel signal TRUN is generated in a manner to be described later.

The nonregistration signal $\overline{EXT}$ is "0" when the same key codes as the key codes N1 through N4 and B1 through B3 corresponding to the key data KU now to be assigned have already been assigned to certain channels, whereas is "1" when the key data KU are not yet assigned to any channel. More particularly, where the same key codes as the key codes N1 through N4 and B1 through B3 corresponding to the key data KD now to be assigned have already been assigned to certain channels, the comparator 25 (FIG. 9) produces a coincidence signal EQ correspondingly to either one of the channel timings during the fore half 11 bit times of one key time during which the key codes N1 through N4 and B1 through B3 are supplied to the scanning display line 12. This coincidence signal EQ is applied to one input of the AND gate circuit 183 shown in FIG. 10, the other input thereof being connected to receive a current key-on signal KON' from the current key-on memory device 177 via AND gate circuit 184 and OR gate circuit 185. The other input of the AND gate circuit 184 is supplied with a signal obtained by inverting the output of the OR gate circuit 187 with an inverter 186. In the case of assigning the upper key range, the output of the OR gate circuit 187 is "0" so that the AND gate circuit 184 is enabled. Accordingly, the output of AND gate circuit 183 becomes "1" where the keys assigned to channels from which the coincidence signal EQ has been produced are now actually depressed and this output "1" is applied to inputs of AND gate circuits 188 and 189.

To the other input of the AND gate circuit 188 is applied the upper key range channel timing signal UchT while the lower key range channel timing signal LchT is applied to the other input of the AND gate circuit 189. Accordingly, where the coincidence signal EQ is produced correspondingly to the upper key range channel, the output "1" of the AND gate circuit 188 is stored in a delay flip-flop circuit 191 via an OR gate circuit 190. On the other hand, where the coincidence signal EQ is produced correspondingly to the lower key range channel (this does not occur in the normal mode), signal "1" is applied to a delay flip-flop circuit 193 from the AND gate circuit 189 via an OR gate circuit 192. The memories of the delay flip-flop circuits 191 and 193 are self-held through AND gate circuits 194 and 195 respectively, and the outputs of the delay flip-flop circuits 191 and 193 are applied to the NOR gate circuit 182.

Consequently, where the key data KD (KU) now to be assigned have already been assigned to either one of the upper key range channels and the key thereof is now being depressed (that is KON' is "1") during the latter half 11 bit times of one key time, the delay flip-flop circuit 191 continues to produce an output "1" so that the nonregistration signal $\overline{EXT}$ produced by the NOR gate circuit 182 becomes "0". Conversely, where the key data KD (KU) now to be assigned has not yet been assigned to any channel, the outputs of the delay flip-flop circuits 191 and 193 are both "0" at the latter half 11 bit times of one key time and the nonregistration signal EXT becomes "1". The signal S1 (FIG. 3) generated by the timing signal generator 20 (FIG. 2) is inverted by an inverter 208 and applied to one inputs of AND gate circuits 194 and 195 so as to clear the memories of the delay flip-flop circuits 191 and 193 at the first channel timing "1" of one key time.

The reason for applying the latter half period signal H2 to the AND gate circuit 170 is to assign in the latter half period of one key time in which a correct nonregistration signal $\overline{EXT}$ is obtainable. The reason for applying the signal obtained by inverting the key-on signal KO1 with the inverter 183 to the AND gate circuit 170 is to execute a new assignment for a blank channel (KO1 is "1"). Further, the reason for applying the nonregistration signal $\overline{EXT}$ to the AND gate circuit 170 is to prevent double assignment to other channels of the depressed key tones already assigned.

When all input signals to the AND gate circuit 170 are "1", the condition for executing the new assignment is satisfied so that a single load signal LD is produced by the AND gate circuit 170 via OR gate circuit 174 corresponding to either one of the channel timings of the upper key range channels UchT designated by the latter half truncate channel signal TRUN of one key time. The key codes N1 through N4 and B1 through B3 on line 12 are stored into the key code memory device 24 (FIG. 9) corresponding to one channel timing at which the load signal LD was generated. In this manner, the key data representing the keys to be newly assigned to a certain channel (which has generated the load signal LD) of the time division time slots, are converted into key codes N1 through N4 and B1 through B4 (of a value shown in C4 for example) which are stored in the key code memory device 24. The current key-on signal KON' and the key-on signal KO1 are respectively stored in the current key-on memory device 177 and the key-on memory device 178 (FIG. 10) according to the channel timing which the load signal LD generated.

The key codes N1 through N4 and B1 through B3 stored in the key code memory device 24 (FIG. 9) corresponding to a channel according to the load signal LD would not be erased until another key code is to be assigned next time. The key-on signals KON' and KO1 stored in the current key-on memory device 177 and the key-on memory device 178 respectively are erased in the following manner.

As AND gate circuit 196 shown in FIG. 10 is supplied with a coincidence signal EQ produced by the comparator 25 shown in FIG. 9, the output KON' of the current key-on memory device 177 and the output of an inverter 197. Key data KD is applied to the inverter 197 via an OR gate circuit 198 and an AND gate circuit 199. The output of the AND gate circuit 196 is inverted by an NOR gate circuit 200 and then applied to a memory holding AND gate circuit 179 of the current key-on memory device 177. Although the output of an OR gate circuit 201 is applied to the other input of the OR gate circuit 198, the output of the OR gate circuit 201 is "0" at the key scanning timing so that it does not influence the key data KD. Further, to the other input of the AND gate circuit 199 is applied the output of an NAND gate circuit 202. This NAND gate circuit 202 is supplied with a single finger mode signal SF and a lower key range scanning timing signal LK so that the NAND gate circuit 202 produces a signal "0" when the lower key range key data KD is generating (LK is "1") in the single finger mode (SF is "1"), thus disabling the AND gate circuit 199. This is made for the purpose of blocking the lower key range key data KD by the AND gate circuit 199 because in the single finger mode, the lower key range key data KD is not used directly for the tone production assignment.

The upper key range key data KD pass, as they are, through OR gate circuit 198 and AND gate circuit 199 to the inverter 197. Consequently, when a key in the upper key range is released, the key data KD corresponding to that key becomes "0" and the output of the inverter 197 becomes "1". At this time, the key codes N1 through N4 and B1 through B3 corresponding to the key data KD of the released key are applied to one input A of the comparator 25 shown in FIG. 9. Where these key codes N1 through N4 and B1 through B3 are assigned to either one of the channels, a coincidence signal EQ corresponding to that channel is produced. Where the key assigned to that channel producing the coincidence signal EQ has been depressed immediately before, the output KON' of the current key-on memory device 177 is "1". Consequently, immediately after the release of the depressed key, the AND gate circuit 196 is enabled, thus producing an output "1" correspondingly to a channel timing to which the key has been assigned. This output "1" is used as a new key-off pulse NOFF. This output "1" of the AND gate circuit 196 is inverted by a NOR gate circuit 200 to apply a signal "1" to one input of the AND gate circuit 79 so as to clear the current key-on signal KON' of the channel which is assigned with a just released key. Thus, the current key-on signal KON' becomes "1" or "0" depending upon the actual key-on the key-off states.

The other input of the NOR gate circuit 200 is supplied with an off channel timing signal OFchT generated by the timing signal generator 20 (FIG. 2) and the initial clear signal IC. Consequently in a channel in which the off channel timing signal OFchT has generated (see FIG. 6), the current key-on signal KON' is cleared and processed as if the key has been released even though the key is not released actually.

An OR gate circuit 201 is supplied with the output of an AND gate circuit 203 and a signal BT14-15 (see FIG. 8) supplied from the OR gate circuit 149 (FIG. 7) of the key scanner 11. The AND gate circuit 203 is supplied with signal BT12-13 (FIG. 8) supplied from the OR gate circuit 148 (FIG. 7) of the key scanner 11 and a fingered chord mode signal FC generated by the latch circuit 14-3 (FIG. 4) of the mode selection circuit 13. In the operation of the arpeggio key data forming circuit 44 (FIG. 1) (the ARP same tone processing and ARP processing outlined with reference to FIG. 8), the octave code converter 27 (FIG. 9) performs octave code conversion for producing a coincidence signal EQ independent of the actual octave code of already assigned key code. The coincidence signal EQ thus produced is used for the arpeggio processing. In order to prevent the coincidence signal EQ from clearing the current key-on memory device 177 during the arpeggio processing described above, the AND gate circuit 203 and OR gate circuit 201 produce a signal "1" which is applied to OR gate circuit 198 to produce a quasi-key data KD of "1".

The output KON' of the current key-on memory device 177 is inverted by an inverter 204 and then applied to one input of an AND gate circuit 205. The other input thereof is supplied with the upper key range channel timing signal UchT, and the output of the AND gate circuit 205 is inverted by an NOR gate circuit 206 and then applied to one input of a self-holding AND gate circuit 180 of the key-on memory device 178. The other input of the AND gate circuit 180 is supplied with the upper key range channel timing signal UchT through an OR gate circuit 207. Upon release of a key, the current key-on signal KON' of a channel assigned with that released key becomes "0", while the output of the inverter 204 becomes "1". If the key is included in the upper key range, the output of the AND gate circuit 205 becomes "1" and the output of the NOR gate 206 becomes "0", thus disabling the AND gate circuit 180. In the case of the upper key range, the current key-on signal KON' stored in the current key-on memory device 177 becomes "0" and immediately thereafter the key-on memory device 178 is cleared. Consequently, the key-on signal KO1 of a key in the upper key range becomes "1" or "0" according to the actual depression or release of a key respectively.

The AND gate circuit 180 is supplied with an upper key range channel timing signal UchT and a lower key range channel timing signal LchT through an OR gate circuit 207 for clearing the key-on signal in the upper or lower key range. At the timing other than those for the channels of the upper and lower key ranges, the AND gate circuit 180 is always disabled. Another self-holding AND gate circuit 181 is provided for the purpose of clearing key-on signal KO1 of the bass tone channel (channel for signal PchT) and the arpeggio channel (channel for signal AchT) and is normally disabled at the upper and lower key channel timings.

The other input of the NOR gate circuit 206 is supplied with an off channel timing signal OFchT and at the channel timing at which the signal OFchT has produced, the output of the NOR gate circuit 206 becomes "0" so that the key-on signal KO1 is cleared irrespective of the fact that the key is not released actually.

Tone Production Assignment in Fingered Chord Mode

In the case of the fingered chord mode, the fingered chord mode signal FC and the automatic bass/chord mode signal ABC become 37 1". As above described, the window circuit 21 produces key data KD of keys C7 through G3 as the upper key range data KU and key data KD of the keys F#3 through C2 as the lower key range key data KL. As shown in the range ABC shown in FIG. 6, the timing signal generator 20 (FIG. 20) produces channel timing signals UchT, LchT, PchT and AchT corresponding to predetermined channels.

The tone production assignment according to the upper key range key data KU is the same as that of the normal mode described above. Except that, in the normal mode all key data KD become the upper key range data KU, while in the automatic bass/chord mode (fingered chord mode and the single finger mode) the key data of some of the keys C7 through G3 constitute the upper key range key data KU, and that in the normal mode, the upper key range channel timing signal UchT is generated corresponding to all tone production channels, whereas in the automatic bass/chord mode, the upper key range channel timing signal UchT is produced corresponding to some of the tone production channels.

In the tone production assignment controller 19 shown in FIG. 10, the lower key range key data KL is applied to one 4 input of an AND gate circuit 171. When a key in the lower key range F#3 through C2 is depressed, the key data KL becomes "1" for one key time of the scanning time of that key. The other inputs of the AND gate circuit 171 are supplied with a lower key range channel timing signal LchT, a latter half period signal H2, a truncate channel signal TRUN, a nonregistration signal EXT, and a signal obtained by inverting the key-on signal KO1 with an inverter 183. The truncate channel signal TRUN becomes "1" at the timing of the most early released channel among the lower key range channels, when the lower key range key data KL is being produced.

When key codes N1 through N4 and B1 through B3 corresponding to the lower key range key data KL now being produced have already been assigned to some of the lower key range channels, the comparator 25 (FIG. 9) produces a coincidence signal EQ correspondingly to that lower key range channel timing, and the coincidence signal EQ is applied to one input of the AND gate circuit 183. The output "1" thereof is stored in a delay flip-flop circuit 193 via an AND gate circuit 189 already enabled by the lower key range channel timing signal LchT. Consequently, if a key corresponding to a lower key range key data KL now being produced has already been assigned, the output of a delay flip-flop circuit 193 becomes continuously "1" in the latter half 11 bit times of one key time. The output of this delay flip-flop circuit 193 is applied to other circuit elements as a signal LKO-EXT, and inverted by the NOR gate circuit 182 to obtain a nonregistration signal EXT supplied to the AND gate circuit 171.

When the AND gate circuit 171 is enabled, a load signal LD is produced to store key codes N1 through N4 and B1 through B3 corresponding to the key data KD (KL) now being produced in the key code memory device 24 (FIG. 9). Concurrently therewith a current key-on signal KON' and a key-on signal KO1 are stored in the current key-on memory device 177 and the key-on memory device 178 respectively. As above described, in the fingered chord mode, the tone production of a depressed key in the lower key range is assigned to a lower key range channel thereby producing the tones of the lower key range depressed keys are produced as an accompaniment tone.

The current key-on signal KON' in the lower key range at the time of the fingered chord mode is erased when the AND gate circuit 196 is enabled (that is a depressed key is newly released) in the same manner as the erasure of the upper key range current key-on signal KON'. The lower key range key-on signal KO1 in the key-on memory device 178 is erased in the following manner.

A memory mode signal M produced by the mode changing control circuit 15 (FIG. 4) is inverted by an inverter 209 and then applied to one input of an AND gate circuit 210, the other input thereof being supplied with a signal formed by inverting the fingered chord mode signal FC and the current key-on signal KON'. Accordingly, in the fingered chord mode (FC is "1") and not in the memory mode (M is "0"), the AND gate circuit 210 is enabled when a key in the lower key range is actually released (KON' is "0"). The output "1" of the AND gate circuit 210 is applied to one input of an AND gate circuit 212, the other input thereof being applied with the lower key range channel timing signal LchT. Thus, when the current key-on signal KON' which became "0" is assigned to a lower key range channel (output "1" of the AND gate circuit 210 is produced by the timing action of the signal LchT), the output of the OR gate circuit 211 (output "1" of the AND gate circuit 210) is applied to one input of the NOR gate circuit 206. Thus, output "1" of the AND gate circuit 210 is inverted by the NOR gate circuit 206, thus disabling the AND gate circuit 180 for self-holding the key-on memory device 178, and clearing the key-on signal KO1. Consequently in the fingered chord mode, when the mode is not the memory mode, and when a key in the lower key range is actually released, the key-on signal KO1 of a channel assigned with that key is cleared.

In the case of the memory mode (M is "1"), the output of an inverter 209 is "0" so that AND gate circuit 210 is disabled. Consequently, even when a key in the lower key range is actually released and the current Key-on signal KON' become "0 ", the key-on signal KO1 would not be released. So, in the case of the memory mode, the tone production of a released key in the lower key range will be continued according to the key-on signal KO1 which is a continuously maintained at "1" after the actual key release.

In the memory mode, the key-on signal KO1 is cleared by the action of an AND gate circuit 213 which is supplied with a signal formed by inverting the current key-on signal KON' with an inverter, a lower key range key data KL outputted from the OR gate circuit 169 of the window circuit 21, a signal formed by inverting with an inverter 214 the output LKOEXT of the delay flip-flop circuit 193 storing a coincidence signal EQ, and a latter half period signal H2. The output of the AND gate circuit 213 is applied to one input of an AND gate circuit 212 via an OR gate circuit 211. When a new key in the lower key range is depressed, the key data KL becomes "1" at the scanning time of that key. Since this key was not depressed before (that is not assigned), no coincidence sighal EQ is produced and the output LKOEXT of the delay flip-flop circuit 193 becomes "0" in the latter half period in one key time and the output of the inverter 214 becomes "1". As a consequence, when the output of the inverter 214 and the key data KL applied to the AND gate circuit 213 are both "1" during the latter half period signal H2 (FIG. 3) is generated, it shows that a key is depressed in the lower key range. When a new key in the lower key range is depressed, the AND gate circuit 213 produced an output "1" during the latter half 11 bit times corresponding to the channel timing an actually released key (KON' is "0" and the output of the inverter 204 is "1"). This output of the AND gate circuit 213 is applied to an AND gate circuit 212 via an OR gate circuit 211. The AND gate circuit 212 selects the output "1" of the AND gate circuit 213 generated at the lower key range channel timing (LchT is "1") and applies the selected output to the NOR gate circuit 206. When the output thereof is "0", the AND gate circuit 180 is disabled thus changing to "0" the lower key range key-on signal KO1 which has been maintained at "1" state even after the actual key release. More particularly, in the memory mode, the key-on signal KO1 is held or stored even after release of a lower key range key. If thereafter a certain key in the lower key range is newly depressed, the key-on signal KO1 of an actually released key is cleared, which has been held up to that time. Of course, a load signal LD regarding the newly depressed key is produced and a current key-on signal KON' and a key-on signal KO1 are newly stored.

The AND gate circuit 183 is used to select the coincidence signal EQ generated with respect to the lower key range channel timing for storing the signal EQ in the delay flip-flop circuit 193, and in the case of the fingered chord mode, the other input of the AND gate circuit 183 is supplied with the output of AND gate circuit 184 through the OR gate circuit 185. The AND gate circuit 184 is supplied with the current key-on signal KON' and the output of an inverter 186. In the fingered chord mode and at the lower key range scanning timing (see LK shown in FIG. 8), the single finger mode signal SF and the signals BT12-13 and BT14-15 (FIG. 8) applied to the OR gate circuit 187 are all "0" so that the output of the inverter 186 is "1", whereby the current key-on signal KON' is applied to one input of the AND gate circuit 183 via AND gate circuit 184. Thus, signal "1" is stored in the delay flip-flop circuit 193 only when a key assigned to a lower key range channel in which the coincidence signal EQ has generated is now being actually depressed.

As above described, in the fingered chord mode, the reason for using the current key-on signal KON' instead of the key-on signal KO1 as the condition for storing the coincidence signal EQ regarding the lower key range channel is to clear the key-on signal KO1 at the time of the memory mode by utilizing a signal formed by inverting the output signal LKOEXT of the delay flip-flop circuit 193 with an inverter 214. In the memory mode, since the key-on signal KO1 is maintained at "1" even after the key release, where the coincidence signal EQ is stored in the delay flip-flop circuit 193 by using the key-on signal KO1, the signal LKOEXT would become "1" when once released key is depressed again so that the AND gate circuit 213 can not detect the newly depressed key thus failing to clear the memory device 178. For the reason described above, in the case of the fingered chord mode, the coincidence signal EQ is stored in the delay flip-flop circuit 193 by utilizing the current key-on signal KON'.

Truncate Circuit 22

Figure 11:
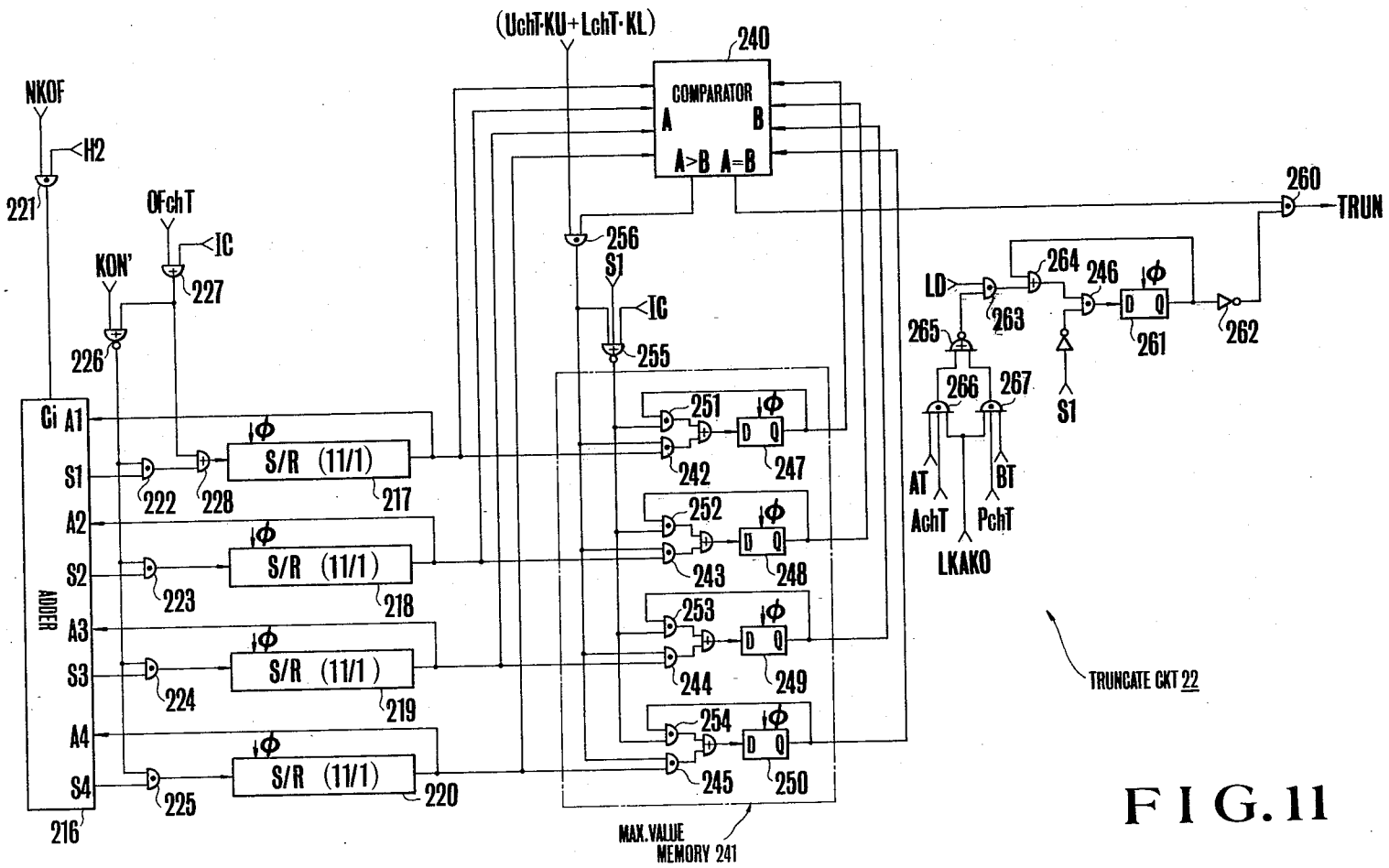
FIG. 11 is a connection diagram showing the detail of the truncate circuit shown in FIG. 1.

The detail of the truncate circuit 22 shown in FIG. 1 is shown in FIG. 11 in which a 4 bit adder 216 and four shift registers 217 to 220 of 11 stage/1 bit type constitute a counter which counts, on the time division basis, the number of the afterward released keys for each channels. The shift registers 217 and 220 are shift-controlled by the system clock pulse $\phi$ and produce outputs or count values, on the time division basis, from their last stages correspondingly to respective channel timings and their outputs are applied to the inputs A1 to A4 of the adder 216. The adder 216 counts the number of signals applied to its carry input Ci from an AND gate circuit 221 and supplies its outputs S1 to S4 to shift registers 217 to 220 respectively through AND gate circuits 222 to 225, the other inputs thereof being supplied with the outputs of an NOR gate circuit 226. One input thereof is supplied with a current key-on signal KON' of each channel outputted, on the tine division basis, from the current key-on memory device 177 of the tone production assignment controller 19 shown in FIG. 10. Consequently, at the channel timing at which the current key-on signal KON' is "0" (that is a key is actually released), the AND gate circuits 222 to 225 are enabled, whereby counting operation becomes possible. At the channel timing wherein the key is depressed, the signal KON' is "1" and the output of the NOR gate circuit 226 is "0" so that AND gate circuits 222 to 225 are disabled, thereby clearing the count value.

Where the initial clear signal IC is generated or at a channel timing in which the off channel timing signal OFchT is being produced, the output of an OR gate circuit 227 becomes "1" which is inverted by the NOR gate circuit 226 so that AND gate circuits 222 to 225 supplied with the inverter signal are disabled. At this time, while the counting operation is impossible, the output "1" of the OR gate circuit 227 is applied to the input of the shift register 217 comprising the least significant bit via an OR gate circuit 228, thus making the count value to be "0001" by compulsion.

An AND gate circuit 221 is supplied with the latter half period signal H2 sent from the timing signal generator 20 (FIG. 2) and the new key-off signal NKOF sent from the OR gate circuit 229 of the tone production assignment controller 19 shown in FIG. 10, the new key-off signal NKOF being produced when any one of the keys is newly released.

When a key which has been assigned to any channel is released, the AND gate circuit 196 shown in FIG. 10 produces a new key-off pulse NOFF at that channel timing. This new key-off pulse NOFF is sent and stored in a delay flip-flop circuit 234 or 235 from an AND gate circuit 230 or 231 via an OR gate circuits 232 or 233. The other input of the AND gate circuit 230 is supplied with the upper key range channel timing signal UchT for storing in the delay flip-flop circuit 234 a new key-off pulse NOFF newly produced corresponding to the upper key range. The other input of the AND gate circuit 231 is supplied with the lower key range channel timing signal LchT for storing in the delay flip-flop circuit 235 a new key-off pulse NOFF produced corresponding to the lower key range channel. The memories in the delay flip-flop circuits 234 and 235 are self-held via AND gate circuits 236 and 237 respectively. The AND gate circuits 236 and 237 are disabled at the first portion of one key time by a signal obtained by inverting a signal S1 (FIG. 3) with the inverter 208, thus clearing the memory of the delay flip-flop circuits 234 and 235.

Accordingly, when a key which has been assigned to a upper key range channel is newly released, the output of the delay flip-flop circuit 234 is continuously maintained at "1" for at least the latter half 11 bit times of one key time. The output of this delay flip-flop circuit 234 is selected by an AND gate circuit 238 according to the signal UchT only at the upper key range channel timing, and the selected output is outputted as a new key-off signal NKOF via an OR gate circuit 229. When a key that has been assigned to a lower key range channel is newly released, the output of the delay flip-flop circuit 235 is continuously maintained at "1" for at least 11 bit times of one key time, and this output "1" is selected by an AND gate circuit 239 according to the signal LchT at the lower key range channel timing and then outputted as a new key-off signal NKOF via the OR gate circuit 229.

The AND gate circuit 221 shown in FIG. 11 passes the new key-off signal NKOF according to the latter half period signal H2 for the latter half 1 bit times of one key time in which the new key-off signal NKOF is effective. As above described, the new key-off signal NKOF is produced correspondingly to the channel group of either one of the upper or lower key range channels. Accordingly, a counter constituted by the adder 216 and the shift registers 217 to 220 counts the number of the new key-off signals NKOF for respective channel groups of the upper or lower key range. For example, where a newly released key is assigned to an upper key range channel, the count value of the counter is increased by one in a channel (in which KON' is "0") in which a key has already been released, among the upper key range channels according to the new key-off signal NKOF. The count value of the counter of a channel whose key has been released firstly becomes the largest value.

The count values of respective channels outputted from the shift registers 217 to 220 are applied to one inputs A of a comparator 240 and to one inputs of AND gate circuit 242 to 245 of a maximum value memory device 241 which is provided for the purpose of storing the maximum count value, and its output is applied to the other inputs B of the comparator 240. The maximum value memory device 241 is constituted by delay flip-flop circuits 247 to 250 for storing the maximum count values, AND gate circuits 251 to 254 for self-holding the maximum count values, and AND gate circuits 242 to 245 for loading the maximum count values.

When signal S1 (see FIG. 3) becomes "1" at the first channel timing of one key time, the output of an NOR gate circuit 255 becomes "0" to disable the self-holding AND gate circuits 251 to 254, thus clearing the maximum value memory device 241. Consequently, at first, the minimum value "0000" is outputted from the memory device 241. The count values of respective channels sequentially outputted from the shift registers 217 to 220 are compared with the outputs of the maximum value memory device 241 by the comparator 240. When A B, that is when the count values outputted by the shift registers 217 to 220 are larger than the outputs of the maximum value memory device 241, an output "1" is applied to one input of an AND gate circuit 256, the other input thereof being supplied with the output (UchT KU+LchT KL) of the OR gate circuit 257 shown in FIG. 10. The output of the OR gate circuit 257 is formed by synthesizing with the output of AND gate circuit 258 supplied with the upper key range channel timing signal UchT and the upper key range key data KU, and the output of AND gate circuit 259 supplied with the lower key range channel timing signal LchT and the lower key range key data signal KL. The output of the AND gate circuit 257 becomes "1" at the timing of signal UchT where a key data KD to be assigned is contained in the upper key range (KU is "1"), whereas becomes "1" at the timing of the signal LchT where a key data KD to be assigned belongs to the lower key range.

Assume now that the key data being supplied belongs to the upper key range, the output of the AND gate circuit 256 becomes "1" only when a condition A>B is satisfied at an upper key range channel timing. The AND gate circuits 242 to 245 are enabled by the output "1" of the AND gate circuit 256 to store the outputs of the shift registers 217 to 220 in the delay flip-flop circuits 247 to 250. In this manner, the count values of respective channels of one channel group of the upper or lower key range are successively compared with each other and the larger count value is stored in the maximum value memory device 241. Consequently, upon completion of the fore half 11 bit times of one key time, the comparisons regarding all channels are completed so that a true maximum count value would be stored in the memory device 241.

At the latter half 11 bit times, a judgment is made as to whether the true maximum count value stored in the maximum value memory device 241 belongs to which channel, that is whether the firstly released key belongs to which channel. More particularly, at the latter half 11 bit times of one key time, the maximum count value stored in the memory device 241 and the count values of respective channels are compared with each other by the comparator 240 to produce a coincidence output "1" (A=B) at the channel timing of the maximum count value. This coincidence signal (A=B) is outputted as a truncate channel signal TRUN via an AND gate circuit 260. It should be understood that the number of the channels of the maximum value is not limited to one but may be more than one in which case the coincidence signal (A=B) is produced at a plurality of channel timings. However, once a load signal LD is produced according to the truncate channel signal TRUN, the coincidence signal (A=B) is blocked by the AND gate circuit 260.

A delay flip-flop circuit 261 is cleared when a signal "0" formed by inverting signal S1 (FIG. 3) at the commencement of one key time is applied to one input of an AND gate circuit 246, and the output of an inverter 262 obtained by inverting the output of the delay flip-flop circuit 261 is initially "1". The output of the inverter 262 is applied to one input of an AND gate circuit 260. As a consequence, for the first time, the coincidence output (A=B) of the comparator 240 passes through the AND gate circuit 260 to produce a truncate channel signal TRUN. When the circuit shown in FIG. 10 produces a load signal LD in response to this signal TRUN, the load signal LD is also applied to one input of an AND gate circuit 263 shown in FIG. 11 so that "1" is stored in the delay flip-flop circuit 261 via an OR gate circuit 264 whereby the output of the inverter 262 becomes "0" to disable the AND gate circuit 260. Thereafter, even when a coincidence signal (A=B) is generated, no truncate channel signal TRUN would be produced.

The output of the NOR gate circuit 265 applied to the other input of the AND gate circuit 263 is always "1" where a key in the upper or lower key range is assigned. An NOR gate circuit 265 is supplied with the outputs of AND gate circuits 266 and 267. The AND gate circuits 266 is supplied with a lower key range any key-on signal LKAKO sent from the lower key range key-on memory device 39 (FIG. 1), and an arpeggio timing signal AT and an arpeggio channel timing signal AchT which are sent from the arpeggio note key data forming circuit 44 (FIG. 1). The AND gate circuit 267 is supplied with a signal LKAKO, and a bass timing signal BT and a base channel timing signal PchT which are sent from the bass note key data forming circuit 42 (FIG. 1). The AND gate circuit 266 or 267 is enabled when the tone production assignment of an arpeggio or a bass tone is assigned to change to "0" the output of the NOR gate circuit 265, thus blocking the load signal LD by the AND gate circuit 263. This is made to prevent the load signal produced by the AND gate circuit 172 or 173 shown in FIG. 10 via the OR gate circuit 174 from being stored in the delay flip-flop circuit 261. As will be described later, the truncate channel signal TRUN is not utilized for the tone production assignment processing of the arpeggio tone or the bass tone, and the load signal LD is generated independently of the truncate channel signal TRUN. When the load signal LD independent of the truncate signal TRUN is stored in the delay flip-flop circuit 261, a trouble would occur at the time of assigning the upper key range key data (more particularly, that at the timing of a signal BT0-1 shown in FIG. 8) executed in parallel with the storing operation, so that the storing operation is inhibitted by the output of the NOR gate circuit 265.

Chord Detection In Fingered Chord Mode

Figure 12:
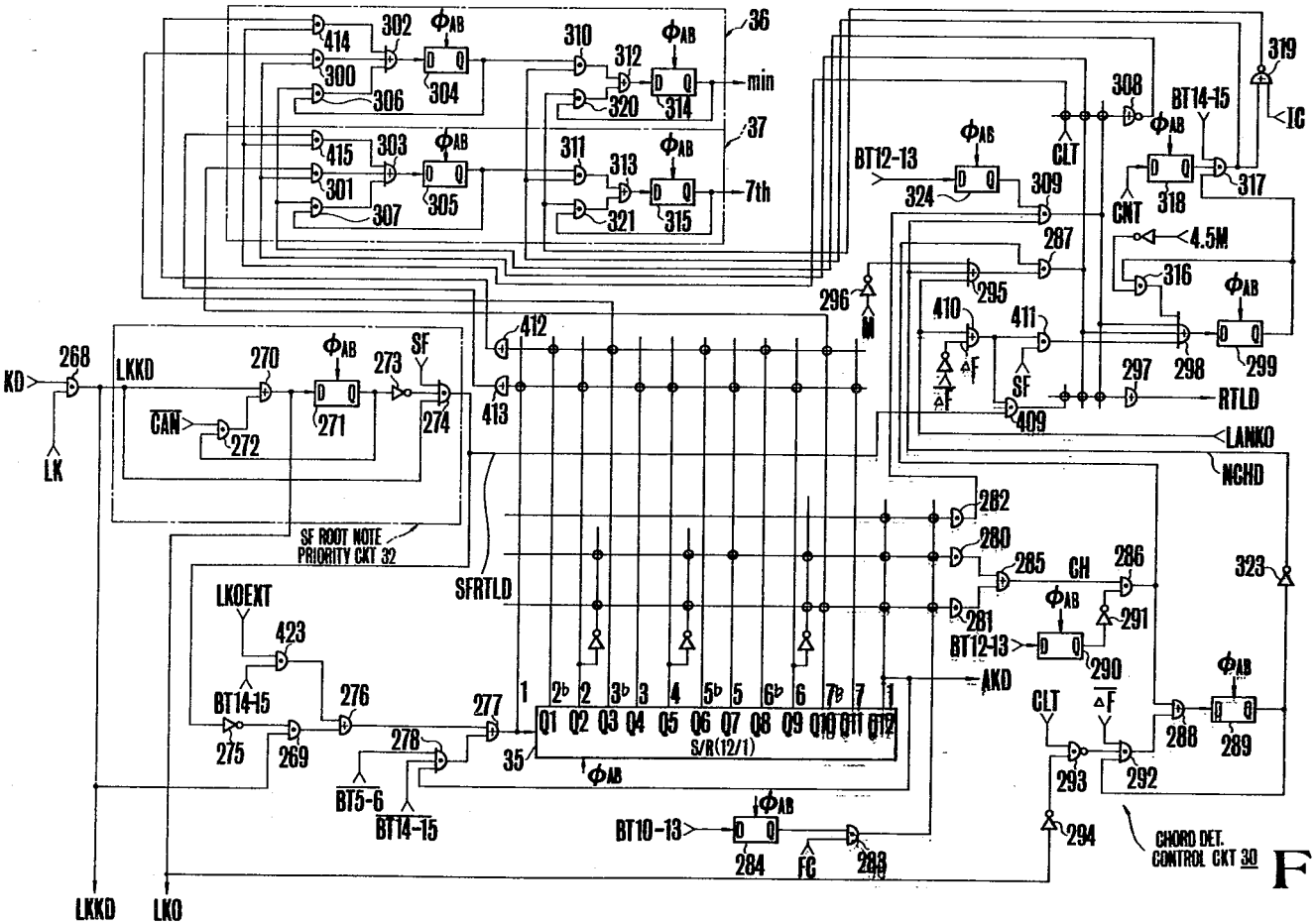
FIG. 12 is a connection diagram showing the detail of the chord detection control circuit shown in FIG. 1.

The detail of the chord detection control circuit 30 shown in FIG. 1 is shown in FIG. 12, in which a key data KD and a lower key range scanning timing signal LK (see FIG. 8) supplied from the key scanner 11 (FIG. 7) are applied to an AND gate circuit 268. Accordingly, this AND gate circuit 268 selects only the key data KD in the lower key range (F#3 to C2). The chord detection control circuit 30 detects a chord based on a lower key range key data LKKD outputted from this AND gate circuit 268. The lower key range key data LKKD represents a depressed key in the lower key range (F#3 to C2) according to the presence or absence of pulses in respective key scanning time slots.

The lower key range key data LKKD applied to one input of an AND gate circuit 269 is also stored in a delay flip-flop circuit 271 via an OR gate circuit 270 in the SF root note priority circuit 32. The delay flip-flop circuit 271 is driven by the key scanning clock pulse $\phi$AB at each one key time, and its output is self-held through an AND gate circuit 272 and an OR gate circuit 270. The other input of the AND gate circuit 272 is supplied with a cancel signal $\overline{\text{CAN}}$ sent from the NOR gate circuit 145 (FIG. 7) of the key scanner 11. As shown in FIG. 8, the cancel signal $\overline{\text{CAN}}$ becomes "0" for 12 key times prior to the commencement of the lower key range scanning, during which the content in the delay flip-flop circuit 271 is cleared. The output of the OR gate circuit 270 is outputted as a lower key range key-on signal LKO which is continuously maintained at "1" between the scanning of the highest tone key being depressed (since the keys are scanned from the side of the highest tone) and the time immediately prior to the changing of the signal $\overline{\text{CAN}}$ to "0" in the next cycle (at the time of scanning key G4 shown in FIG. 8).

The output of the delay flip-flop circuit 271 is inverted by an inverter 273 and then applied to one input of an AND gate circuit 274, the other input thereof being supplied with a single finger mode signal SF supplied from the latch circuit 14-4 (FIG. 4) of the mode selection circuit 13. The output of the inverter 274 is inverted by an inverter 275 and then sent to one input of an AND gate circuit 269. Since signal SF is "0" in the fingered chord mode, the output of the AND gate circuit 274 becomes "0" and the output of inverter 275 becomes "1" so that AND gate circuit 269 always passes the lower key range key data LKKD sent from the AND gate circuit 268.

The lower key range key data LKKD passing through the AND gate circuit 269 is applied to a lower key range key data register 35 via OR gate circuits 276 and 277, the register 35 being constituted by a 12 stage-/one bit shift register. The register 35 is driven by the key scanning clock pulse $\phi$AB to sequentially shift the lower key range key data LKKD therethrough. The output Q12 of the last stage of the register 35 is fed back to its first stage via an AND gate circuit 278 and the OR gate circuit 277. To the other inputs of the AND gate circuit 278 are applied a signal $\overline{\text{BT5-6}}$ sent from the NOR gate circuit 279 of the key scanner 11 and a signal $\overline{\text{BT14-15}}$ formed by inverting a signal BT14-15 supplied from the OR gate circuit 149 (FIG. 7).

The signal $\overline{\text{BT5-6}}$ becomes "0" at the time (block timing) of generating outputs BT5 and BT6 from the decoder 135 shown in FIG. 7 (see BT0 to 15 in FIG. 8) that is during the 12 key times immediately prior to the scanning of the lower key range so as to clear the memories at all stages of the register 35. Thereafter, the lower key range key data LKKD generated at the time of scanning the lower key range are stored in the shift register 35. Since this shift register 35 comprises 12 stages, 12 tone key data of from F#3 to G2 are stored at the block timings BT7 and BT8 (FIG. 8), and the data obtained by delaying respective key data for 12 key times are outputted from the last stage Q12. Since signals BT5-6 and $\overline{\text{BT14-15}}$ are both "1" at the time of scanning the lower key range, the stored key data LKKD would be self-held via an AND gate circuit 278. At the block timings BT9 and BT10, the received key data F#3 to G2 are sequentially (in the order of F#3, F3, E3 . . . G2) outputted from the last stage Q12 of the register 35 according to the order of scanning and the outputted key data are fed back to the first stage Q1 via AND gate circuit 278 and OR gate circuit 277. At this time, keys F#2, F2 . . . C2 one octave below and having the same notes are scanned to sequentially produce key data LKKD of these keys which are sent to the OR gate circuit 277 in which the key data LKKD now being scanned and the key data one octave above of the same notes and already have been stored are synthesized. For this reason, irrespective of the octave, a depressed key in the lower key range and having any note (C to C♯) would be stored in the lower key range key data register 35. The memory is held until the AND gate circuit 278 is disabled by the signal BT14-15, that is between times BT10 to BT13 after completion of the scanning of the lower key range (see FIG. 8).

Since the outputs from the last stage Q12 of the shift register 35 correspond to the key data LKKD delayed by 12 key times, they correspond to the scanning timing of 12 notes (C to C♯). In other words, the notes of the data outputted from the last stage Q12 of the shift register 35 are represented by the note codes N1 to N4 produced by the key scanner 11 (FIG. 7). The first key time of one key time of the block timing BT10 or BT12 corresponds to the note timing of the note C, while 12 key times of block timings BT10 and BT11 or block timings BT12 and BT13 (further, BT14 and BT15) respectively correspond to 12 notes C, B, A♯. . . D, C♯.

Since the shift register 35 successively takes in the key data generated in the order of tone pitches, data of respective notes are stored at respective stages including the first stage Q1 to the last stage Q12 starting from the low tone side. When detecting a chord, the key data (essentially a note data) outputted from the last stage Q12 of the shift register 35 is deemed as one degree (root note), and a check is made whether key data having an interval relation of a predetermined degree with respect to the root note presents or not at other stages. To this end, the output of the first stage Q1 of the shift register 35 is deemed as minor second degrees (**2*b*), the output of stage Q2 as major third degrees, the output of the stage Q4 as major third degrees (3), the output of the stage Q5 as the perfect fourth degrees (4) the output of the stage Q6 as diminished fifth degrees (5*b*), the output from the stage Q7 as perfect fifth degrees (5), the output of the stage Q8 as minor sixth degrees (6*b*), the output of the stage Q9 as major sixth degrees (6), the output of stage Q10 as minor seventh degrees (7*b*), and the output of the stage Q11 as the major seventh degrees (7**).

A portion of the notes of the key data (note data) outputted from respective stages Q1 to Q12 of the shift register 35 at respective key times of the block timings BT10 and BT11 or BT12 and BT13 (see FIG. 8) is shown in the following Table VI.

TABLE VI

| | | Degree | | | | | | | | | | | |
|---|---|---|---|---|---|---|---|---|---|---|---|---|---|
| | | 2♭ | 2 | 3♭ | 3 | 4 | 5♭ | 5 | 6♭ | 6 | 7♭ | 7 | 1 |
| | | Stage | | | | | | | | | | | |
| Key Time | | Q1 | Q2 | Q3 | Q4 | Q5 | Q6 | Q7 | Q8 | Q9 | Q10 | Q11 | Q12 |
| BT10 | 1 | C♯ | D | D♯ | E | F | F♯ | G | G♯ | A | A♯ | B | C |
| or | 2 | C | C♯ | D | D♯ | E | F | F♯ | G | G♯ | A | A♯ | B |
| BT12 | 3 | B | C | C♯ | D | D♯ | E | F | F♯ | G | G♯ | A | A♯ |
| | 4 | A♯ | B | C | C♯ | D | D♯ | E | F | F♯ | G | G♯ | A |
| | 5 | A | . | .. | | | | . | .. | F | F♯ | G | G♯ |
| | 6 | G♯ | . | .. | | | | | | | . | .. | G |
| BT11 | 7 | G | G♯ | A | A♯ | B | C | C♯ | D | D♯ | E | F | F♯ |
| or | 8 | F♯ | . | .. | | | | ... | C♯ | D | D♯ | E | F |
| BT13 | 9 | F | . | .. | | | | | | | . | .. | E |
| | 10 | E | . | .. | | | | | | | . | .. | D♯ |
| | 11 | D♯ | E | F | F♯ | G | .. | . | | | . | .. | D |
| | 12 | D | D♯ | E | F | F♯ | G | G♯ | A | A♯ | B | C | C♯ |

An AND gate circuit 280 is provided for detecting three chords (major chord or minor chord) and applied with the output of the stage Q12 of the shift register 35 corresponding to one degree (root note), the output of the stage Q7 corresponding to the perfect fifth degrees, the inverted output of the stage Q2 corresponding to the major second degrees, the inverted output of the stage Q5 corresponding to the perfect fourth degrees, and the inverted output of the stage Q9 corresponding to the major sixth degrees. An AND gate circuit 281 is provided for detecting seventh chord and supplied with the output of the last stage Q12 corresponding to the one degree, the output of the stage Q10 corresponding to the minor seventh, and inverted outputs of stages Q2, Q5 and Q9. Where a chord is not detected, for the purpose of detecting a quasi-root note an AND gate circuit 282 is provided which is supplied with the output of the stage Q12.

Further, the output of an AND gate circuit 283 is applied to the inputs of AND gate circuit 280, 281 and 282. The AND gate circuit 283 is supplied with a fingered chord mode signal FC, and signals formed by delaying for one bit time signals BT10-13 (FIG. 8) sent from the OR gate circuit 147 (FIG. 7) of the key scanner 11 with a delay flip-flop circuit 284. For this reason, the AND gate circuits 280 to 282 are enabled only during an interval between the second key time of the block timing BT (FIG. 8) and the first key time (interval of generating the signals when the signals BT10-13 are delayed by one key time) of the block timing BT14 (FIG. 6) at the time of the fingered chord mode (FC is "1") for detecting the chord. When a chord is formed, the AND gate circuit 280 or 281 is enabled at the note timing of the root note of the formed chord and a signal "1" (chord forming signal CH) is outputted through an OR gate circuit 285.

During the chord detection by AND gate circuits 280 and 281, note B is firstly made to be the quasi-root note. Because by the output of the delay flip-flop circuit 284, the chord detection is made possible from the second key time of the block timing BT10. As shown in Table VI, at the second key time of the block timing BT10 the key data of the note B arrives at the last stage Q12 of the shift register 35. At the next key time, the note A♯ becomes the quasi-root note. Thereafter the quasi-root note changes in the order of the tone pitch (A, G♯ . . . ) and detection of forming of a chord utilizing respective ones of 12 notes (B to C) as the quasi-root notes completes when the note C is made to be the quasi-root note at the first key time of the signal BT12 (see FIG. 8). As a consequence, the output CH of the OR gate circuit 285 becomes "1" when the chord formation is detected by utilizing the note B as the quasi-root note, but becomes "0" when the chord formation is not detected. Thus, the result of detection of the chord formation appears according to the order of tone pitches, and the result of detecting a chord formed by utilizing the note C as the quasi-root note appears at the last (at the first key time of the signal BT12). Since in a root note shift register 41 to be described later, a single data RTLD is selected according to later arrival priority (low tone priority) where a plurality of root note data RTLD are generated, note C is made to be the last one whereby the priority is given to this note C.

The output of the OR gate circuit 285 is applied to one input of an AND gate circuit 286, the other input thereof being supplied with a signal formed by inverting with an inverter 291 a signal obtainable by delaying for one key time the block timing signal BT12-13 (see FIG. 8) produced by the OR gate circuit 148 (FIG. 7) of the key scanner 11 with a delay flip-flop circuit 290. The output of the inverter 291 is "0" during 12 key times between the second key time of the block timings BT12 and the first key time of the block timing BT14 (that is between the note timing of note B and that of the note C). Accordingly, when a chord forming signal CH utilizing 12 notes (B, A# . . . C) generated between the second key time of the block timing BT10 and the first key time of the block timing BT12 as the quasi-root note, passes through the AND gate circuit 286, the chord forming signal CH would be blocked at the next and the following key times (the second key time of the signal BT12). In other words, the chord forming is detected during only 12 key times between the second key time of the block timing BT10 and the first key time of the block timing BT12, as shown by FC in the region Z shown in FIG. 8.

The chord forming signal CH passing through the AND gate circuit 286 in an interval between the second key time of the block timing BT10, and the first key time of the block timing BT12, is not only applied to one input of an AND gate circuit 287 but also stored in a delay flip-flop circuit 289 through an OR gate circuit 288. The output of the delay flip-flop circuit 289 is self-held through an AND gate circuit 292 and the OR gate circuit 288. The other inputs of the AND gate circuit 292 are supplied with the SF/FC mode changing signal $\overline{\Delta F}$ sent from the mode changing control circuit 15 (FIG. 4) and the output of an NAND gate circuit 293. As shown in FIG. 5, the signal $\overline{\Delta F}$ temporarily becomes "0" (for 4.5 ms$+\alpha$, that is at least one scanning cycle) at the time of mode change but the signal $\overline{\Delta F}$ is normally "1". The NAND gate circuit 293 is supplied with a signal CLT (FIG. 8) given by the key scanner 11 (FIG. 11) and representing the scanning timing of the lowest tone key C2, and a signal obtained by inverting with an inverter 294 the lower key range key-on signal LKO outputted from the OR gate circuit 270. When either one of the keys in the lower key range is depressed, the output of the inverter 294 is always "0" at the time of generating the signal CLT and the NAND gate circuit 293 is not enabled so that the output of this NAND gate circuit 293 is always "1". Thus, once a chord is formed, the delay flip-flop circuit 289 continues to store signal "1". The chord forming memory in the delay flip-flop device 289 is cleared when all keys in the lower key range are released (LKO is "0" and the output of the NAND gate circuit 293 becomes "0" at the time of generating a signal CLT), or when the mode is changed from the fingered chord mode (FC) to the single finger mode SF ($\Delta F$ becomes "0").

To the other input of the AND gate circuit 287 is applied the output of an OR gate circuit 295. Where the mode is not the memory mode, the memory mode signal M is "0" so that an inverter 296 applies a signal "1" to the OR gate circuit 295. Thus, the AND gate circuit 287 always passes the chord forming signal CH selected by the AND gate circuit 286. The output thereof is outputted as a root note data RTLD via an OR gate circuit 297 and stored in a delay flip-flop circuit 299 via an OR gate circuit 298. Also the output of the AND gate circuit 287 is applied to one inputs of an AND gate circuit 300 of the minor chord memory device 36 and of an AND gate circuit 301 of the seventh chord memory device 37. Consequently, the root note data RTLD becomes "1" correspondingly to the note timing of the root note of the detected chord (at any one of 12 key times between the note timing of the note B of the second key time of the block timing BT10 and the note timing of the note C at the first key time of the block timing BT12). AND gate circuits 300 and 301 are enabled at the timing of the root note.

The other input of the AND gate circuit 300 is supplied with the output of the stage Q3 of the shift register 35 corresponding to the minor third degrees (3*b*), while the other input of the AND gate circuit 301 is supplied with the output of the stage Q10 of the shift register 35 corresponding to the minor seventh degrees (7*b*). Where a major chord is formed, the outputs of the stages Q3 and Q10 are both "0" at the time of forming the chord (minor third and minor seventh do not exist) so that the signal "0" is applied to delay flip-flop circuits 304 and 305 from AND gate circuits 300 and 301 via OR gate circuits 302 and 303 respectively. Where a minor chord is formed, the output of the stage Q3 is "1" (minor third exists) at the time of forming the chord so that the AND gate circuit 300 applies a signal "1" to a delay flip-flop circuit 304 via an OR gate circuit 302. Where a seventh chord is formed, the output of the stage Q10 is "1" (minor seventh exists) at the time of forming the chord, and the AND gate circuit 301 applies signal "1" to the delay flip-flop circuit 305 via OR gate circuit 303. In the case of a minor seventh chord, signal "1" is applied to both delay flip-flop circuits 304 and 305.

The signal "0" or "1" applied to the delay flip-flop circuits 304 and 305 is self-held through AND gate circuits 306 and 307 to which is applied the output of an NOR gate circuit 308. This NOR gate circuit 308 is supplied with the outputs of the AND gate circuits 287 and 309 and the lowest tone key scanning signal CLT. Briefly stated, the output of the NOR gate circuit 308 is "1" only when a new chord type data is taken into or at times other than the time of generating the signal CLT so as to enable AND gate circuits 306 and 307 for self-holding the data received by the delay flip-flop circuits 304 and 305. Thus, the new chord type data are temporarily stored between the input thereof and the generation of the next scanning cycle signal CLT.

The outputs of the delay flip-flop circuits 304 and 305 are applied to delay flip-flop circuits 314 and 315 via AND gate circuits 310 and 311 and OR gate circuits 312 and 313. The purpose of the delay flip-flop circuits 314 and 315 is to continuously store the chord type data which have been temporarily stored in the delay flip-flop circuits 304 and 305, and operate to take in the data when a chord is changed or formed. The output "1" of the AND gate circuit 287 which is produced at the time of detecting a chord formed is stored in a delay flip-flop circuit 299 via an OR gate circuit 298. Although the memory in the delay flip-flop circuit 299 is held through an AND gate circuit 316, it is cleared by a signal formed by inverting the scanning cycle pulse 4.5 M at the beginning of the scanning cycle (as shown in FIG. 8, the first key time BTO of the block timings). When "1" is stored in the delay flip-flop circuit 299, an AND gate circuit 317 is enabled which is supplied with the output of the delay flip-flop circuit 299, a signal BT14-15 sent from the OR gate circuit 149 (FIG. 7) of the key scanner 11, and a signal formed by delaying for one key time the C note timing signal CNT supplied from the AND gate circuit CNT supplied from the AND gate circuit 150 (FIG. 7) by a delay flip-flop circuit 318. Thus, the AND gate circuit 317 produces an output "1" at a time one key time later than the time of generating the signal CNT (FIG. 8) during the period of generation of the signal BT 14-15 (FIG. 8), that is at the second key time of the block timing BT14. This output "1" of the AND gate circuit 317 enables the AND gate circuits 310 and 311 so as to transfer the data in the delay flip-flop circuits 304 and 305 into the delay flip-flop circuits 314 and 315.

The outputs of the delay flip-flop circuits 314 and 315 are self-held through AND gate circuits 320 and 321 which are supplied with the output of an AND gate circuit 319. The output thereof becomes "0" when a new chord type data is taken in according to the output "1" of the AND gate circuit 317 (or at the time of the initial clearing) for clearing the old memories. In this manner, the data once stored in the delay flip-flop circuits 314 and 315 are continuously held until the chord changes. The output of the delay flip-flop circuit 314 is used as a minor chord data min, while the output of the delay flip-flop circuit 315 is used as a seventh chord data 7th. The data min and 7th are "0" and "0" for a major chord, "1" and "0" for a minor chord, "0" and "1" for a seventh chord and "1" l and "1" for a minor seventh chord.

Where a chord is not formed, the signal "1" is not stored in the delay flip-flop circuit 289 which stores the formed chord and the AND gate circuit 287 does not produce a signal CH representing the root note timing of the chord formed. The output of the delay flip-flop circuit 289 is inverted with an inverter 323 and then applied to one inputs of the AND gate circuit 309 and the OR gate circuit 295 to act as a chord not forming signal NCHD. The other input of the AND gate circuit 309 is supplied with a signal formed by delaying for one key time the signal BT12-13 (FIG. 8) sent from the OR gate circuit 148 (FIG. 7) of the key scanner 11 with a delay flip-flop circuit 324, and the output of an AND gate circuit 282. As above described, since the chord is detected during 12 key times (see FIG. 8) between the second key time of the block timing BT10 and the first key time of the block timing BT12, the result of the chord detection is positively stored in the delay flip-flop circuit 289 at the next 12 key times, that is, between the second key time of the block timing BT12 and the first key time of the block timing BT14 when the output of the delay flip-flop circuit 289 is "1".

When a chord is formed, the chord not forming signal NCHD is "0" so that the AND gate circuit 309 is disabled. However, where a chord is not formed, the chord not forming signal NCHD is "1" so that all key data (the output of the stage Q12 of the shift register 35) of the note B to C and outputted from the AND gate circuit 282 in an interval between the second key time (note timing of note B) of the block timing BT12 and the first key time (note timing of note C) passes through the AND gate circuit 309, and the output thereof is outputted as a root note data RTLD via OR gate circuit 297. Consequently, when the chord is not formed, the root note data RTLD become "1" at the note timings of all depressed keys in the lower key range. In this case, the data "1" of the depressed keys appear in the root note data RTLD in the order of the tone pitches taking the note B as the highest. Thus, the data of note C appears at the last. Since in a root note shift register 41 to be described later, the root note data RTLD is preferentially selected in which priority is given to the last data (low tone priority), where the chord is not formed the lowest one of the depressed key in the lower key range is considered as the root tone.

The output of the AND gate circuit 309 is not only stored in the delay flip-flop circuit 299 via OR gate circuit 298 but also applied to one input of the NOR gate circuit 308. Thus, when a chord is not formed, both delay flip-flop circuits 304 and 305 are cleared by the output "0" of the NOR gate circuit 308, whereby the data representing the major chord become "0" and "0" respectively. In the same manner as above described when "1" is stored, the outputs "0" and "0" of the delay flip-flop circuits 304 and 305 are transferred to and stored in the delay flip-flop circuits 314 and 315. Accordingly, where a chord is not formed both data min and 7th are "0", thus representing a major chord.

If the mode is not the memory mode (M is "0"), the output of the OR gate circuit 295 is always "1" so that a signal representing the root note timing is produced by the AND gate circuit 287 each time a chord is formed. However, in the memory mode the signal M becomes "1", whereas the signal applied to the OR gate circuit 295 from inverter 296 becomes "0". The inputs of the OR gate circuit 295 are supplied with a lower key range any key-on signal LANKO and a chord not forming signal NCHD. As a consequence, in the memory mode, the AND gate circuit 287 produces data showing the root note of a chord formed while the lower key range any key-on signal LANKO or the chord not forming signal NCHD is being produced. Especially, under a normal condition, a chord is detected when the signal LANKO is generated, that is a key in the lower key range is depressed (the chord forming signal CH is passed).

Figure 13:
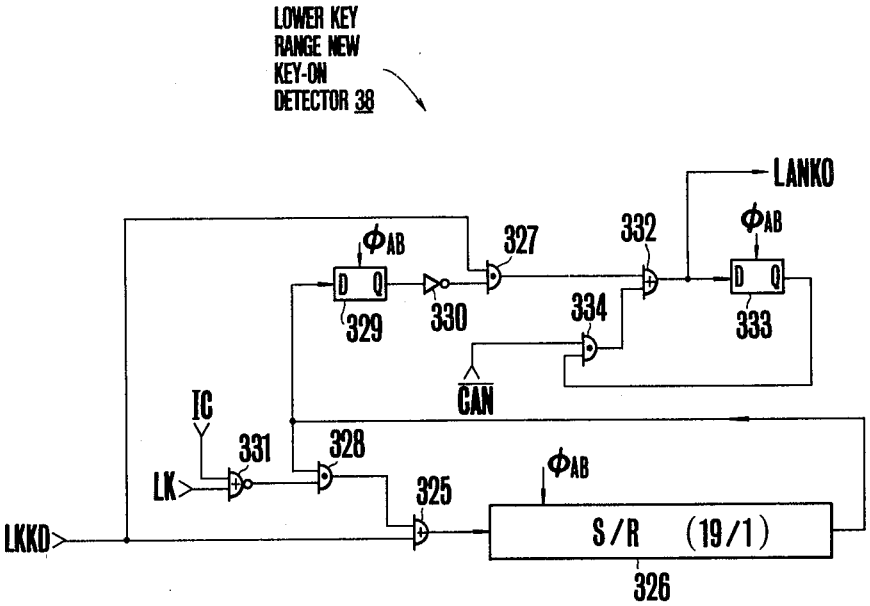
FIG. 13 is a connection diagram showing the detail of the lower key range new key-on detector shown in FIG. 1.

The lower key range any new key-on signal LANKO is supplied from a lower key range new key-on detector 38 shown in FIG. 13. The lower key range key data LKKD produced by the AND gate circuit 268 shown in FIG. 12 is supplied to the lower key range new key-on detection circuit 38 shown in FIG. 13. In FIG. 13, the lower key range key data LKKD is applied to a shift register 326 via an OR gate circuit 325 and to one input of an AND gate circuit 327. The shift register 326 is of the 19 stage-one bit type and driven by the key scanning clock pulse $\phi$AB. The output of the shift register 326 is self-held via an AND gate circuit 328 and an OR gate circuit 325 and is also applied to a delay flip-flop circuit 329, the output thereof being inverted with an inverter 330 and then applied to the other input of the AND gate circuit 327. A signal obtained by inverting the initial clear signal IC or the lower key range scanning timing signal LK with an NOR gate circuit 331 is applied to the other input of the AND gate circuit 328.

The number of stages of the shift register 326, that is 19, corresponds to the number of the keys in the lower key range (F#3 to C2). The key data LKKD regarding 19 keys (F#3 to C2) and successively generated at the lower key range scanning timing are sequentially applied to the shift register 326 via an OR gate circuit 325. At this time, the output of an NOR gate circuit 331 is brought to "0" by the signal LK of "1", thus clearing old memory data in the shift register 326. Upon termination of the lower key range scanning, signal LK becomes "0" so that the AND gate circuit 328 is enabled by the output "1" of the NOR gate circuit 331 whereby the lower key range data just received by the shift register 326 is stored or held. This memory is held until a signal LK is generated during the next scanning cycle. As a consequence, when a new key data LKKD is supplied in the next scanning cycle, the last stage of the shift register 326 outputs a key data representing the result of the previous lower key range scanning.

One scanning cycle comprises 16 block timings (BT0 to BT15) and one block timing includes 6 key times so that one scanning cycle comprises 96 key times. Then, when the key data obtained in the previous scanning cycle is delayed by 96 key times the delayed key data would coincides with the key scanning timing in the present scanning cycle. However, since the shift register 326 comprises 19 stages, the delay time for circulating five times is 95 key times which is less than 96 key times by one key time. For this reason, the output of the shift register 326 is delayed one key time by the delay flip-flop circuit 329 to make its output to be coincide with the key scanning timing.

The output of the delay flip-flop circuit 329 is inverted with an inverter 330. For this reason, when a key which was released in the previous scanning cycle (output of the inverter 330 is "1") is depressed in the present scanning cycle (LKKD is "1"), in other words when a new key is depressed in the lower key range, the output of an AND gate circuit 327 becomes "1" which is applied to a delay flip-flop circuit 333 via an OR gate circuit 332 and stored in the delay flip-flop circuit 333 until cleared by a cancel signal $\overline{\text{CAN}}$ (FIG. 8) applied to one input of an AND gate circuit 334 immediately before the lower key range scanning timing of the next scanning cycle. The signal stored in the delay flip-flop circuit 333 is outputted as a lower key range any key-on signal LANKO via the AND gate circuit 334 and the OR gate circuit 332. This signal LANKO is continuously maintained at "1" when the fact that any key in the low key range is newly depressed is detected in an interval between the scanning time of that key (any one of the scanning time of the first key time of the block timings BT7 to BT9 and BT10) and the block timing BT14 of the next scanning cycle that is, the time immediately before $\overline{\text{CAN}}$ become "0". Accordingly, where any key in the lower key range is newly depressed, during an interval between BT10 and BT15 including a block timing for detecting a chord, the signal LANKO is always "1".

The lower key range any key-on signal LANKO is supplied to the chord detection control circuit 30 shown in FIG. 12 and then supplied to the AND gate circuit 287 via OR gate circuit 295. Thus, in the memory mode (M is "1"), the chord forming signal CH generated when a new key in the lower key range is depressed is outputted as an effective chord detection result. Even when a chord is formed as the key in the lower key range is released, the chord forming signal CH at that time is blocked by the AND gate circuit 287, thus being rendered invalid. Because, in the memory mode, the tone production is processed as if the key were being continuously depressed irrespective of the release of the key so that the chord detection should not respond to key release.

In the case of the memory mode, where a surplus key is inadvertently depressed so that the chord is not formed, even when only the surplus key is immediately released to form a chord, no lower key range any new key-on signal LANKO is generated so that it is impossible to enable the AND gate circuit 287. In the above described case, for enabling code detection by passing the chord forming signal CH caused by the release of any key, the chord not forming signal NCHD is applied to one input of AND gate circuit 287 via OR gate circuit 295. More particularly, where a chord is not yet formed (NCHD is "1"), the AND gate circuit 287 is enabled even though no lower key range any key-on signal LANKO is actually produced, whereby the chord forming signal CH is outputted via the AND gate circuits 286 and 287.

In the chord detection control circuit 30 shown in FIG. 12, the circuit elements described above correspond to the fingered chord mode (FC) chord detector 31 shown in FIG. 1.

Figure 14:
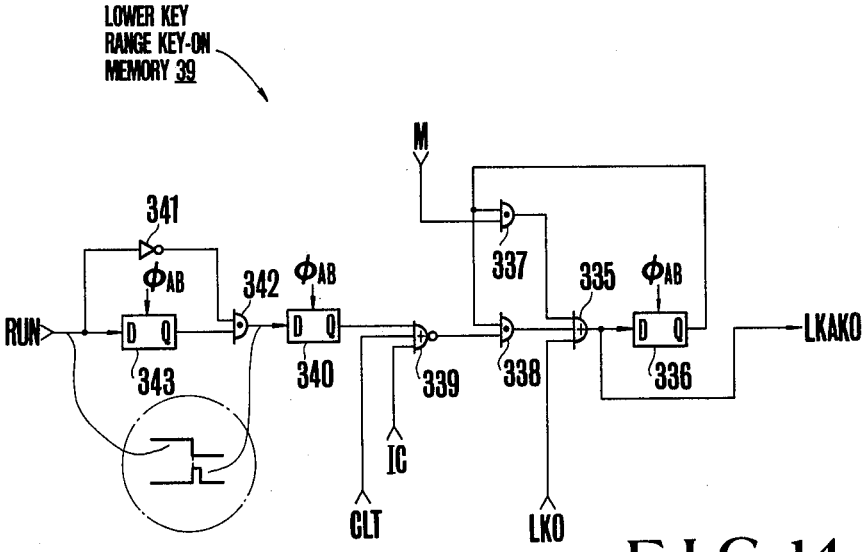
FIG. 14 is a connection diagram showing one example of the lower key range key-on memory device shown in FIG. 1.

The detail of the lower key range key-on memory device 39 will now be described with reference to FIG. 14. The lower key range key-on signal LKO outputted from the OR gate circuit 270 shown in FIG. 12 is applied to one input of an OR gate circuit 335 shown in FIG. 14 to be stored in a delay flip-flop circuit 336, the output thereof being self-held via AND gate circuit 337 or 338 and the OR gate circuit 335. The output of the OR gate circuit 335 is supplied to other circuit elements to act as the lower key range any key-on signal LKAKO.

In the memory mode, the memory mode signal M applied to the AND gate circuit 337 is "1" so that the delay flip-flop circuit 336 is always maintained at the self-holding state. Thus, whenever a key is depressed in the lower key range to produce a signal LKO, the lower key range any key-on signal LKAKO is continuously maintained at "1".

Where the mode is not the memory mode, the signal LKAKO is held by the action of the AND gate circuit 338 which is supplied with the output of an NOR gate circuit 339. A signal CLT (FIG. 8) representing the scanning timing of the lowest tone key C2 is applied to one input of the NOR gate circuit 339 so that the AND gate circuit 338 is disabled at each lowest tone key scanning timing (the first key time of BT10) in one scanning cycle, thus clearing the self-holding state. On the other hand, the lower key range key-on signal LKO applied to the OR gate circuit 335 is maintained at "1" (by the action of the AND gate circuit 272 shown in FIG. 12), if any key in the lower key range is being depressed, during an interval between the scanning timing of that key and a time immediately prior to the block timing BT5 of the next scanning cycle, so that the signal "1" caused by signal LKO would be applied to the delay flip-flop circuit 336 via the OR gate circuit 335 when the self-forming function provided by AND gate circuit 338 is interrupted. However, when no key in the lower key range is depressed, the signal LKO becomes "0" at the lowest tone key scanning timing at which the AND gate circuit 338 is disabled, thus clearing the memory in the delay flip-flop circuit 336. As a consequence, so long as any key is being depressed in the lower key range, the lower key range any key-on signal LKAKO is continuously maintained at "1", whereas "0" when no key is depressed in the lower key range.

Where the mode is not the memory mode, the self-holding action of the signal LKAKO is cleared by a signal "1" from a delay flip-flop circuit 340 even when the automatic rhythm is terminated. The rhythm run signal RUN from the automatic rhythm device 45 (FIG. 1) is inverted by an inverter 341 and then applied to one input of an AND gate circuit 342 and to the other input thereof after being delayed one key time with a delay flip-flop circuit 343. As the automatic rhythm terminates, the rhythm run signal RUN changes to "0". At this time, the output of the delay flip-flop circuit 343 representing the state of the immediately prior signal RUN is "1" and the output of the inverter 341 which inverts the signal RUN which became "0" is "1". Thus the AND gate circuit 342 produces an output pulse "1" of one key time, and this output "1" is applied to the NOR gate circuit 339 after being delayed one key time by the delay flip-flop circuit 340 for clearing the signal LKAKO.

Bass Tone Key Data Forming and Tone Production Assignment

Let us now describe the formation of a bass tone key data and the tone production assignment in the case of the fingered chord mode. The automatic bass/chord processing circuit 40 (FIG. 1) including the bass note key data forming circuit 42 is shown in detail in FIG. 15.

Figure 15:
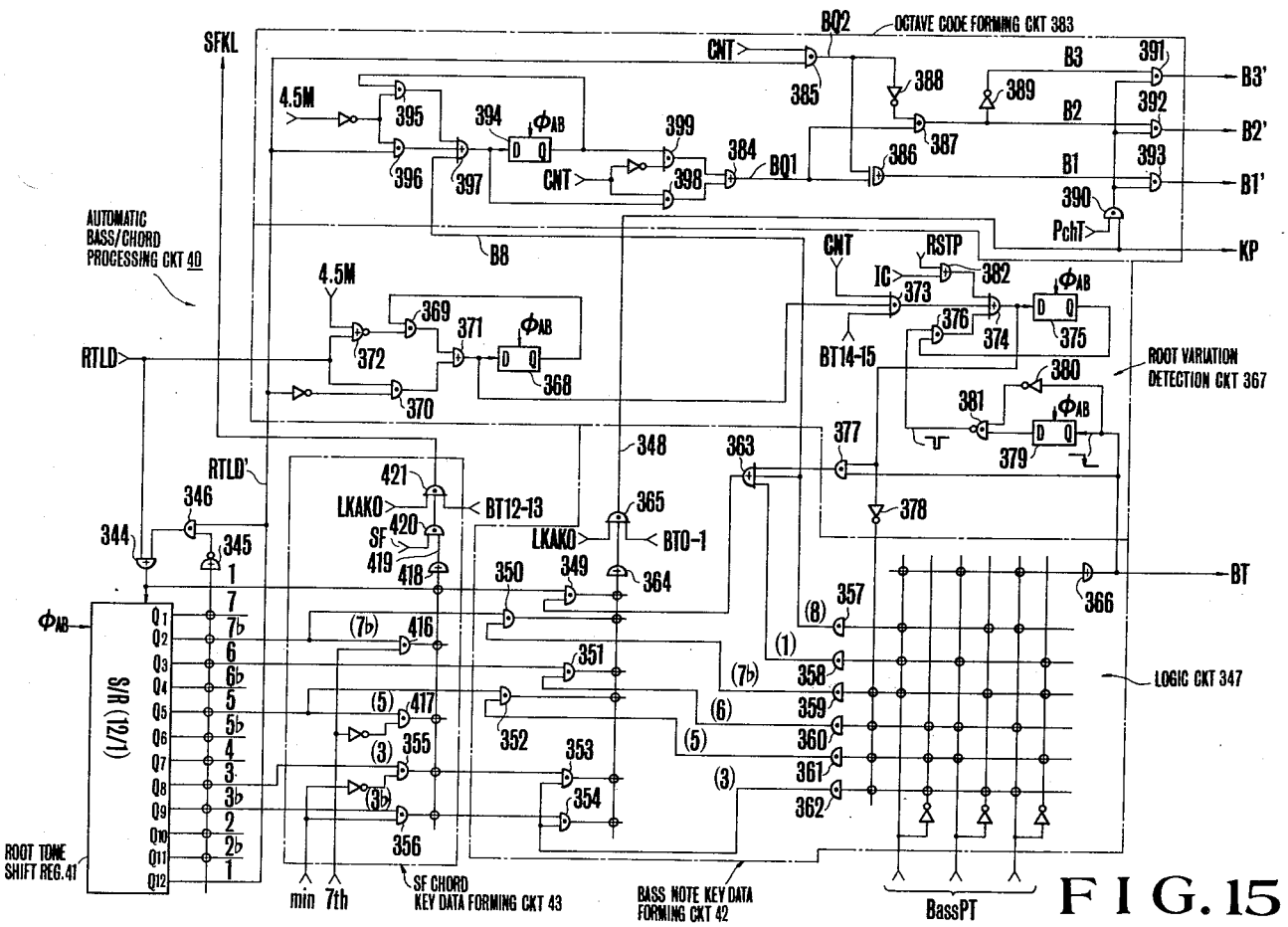
FIG. 15 is a connection diagram showing the detail of the automatic bass/code processing circuit shown in FIG. 1.

The root note data RTLD outputted from the OR gate circuit 297 (FIG. 12) of the chord detection control circuit is applied to a root note shift register 41 via an OR gate circuit 344 shown in FIG. 15. The root note shift register 41 is of the 12 stage/one bit type and driven by the key scanning clock pulse $\phi$AB. Accordingly, the root note data RTLD applied to the shift register 41 from the OR gate circuit 344 is sequentially delayed (or shifted) at each one key time, and after 12 key times outputted from the last stage Q12 as a signal RTLD'. A later arrival priority (low tone priority) circuit is constituted by an NOR gate circuit 345 supplied with all outputs of the first to 11th stagegs Q1 to Q11 of the shift register 41, and an AND gate circuit 346 supplied with the output of the NOR gate circuit 345 and the output RTLD' of the 12th stage Q12.

As above described, the root note data RTLD comprise time division multiplex data similar to key data KD which are time division 12 note timings starting from the B note timings followed by successive note timings to the lowest tone note C and which show the root-note note depending upon the presence and absence of a pulse at the note timing. Thus, in the root note data RTLD, the pulse arriving at a later time shows the note of lower tone. A later arrival priority (low tone priority) circuit constituted by the NOR gate circuit 345 and the AND gate circuit 346 preferentially selects only one root note data RTLD which reaches at the latest and stores the selected data in the shift register 41. Thus, data representing a single root-note note of a low tone preferentially selected would be stored in the shift register 41.

For the first time, all root note data RTLD are applied to the shift register 41 and data RTLD' delayed by 12 key times are outputted from the 12th stage Q12 of the shift register 41. The note timing of this delayed data RTLD' is synchronous with the note timing of the data RTLD (that is the note timing of the key scanning), the AND gate circuit 346 and the NOR gate circuit 345 perform the control as to whether the delayed root tone data RTLD' should be fed back to the shift register 41 via OR gate circuit 344 or should be blocked with the later arrival (low tone) priority. If there is a root note data "1" arrived at a later (of lower tone) time than the data RTLD' outputted from the 12th stage Q12 of the shift register 41, either one of the outputs of the stages Q1 to Q11 (corresponding to all 11 notes other than the note of RTLD') becomes "1" and the output of the NOR gate circuit 345 becomes "0", thus blocking the data RTLD' with the AND gate circuit 346. If the data RTLD' outputted from the 12th stage Q12 arrives at most lately (that is the lowest tone), since the "1" appearing before (on the high tone side) is blocked by the AND gate circuit 346, the outputs of stages Q1 to Q11 are all "0" and the output of the NOR gate circuit 345 is "1" so that the root note data RTLD' of the lowest tone passes through the AND gate circuit 346 and then returned to the shift register 41 via the OR gate circuit 344. When the number of the root note data stored in the shift register 41 is reduced to only one, thereafter the only one root note data would be circulated and stored.

As above described when "1" is produced as the root note data RTLD at a plurality of note timings, only data "1" of the lowest tone is selected for storing it in the shift register 41. Of course, in most cases where "1" is produced as the root note data RTLD from the first time at only a single note timing, the data "1" is stored in the shift register 41 as it is.

It should be understood that the NOR gate circuit 345 and AND gate circuit 346 constitute a mere low tone priority circuit but function as a later arrival priority circuit by which old root note data RTLD' is cleared when a chord (root note) changes. More particularly, upon arrival of a new root note data RTLD (even when it is the note timing of B that might be judged as the highest one by the priority judgment), the output of the NOR gate circuit 345 is made to be "0" by the outputs Q1 to Q11 of the shift register 41 supplied with the new root note data RTLD, thus clearing old root note data RTLD' which has been stored.

One example of selecting a single root noe data with the latter arrival priority will be described separately for the cases of chord forming and not forming.

Figure 16:
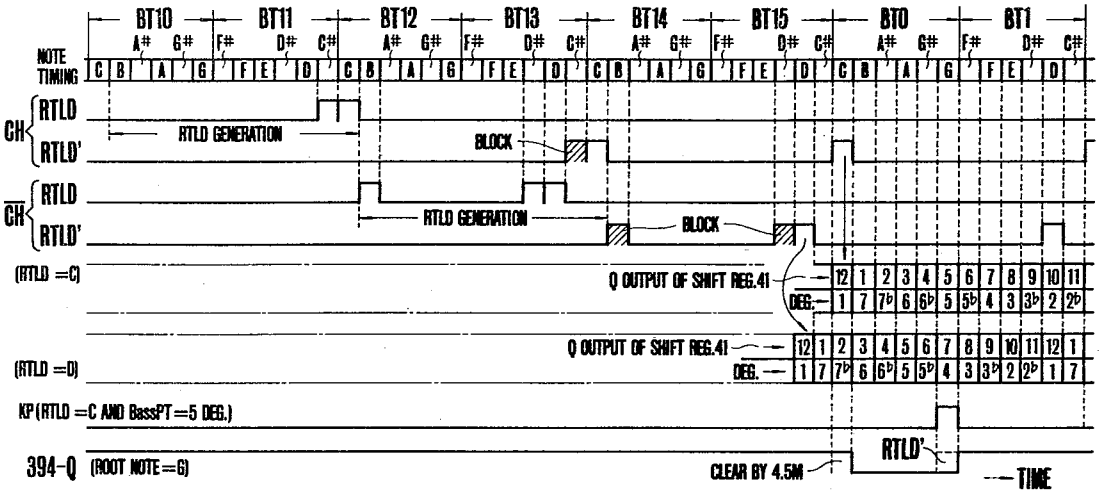
FIG. 16 is a time chart useful to explain the operation of the processing circuit shown in FIG. 15, especially the operation of the root note shift register.

As above described in the case of chord forming, due to the operation of the AND gate circuit 286 (FIG. 12), the root note data RTLD is generated only for 12 key times between the second key time of the block timing BT10 (note timing of B) and the first key time of the block timing BT12 (note timing of C). The rows CH shown in FIG. 16 shows one example of the root note data RTLD when a chord is formed (CH is "1") and a data RTLD' obtained by delaying the data RTLD. In the row of note timings shown in FIG. 16, notes corresponding to respective key times between a block timing BT10 and the block timing BT1 of the next scanning cycle are shown. The rows CH in FIG. 16 illustrate generation of the root note data RTLD corresponding to two notes C# and C, for example which are generated when 4 keys of C, C#, G and G# in the lower range are depressed. When data "1" of C# arrives at the stage Q12 of the shift register 35 shown in FIG. 12, data "1" exists at stage Q7 corresponding to perfect fifth, while data "1" of C and G exist at stages Q11 and Q6 (see Table VI) so that the AND gate circuit 280 detects that C# major chord has been formed to produce the root note data RTLD at the note timing of C#. Then, when data "1" of C arrives at the stage Q12 of the shift register 35, G exists at stage Q7, C# exists at stage Q1, and G# exists at stage Q8 (see Table VII), whereby the AND gate circuit 280 detects that the C major chord is formed.

When data RTLD' obtained by delaying the root note data RTLD of C# for 12 key times is outputted from the stage Q12 of the shift register 41 shown in FIG. 15 at the note timing C# of the block timing BT13, data "1" obtained by delaying 11 key times the root note data RTLD of C received at the note timing C of the block timing BT12 is outputted from stage Q11. Accordingly, the root note data RTLD' of C# is blocked by the AND gate circuit 346 by the presence of the root note data RTLD of C arrived at a later time (low tone). In this manner, only the root note data of C is stored in the shift register 41 and after the block timing BT14, the stored root note data RTLD' becomes "1" only at the note timing of C.

As above described, when a chord is not formed, by the operation of the AND gate circuit 309 (FIG. 12) the root note data RTLD is generated only for 12 key times between the second key time of the block timing BT12 (note timing of B) and the first key time of the block timing BT14 (note timing of C). In rows CH in FIG. 16 is shown an example of generating "1" at the note timings of B,D# and D as the root note data RTLD where a chord is not formed (CH is "0"). Where 3 keys of B, D# and D are depressed in the lower key range, a chord is not formed and as shown by CH, the root note data RTLD is produced at all the note timings corresponding to depressed keys. Data RTLD' obtained by delaying 12 key times the root note data RTLD of B is produced at the note timing of B of block timing BT14. However, since data "1" of D and D# are produced from stages Q3 and Q4 of the shift register 41, the data RTLD' of B would be blocked by the AND gate circuit 346. Although data RTLD' obtained by delaying 12 key times the root note data RTLD of D# is produced at the note timing of D# of the block timing BT15, this data RTLD' of D# is also blocked by the AND gate circuit 346 as data "1" of D is produced by the stage Q11 of the shift register 41. When data RTLD' obtained by delaying 12 key times the root note data RTLD of D is produced at the note timing D of the block timing BT15, all data RTLD' of B and D# generated before are blocked so that the outputs of stages Q1 through Q11 of the shift register 41 are all "0" and data RTLD' is stored or held at this note timing of D. As above described, when a chord is not formed, the lowest note of the depressed keys is selected as the root note.

An important function of the root tone shift register 41 is to form note timing data of a subordinate note (an note which forms a chord together with a root note, that is an note separated from the root note by a predetermined degree) by sequentially shifting (delaying) a single root note data (RTLD') at each key time. By delaying the root note data RTLD' applied from the AND gate circuit 346 via the OR gate circuit 344 at respective stages Q1 through Q12 of the shift register 41 for one key time, "1" is outputted from respective stages Q1 through Q12 at the note timings which sequentially shift from the note timing of the root note toward the lower note side. Consequently, the output "1" of the stage Q1 delayed by one key time corresponds to a note of a semitone below the root note that is the note timing of a tone of major seventh degrees (7), while the output "1" of stage Q2 delayed by two key times corresponds to the note timing of a note of two semitone below the root note, that is the minor 7 degrees (7*b*). In the same manner, the outputs "1" of the stages Q3 through Q11 of the shift register 41 correspond to the note timings of major 6th degrees (6), minor 6 degrees (6*b*), a perfect fifth degrees (5), diminished 5 degrees (5*b*), perfect fourth degrees, (4), major third degrees (3), minor third degrees (3*b*), major second degrees (2), and minor second degrees (2*b*) respectively. The output "1" of the stage Q12, that is the OR gate circuit 344 corresponds to the same note as the root note, that is one degree (1).

For example, where the root note data RTLD' is produced at the note timing of C, the timings at which the outputs of stages Q1 through Q11 the shift register become 1 are the timings of B, A#, A, G#, . . . C# as shown in FIG. 16. These notes correspond to major seventh degrees (7), minor seventh degrees (7*b*), . . . minor second degrees (2*b*) respectively where C is made 1 degree. Where the root note data RTLD' is produced at the note timing of D, the timings at which the outputs of the stages Q1 through Q11 of the shift register 41 become "1" are the timings of C#, C, B, A#, . . . D# as shown in FIG. 16. These notes correspond to the major seventh degrees (7), minor seventh degrees (7*b*), . . . minor second degrees (2*b*) respectively.

The outputs of the predetermined stages Q2, Q3, Q5, Q8, Q9 and Q12 of the root note shift register 41, and the output of the OR gate circuit 344 are applied to logic circuit 347 of the bass note key data forming circuit 42. The logic circuit 347 is constructed to select the outputs of the stages of the register 41 corresponding to the interval shown by the bass pattern data BassPT supplied from the automatic rhythm device 45 (FIG. 1) for multiplexing the selected output and sending out the multiplexed output to a single output line 348. Of course, while a given bass pattern data BassPT is being produced, a data corresponding to a single note timing is applied to the output line 348, when the bass pattern data Bass PT changes to another one, data "1" for the another one is supplied to the output line 348. For this reason, the bass note key data KP appearing on the output line 348 is time division multiplex data identical to the key data KD obtainable from the key scanner 11 (FIG. 7).

A note timing data of one degree (1) outputted from the OR gate circuit 344 or the stage Q12 of the shift register 41 is applied to one input of an AND gate circuit 349. The note timing data of minor seventh degree (7*b*) outputted from stage Q2 of the shift register 41 is applied to one input of an AND gate circuit 350. The note timing data of major sixth (6) outputted from stage Q3 is applied to one input of an AND gate circuit 351, while the note timing data of the perfect fifth degrees (5) outputted from stage Q5 is applied to one input of an AND gate circuit 352. The note timing data of the major third degrees (3) and the minor third degrees (3*b*) respectively outputted from the stages Q8 and Q9 are supplied to one inputs of AND gate circuits 353 and 354 respectively through AND gate circuits 355 and 356.

The AND gate circuits 355 and 356 are provided for the purpose of effecting the switching between the major third and the minor third. When the minor chord data min sent from the delay flip-flop circuit 314 shown in FIG. 12 is "1", the output of the stage Q9 corresponding to the minor third degree (3*b*) is selected and applied to the AND gate circuit 354 via the AND gate circuit 356. At this time, the AND gate circuit 355 is disabled thus blocking the output of the stage Q8 corresponding to the major third degree (3). When the minor chord data min is "0", the output of the stage Q8 corresponding to the major third degrees (3) is selected and applied to the AND gate circuit 353 via AND gate circuit 355, thus blocking the output of the stage Q9 corresponding to the minor third degree (3*b*) with the AND gate circuit 356. Consequently, either one of the note timing data of the major third degree (3) or minor third degrees (3*b*) is applied to the AND gate circuits 353 and 354 depending upon whether a chord is a minor chord or not.

The bass pattern data BassPT is generated at the time of producing the bass tone as a musical tone and the data BassPT represents the interval of a bass tone (spacing from a root note) to be produced at that time according to the content of a code consisting of 3 bits. The purpose of AND gate circuits 357 through 362 is to decode the data BassPT encoded to 3 bit. The output of the AND gate circuit 357 representing a bass note of eight degree (a root note one octave above), and the output of the AND gate circuit 358 representing a bass note of one degree are applied to the AND gate circuit 349 via an OR gate circuit 363. The output of an AND gate circuit 359 representing a bass note of the minor seventh is applied to the other input of the AND gate circuit 350, while the output of the AND gate circuit 360 representing a bass note of the major sixth is applied to the other input of the AND gate circuit 351. The output of the AND gate circuit 361 representing a bass note of the perfect fifth is applied to the other input of the AND gate circuit 352. The output of the AND gate circuit 362 representing a bass note of the third is applied to one inputs of AND gate circuits 353 and 352. As above described, since either one of the note timings of the major third and minor third is applied to the AND gate circuits 353 and 354, the output of the AND gate circuit 362 representing the third selects either one of the major third and minor third.

Either one of the AND gate circuits 357 through 362 produces an output "1" while the bass pattern data BassPT is being generated. Consequently, the AND gate circuits 349 through 354 select the note timing data of only one stage of the shift register 41 corresponding to the degree represented by the bass pattern data BassPT. The outputs of the AND gate circuits 349 through 354 are multiplexed by an OR gate circuit 364 and then applied to one input of and AND gate circuit 365. To the other inputs thereof are applied the lower key range any key-on signal LKAKO sent from the lower key range key-on memory device 39 shown in FIG. 14, and the signal BT0-1 (FIG. 8) sent from the OR gate circuit 146 (FIG. 7) of the key scanner 11. The output of the AND gate circuit 365 is outputted through the output line 348 as the bass note key data KP.

The signal BT0-1 is applied to the AND gate circuit 365 for the purpose of generating the bass note key data KP during only the 12 key times of the block timings BT0 and BT1 at which the signal BT0-1 becomes "1" and assigns the tone production of the bass tone. Further, the lower key range any key-on signal LKAKO is applied to the AND gate circuit 365 for the purpose of producing a bass note key data KP for producing an automatic bass tone only when any key is depressed in the lower key range. As shown in FIG. 14, in the memory mode (M is "1"), since the lower key range any key-on signal LKAKO is continuously generated after key release, the bass note key data KP is generated after the key release. Consequently in the memory mode, not only a tone (a chord tone) in a lower key range but also a bass tone are continuously produced after the key release.

All bits of the bass pattern data BassPT are applied to an OR gate circuit 366 which produces a bass timing signal BT that becomes "1" while any bass pattern data BassPT is being produced, that is a bass tone is to be produced.

Suppose now that a root note stored in the root note shift register 41 is C and that the bass pattern data BassPT designates the fifth. Then, the bass note key data KP becomes "1" at the note timing of G of the block timing BT0 as shown by KP in FIG. 16. At this time the AND gate circuit 352 is enabled and the output of the stage Q5 of the shift register 41 is selected and outputted as the bass note key data KP. The stage Q5 produces an output "1" 5 key times after the application of signal "1" to the shift register 41 at the note timing of root note C so that a key data KP is produced at the note timing of G five key times after the note timing of note C (that is a tone 5 degrees above).

The root note data RTLD supplied from the chord detection control circuit 30 (FIG. 12) is also applied to a root variation detection circuit 367 in which an AND gate circuit 370 detects the change of the root note. A delay flip-flop circuit 368 is provided for storing the output "1" of the AND gate circuit 370 (i.e., the fact that the root note has changed) and the memory of the delay flip-circuit 368 is self-held via an AND gate circuit 369 and an OR gate circuit 371. A new root mode data RTLD and a signal formed by inverting an old root note data RTLD′ outputted from the 12th stage Q12 of the root note shift register 41 are applied to an AND gate circuit 370. Thus, where presently detected root note is different from that previously detected and stored, the old root note data RTLD′ is "0" (since it is not the note timing of the old root note) at the note timing at which the root note data RTLD becomes "1", whereby the AND gate circuit 370 is enabled and the output "1" thereof is stored in the delay flip-flop circuit 368 via the OR gate circuit 370.

As above described the root note data RTLD may be produced at a plurality of note timings in which the root note data previously arrived at is a false or quasi-root note data not stored in the root note shift register 41. Even by the quasi-root note data RTLD, the AND gate circuit 370 is enabled thus storing "1" in the delay flip-flop circuit 368. For this reason, a signal formed by inverting the root note data RTLD with a NOR gate circuit 372 is applied to the self-holding AND gate circuit 369. Accordingly, even when the quasi-root note data RTLD causes data "1" to be stored in the delay flip-flop circuit 368, the AND gate circuit 369 is disabled by making "0" the output of the NOR gate circuit 372 with a true root note data RTLD that arrives at thereafter, thus clearing the memory of the quasi-root note.

Since no root note data RTLD is formed after the true root note data RTLD that arrives at the latest, the output of the AND gate circuit 370 regarding the true root note data RTLD would be stored in the delay flip-flop circuit 368. To the other input of the NOR gate circuit 372 is applied to scanning cycle clock pulse 4.5 M, so that at the first note timing of the block timing BT0 at which this pulse 4.5 M is generated, the memory of the delay flip-flop circuit 368 is cleared. As a consequence, when the root tone is changed, the output of the OR gate circuit 371 is "1" during an interval between the block timings BT10 through BT13 at which the root note data BT10 through BT13 are produced and the block timing BT15 immediately prior to the generation of the scanning cycle pulse 4.5 M.

The output of the OR gate circuit 371 is applied to one input of AND gate circuit 373, the other inputs thereof being supplied with the C note timing signal CNT and the signal BT 14-15 (FIG. 8) from the key scanner 11 (FIG. 7). Thus, the AND gate circuit 373 is enabled at the note timing of C at the block timing BT14 for passing a root note change signal (which is 1 when the root note is changed) to store the signal in a delay flip-flop circuit 375 via an OR gate circuit 374. The C note timing of the block timing BT14 is the last effective timing of the root note data RTLD generated at the time when a chord is not formed. Then, the presence or absence of the root note change can be correctly judged.

The output of the delay flip-flop circuit 375 is self-held via an AND gate circuit 376 and the OR gate circuit 374, the output thereof continuously becoming "1" upon the root note change and applied to one input of an AND gate circuit 377. To the other input thereof is applied a bass timing signal BT from the OR gate circuit 366. The output of the AND gate circuit 377 is applied to an AND gate circuit 349 via an OR gate circuit 363 as a signal designating a bass note of one degree (root note). The output of the OR gate circuit 374 is inverted by an inverter 378 and then applied to AND gate circuits 359, 360, 361 and 362 for decoding a bass pattern data of 7, 6, 5 or 3 degrees.

Thus, when the root tone is changed, at the timing of the bass pattern data BassPT generated immediately thereafter, the AND gate circuit 377 produces an output "1" while the data BassPT is being generated (signal BT is "1") and this output "1" causes the AND gate circuit 349 to produce a bass note key data KP at the note timing of one degree. At this time, even though the bass pattern data BassPT designates an interval other than 1 or 8 degrees, the decoded output of the data BassPT is precluded by the output "0" of an inverter 378.

The bass timing signal BT outputted from the OR gate circuit 366 is delayed one key time with a delay flip-flop circuit 379 and then applied to one input of an NAND gate circuit 381 and is also inverted by an inverter 380 and then applied to the other input of the NAND gate circuit 381. When the bass timing signal BT changes to 37 0", that is when one bass tone production timing terminates, the NAND gate circuit 381 is enabled for only one key time thus producing an output "0" which disables the AND gate circuit 376 to clear the root note change memory signal "1" stored in the delay flip-flop circuit 375. Thus upon change of the root tone, the root tone is produced at the bass tone production timing immediately after the root change thus representing the change of a root note or a chord.

A rhythm stop signal RSTP supplied from the automatic rhythm device 45 (FIG. 1) or an initial clear signal IC is applied to one input of the OR gate circuit 374 via an OR gate circuit 382 to be stored in the delay flip-flop circuit 375 in the same manner as the root note change signal. The rhythm stop signal RSTP becomes "1" when all rhythm selection switches are OFF, or the rhythm run signal becomes "0", that is the pattern generator 46 (FIG. 6) of the automatic rhythm device 45 is brought to a state in which the bass pattern data BassPT can not be produced (rhythm stop state). Thus at the rhythm stop state, a signal RSTP of "1" is stored and held in the delay flip-flop circuit 375 to make "1" the output of the OR gate circuit 374. Since at the rhythm stop state, no bass pattern data BassPT is generated, no bass timing signal BT is generated so that AND gate circuit 377 would not be enabled. However, when the rhythm stop state is released to generate the first bass pattern data BassPT, the AND gate circuit 377 is enabled. Accordingly, at a time of starting a rhythm performance, a bass note of one degree would be produced as the first bass note in the same manner as the root note change described above.

The octave chords B1', B2' and B3' of bass tone are formed by the octave chord forming circuit 383 which is constructed to satisfy a requirement for setting the bass tone range in the following manner.

Bass Note Range Setting Requirement (1) The root note (one degree) should lie in a note range of C2, C#2, D2, . . . B2

(2) The subordinate note of 8 degrees (a root note one octave above) should lie in a note range of C3, C#3, D3, . . . B3.

(3) The subordinate notes (3, 5, 6 or 7 degrees) other than 8 degrees should generally lie in the same note range (C2 through B2) as the root note, but where they are lower than the root note they should lie in a note range (C3 through B3) one octave above.

When the requirement (3) is satisfied, all subordinate tones are generated on the higher note side than the root note thus enabling "a walking bass" performance. Where the root note is note C (that is C2 tone), there is no possibility of forming subordinate notes which are lower than the root note (because C2 is the lowest tone), or as can be noted from Table V, with this system the values of the octave codes B1 through B3 are different from those of the octave codes B1 through B3 of other notes C#2 through B2 or C#3 through B3 so that it is impossible to effect processings for filing the requirements (1) through (3) in common with all root notes (C through B). For this reason, as shown in Table VII, octave codes B1 through B3 of different modes are determined for a case where the root note is C and a case where the notes are different from C (C# through B). To determine or form the octave codes B1 through B3 either one of the events a through g shown in the following Table VII is used.

TABLE VII

| | | event | | | | | | |
|---|---|---|---|---|---|---|---|---|
| | | bass note to be produced | note range | octave code B3 | B2 | B1 | BQ1 | BQ2 |
| root note C | a | root note | C2 | 1 | 0 | 1 | 0 | 1 |
| | b | 8 degrees | C3 | 1 | 0 | 0 | 1 | 1 |
| | c | subordinate note other than 8 degrees | C#2 through B2 | 1 | 0 | 0 | 0 | 0 |
| other than root note C | d | root note | C#2 through B2 | 1 | 0 | 0 | 0 | 0 |
| | e | 8 degrees | C#3 through B3 | 0 | 1 | 1 | 1 | 0 |
| | f | subordinate note higher than root | D2 through C2 | 1 | 0 | 0 | 0 | 0 |

TABLE VII-continued

| | event | | | | | | |
|---|---|---|---|---|---|---|---|
| | bass note to be produced | note range | octave code B3 | B2 | B1 | BQ1 | BQ2 |
| g | note subordinate note lower than root note | C#3 through A#3 | 0 | 1 | 1 | 0 | 0 |

Columns BQ1 and BQ2 in Table VII show the states of the signals BQ1 and BQ2 generated by an OR gate circuit 384 and an AND gate circuit 385. The notes C2, C3, or note ranges C#2 through B2 etc. shown in the column of note range show the note range of the bass note that can be produced in respective events a through g. For example, the event a in which the root note is C, means that the note C2 is produced as the root note. Event d in which the root note is other than C, means that tones of notes C#2 through B2 are produced as the root notes. In order to satisfy above described requirements (1) through (3), it is necessary to determine the note range as shown in Table VII. As can be noted from the octave code table shown in Table V, in order to obtain these note ranges, the values of the octave codes B1 through B3 are determined as shown in the columns of the octave codes B1 through B3 as shown in Table VII. The octave code forming circuit 383 is constituted by an exclusive OR gate circuit 386, an AND gate circuit 387, and inverters 388 and 389. For the subordinate tone higher than the root note or the subordinate tone lower than the root tone other than the root tone C shown in Table VII, the circuit is constructed such that note C is judged as the highest tone, while C# as the lowest tone.

Whether the bass tone to be produced (subordinate tones of 7, 6, 5 or 3 degrees) is higher or lower than the root tone is judged according to the order of the note timings of the root note data RTLD' and the timing of generating the bass note key data KP (representing the note timing of a subordinate tone to be produced). The bass note key data KP on the output line 348 is applied to one input of an AND gate circuit 390, and the output thereof is applied to AND gate circuits 391, 392 and 393 for selecting the octave codes B1, B2 and B3 formed with these AND gate circuits 391, 392 and 393 of the note timings of the bass note key data KP thereby producing octave codes B1', B2' and B3' of the bass tone. Deriving out of the octave codes B1', B2' and B3' at the time of generating the bass note key data KP helps the dynamic judgment as to whether the subordinate note is high or low. The AND gate circuit 390 is also supplied with a bass channel timing signal PchT (see FIG. 6) supplied from the AND gate circuit 118 of the timing signal generator 20 shown in FIG. 2 for processing the bass note assignment thus producing the octave codes B1' through B3' at the channel timings for the bass note assignment.

A circuit comprising a delay flip-flop circuit 394, AND gate circuits 395 and 396 and an OR gate circuit 397 stores the fact that the octave is raised by one to produce an output "1" at the note timing of an subordinate note (or 8 degree tone) to be raised one octave. A signal formed by inverting the scanning cycle pulse 4.5 M is applied to one inputs of the AND gate circuits 395 and 396, and the to the other input of the AND gate circuit 396 is applied a root note data RTLD' outputted from the root note shift register 41. The scanning cycle pulse 4.5 M becomes "1" at the scanning timing of the highest note key C7 or at the note timing of the note C of the block timing BT0. As a consequence, the root mode data RTLD' of C produced at the block timing BT0 is blocked by the AND gate circuit 396 so that the data RTLD' would not be stored in the delay flip-flop circuit 394. Since the scanning cycle pulse 4.5 M is "0" at the note timing of the note C of the block timing BT2, the C root note data RTLD' at that time would be stored in the delay flip-flop circuit 394 but since the octave codes B1' through B3' are produced based on the bass note key data KP only at the block timings BT0 and BT1, the state of the delay flip-flop circuit 394 between the block timing BT2 through BT15 has no means. When the root note data RTLD' becomes "1" at a note timing other than C, the scanning cycle pulse 4.5 M becomes "0" so that data "1" is received via the AND gate circuit 396 at its root note timing. The received data is thereafter self-held through the delay flip-flop circuit 394 and the AND gate circuit 395 which is disabled by a scanning cycle pulse 4.5 M generated at the beginning of the next scanning cycle, thus releasing the self-holding. Considering an interval between the block timings BT0 and BT1 in which the octave codes B1' through B3' are generated, before the root note timing the output of the delay flip-flop circuit 394 is "0" (at the note timing of a tone higher than the root tone, since the scanning is made according to the order of the tone pitches), showing that it is not necessary to raise one octave. However, after the root note timing (at the note timing of a tone lower than the root tone) the output of the delay flip-flop 394 becomes "1" showing that the octave should be raised by one.

The output B8 of an AND gate circuit 357 showing that the bass pattern data BassPT is 8 degrees is stored in the delay flip-flop circuit 394 via an OR gate circuit 397. Accordingly where 8 degree bass tone is to be produced, the output of the delay flip-flop circuit 394 is always "1" showing that the octave should be raised by one.

The operation of the octave code forming circuit 383 will now be described for respective events a through g.

When the root note is C, the root note data RTLD' becomes "1" at the note timing of C. Consequently, at the block timings BT0 and BT1, "1" is not stored in the delay flip-flop circuit 394 as above described. In the case of the event a, the AND gate circuit 385 inputted with the root note data RTLD' and the C note timing signal CNT (FIG. 8) is enabled at the note timing of the root note or note C in the block timing BTO, so its output signal BQ2 becomes "1". At this time, as the AND gate circuits 395 and 396 are disabled by the scanning cycle pulse 4.5 M, the signal supplied to the AND gate circuit 398 from the OR gate circuit 397 is 37 0". The output of an AND gate circuit 399 supplied with a signal "0" formed by inverting the C note timing signal CNT also becomes "0" and the output signal BQ1 of the OR gate circuit 384 inputted with the outputs of both AND gate circuits 398 and 399 is also "0". Thus, at the note timing of the root note C, signal BQ1 is "0" and signal BQ2 is "1". The output of an exclusive OR gate circuit 386 (bit B1 of the octave code) is "1", the output of the AND gate circuit 387 inputted with a signal obtained by inverting signals BQ1 and BQ2 with the inverter 388 (bit B2 of octave code), and a signal formed by inverting the output "0" of the AND gate circuit 387 with inverter 389 becomes "1" (bit B3 of the octave code). Consequently, octave codes B3, B2 and B1 having values "1", "0" and "1" respectively are applied to the AND gate circuits 391 through 393. In the case of the event a, since the bass note key data KP becomes "1" at the note timing of the root tone C above described values "1", "0" and "1" formed at the note timing of the note C are selected by the AND gate circuits 391 through 393 to obtain octave codes B3', B2' and B1' which show the octave note range of note C2.

In the case of the event b, at the note timing of C of the block timing BT0, the AND gate circuit 385 is enabled as above described thus changing the signal BQ2 to "1". On the other hand, since signal B8 representing 8 degrees becomes "1", a signal applied to AND gate circuit 398 from OR gate circuit 397 is always "1" during the bass tone production so that the output BQ1 of the AND gate circuig 398 becomes "1" at the note timing of C at which signal CNT is produced. Where signals BQ1 and BQ2 are both "1", the output B1 of the exclusive OR gate circuit 386 is "0", the output B2 of AND gate circuit 387 is "0", and the output B3 of the inverter 389 is "1". Accordingly, at 8 degrees at which the bass note key data KP becomes "1" that is at the note timing of root note C, octave codes B3', B2' and B1' constituting a value "100" are obtained which represents the octave note range of the note C3.

In the case of event c, the subordinate tone to be produced is a note other than the note c. At a note timing other than the note C, the signal CNT is "0" and the outputs of the AND gate circuits 385 and 398 are both "0". Although the AND gate circuit 399 is enabled, in the case of the root note C, since the output of the delay flip-flop circuit 394 is "0", the output of the AND gate circuit 399 also becomes "0". Consequently, both signals BQ1 and BQ2 become "0", the output B2 of the AND gate circuit 387 is also "0" and the output B3 of the inverter 389 become "1". Consequently, octave codes B3', B2' and B1' are outputted which assume a value "100" at the timing of the bass note key data KP of a subordinate tone which becomes "1" at a note timing other than C. This means that the subordinate tone lies in a note range of C#2 through B2.

Where the root tone is a tone other than C, since the C note timing signal CNT is "0" when the root note data RTLD' becomes "1", the output BQ2 of the AND gate circuit 385 is always "0". As above described, the root note data RTLD' is stored in the delay flip-flop circuit 394 through the AND gate circuit 396 and the OR gate circuit 397. When "1" is inputted to the delay flip-flop circuit 394 at the note timing of the root tone, the output of the delay flip-flop circuit 394 changes to "1" one key time later. As an example, the output Q of the delay flip-flop circuit 394 when the root note is G is shown by 394-Q in FIG. 16. As the old memory is cleared by the timing action of the scanning cycle pulse 4.5 M, the output of the delay flip-flop circuit 394 changes to "0" at the note timing of the note B one key time later. As the root note data of "1" produced at the note timing of G is taken in, the output of the delay fip-flop circuit 394 changes to "1" at the note timing of F# one key time later. Consequently, at a note timing of higher note (B through G#) than the root note G, the output of the delay flip-flop circuit is "0" at the block timings BT0 and BT1 whereas at a note timing of lower note (F# through C#) the output of the delay flip-flop circuit 394 becomes "1".

Firstly, in the case of the event d, at a note timing of the root note (a note other than C) the signal CNT is always "0" so that the output of the delay flip-flop circuit 394 is given as signal BQ1 from the AND gate circuit 399 via the OR gate circuit 394. As shown by 394-Q in FIG. 16, at the note timing of the root note, the output of the delay flip-flop circuit 394 is still "0". Consequently, signals BQ1 and BQ2 are both "0", so that the values of the octave codes B3, B2 and B1 become "100" in the same manner as above described event c, and this value "100" outputted as the octave codes B3', B2' and B1' based on the key data KP which becomes "1" at the note timing of the root note. This means that the note range of the root note comprises C#2 through B2.

In the case of the event, as signal B8 representing 8 degrees becomes always "1" during a bass tone (8 degree tone) is being produced, the output of the delay flip-flop circuit 394 is always 37 1", whereby signal BQ1 produced by the AND gate circuit 399 via the OR gate circuit 384 is always "1". Where signal BQ1 is "1" and signal BQ2 is "0", the output B1 of the exclusive OR gate circuit 386 is "1", the output B2 of the AND gate circuit 387 is also 1, while the output B3 of the inverter 389 is 37 0". Consequently, as the bass key data KD becomes "1" at the note timing of 8 degrees or the root note, octave codes B3', B2' and B1' having a value of "011" would be produced showing a note range C#3 through B3 one octave above with respect to the root note.

In the case of the event f, the note timing of a subordinate tone higher than the root tone are produced before the note timing of the root tone at the block timings BT0 and BT1. Accordingly, when the bass note key data KP of a subordinate tone higher than the root tone is generated, since the delay flip-flop circuit 394 does not still store "1" (see 394-Q in FIG. 16), the output BQ1 of the OR gate circuit 384 is "0". The tone pitch order at block timings BT0 and BT1 is such that the note C is the highest (has the highest priority) followed by B, A# . . . C#. Where a subordinate toner higher than the root tone is a note other than C, that is B, A#, . . . D (since C# is the last note timing of the lowest tone, that is BT1, the subordinate tone can never become higher than the root tone) the AND gate circuit 399 is enabled when the signal CNT is "0", whereby the output "0" of the delay flip-flop circuit 394 is utilized as the signal BQ1. At this time, since signals BQ1 and BQ2 are both "0", in the same manner as the event c described above, data "100" would be obtained as the octave codes B3, B2 and B1. As a consequence, the octave note range of a subordinate tone higher than the root tone (C# through B2) is the same as that of a root tone (D2 through B2). Where a subordinate tone higher than the root tone is C, the AND gate circuit 398 is enabled when signal CNT is "1" so that the output of the OR gate circuit 397 is utilized as the signal BQ1. When the C note timing signal CNT is produced at the block timing BT0, the pulse 4.5 M is also produced so that the signal applied to the OR gate circuit 397 from the AND gate circuits 395 and 396 is "0" and the signal BQ1 is "0". Consequently, "100" is obtained as the octave codes B3, B2 and B1 and the C as the subordinate tone is always produced with a tone pitch of C3.

In the case of the event g, the note timing of a subordinate tone lower than the root tone is produced later than the note timing of the root tone at the block timings BT0 and BT1. Consequently,, as the bass note key data KP of a subordinate tone lower than the root tone is produced, the delay flip-flop circuit 394 has already been storing "1" (see 394-Q in FIG. 16) so that the signal BQ1 outputted from the AND gate circuit 399 via the OR gate circuit 384 becomes "1". In the same manner as in the case of event c, when the signal BQ1 is "1" and the signal BQ2 is "0", "011" would be obtained as the octave codes B3, B2 and B1, thus setting a note range of C#3 through C4. However, as above described, since the note C is treated as a subordinate tone higher the root tone and the note B can not become a subordinate tone lower than a root tone other than C, the note range of the subordinate tone lower than the root tone determined by the these octave codes B3, B2 and B1 ("011") is from C#3 to A#3. The note range is higher by one octave than that C#2 through B2 of the root note.

The bass note key data KP produced by the bass note key data forming circuit 42 is supplied to one input of the AND gate circuit 172 of the tone production assignment controller 19 shown in FIG. 10, the other inputs of the AND gate circuit 172 being supplied with a latter half period signal H2 showing the latter half of one key time, and a bass channel timing signal PchT (FIG. 6) sent from the timing signal generator 20 shown in FIG. 2. For this reason, when a bass note key data KP is produced at a desired note timing in the block timings BT0 and BT1 (see KP in FIG. 16), the AND gate circuit 172 is enabled at the second channel timing (the time of generating PchT) in the latter half 11 bit times in one key time in which the key data KP is generated, and in response to this output "1" the OR gate circuit 174 produces a load signal LD which causes the current key-on memory device 177 and the key-on memory device 178 to store data "1" corresponding to the bass channel timing PchT.

The load signal LD is supplied to the key code memory device 24 shown in FIG. 9. At the bass channel timing in the fore half and the latter half 11 bit times in one key time generated by the bass note key data KP, and the AND gate circuit 390 in the octave code forming circuit 383 shown in FIG. 15 is enabled to output octave codes B1′ through B3′ in synchronism with its bass channel timing PchT. These octave codes B1′ through B3′ are supplied to one inputs of AND gate circuits 403, 404 and 405 respectively via OR gate circuits 400, 401 and 402 in the octave code converter 26 shown in FIG. 9. An AND gate circuit 406 in the octave code converter 26 is supplied with a bass channel timing signal PchT, a bass timing signal BT sent from the bass note key data forming circuit 42 (FIG. 15), and a lower key range any key-on signal LKAKO supplied from the lower key range any key-on memory device 39 (FIG. 14). The output of the AND gate circuit 406 is applied to one inputs of the AND gate circuits 403 through 405 via the OR gate circuit 156.

Thus, when any key in the lower key range is being depressed (LKAKO is "1") and when a bass tone is to be produced (BT is "1"), AND gate circuits 403 through 405 are enabled at the bass channel timing (PchT is "1") to select the octave codes B1′ through B3′ of the bass tone applied through the OR gate circuits 400 through 402 so as to produce an output via OR gate circuits 157 through 159. Since at this time, the output of the inverter 155 is "0", the octave codes B1 through B3 given from the scanned key representing line 12 is blocked by the AND gate circuits 152 through 154.

The timing of selecting the bass tone octave codes B1′ through B3′ from the octave code converter 26 coincides with that of generating a load signal LD utilized to assign the bass tone corresponding to the bass channel timing.

The note codes N1 through N4 supplied to the scanned key representing line 12 represents note corresponding to a note timing now designated by the present producing bass note key data KP, that is the note of the bass tone. This can be understood from the fact that all processings executed by the chord detection control circuit 30 shown in FIG. 12 or the automatic bass/-chord processing circuit 40 shown in FIG. 15 are performed in synchronism with the note timing (see FIG. 8 or 16) of the key scanning. Thus, upon generation of a load signal LD utilized to assign bass tones, note codes N1 through N4 representing the note of a bass tone to be produced or assigned, and the octave code B1 through B3 (B1′ through B3′) representing the octave tone range of that bass tone are applied to the input side of the key code memory device 24 so that the key codes N1 through N3 representing the bass tone are inputted to and stored in the key code memory device 24 in synchronism with the timing of the bass channel, that is at the time of generating the load signal LD. In this manner, the bass tone is assigned to a single specific channel designated by the signal PchT.

Although "1" is once applied to the current key-on memory device 177 (FIG. 10) at the timing of the bass channel, this data "1" has no significant meaning because the output KON′ of the current key-on memory device 177 is not used for the bass note assignment. The data "1" stored in the key-on memory device 178 at the timing of the bass channel is utilized as a key-on signal KO1 showing that a bass tone is to be produced. This key-on signal KO1 of the bass channel is stored and held via the AND gate circuit 181, the other input thereof receiving the output of an AND gate circuit 407 via an OR gate circuit 408. The AND gate circuit 407 is supplied with a lower key range any key-on signal LKAKO, a bass timing signal BT, and a bass channel timing signal PchT, in the same manner as the AND gate circuit 406 (FIG. 9). When the signals LKAKO and BT are both "1", the AND gate circuit 181 is enabled through the AND gate circuit 407 each time the signal PchT is produced, thus storing and holding the key-on signal KO1 of the bass channel. As the bass timing signal BT changes to "0" upon completion of the bass tone production timing or when all keys in the lower key range are released (LKAKO is "0") the key-on signal KO1 of the bass channel would be cleared. As above described, since the signal LKAKO is held at "1" even after the key release in the case of the memory mode (see FIG. 14), the memory performance would be applied also to the bass tone.

Chord Detection in Single Finger Mode

In the single finger mode (SF), the lower key range of the keyboard is not used to designate the tone itself to be produced but to designate the root note of a chord and the type thereof. Heretofore, the root note designation and the chord type designation in the single finger mode were performed by using different keyboards, for example the lower keyboard and the pedal keyboard, or a switch train but in the electronic musical instrument according to this invention both the root note and the chord type are designated with a single (one array) keyboard, for example the lower key range thereof.

More particularly a single key corresponding to a root note is depressed with the key most extreme (in this embodiment the key being the highest tone, but it may being the lowest tone) and other keys are used to designate the type of the chord. In other words, where a key corresponding to a root note is depressed as the highest tone, the keys on the lower side of that key are used to designate the chord type. The method of designating the chord type comprises designating the seventh chord by depressing a natural (white) key, designating a minor chord by depressing sharp (black) key and not depressing any keys other than the root note key thereby designating a major chord. The method of designating the chord type is not limited to selectively depress the natural and sharp keys, any suitable method may be used for example by using different key ranges.

In the SF root note detection priority circuit 32 of the chord detection control circuit 30, the note timing firstly becoming "1", that is the scanning timing of a key switch produces the highest tone in the lower key range is preferentially detected with the lower key range key date LKKD of one scanning cycle so as to detect the root note designated in the single finger mode performance. Since the key scanning is made according to the order of tone pitches, the note timing which becomes "1" at first is the key scanning timing of the highest tone key.

The memory in the delay flip-flop circuit 271 of the SF root note detection priority circuit 32 is cleared by a cancel signal CAN (see FIG. 8) prior to the lower key range scanning timing (see FIG. 8). Prior to the scanning timing of a depressed key of the lower key range which produces the highest tone, the lower key range key date LKKD is "0", and the delay flip-flop circuit 271 is at "0" state. At the time of scanning a depressed key of the lower key range which produces the highest tone, the lower key range key data LKKD becomes "1". At this time, the delay flip-flop circuit 271 outputs a delayed result "0" of the scanning made one key time before whereby the output of the inverter 273 becomes "1". The single finger mode signal SF applied to the AND gate circuit 274 is "1" at the time of the single finger mode. Consequently, the AND gate circuit 274 inputted with the output of the inverter 273 and the lower key range key data LKKD produces an output "1" when the lower key range kay date LKKD firstly becomes "1" during one scaning cycle, that is at the scanning timing (at the note timing) of the highest tone key in the lower key range (at the note timing).

At the time of scanning a key next to the highest tone key, the output of the delay flip-flop circuit 271 changes to "1" (which corresponds to a data obtained by delaying by one key time the highest tone key data) and this data "1" is maintained until the cancel signal CAN becomes "0" at the next scanning cycle. Accordingly, even when the key data LKKD becomes "1" at the time of scanning a key on the lower tone side (at the lower key scanning order) than the highest tone key in the lower key range, the key date LKKD of the keys on the lower tone side will be blocked at the AND gate circuit 274 by the output "0" of the inverter 273 which inverts the output "1" of the delay flip-flop circuit 271. In this manner, only the key date (LKKD) of the highest tone key in the lower key range is preferentially selected and then outputted from the AND gate circuit 274. The output of this AND gate circuit 274 is applied to one input of an AND gate circuit 409 as a data SFRTLD representing the note timing of the root note of a chord at the time of the single finger mode performance and outputted as a root note data RTLD via an OR gate circuit 297.

The other input of the AND gate circuit 409 is supplied with a lower key range any key-on signal LANKO via an OR gate circuit 410, the signal LANKO being supplied from the lower key range any key-on detector 38 shown in FIG. 13.

Figure 17:
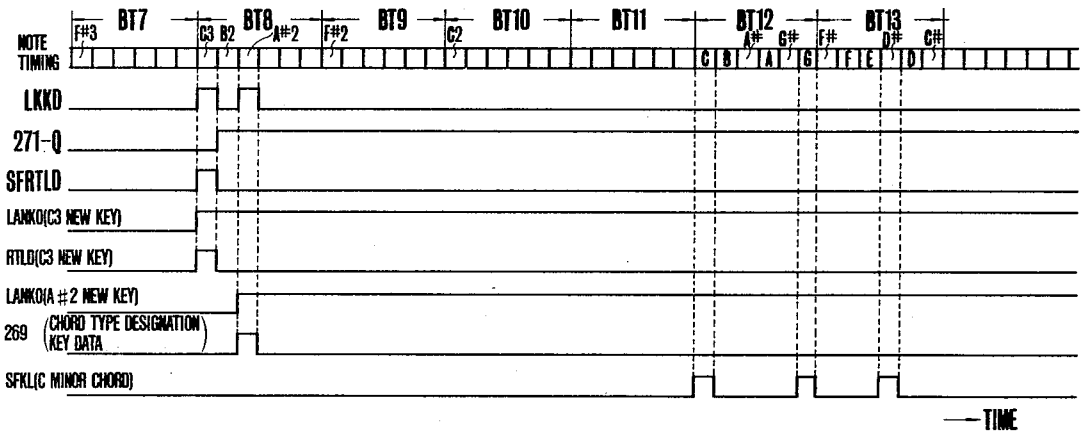
FIG. 17 is a time chart useful to explain the processing operation of the chord detection control circuit shown in FIG. 12 at the time of the single finger mode.

On the assumption that a C3 key and A♯2 key (sharp key) in the lower key range are depressed, an example of generating the lower key range key data LKKD and one examples of the output (271-Q) of the delay flip-flop circuit 271 and of the output SFRTLD of the AND circuit 274 are shown in FIG. 17. As shown, the data SFRTLD is generated at the timing of C3 which appears at the first portion of the lower key range key data LKKD which is a time division multiplex data and generated by the first key time of an interval between the block timing BT7 and the block timing BT10, and the output (271-Q) of the delay flip-flop circuit 271 becomes "1" at the next timing, thus blocking the key data of A♯2 key by the AND gate circuit 274.

As has already been described with reference to FIG. 13, the lower key range any key-on signal LANKO changes to "1" at the time of scanning a newly depressed key, and this signal "1" is maintained until it is clearly by a cancel signal CAN prior to the lower key range scanning timing of the next scanning cycle. Thus, if the lower key range highest tone key were depressed for the first time, the signal LANKO would be "1" at the time of generation of the data SFRTLD (depression of the highest tone key), but if the highest tone key were not depressed for the first time, the signal LANKO would be "0" at the time of generating the data SFRTLD. In the example shown in FIG. 17, where the lower key range highest tone key C3 were depressed for the first time, the signal LANKO would change to "1" at the time of scanning the highest tone key C3 and the data SFRTLD generated at that time is selected by the AND gate circuit 409 (FIG. 12) and then outputted as a root note data RTLD via the OR gate circuit 297. However, where key A♯2 lower than the highest tone key C3 is depressed for the first time, the signal LANKO changes to "1" at the time of scanning the key A♯2 so that the signal LANKO is still "0" at the time of scanning the key C3 and the data SFRTLD is blocked by the AND gate circuit 409 whereby no root note data RTLD would be produced. Where no any key-on signal LANKO is generated, the data SFRTLD would be blocked in the same manner. Thus, in the single finger mode, the root note data RTLD would be produced only when the lower key range highest tone key is newly depressed, that is when the root note is changed. Different from the fingered chord mode, the root note data RTLD in the single finger mode is generated at the time of scanning the lower key range scanning time (between the block timings BT7 through BT9) and the lowest key scanning time).

In FIG. 12, the inverter 275 and the AND gate circuit 269 connected between the SF root note detection priority circuit 32 and the lower key range key data register 35 cancel the key data LKKD of the highest tone (root tone) preferentially selected by the priority circuit 32 and select only key data that designates the chord type. When the key date "1" of the highest tone key (in the example shown in FIG. 17, key C3) is applied to one input of the AND gate circuit 269, the output SFRTLD of the AND gate circuit 274 is "1" and the output of the inverter 275 is "0". For this reason, the key data LKKD of the highest tone key (that is the root note) is blocked by the AND gate circuit 269 and not applied to the register 35. The output of the inverter 275 is "1" at a time other than the scanning timing (SFRTLD) of the highest tone key, and the key data LKKD on the lower tone side (that designates the chord type) is selected by the AND gate circuit 269 and stored in the register 35 via the OR gate circuit 276 and 277. One example of the output of the AND gate circuit 269 is shown by a curve 269 in FIG. 17. Thus, the key data of the highest tone key C3 is cancelled and only the key data of the key A#2 is selected.

Since the memory holding AND gate circuit 278 is enabled during the lower key range scanning interval ($\overline{BT5\text{-}6}$ and $\overline{BT14\text{-}15}$ are "1"), the key data designating the chord type and has been received in the register 35 circulates and held in the 12 stage shift register 35, and the outputs of the stages Q1, Q3, Q6, Q8 and Q10 thereof are applied to a sharp key detecting OR gate circuit 412, and the outputs of the stages Q2, Q4, Q5, Q7, Q9 and Q11 and the output of the OR gate circuit 277 are applied to an OR gate circuit 413 for detecting natural keys. The outputs of the OR gate circuits 412 and 413 are applied to one input of an AND gate circuit 414 of the minor chord memory device 36 and one input of an AND gate circuit 415 of the seventh chord memory device 37, the other inputs of the AND gate circuits 414 and 415 being supplied with a signal CLT (FIG. 8) representing the scanning timing of the lowest tone key C2. The AND gate circuits 414 and 415 are enabled at the key scanning timing of the lowest tone key C2 so that outputs of the OR gate circuits 412 and 413 would be applied to the delay flip-flop circuits 304 and 305 respectively through the AND gate circuits 414 and 415. At this time, the output "0" of the NOR gate circuit 308 which inverts the signal CLT clears the old memories in the delay flip-flop circuits 304 and 305. When the signal CLT becomes "0" at the next timing, the output of the NOR gate circuit 308 becomes "1" and the outputs of the OR gate circuits 412 and 413 received immediately before are self-held in the delay flip-flop circuits 304 and 305 respectively via the AND gate circuits 306 and 307.

When the lowest tone key scanning timing signal CLT is generated, the data of the lowest key C2 is being produced as the key data LKKD, and the data produced by the 12th stage Q12 of the shift register 35 is also the data regarding the key C (Key C3). Accordingly, a key data (note data) representing whether a C key (C3 or C2 in the lower key range) has been depressed or not is applied to an natural key detection OR gate circuit 413. At this time, the stages Q1 through Q11 of the shift register 35 produce outputs respectively delayed by one to 11 key times the key data (note data) of the keys C# through B respectively corresponding to the scanning times one to 11 key times before the scanning timing of the key C. Thus, the stages Q2, Q4, Q5, Q7, Q9 and Q11 produce key data of D, E, F, G, A and D (natural keys) respectively. Stages Q1, Q3, Q6, Q8 and Q10 respectively produce key data of C#, D#, F#, G# and A# (that is sharp keys).

For this reason, where any natural key is being depressed as a key that designates the chord type, at the lowest tone key scanning timing (CLT is "1") the output of the OR gate circuit 277 and either one of the outputs of the stages Q2, Q4, Q5, Q7, Q9 and Q11 of the shift register 35 are "1", and data "1" is sent and stored in the delay flip-flop circuit 305 of the seventh chord memory device 37 via the OR gate circuit 413 and the AND gate circuit 415. On the other hand, when any sharp key is being depressed for designating the chord type, either one of the stages Q1, Q3, Q6, Q8 and Q10 of the shift register 35 produces an output "1" at the time of scanning the lowest tone key and this output "1" is stored in the delay flip-flop circuit 304 of the minor chord memory device 36 via the OR gate circuit 412 and the AND gate circuit 414 where a key designating the chord type is not depressed, the outputs of the OR gate circuits 412 and 413 are both "0" at the time of scanning the lowest tone key and "0" is stored in the delay flip-flop circuits 304 and 305.

As above described, the outputs of the delay flip-flop circuits 304 and 305 are transferred to the delay flip-flop circuits 314 and 315, and such transfer is made only when "1" is stored in the delay flip-flop circuit 299. In the single finger mode, the AND gate 411 is enabled by a single finger mode singal SF, so that the output "1" of the OR gate circuit 410 is stored in the delay flip-flop circuit 299 via the AND gate circuit 411 and the OR gate circuit 298. As above described, the OR gate circuit 410 is supplied with the lower key range any key-on signal LANKO. Accordingly when any new key is depressed in the lower key range, that is when the root note is changed (in the example shown in FIG. 17 when key C3 is the new key) or the chord type is changed (in the example shown in FIG. 17, key A#2 is the new key), data "1" is stored in the delay flip-flop circuit 299 whereby the old memories of the delay flip-flop circuits 314 and 315 are cleared and the outputs of the delay flip-flop circuits 304 and 305 are stored in the delay flip-flop circuits 314 and 315.

To the other input of the OR gate circuit 410 is applied a signal F formed by inventing a signal ΔF supplied from the mode changes control circuit 15 shown in FIG. 4. This signal ΔF becomes "0" for 4.5 ms+α at the time of mode change (including changing between the fingered chord mode and the single finger mode), whereas the signal ΔF is "1" for about one scanning cycle (4.5 ms+) at the time of mode changing, and used to clear the data min and 7th stored in the minor chord memory device 36 and the seventh chord memory device at the time of mode change.

For example, where the mode is changed from the fingered chord mode to the single finger mode, signal ΔF changes to "1" by the timing action of pulse 4.5 M (because ΔF changes to "0" as shown in FIG. 5), the signal SF changes to "1" one key time later (see latch circuit 14-4 shown in FIG. 4). Based on these signals SF and ΔF, the output of the AND gate circuit 411 (FIG. 12) becomes "1" for an interval of 4.5 ms and stored in the delay flip-flop circuit 299, and the output "1" thereof clears the chord type data min and 7th respectively stored in the delay flip-flop circuits 314 and 315 during the fingered chord mode. The data sent from the delay flip-flop circuits 304 and 305 to the delay flip-flop circuits 314 and 315 at this time are "0". Because, as shown in FIG. 4, when the signal $\overline{\Delta F}$ is "0" at the time of changing the mode from fingered chord mode to the single finger mode, the inverter 86 produces, via the OR gate circuit 87, a mode changing pulse ΔABC having the same width as the signal $\overline{\Delta F}$ (or ΔF). Due to this mode changing pulse ΔABC, the AND gate circuit 142 in FIG. 7 of the key scanner 11 blocks the key data (KD when LK is "1") in the lower key range for one scanning cycle. For this reason, when the contents of the minor chord memory device 36 and the seventh chord memory device 37 are cleared by the signal F applied to the OR gate circuit 410 shown in FIG. 12, the lower key range key data LKKD is not produced so that the data applied to the delay flip-flop circuit 304 and 305 from the sharp key detecting OR gate circuit 412 and the natural key detecting OR gate circuit 413 are both "0".

In the chord detection control circuit 30 shown in FIG. 12, the circuit elements corresponding to the SF chord type detector 33 (FIG. 1) have all been described above, that is elements 35, 36, 37, 269, 275, 299 and 409 through 415.

Chord Key Data Formation in Single Finger Mode

The root note data RTLD is stored in the root note shift register 41 shown in FIG. 15 in the same manner as in the single finger chord mode except that the root note data RTLD in the single finger mode is generated at the lower key range scanning timing (BT7 through BT9) and at the first key time of CLT, that is BT10) and that the data RTLD is generated only at a single scanning timing. Data which becomes "1" at the note timing of the root note is sequentially delayed in the shift register 41, so that the respective stages thereof Q1 through Q11 produce "1" at the note timing showing the subordinate notes corresponding to respective degrees (7, **7*b*, 6, 6*b*, 5, 5*b*, 4, 3, 3*b*, 2 and 2*b*), as above described. Since the NOR gate circuit 345 and the AND gate circuit 346** constitute a later arrival priority circuit, when a new root note data is produced owing to the change in the root note, the old root note data RTLD' is cleared in the same manner as above described.

The data outputted from the stages Q2 and Q5 of the shift register 41 and corresponding to the minor seventh (**7*b*) and perfect fifth (5) are respectively applied to inputs of the AND gate circuits 416 and 417 of the SF chord key data forming circuit 43. The AND gate circuits 355 and 356 supplied with the outputs of stages Q8 and Q9 of the shift register 41 and are utilized for effecting changing between the major third (3) and the minor third (3*b*) constitute a portion of the SF chord key data forming circuit 43. Depending upon "1" or "0" of the minor chord data min supplied from the minor chord memory device 36 shown in FIG. 12, the subordinate note timing data of either one of the major third or minor third is selected by the AND gate circuit 355 or 356, in the same manner as above described. The seventh chord data 7th from the seventh chord memory device 37 shown in FIG. 12 is applied to the AND gate circuit 416 and a signal obtained by inverting the data 7th is applied to the AND gate circuit 417. Thus, since the data 7th is "1" at the time of the seventh chord, the AND gate circuit 416 selects a subordinates note timing data corresponding to the minor seventh 7*b*, whereas a subordinate note timing data of the perfect 5th is not selected. When the chord is not the seventh chord the data 7th is "0" so that the AND gate circuit 417 select a subordinate note timing data corresponding to the perfect fifth (5**) but a subordinate note timing data of the minor seventh is not selected.

The outputs of the AND gate circuits 355, 356, 416 and 417 and the data representing the note timing of the root note (one degree) outputted from the OR gate circuit 344 are synthesized by an OR gate circuit 418 and the synthesized data is applied to a single line 419 as time division multiplex data representing the chord constituting tones of the single finger mode. The data on the line 419 is applied to one input of an AND gate circuit 421 via an AND gate circuit 420 which is applied with a single finger mode signal SF so as to select the multiplexed data on the line 419 only in the single finger mode. The other input of the AND gate circuit 421 is supplied with a signal BT12-13 (FIG. 8) sent from the OR gate circuit 148 of the key scanner 11 and a lower key range any key-on signal LKAKO from the lower key range key-on memory device 39 (FIG. 14). The output of the AND gate circuit 421 is applied to the OR gate circuit 169 in the window circuit 21 shown in FIG. 10 to act as a single finger chord key data SFKL. Thus, the single finger chord key data SFKL is generated at block timings BT12 and BT13 (BT13-13 is "1") in the single finger mode (SF is "1") provided that any key is depressed in the lower key range. In 12 key times between block timings BT12 and BT13, the root note data circulates through the shift register 41 so that respective stages Q1 through Q12 sequentially produce "1" at the note timing of the notes corresponding to the root note and the respective degrees (7, **7*b*, . . . , 2*b*, 2). The note timings (the notes corresponding to respective degrees) at which data "1" are produced from stages Q1 through Q11 corresponding to respective degrees (7, 7*b*, . . . , 2*b*, 2**) are determined by the note timing (i.e., root note) of the root note data RTLD', in the same manner as has been described in connection with the forming of the base note key data.

SFKL shown in FIG. 17 corresponds to the chord key data SFKL produced at the time of depressing keys C3 and A#2 (sharp keys) in the lower key range. Since the designated chord is a C minor chord, the key data SFKL becomes "1" at the note timings of C, G and D#. More particularly, the root note data RTLD' becomes "1" at the C note timing of the block timing BT12 and this data "1" is applied to the OR gate circuit 418 via the AND gate circuit 346 and the OR gate circuit 344 to be outputted as the key data SFKL. Since the seventh chord data 7th is "0", the output of stage Q2 formed by delaying the root note data RTLD' by two key times would not be selected by the AND gate circuit 416. However, the AND gate circuit 417 is enabled so that the output of the stage Q5 obtained by delaying the C note timing data (RTLD') by 5 key times becomes "1" at the G note timing and this output "1" is applied to the OR gate circuit 418 via the AND gate circuit 417. Accordingly, the key data SFKL becomes "1" at the note timing of G which is a subordinate tone of 5 degrees. As the minor chord data min is "1" the AND gate circuit 355 is disabled, whereas the AND gate circuit 356 is enabled with the result that the output of stage Q9 formed by delaying 9 key times the C note timing data (RTLD') becomes "1" at the D# note timing which is applied to the OR gate circuit 418 from the AND gate circuit 356. As a consequence, the key data SFKL becomes "1" at the note timing of D# which is a subordinate note of the minor third.

In the case of a major chord, since data min and 7th are both "0", a key data SFKL would be produced correspondingly to the three tones of the first and fifth (produced by AND gate circuit 417) and the major third (produced by the AND gate circuit 355). In the case of the seventh chord, since data min is "0", and the 7th is "1", a key data SFKL is produced correspondingly to the three tones of the first and minor seventh (produced by AND gate circuit 416) and major third (produced by AND gate circuit 355). In the case of the minor seventh chord, data min and 7th are both "1", the key data SFKL is produced correspondingly to the 3 tones of the first, minor seventh and minor third.

The key data SFKL supplied to the OR gate circuit 169 is supplied to the tone production assignment controller 19 as the lower key range key data KL. Accordingly, in the same manner as the assigning of the lower key range key data KL, the three tones (3 tones shown by SFKL) of the chord constituting tones are assigned to either ones of the lower key range tone production channels.

As the block timings BT12 and BT13 at which the single finger chord key data SFKL is generated, the values of the octave codes B3, B2 and B1 supplied from the key scanner 11 over the line 12 are "110" and do not correspond to the actual octave tone range (see Table V). For this reason the values of these octave codes B1 through B3 are converted to a value corresponding to a predetermined key range by the octave chord converter 26 shown in FIG. 9. More particularly, the single finger mode signal SF and the signal BT12-13 are inputted to the AND gate circuit 160 for producing an output "1" therefrom at the block timings BT12 and BT13 (BT12-13 is "1") at which the key data SFKL is generated at the time of the single finger mode (SF is "1"). This output "1" of the AND gate circuit 160 is inverted with the inverter 161 so as to disable the AND gate circuit 153 which is supplied with the bit B2 of the octave codes B1 through B3 given from the line 12 thus changing the value of this bit B2 to "0". Thus the values of the octave codes B3, B2 and B1 on the line 12 and inputted to the octave code converter 26 are changed to "100" from "110". As shown in Table V, this shows the tone range of C3 through C♯2. The note codes N1 through N4 on the line 12 represents the notes corresponding to respective note timings of key data SFKL so that they are used without any change. Accordingly, in this embodiment, the chords in the single finger mode are produced in the range of C3 through C♯2.

In the case of the single finger mode, the key data in the lower key range does not directly show the chord constituting tones to be actually produced as a musical tone. For this reason, the current key-on memory device 177 (FIG. 10) can not utilize the lower key range key data KD given from the key scanner 11. Thus, the AND gate circuit 199 and the NAND gate circuit 202 (FIG. 10) are provided for the purpose of blocking the key data KD utilized for clearing the current key-on memory device 177. In the case of the single finger mode (SF is "1") the output of the NAND gate circuit 202 becomes "0" at the lower key range scanning timing (LK is "1") so that all key data KD of the lower key range supplied through the OR gate circuit 198 is all blocked. Consequently, in the case of the single finger mode, even when data "1" is temporarily stored in the current key-on memory device 177 by the load signal LD the lower key range channel timing, the stored data "1" will be cleared at once when a coincidence signal EQ is produced afterward from the comparator 25 at the same channel timing.

The memory of the key-on signal KO1 of the lower key range channel stored in the key-on memory device 178 will be held by the lower key range any key-on signal KLAKO in the single finger mode. The lower key range any key-on signal LKAKO supplied from the lower key range key-on memory device 39 shown in FIG. 14 is inverted by the inverter 422 shown in FIG. 10 and then applied to the OR gate circuit 211. Where the mode is not the memory mode, the lower key range any key-on signal LKAKO becomes "0" when no key is depressed in the lower key range. When the signal LKAKO becomes "0", the output of the inverter 422 becomes "1" and the signal "1" is applied to the AND gate circuit 212 via the OR gate circuit 211, and at the lower key range channel timing (LchT is "1") the signal "1" is applied to the NOR gate circuit 206 via the AND gate circuit 212, whereby the output of the NOR gate circuit 206 becomes "0" at the lower key range channel timing so that all key-on signals KO1 of the lower key range channels change to "0".

As above described in the memory mode (M is "1") since the lowe key range any key-on signal LKAKO is continuously maintained at "1", even when a key that has been designated the root note and the chord type in the lower key range is released, the key-on signal KO1 of the lower key range channel would not be cleared and maintained at "1". Since at this time, the AND gate circuit 421 in the SF chord key data forming circuit 43 shown in FIG. 15 is also enabled, the key data SFKL too is continuously outputted.

In the memory mode, the lower key range key-on signal KO1 in the key-on memory circuit 178 is cleared when the chord is changed. Then, a key data SFKL of a tone which has not been assigned to a lower key range channel is produced. In one key time in which this new key data SFKL is produced, the comparator 25 (FIG. 9) does not produce any coincidence signal EQ at the lower key range channel timing. As a consequence the output LKOEXT of the flip-flop circuit 193 (FIG. 10) is "0" at the latter half 11 bit times of one key time in which the new key data SFKL was produced, whereby the output of the inverter 214 becomes "1". Further the output KON' of the current key-on memory device 177 corresponding to a lower key range channel has already been cleared to become "0". Thus, the AND gate circuit 213 is enabled during the latter half 11 bit times (H2 is "1") of one key time in which the new key data SFKL is produced so that the output of the AND gate circuit 212 becomes "1" at a lower key range channel timing (LchT is "1"), thus clearing all key-on signals of the lower key range channels.

Where the chord is not changed, a coincidence signal EQ is generated at either one of the lower key range channel timing each time a key data SFKL is generated, and the coincidence signal EQ is applied to one input of the AND gate circuit 183. In the single finger mode, the signal SF applied to the OR gate circuit 187 is "1", thus disabling the AND gate circuit 184 but enabling the AND gate circuit 215, the other input thereof being supplied with a key-on signal KO1 from the key-on memory device 178 and the output is applied to the other input of the AND gate circuit 183 via the OR gate circuit 185. Accordingly, in the case of the single finger mode, the coincidence signal EQ is selected by the AND gate circuit 183 and stored in the delay flip-flop circuit 193 provided that the key-on signal KO1 is being generated. The output LKOEXT ("1") of the delay flip-flop circuit 193 does not enable the AND gate circuit 213 so that the key-on signal KO1 would not be cleared. In the memory mode, even when a key that designates a chord same as that stored after release of a key, is newly depressed, the key-on signal KO1 is not cleared. Because, as the chord is the same, a coincidence signal EQ is also formed for a key data SFKL produced by the newly depressed key so that the key-on signal KO1 still held even after the key release is given to the AND gate circuit 183 from the AND gate circuit 215 via the OR gate circuit 185 to select the coincidence signal EQ by the AND gate circuit 183 with the result that the output LKOEXT of the delay flip-flop circuit 193 becomes "1". As above described, in the memory mode of the single finger mode, the key-on signal KO1 of the lower key range is cleared when the chord is changed but not by mere release of a key.

The formation of a bass note key data KP and the tone production assignment thereof in the single finger mode are identical to those of the fingered chord mode described above. In the formation of a chord key data of the single finger mode, although the contents of the root note shift register 41 (FIG. 15) was used at the block timings BT12 and BT13, whereas in the formation of a bass tone key data, the same content of the root note shift register 41 is utilized at the block timings BT0 and BT1.

Arpeggio Key Data Formation and Tone Production Assignment

In this embodiment, the automatic arpeggio performance is interlocked with the automatic bass/chord performance (fingered chord mode or single finger mode). One tone (note) of the pitch order designated by an arpeggio pattern data ArpPT is selected among the chord constituting tones (root note and subordinate note) assigned to the lower key range channels, and predetermined octave codes B1 through B3 are added to the note codes N1 through N4 of that tone (note), the resulting codes are assigned to an exclusive arpeggio channel (a channel designated by the signal AchT) for producing an arpeggio.

Figure 18:
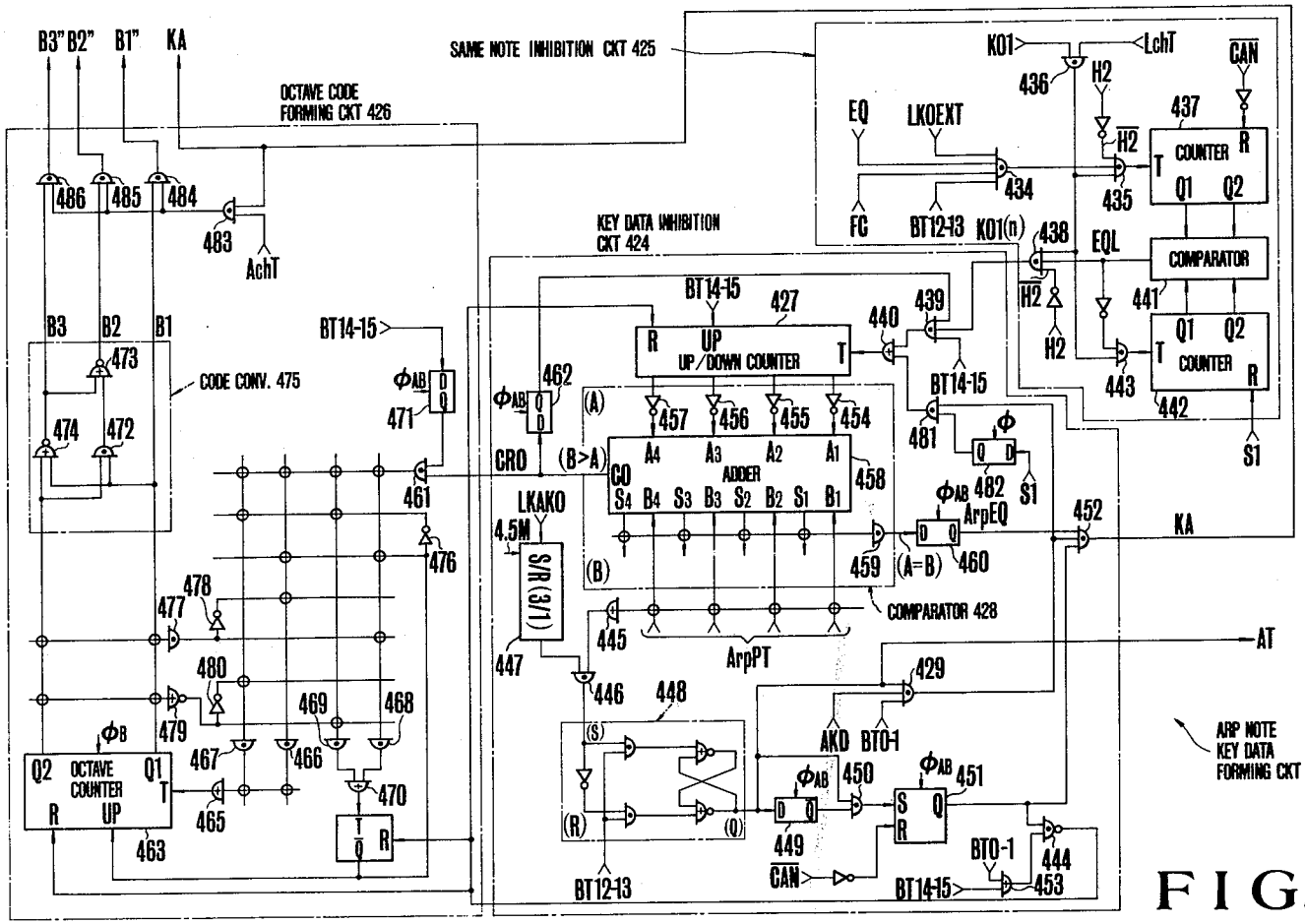
FIG. 18 is a connection diagram showing the detail of the arpeggio key data forming circuit shown in FIG. 1.

In the arpeggio key data forming circuit 44 shown in FIG. 18 a single note of the pitch order designated by the arpeggio pattern data ArpPT is selected among the chord constituting tones for producing an arpeggio note key data KA as well as the octave codes B1" through B3" at the note timing of that note. The selection of the note of the pitch order shown by the arpeggio pattern data ArpPT is made by extracting a single key data at a predetermined note timing among time division multiplex chord constituting tone key data AKD which become "1" at respective note timings of the notes constituting a chord.

The circuit is constructed to form the chord constituting tone key data AKD based on the key codes N1 through B3 already assigned to the lower key range channels (these codes are outputted from the key code memory device 24 shown in FIG. 9 at high speed channel timings) and on the key codes N1 through B3 on the scanned key representing line 12 (these codes are outputted according to the key scanning timings lower than the channel timings). To this end, there are provided the comparator 25, the octave chord converter 27 (FIG. 9), the delay flip-flop circuit 193 (FIG. 10) that stores the coincidence signal EQ, and the ARP key data memory device 34 which produces the chord constituting tone key data AKD based on the output LKOEXT outputted from the delay flip-flop circuit 193. For example, the ARP key data memory device 34 comprises the AND gate circuit 423 and the lower key range key data register 35.

Referring now to FIG. 18, the arpeggio note key data forming circuit 44 comprises a key data extraction circuit 424, a same note inhibition circuit 425 and an octave chord forming circuit 426. The key data extraction circuit 424 executes the following processings. Thus, an up/down counter 427 counts the number n of the tones, that is the chord constituting tones assigned to the lower key range channels according to the key-on signal KO1 (assigned, on the time divisioned basis, to respective channel according to high speed channel timings) supplied from the key-on memory device 178 (FIG. 10) via the same note inhibition circuit 425, and the resulting count and the value of the arpeggio pattern data ArpPT from the automatic rhythm device 45 (FIG. 1) are compared each other by a comparator 428 and the number n of the chord constituting tones is multiplied with N (an integer) until the count value of the counter 427 becomes equal to or larger than the value of the data ArpPT. The value of the arpeggio pattern data ArpPT shows the order of a chord constituting tones counted from the low tone side (that shows the order of pitch counted from the low tone side). The arpeggio pattern data ArpPT is generated corresponding to a timing to be produced the arpeggio tone of the pitch order designated by the data ArpPT. When the value of the data ArpPT is larger than the number n of the chord constituting tones, the multiplier N to obtain a count value N·n of the counter 427 should be larger than 2.

Upon completion of the addition operation of the counter 427 to obtain the count value N·n, 1 is subtracted from the count value N·n each time a chord constituting tone key data AKD is produced (that is that it is becomes "1"). The chord constituting key data AKD is applied to one input of an AND gate circuit 429 in the key data extraction circuit 424 shown in FIG. 18 from the last stage Q12 of the lower key range key data register 35 shown in FIG. 12. Similar to the key data KD obtained by the key scanning, the key data AKD is a time division multiplex data sequentially generated in the order of notes (note timings) from the high tone side. Prior to the subtraction, the count value N n of the counter 427 corresponds to the order of the tone pitch of the highest tone (that is the firstly appearing key data AKD) among the chord constituting tones. This is caused by the fact that since the number n of the chord constituting tones corresponds to the pitch order of the highest tone (nth from the low tone side), N·n which is an integer multiple of the number n also corresponds to the pitch order of the highest tone. By sequentially subtracting 1 from the count value N·n corresponding to the pitch order of the highest tone, the count value (N·n−1) obtained after subtracting 1 becomes the pitch order one order lower than that of the highest tone (N n−1th counted from the low tone side), and the count value (N n−2) after subtracting 2 corresponding to the pitch order of a chord constituting tone two order lower than that of the highest tone (N·n−2th counted from the low tone side). Thus, respective chord constituting tones sequentially become to correspond to the pitch order on the highest tone side to the low tone side. The key data AKD that causes the subtraction operations gradually shift toward the low tone side (because they are generated from the high tone side). For this reason the count value (N·n−X) (X represents the number of times of subtracting 1) corresponds to the pitch order of a key data AKD to be produced next (arriving at first), and a chord constituting tone produced under a state in which the count value (N·n−X) coincides with the value of the pattern data ArpPT corresponds to a tone of a pitch order designated by the data ArpPT, and the key data AKD at that time (upon coincidence) is extracted as an arpeggio note key data KA.

Above described facts are shown in the following table VIII on the assumption that the chord constituting tones comprises 3 tones of C, E and G (n=3) and that the value of the pattern data ArpPT is "7".

TABLE VIII

| | | | |
|---|---|---|---|
| Chord constituting tone | high ← | | → low |
| | C G E | C G E | C G E |
| Addition | | | n = 3 |
| | | 2.n = 6 | |
| | N.n = 9 | | |
| Subtraction | X = 2 | N n − X = ArpPT = 7 | |

More particularly, at the addition operation the number n=3 of the chord constituting tones is multiplied with integers until the count value becomes the same or larger than the value "7" of the pattern data ArpPT, thus obtaining a count value N·n=3×3=9 of the counter 427. During the subtraction operation, by respectively subtracting 1 at the timings of generating the highest tone C of a chord constituting tone key data AKD generated from the high tone side and the next note G, the result of subtraction becomes N·n−X=9−2=7, which coincides with the data ArpPT. Accordingly, a key data AKD produced at the timing of the next note E would be extracted as the arpeggio key data KA.

In the same note inhibition circuit 425 in the lower key range channels, whether the tones belonging to different octaves but having the same notes are assigned to different channels or not is judged at the block timings BT12 and BT13 (the ARP same note processing at Z shown in FIG. 8). Where there are chord constituting tones belonging to different octaves but having the same notes, the key-on signal KO1 is excluded by a number equal to the number of the chord constituting tones and the remaining key-on signals KO1 of the lower key range channels are applied to the key data extraction circuit 424. The chord constituting tone key data AKD utilized by an arpeggio performance corresponds to a note name alone and does not correspond to the octave of an octave constituting tone assigned to a lower key range channel. Accordingly the same note inhibition circuit 425 is provided for the purpose of limiting the lower key range key-on signal KO1 of the different octave but of the same note to only one (one channel). In the single finger mode there is no chord constituting tone of different octave but of the same note, the same note inhibition circuit 425 is used only for the fingered chord mode. The addition operation (which corresponds to the ARP processing shown in Z in FIG. 8) in the counter 427 of the key data extraction circuit 424 is executed at the block timings BT14 and BT15 after detecting the same note.

The purpose of the octave code forming circuit 426 is to form octave codes B1 through B3 representing the octave tone range of a note represented by an arpeggio note key data KA, that is the octave tone range of an arpeggio tone. The value of the octave codes B1 through B3 is determined according to the value of the multiplier N for obtaining the product N n obtained as a result of the addition operation executed by the counter 427 in the key data extraction circuit 424. More particularly, each time the counter 427 counts the number of the chord constituting tones, the octave is raised by one. Where the addition of the number n is still repeated after a predetermined highest octave has been reached, thereafter the octave is lowered one after one.

The operation of the same note inhibition circuit 425 in the fingered chord mode will now be described.

For the purpose of detecting the fact that tones of the same note are assigned to discrete channels in the lower key range, the comparator 25 (FIG. 9) is used at the block timing BT12 and BT13. As has already been described, during 12 key times between the block timings BT12 and BT13, the note codes N1 through N4 of the 12 notes of from C to C# are sequentially applied, in each key time, to one input A of the comparator 25 from the key scanner 11 through line 12 (see note timings shown in FIG. 16). At these block timings BT12 and BT13, the value of the octave codes B3, B2 and B1 applied from the key scanner 11 over the line 12 are "110".

For comparing the values of the note codes N1 through N4 of the key codes N1 through B3 representing the tones outputted, on the time dicision basis from the key code memory device 24 at high speed channel timings and assigned to respective channels with the values of the note codes N1 through N4 applied to the line 12 with the comparator 25, the values of the octave codes B1 through B3 outputted from the key code memory device 24 are converted to the same values as those of the octave codes B1 through B3 on the line 12. More particularly, an AND gate circuit 430 of the octave code converter 27 shown in FIG. 9 is supplied with the fingered chord mode signal FC and the signal BT12-13 for producing an output "1" at the block timings BT12 and BT13 at the time of the fingered chord mode (FC is "1"). This output "1" of the AND gate circuit 430 is applied to one inputs of the OR gate circuits 163 through 165 via an OR gate circuit 431 to convert all octave codes B1 through B3 outputted from the key code memory device 24 to "1". However, since an AND gate circuit 432 supplied with the output "1" of the OR gate circuit 163 is disabled by the output "0" of an inverter 433 which inverts the output "1" of the AND gate 430, the bit B1 of the octave code is changed to "0". As above described, the values of the octave code (B3), (B2) and (B1) outputted from the key code memory device 24 are converted to values "110" which are the same as those of the octave codes B3, B2 and B1 on the line 12, and the data "110" is inputted to the comparator 25.

Thus, the comparator 25 produces a coincidence signal EQ at the channel timing to which are assigned the note codes (N1 through N4) of the same notes as the note codes N1 through N4 supplied to the line 12 and do not vary in one key time. At this time, if the tones of the same note were assigning to discrete channels, a coincidence signal EQ would be produced at a plurality of channel timings in the fore half 11 bit times and the latter half 11 bit times in one key time.

As above described, the coincidence signal EQ is applied to one input of the AND gate circuit 183 shown in FIG. 10. At the block timings BT12 and BT13, the signal BT12-13 applied to the OR gate circuit 187 is "1" so that a key-on signal KO1 outputted from the key-on memory device 178 is applied to other input of the AND gate circuit 183 from the AND gate circuit 215 via the OR gate circuit 185. If the coincidence signal EQ were produced corresponding to the lower key range channel timing of a depressed key (KO1 is "1") (and LchT is "1"), "1" would be stored in the delay flip-flop circuit 193. The output LKOEXT thereof is applied to one input of an AND gate circuit 434 of the same note inhibition circuit 425. The other input of the AND gate circuit 434 is supplied with the coincidence signal EQ from the comparator 25 (FIG. 9), the fingered chord mode signal FC and the signal BT12-13. The output signal LKOEXT of the delay flip-flop circuit 193 changes to "1" one bit time later than the production of the coincidence signal EQ. Thus, for the first coincidence signal EQ, the AND gate circuit 434 would not be enabled but enabled when a coincidence signal EQ is produced subsequently. The output of the AND gate circuit 434 is applied to one input of an AND gate circuit 435. The other inputs thereof are connected to receive a signal $\overline{H2}$ obtained by inverting the latter half period signal $\overline{H2}$ (FIG. 3) (which becomes "1" in the fore half 11 bit times of one key time) and the output of an AND gate circuit 436 which is supplied with a key-on signal KO1 outputted from the key-on memory device 178 shown in FIG. 10 and a lower key range channel timing signal LchT, thus selecting only the key-on signal KO1 of the lower key range channel.

Figure 19:
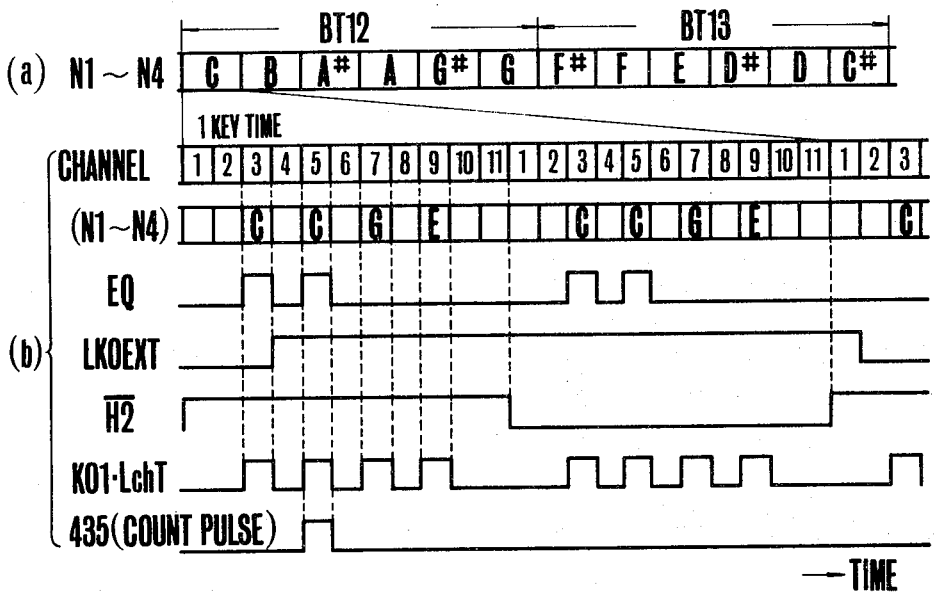
FIGS. 19(*a*) and 19(*b*) are a timing chart showing the operation until the number of the same notes is counted by the same note inhibition circuit shown in FIG. 18.

As shown by (N1 through N4) in FIG. 19(*b*), for example, it is now assumed that different octave bit of the same notes C (that is C2 and C3) are assigned to the lower key range channels "3" and "4"; and that tone of G and E are respectively assigned to lower key range channels "7" and "9". As shown in FIG. 6, at the channel timings "3","5","7" and "9" the lower key range channel timing signal LchT is produced. FIG. 19(*b*) is an enlarged view showing the first key time of the block timing BT12 shown in FIG. 19(*a*), that is an interval in which the C note code is applied on the line 12 as note codes N1 through N4. Since the note codes N1 through N4 on the line 12 are C, the comparator 25 produces a coincidence signal EQ at the channel timings "3" and "5" at which the C note codes (N1 through N4) are outputted from the key code memory device 24 (FIG. 9). When the coincidence signal EQ is produced during the fore half channel timing "3" of one key time, the output LKOEXT of the delay flip-flop circuit 193 (FIG. 10) changes to "1" one bit time later. Consequently, the AND gate circuit 434 shown in FIG. 18 is not enabled at the channel timing "3". This output signal LKOEXT is maintained at "1" until it is cleared by signal S1 at the beginning of the next key time. (see AND gate circuit 195 shown in FIG. 10). Thus, the AND gate circuit 434 is enabled when the second coincidence signal EQ is produced at the next channel timing "5". The signal $\overline{H2}$ and the output (KO1.LchT) applied to the AND gate circuit 435 are produced as shown in FIG. 19(*b*). The AND gate circuit 435 produces an output "1" only during the fore half period in which H2 is "1", provided that the second coincidence signal EQ enabling the AND gate circuit 434 corresponds to the lower key range channel in which a key is being depressed (including a key depression in the memory mode). This output "1" of the AND gate circuit 435 (shown as 435 in FIG. 19(*b*) is applied to a counter 437 as a count pulse. The coincidence signal EQ is also produced at the timings of the latter half channels "3" and "5" to enable the AND gate circuit 434. However, since signal $\overline{H2}$ is "0", no count pulse is given.

Different octave same note detection processing shown in FIG. 19(*b*) is repeated at each note timing FIG. 19(*a*) of the block timings BT12 and BT13. Each time different octave but same notes are detected, the count value of the counter 437 is increased by 1. However in the example shown in FIG. 19, since the different octave same notes in the lower key range channel comprise only C, the count value of the counter 437 at the end of the block timing BT13 is one (binary "01"). The counter 437 is reset by a signal formed by inverting a cancel signal $\overline{CAN}$ (FIG. 8) at the block timings BT5 and BT6.

As above described the counter 437 counts the number (pair number) of the different octave same notes at the block timings BT12 and BT13 in the fingered chord mode.

The key-on signal KO1 of the lower key range channel produced by the AND gate circuit 436 is applied to one input of an AND gate circuit 439 via an AND gate circuit 438 and further to the count input T of the counter 427 via an OR gate circuit 440. The purpose of the AND gate circuit 438 is to exclude pulses (that is key-on signal KO1) of the number equal to that of the different octave same notes which is counted by the counter 437 among the pulse train (output of the AND gate circuit 436) of the time division multiplex signal KO1 which become "1" corresponding to the lower key range channel timing at which a key is being depressed.

The count output of the counter 437 is applied to one input of a comparator 441 with its other input connected to receive the output of a counter 442 which is cleared by signal S1 (FIG. 3) at the beginning of one key time. When the count value of the counter 437 is a value other than zero, both inputs of the comparator 441 do not coincide each other at the beginning of one key time (because the counter 442 is cleared) so that the coincidence output EQL is "0". An AND gate circuit 443 is inputted with a signal obtained by inverting the coincidence signal EQL so that it selects a key-on signal KO1 sent from the AND gate circuit 436 when the coincidence signal EQL is "0", that is the count values of both counters 437 and 442 do not coincide each other and the selected key-on signal KO1 is applied to the count input T of the counter 442. The coincidence output EQL is also applied to one input of the AND gate circuit 438 so as to disables the same when the count values of both counters 437 and 442 do not coincide with each other thus blocking the key-on signal KO1. Coincidence of the count values of both counters 437 and 442 means that the key-on signals KO1 of the same number as that of the different octave same note have been inhibitted or blocked. Accordingly, after the coincidence, the AND gate circuit 438 is enabled (EQL is "1"), the remaining lower key range key-on signals KO1 are passed. The other input of the AND gate circuit 438 is supplied with a signal $\overline{H2}$ formed by inverting the latter half period signal H2 so that this AND gate circuit passes the lower key range key-on signal KO1 only during the latter half period in one key time. Because, since the counter 442 is cleared at the beginning of one key time, during the fore half 11 bit times of one key time, it is possible to eliminate key-on signals KO1 of same number as that of the same note.

Figure 20:
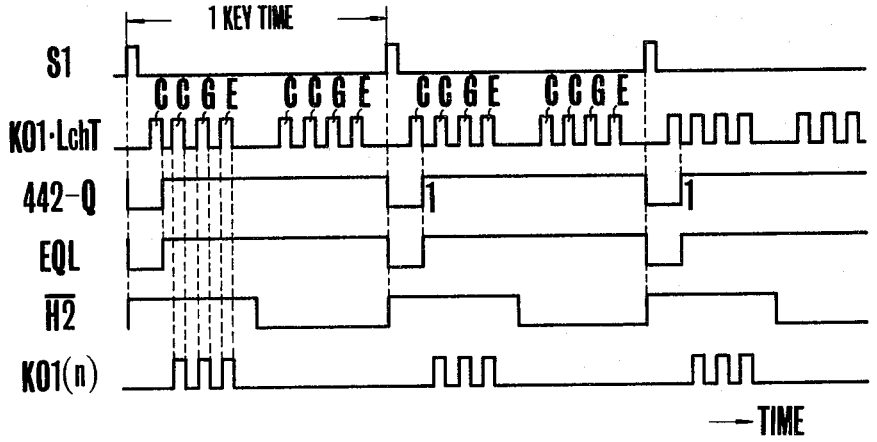
FIG. 20 is a timing chart for explaining the operation of the same note inhibition circuit shown in FIG. 18 until a key-on signal is obtained from which the same note has been inhibited.

On the assumption that, like FIG. 19(*b*), four notes C, C, G and E are assigned to the lower key range channels "3", "5", "7" and "9" respectively and that the keys corresponding thereto are all being depressed to produce key-on signals KO1, one example of the inhibition method will be described with reference to FIG. 20 in which KO1 LchT shows key-on signal KO1 of the lower key range channel outputted from the AND gate circuit 436, and 442-Q shows the outut of the counter 442. The count value of the counter 437 that counts the number of the different octave same note is 1 (binary "01"). At the beginning of one key time, the output EQL of the comparator 441 is "0" and the key-on signal KO1 LchT generated at the beginning of one key time is blocked by the AND gate circuit 438 and the count value of the counter 442 is increased by 1 by the first key-on signal. Then the count value "1" of the counter 437 becomes to coincide with the count value of the counter 442 to change the coincidence output EQL to "1". Thus, in the fore half period ($\overline{H2}$ is "1") three succeeding key-on signals KO1.LchT pass through the AND gate circuit 438. The number of pulses based on the key-on signal KO1(n) outputted from the AND gate circuit 438 in one key time corresponds to the number n of the chord constituting tones after exclusion of the notes having same note name. As shown in FIG. 20, the key-on signal KO1 (n) comprising a train of pulses of the number corresponding to the number n of the chord constituting tones is produced recurrently at each one key time. However the count processing of the number of the different octave same notes is completed at the end of the block timing BT13 as above described, the key-on signal KO1(n) subsequently outputted from the AND gate circuit 438 represents the number n of the effective chord constituting tones. To this end the AND gate circuit 439 is supplied with the signal BT14-15 to select the key-on signal KO1(n) produced by the AND gate circuit 438 (or the same note inhibition circuit 425) at the block timings BT14 and BT15 and to apply the selected key-on signal KO1(n) to the counter 427.

In the single finger mode, the output of the counter 437 that counts the number of the different octave same notes is always "0", while the output EQL of the comparator 441 is always "1". Accordingly, all key-on signals KO1 of the lower key range channels are outputted from the AND gate circuit 438 as the signals KO1(n).

The counter 427 is of the up/down type and the signal BT14-15 is applied to a up/down switching input UP to set the counter 427 in a countup mode at the block timings BT14 and BT15. Consequently, the key-on signal KO1(n) applied to the counter 427 from the AND gate circuit 439 via the OR gate circuit 440 are counted (added) by the counter 427.

The output of an NAND gate circuit 444 is applied to the reset input R of the counter 427 so that it is normally reset and this rest state is cleared only at the block timings BT14, BT15, BT0 and BT1 immediately after generation of an arpeggio pattern data ArpPT. All bits of this data are applied to an OR gate circuit 445 so that when any arpeggio pattern data ArpPT is given, the output of the OR gate circuit 445 changes to "1". The output passes through an AND gate circuit 446, when any one of the lower key range key is depressed (in the memory mode, even after key release, it is deemed that the key is being depressed.) to reach a flip-flop circuit 448. The other input of the AND gate circuit 446 is supplied with a lower key range any key-on signal LKAKO sent from the lower key range any key-on memory device 38 (FIG. 14) via a shift register 447 which is of the 3 stage/one bit type driven by the scanning cycle pulse 4.5 M and serves to set a waiting time until the generated signal LKAKO becomes stable, that is until all lower key range depressed keys are assigned to tone production channels.

The flip-flop circuit 448 is provided to receive a signal sent from the AND gate circuit 446 at the timing of the signal BT12-13 (that is block timings BT12 and BT13) and is set when the output of the AND gate circuit 446 is "1" while reset when this output is "0". Consequently, the flip-flop circuit 448 produces a signal in which the output "1" and "0" of the OR gate circuit 445 (which correspond to the generation and disappearance of the pattern data ArpPT respectively) are produced synchronously with the timings BT12 and BT13. The output Q of the delay flip-flop circuit 448 is applied to a build-up detection delay flip-flop circuit 449 and to one inputs of an AND gate circuit 450 and the AND gate circuit 429 and is used as an arpeggio timing signal AT.

Figure 21:
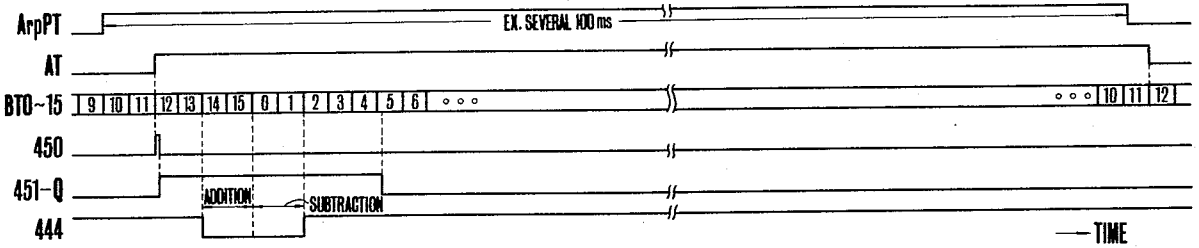
FIG. 21 is a timing chart showing an interval in which addition and subtraction counting is possible in the key data extraction circuit shown in FIG. 18.

One actual example of the generation of the arpeggio pattern data ArpPT is illustrated in FIG. 21, the time width of generation being substantially equal to a usual interval in which a key is held depressed, for example a relatively long time of about several hundreds milliseconds. An arpeggio timing signals AT produced by the delay flip-flop circuit 448 corresponding to the timing of generation of the data ArpPT is also shown in FIG. 21. The width of this signal AT substantially corresponds to that of the data ArpPT. It should be noted that the build-up and build-down timings of the signal AT are synchronous with those of the block timing BT12. BT0 through 15 shown in FIG. 21 show the block timings BT0 through BT15.

The output AT of the delay flip-flop circuit 448 is delayed one key time with the delay flip-flop circuit 449 and an inverted signal $\overline{Q}$ of the delayed output is applied to one input of the AND gate circuit 450. Consequently the output thereof becomes "1" only during one key time at the build-up timing of the arpeggio timing signal AT, as shown by 450 in FIG. 21. The output of the AND gate circuit 450 is applied to the set input S of the flip-flop circuit 451, the reset input R thereof being applied with a signal formed by inverting a cancel signal $\overline{CAN}$ (FIG. 8). For this reason the output Q of the flip-flop circuit 451 is "1" as shown by 451-Q in FIG. 21 during an interval between the block timing BT12 at which the arpeggio timing signal AT builds up and the block timing BT4 of the next scanning cycle (actually however, the output timing is delayed by one key time by the clock pulse $\phi$AB). The output of the flip-flop circuit 451 is applied to one input of the NAND gate circuit 444, the other input thereof receiving signals BT0-1 and BT14-15 (FIG. 8) via an OR gate circuit 453. Accordingly, as shown at 444 in FIG. 21, the output of the NAND gate circuit 444 becomes "0" only at the block timings BT14, BT15, BT0 and BT1 immediately after the generation of the arpeggio pattern data ArpPT, and always "1" in other times.

The reset state of the counter 427 is released only when the output of the NAND gate circuit 444 is "0" thus becoming to count. Thus, the counter 427 operates to count (add) only at the block timings BT14 and BT15 immediately following the generation of the arpeggio pattern data ArpPT, and to subtract only at the time of the block timings BT0 and BT1 immediately thereafter (its mode is changed to the down count mode when the signal BT14-15 becomes "0").

its count input T from an OR gate circuit 465 according to the clock pulse $\phi$B.

The count input T of the counter 463 is supplied with the output of an AND gate circuit 466 or 467 via the OR gate circuit 465, while the count input T of the T type flip-flop circuit 464 is supplied with the output of an AND gate circuit 468 or 469 via an OR gate circuit 470. The AND gate circuits 466 through 469 are supplied with the output of an AND gate circuit 461 which is supplied with the carry signal CRO and a signal formed by delaying one key time the signal BT14-15 with a delay flip-flop circuit 471.

In the first key time (the first key time of BT14, that is the C note timing) of the block timings BT14 and BT15 in which the counter 463 and the delay flip-flop circuit 464 are free from the state of set, the output of the delay flip-flop circuit 471 is "0" (see FIGS. 22 and 23), the output of the AND gate circuit 461 is "0", and those of AND gate circuits 466 through 469 are "0" so that the states of the counter 463 and flip-flop circuit 464 do not change. More particularly, due to the reset the inverted output $\overline{Q}$ of the flip-flop circuit 464 is "1", and the mode of the counter 463 has changed to the up count mode. The outputs Q2 and Q1 of the counter 463 are "00" because it is reset. The outputs Q2 and Q1 of the counter 463 are converted into octave codes B3, B2 and B1 by a code converter 475 constituted by an AND gate circuit 472 and NOR gate circuits 473 and 474. The code conversion table is shown in the following Table IX.

TABLE IX

| Counter 463 | | Octave code | | | |
|---|---|---|---|---|---|
| Q2 | Q1 | B3 | B2 | B1 | Tone range |
| 0 | 0 | 1 | 0 | 0 | C#2 to C3 |
| 0 | 1 | 0 | 1 | 1 | C#3 to C4 |
| 1 | 0 | 0 | 1 | 0 | C#4 to C5 |
| 1 | 1 | 0 | 0 | 1 | C#5 to C6 |

Consequently, when the number n of the chord constituting tones is firstly counted by the counter 427 (the first key time of BT14), the values of the octave cords B3, B2 and B1 outputted from the code converter 475 are "100" showing the tone range of C#2 through C3, which is the lowest octave tone range of an arpeggio.

Between the second key time of the block timing BT14 (B note timing) and the first key time of the subsequent block timing BT0, the output of the delay flip-flop circuit 471 is "1" (see FIGS. 22 and 23) when the carry signal CRO becomes "0" (see FIG. 22) during the first counting step of the number n of the chord constituting tones by the counter 427, in other words, the number n of the chord constituting tones is the same or larger than the value of the pattern data ArpPT, the signal CRO has already been changed to "0" when the output of the delay flip-flop circuit 471 becomes "1" whereby the AND gate circuit 461 would not be enabled. Consequently, signal "1" is not applied to the count input T of the octave counter 463 and the value "00" of its outputs Q1, Q2 do not change (see FIG. 22).

In case that the carry signal CRO is still "1" when the first counting operation of the number n of the chord constituting tones of the counter 427 has completed (see FIG. 23), that is the number n of the chord constituting tones is smaller than the value of the pattern data ArpPT, the AND gate circuit 461 is enabled when the output of the delay flip-flop circuit 471 changes to "1", thus applying a signal "1" to the AND gate circuits 466 through 469. The AND gate circuits 466 and 468 are supplied with the inverted output Q of "1" of the flip-flop circuit 464 which shows an up count mode, whereas the AND gate circuits 467 and 469 are supplied with a signal formed by inverting the inverted output Q of the flip-flop circuit 464 with an inverter 476. To the other input of the AND gate circuit 466 is applied a signal formed by inverting with an inverter 478 the output of an AND gate circuit 477 inputted with the outputs Q1 and Q2 of the counter 463. As the outputs Q1 and Q2 of the counter 463 become the highest value "11", the output of the AND gate circuit 477 becomes "1". The outputs Q1 and Q2 of the counter 463 are also applied to an NOR gate circuit 479. When the outputs Q1 and Q2 of the counter 463 are "00", the output of the NOR gate circuit 479 becomes "1", and the output thereof is applied to one input of the AND gate circuit 469. A signal obtained by inverting the output of the NOR gate circuit 479 with an inverter 480 is applied to the AND gate circuit 467. Further the output of the AND gate circuit 477 is applied to the AND gate circuit 468. At first, since the inverted output $\overline{Q}$ of the flip-flop circuit 464 is "1" and the output of the inverter 478 is "1", the AND gate circuit 466 is enabled to give "1" to the count input T of the octave counter 463. Immediately it counts the number of "1" applied to the count input T which is formed at the build-up of the output of the delay flip-flop circuit 471 according to the pulse $\phi$B, whereby the outputs Q2 and Q1 of the counter 463 change to "01" (see FIG. 23). Consequently the values of the octave codes B3, B2 and B1 produced by the code converter 475 change to "011" (see Table IX) showing the tone range C#3 through C4, one octave above.

When the carry signal CRO changes to "0" (see FIG. 23) during the second counting operation of the number n of the chord constituting tones with the counter 427, the output of the AND gate circuit 461 becomes "0" when the next count pulse $\phi$B is produced (the note timing of A# of BT14), so that the octave counter 463 does not operate to count. Thereafter, the counts Q2 and Q1 of the counter 463 are maintained at "01". (see FIG. 23).

When the carry signal CRO is still "1" after compeletion of the second counting operation of the number n of the chord constituting tones of the counter 427, the output of the AND gate circuit 466 becomes "1" by the pulse $\phi$B produced at the beginning of the next key time (note timing of A# of BT14) and this output "1" further increases by one the count value of the octave counter 463. In this manner, until the carry signal CRO changes to "0", the octave counter 463 counts at each key time, that is each time when the number n of the chord constituting tones is added by the counter 427. Owing to the third up counting operation executed at the fourth key time (A note timing) of the block timing BT14, as the outputs Q2 and Q1 of the counter reach the maximum value "11", the AND gate circuit 468 is enabled, and one key time later (the note timing of G#) the output $\overline{Q}$ of the flip-flop circuit 464 is inverted to "0". This brings the counter 463 to the down count mode so that thereafter, its count value is decreased by one at each key time by a signal "1" sent from the AND gate circuit 467. Thereafter, when the carry signal CRO is continuously maintained at "1" and when the outputs Q2 and Q1 become "00" by the third count down operation executed in one key time of the block timing BT15 (F# note timing), the AND gate circuit 469 is enabled and one The comparator 428 supplied with the count value of the counter 427 to one input A and the arpeggio pattern input ArpPT to the other input B comprises inverters 454 through 457 which invert the count of the counter 427, a 4 bit adder 458 which adds together the output 4 bits of the inverters 454 through 457 and the 4 bit data ArpPT, and an AND gate circuit 459 inputted with all 4 bits outputs of the adder 458. A carry signal CRO generated when the content of the adder 458 overflows is utilized as a signal showing that the value of the pattern data ArpPT (B input) is larger than the count value (A input) of the couner 427. For example, when the count value (A input) of the counter 427 is "0011" and the data ArpPT is "0100" (B>A), the calculation equation is as follows.

"0011" ⟶ "1100" (invert)
+) "0100"
Carry "1" ⟵ "0000"

meaning that the carry signal CRO becomes "1". When the count value A of the counter 427 is the same or larger than the value B of data ArpPT (B A), no carry signal CRO is produced. When the count value A is equal to the value of the data ArpPT B, the outputs of the adder 458 are all "1" so that the output of the AND gate circuit 459 becomes "1". For example when the count value A of the counter 427 is "0011" and the value B of the data ArpPT is also "0011" a calculation is made as follows.

"0011" ⟶ "1100" (invert)
+) "0011"
"1111"

Thus the outputs are all "1".

The output "1" of the AND gate circuit 459 is delayed one key time by the delay flip-flop circuit 460 and applied to one input of the AND gate circuit 452 as an arpeggio pattern data coincidence signal ArpEQ.

The carry signal CRO produced by the adder 458 is applied to one input of an AND gate circuit 461, and after being delayed by one key time by a delay flip-flop circuit 462 is applied to one input of the AND gate circuit 439. For this reason, during the first key time (C note timing) of the block timing BT14 (BT14 immediately after generation of the pattern data ArpPT) in which the addition operation is done, the delay flip-flop circuit 462 outputs the state of the carry signal CRO outputted from the adder 458 during the last one key time (C# note timing) of the block timing BT13 immediately before the first key time. At the block timing BT13, the counter 427 is reset as above described, the value of the arpeggio pattern data ArpPT is larger than that of the counter 427 and the carry signal CRO is "1". Thus, during the first one key time of the block timing BT14 in which the addition operation is executed, the output of the delay flip-flop circuit 462 is always "1" so that all key-on signals KO1(n) (see FIG. 20) corresponding to the number (n) of the chord constituting tones produced in the fore half of one key time pass through the AND gate circuit 439 to be applied to the counter 427 through the OR gate circuit 440.

As above described, the counter 427 counts the number n of the chord constituting tones during the first key time of the block timing BT14. Where the value of the arpeggio pattern data ArpPT is the same or smaller than the number n of the chord constituting tones, the relation B>A would not be held in the comparator 428 at the time of firstly counting the number n (that is at any one of the fore half 11 bit times of the first key time of the block timing BT14), whereby the carry signal CRO changes to "0" (see FIG. 22). This carry signal CRO of "0" is applied to the delay flip-flop circuit 462 by the timing action of the clock pulse $\phi$A (FIG. 3) during the latter half of the same key time (i.e., the first key time of BT14) and outputted from the flip-flop circuit 462 when the clock pulse $\phi$B is generated in the next key time (the second key time of BT14, that is the note timing of B). Accordingly, when a relation B>A does not hold in the comparator 428, the signal applied to the AND gate circuit 439 from the delay flip-flop circuit 462 during the next key time becomes "0", thus blocking the key-on signal KO1(n). Thus the counting operation is stopped (see 462-Q in FIG. 22).

Where the value of the arpeggio pattern data ArpPT is larger than the number n of the chord constituting tones, the relation B>A holds in the comparator 428 (see FIG. 23) even when the counting operation of n is completed in the first key time of the block timing BT14. For this reason the carry signal CRO is still "1" so that "1" is outputted from the delay flip-flop circuit 462 in the next key time. In other words, also in the next key time (the second key time of BT14, that is the note timing of B), n key-on signals KO1 (n) pass through the AND gate circuit 439 to the counter 427, whereby the count value of the counter 427 increases by n. At the second time of counting the number n, where the relation B>A does not hold in the comparator 428, the output of the delay flip-flop circuit 462 becomes "0" in the next key time in the same manner as above described thus stopping subsequent counting operation. On the contrary, the B>A still holds in the comparator 428, the count value of the counter 427 would be increased by n in the next key time.

As above described, the number of the key-on signals KO1(n) is counted until the count A of the counter 427 becomes equal to or larger than the value B of the pattern data ArpPT at each key time. Thus the number n on of the chord constituting tones is multiplied with an integer N. When the relation B>A does not hold in the comparator 428, the relationship between the count value N.n of the counter 427 and the value of the pattern data ArpPT can be shown as follows.

$$N \cdot n \geqq ArpPT > (N-1) \cdot n$$

In the octave code forming circuit 426 simultaneously with the addition operation of the counter 427, the counting operation of an octave counter 463 is executed. The octave counter 463 is of the up/down type and an inverted output Q of a T type flip-flop circuit 464 (acting as a binary counter) is applied to the up/down control input UP of the counter 463. Like the counter 427, the output of the NAND gate circuit 444 (FIG. 21) is applied to the reset inputs R of the octave counter 463 and the T type flip-flop circuit 464. This flip-flop circuit is supplied with the two phase clock pulse $\phi$AB to take in count input T or reset input R with the pulse $\phi$A and sets and outputs them according to pulse $\phi$B. Thus, there is a delay of one key time between the input and output timings of the flip-flop circuit 464. The octave counter 463 counts the number of signals "1" applied to key time thereafter (F note timing) the output $\overline{Q}$ of the flip-flop circuit 464 inverts to "1". As above described, the octave counter 463 alternately repeats up counting and down counting until the carry signal CRO changes to "0". Such up counting and down counting are repeated because the value of the pattern data ArpPT is much larger than the number n of the chord constituting tones.

Figure 22:
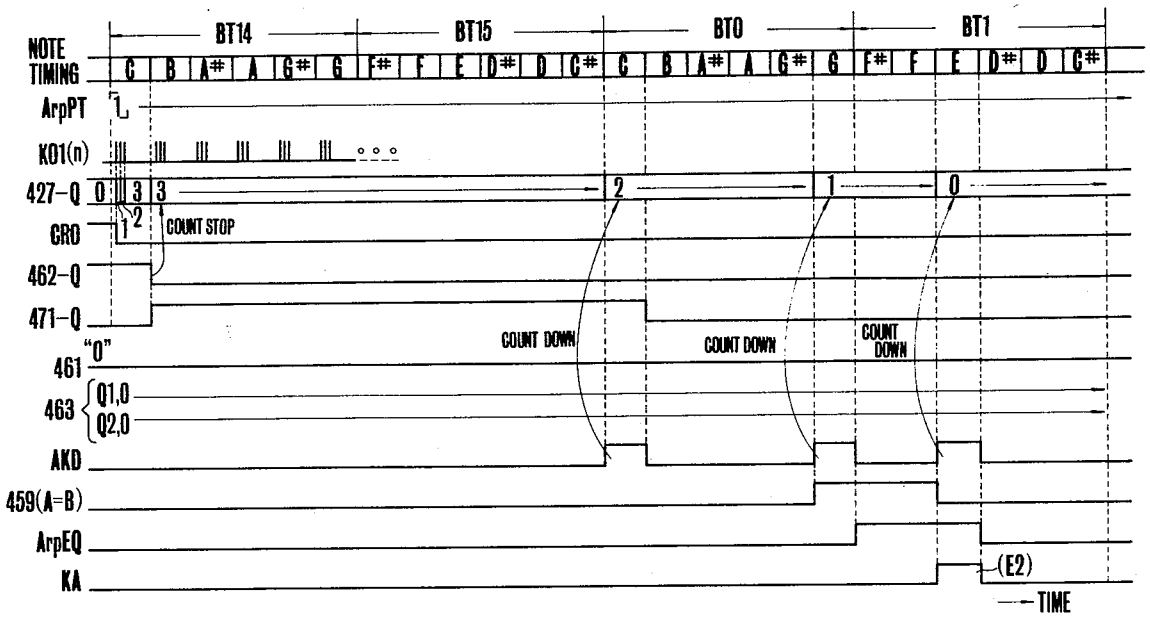
FIGS. 22 and 23 are timing charts respectively showing the operation of the arpeggio note key data forming circuit until the arpeggio key data is extracted.
Figure 23:
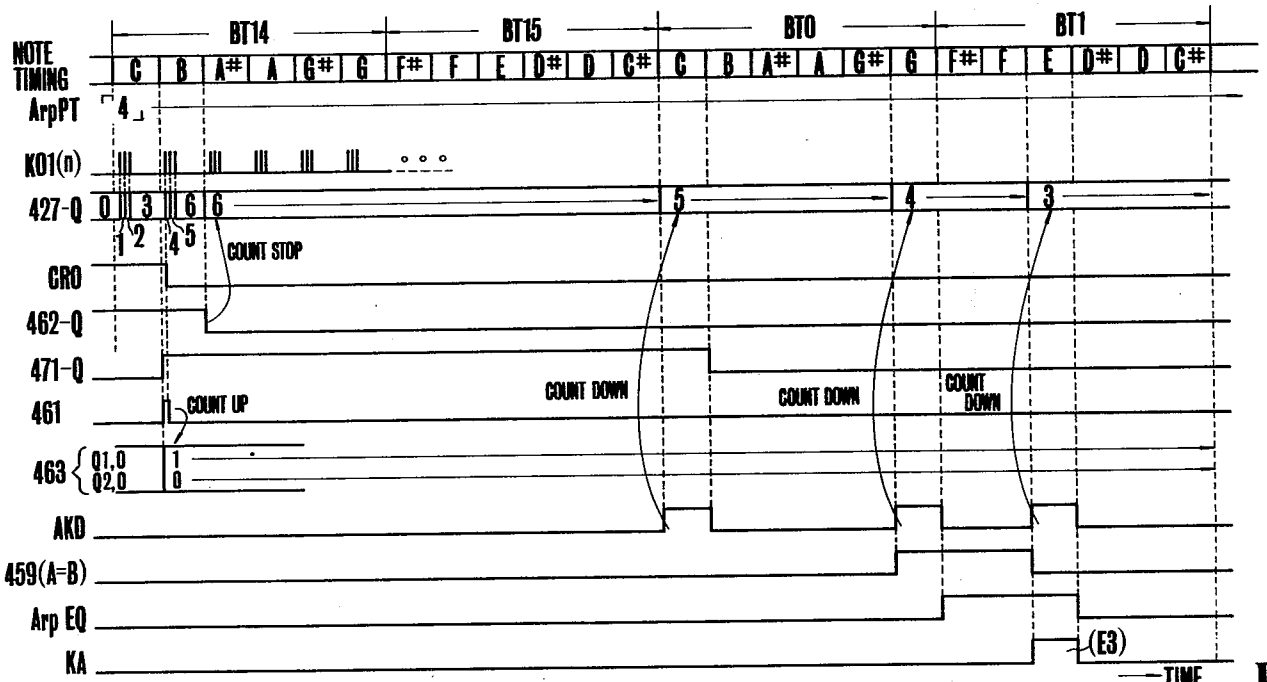
Figure 24:
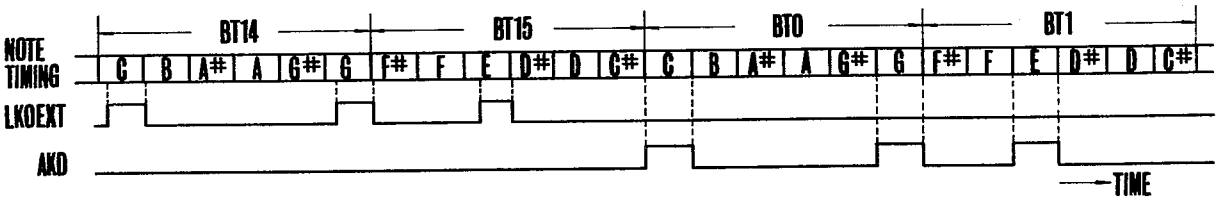
FIG. 24 is a timing chart showing one example of generation of the chord constituting key data for an arpeggio from the lower key range key data register shown in FIG. 12.

FIG. 22 and FIG. 23 are timing charts showing one example of the operations of the key data extraction circuit 424 and the octave code forming circuit 426, particularly FIG. 22 is one example of the operation when the chord constituting tones comprises 3 tones of C, E and G, and the value of the arpeggio pattern data ArpPT is "4", FIG. 24 is another example when the code constituting tones comprises 3 tones of C, E and G, and value of the arpeggio pattern data ArpPT is 4. FIGS. 22 and 23 show enlarged block timings BT14 through BT1 when the reset state of the counter 427 is released by the output "0" of the NAND gate circuit 444 as shown in FIG. 21. In this case it may be considered that the key-on signals KO1(n) corresponding to the chord constituting tones C, E and G are generated as shown in the enlarged view shown in FIG. 20. In FIGS. 22 and 23, 427-Q shows the count value of the counter 427, 462-Q the output of the delay flip-flop circuit 471, 461 the output of the AND gate circuit 461, and 463 the states of the outputs Q1 and Q2 of the octave counter 463.

In the case shown in FIG. 22, when the leading pulse of the key-on signal KO1(n) is added by the counter 427 in the first key time (C note timing) of the block timing BT14, the count value 1 of the counter 427 coincides with the value one of the pattern data ArpPT, thus changing the carry signal CRO outputted from the comparator 428 to "0". However, since the state of the delay flip-flop circuit 462 is not changed (still "1"), the counting operation of the counter 427 is continue to count the second and the third pulses of the key-on signal KO1(n) produced in the fore half interval of one key time so that the count value (427-Q) changes from "1" to "2" and then "3". At the next B note timing, the output (462-Q) of the delay flip-flop circuit 462 changes to "0". Consequently, the AND gate circuit 439 is disabled so that the key-on signal KO1(n) is blocked to terminate the counting operation. Thereafter the count value (427-Q) of the counter 427 is continuously maintained at "3".

Since the carry signal CRO has changed to "0" as a result of the first addition (at the note timing of C), when the output (471-Q) of the delay flip-flop circuit 471 changes to "1" at the next note timing of B, the AND gate circuit 461 woul not be enabled. Accordingly, the octave counter 463 does not operate and maintained reset value "00".

In the case shown in FIG. 23, even when all pulses of the key-on signal KO1(n) are counted in the first key time at the block timing BT14, the count value (427-Q) of the counter 427 remains at "3" which is smaller than the value "4" of the pattern data ArpPT. Consequently, the relation B>A still holds in the comparator 428 whereby the carry signal CRO is continuously produced. When the leading pulse of the key-on signal KO1(n) is counted by the counter 427 at the next B note timing, the count value (427-Q) of the counter 427 becomes "4" with the result that the carry signal CRO changes to "0". Since the output (471-Q) of the delay flip-flop circuit 471 has already changed to "1" several bit times before, the AND gate circuit 461 is enabled for a short time until the carry signal CRO changes to "0" (461 in FIG. 23). At this time the output of the AND gate circuit 466 becomes "1" corresponding to the output "1" of the AND gate circuit 461 as above described, and this output "1" is applied to the count input T of the octave counter 463. The output of the AND gate circuit 461 is at "1" during several bit times in the fore half period of one key time. At this time, since pulse $\phi$B is generated (see FIG. 3), the count value of the octave counter 463 is increased by one, whereby the outputs Q2 and Q1 of the counter 463 change to one.

The counter 427 continues to count the number of the generated key-on signals KO1(n) to change its count value from "4" to "5" and then to "6". At the next note timing of A#, the carry signal CRO has already been changed to "0" at the time of generating immediately preceding pulse $\phi_A$, the output 462-Q of the delay flip-flop circuit 462 becomes "0" so that the addition (counting) operation of the key-on signals KO1(n) of the counter 427 would be stopped.

While the counter 427 is adding or the octave counter 463 is counting at the block timing BT14 and BT15, the lower key range key data register 35 shown in FIG. 12 is supplied with the key data corresponding to respective note timings of the chord constituting tones. Portions corresponding to the circuit, that is the circuit elements corresponding to the ARP key data memory device 34 (FIG. 1) which receives the key data of the chord constituting tones (assigned to the lower key range channels) for the arpeggio performance comprise the lower key range key data register 35, AND gate circuit 423 and OR gate circuits 276 and 277. The AND gate circuit 423 is supplied with a signal BT14-15 representing the block timings BT14 and BT15 and the output LKOEXT of the delay flip-flop circuit 193 (FIG. 10) that stores the coincidence signal EQ regarding the lower key range channel, so that this AND gate circuit 423 selects the signal LKOEXT at the block timing BT14-15 and applies the selected signal to the lower key range key data register 35 via OR gate circuits 276 and 277. During this time a signal $\overline{\text{BT14-15}}$ formed by inverting the signal BT14-15 is "0" so that the self-holding AND gate circuit 278 is not enabled. Thus, the key data stored in the register 35 prior to the block timing BT14 (in the case of the fingered chord mode the key data of the lower key range depressed key stored for the detection of a chord, whereas in the case of the single finger mode, the key data corresponding to natural or sharp keys stored for detecting the chord type) is blocked by the AND gate circuit 278 and not fed back to the shift register 35 (that is cleared).

Among 12 note timings (C through C#) produced at the block timings BT14 and BT15, a note timing of the same note of a tone (chord constituting tone) already assigned to a lower key range channel is selected and signal "1" is inputted to the lower key range key data register 35 corresponding to its note timing. The notes corresponding to respective note timings are represented by the note codes N1 through N4 applied to the scanned key representing line 12 from the key scanner 11. To this end the comparator 25 (FIG. 9) is used for the purpose of selecting the note timings corresponding to the notes of respective chord constituting tones. Since the values of the octave codes B3, B2 and B1 applied to the scanned key representing line 12 at the block timings BT14 and BT15 are "111", it is necessary to change the values of octave codes B1 through B3 among the key codes N1 through N3 of respective channels outputted from the key code memory device 24 (FIG. 9) to "111" and to apply them to the comparator 25. Because, as the comparator 25 is required to compare only the note codes N1 through N4, it is essential to fix the values of the octave codes B1 through B3 to the same values. To this end, in the octave code converter 27 shown in FIG. 9, signal BT14-15 is applied to the OR gate circuits 163 through 165 via the OR gate circuit 431, while at the block timings BT14 and BT15, the values of the octave chords B1 through B3 are changed to "111". At this time, since the signal BT12-13 is "0", the output of the AND gate circuit 430 is "0", and the output of the inverter 433 is "1", so that the output "1" of the OR gate circuit 163 passes through the AND gate circuit 432.

The note codes N1 through N4 on the line 12 which are maintained at the same value for one key time, and the note codes (N1 through N4) from the key code memory device 24 which vary at a high speed at each channel timing are compared with comparator 25, and at a channel timing at which the codes coincide each other a coincidence signal EQ is produced. Generation of a coincidence signal EQ at a lower key range channel timing means that a tone of the same notes as that corresponding to a present note timing (the note thereof is represented by the note codes N1 through N4 on the line 12) presents in the chord constituting tones (tones assigned to the lower key range channels). The coincidence signal EQ generated at a lower key range channel timing (LchT is "1") is selected by AND gate circuit 189 (FIG. 10) and stored in the delay flip-flop circuit 193 and its output LKOEXT is maintained at "1" until the next key time begins (until S1 is generated). The operation of the circuit until this signal LKOEXT is produced is just the same as that of the example shown in FIG. 19(*b*). Although FIG. 19(*b*) shows the operation at the block timing BT12, the operation at the block timing BT14 is the same. When a key of a channel is being depressed, the AND gate circuit 183 (FIG. 10) which selects the coincidence signal EQ is applied with a key-on signal KO1 from the key-on memory device 178 via the AND gate circuit 215 and the OR gate circuit 185. Because the signal BT14-15 applied to the OR gate circuit 187 is "1".

As can be clearly understood from the foregoing description, the output LKOEXT of the delay flip-flop circuit 193 becomes "1" corresponding to the note timings of the chord constituting tones (at least during the latter half period of one key time). Where different octave same note tones are assigned to different lower key range channels respectively, only one signal LKOEXT would be produced corresponding to a single note timing. (see FIG. 19(*b*)).

For example, when it is now supposed that the chord constituting tones comprise 3 tones of C, E and G, signal LKOEXT becomes "1" corresponding to the note timings of the notes C, G and F at the block timings BT14 and Bt15, as shown in FIG. 24. Considering in detail the timing of the generation of the signal LKOEXT, it changes to "1" at an intermediate point in the fore half period of one key time and then changes to "0" at the beginning of the next key time as shown in FIG. 19(*b*). However, wherer the signal LKOEXT is stored in the register 35 shown in FIG. 12, the input signal LKOEXT is stored by the pulse $\phi_A$ (FIG. 3) generated in the latter half period of one key time, and then the memory state (the output states of respective stages) of the register 35 is set by the pulse $\phi_B$ (FIG. 3) generated in the fore half period of the next one key time so that it is only necessary that the signal LKOEXT is at a correct state in the latter half period of one key time.

The signal LKOEXT received in the lower key data register 35 via AND gate circuit 423 (FIG. 12) at the block timings BT14 and BT15, is delayed 12 key times in the register 35 and finally outputted from 12th stage Q12 at the block timings BT0 and BT1. The output Q12 of this 12th stage of this register 35 is applied to the AND gate circuit 429 shown in FIG. 18 as the chord constituting tone key data AKD. FIG. 24 shows the state of the key data AKD produced by the register 35 12 key times after based on the signal LKOEXT. The note timings are arranged in the order of tone pitches (C, B., . . . , C♯) so that a key data AKD on the high tone side is firstly produced. Also in the example shown in FIG. 22 and FIG. 23 the chord constituting tones were assumed to comprise three tones of C, E and G so that is shown the key data AKD produced in the same manner as that shown in FIG. 24.

In FIG. 18, to the other input of the AND gate circuit 429 is applied with an arpeggio timing signal AT (FIG. 21) and a signal BT0-1 (FIG. 8) representing block timings BT0 and BT1. At a time of generating an arpeggio tone (AT is "1"), the chord constituting tone key data AKD is selected by the AND gate circuit 429 at the block timings BT0 and BT1 (BT0.1 is "1"). The key data AKD selected by the AND gate circuit 429 is applied to one inputs of AND gate circuits 452 and 481.

The other input of the AND gate circuit 481 is supplied with a signal S1 (FIG. 3) via a delay flip-flop circuit 482 which delays signal S1 by one bit time according to the system clock pulses $\phi$. As a consequence, the AND gate circuit 481 produces a pulse "1" for one bit time at a time (the timing of this fore half channel "2" of one key time) immediately after the generation of the signal S1 when the key data AKD becomes "1". The output pulse of the AND gate circuit 481 is applied to the count input T of the counter 427 via the OR gate circuit 440. At the block timings BT0 and BT1, the signal BT14-15 is "0", so that the counter 427 is in the down count mode. For this reason the count value of the counter 427 is decreased by one each time a chord constituting tone key data AKD is produced.

In the example shown in FIG. 22, the addition or counting operation of the counter 427 is stopped (427-Q) when the count thereof reaches "3". When the key data AKD of the highest tone C is firstly given at the block timings BT0 and BT1, the count value of the counter 427 decreases to "2".

Since the pattern data ArpPT is "1", a relation A=B does not hold in the comparator 428, whereby the key data AKD of C is blocked by the AND gate circuit 452. Then when the key data AKD of G is given, the count of the counter 427 is further decreased to one. At this time a relation A=B holds in the comparator 428 so that the output of the AND gate circuit 459 becomes "1". (see 459 (A=B) in FIG. 22). At this time, however, since the delay flip-flop circuit 460 delays the output "0" of the AND gate circuit 459 one key time before (at the note timing of G♯) and produces this delayed signal "0" (see ArpEQ in FIG. 22), the AND gate circuit 452 is not enabled and the key data AKD produced at the note timing of G is also blocked by the AND gate circuit 452. At the next timing of F♯, the output signal ArpEQ of the delay flip-flop circuit 460 changes to "1".

For this reason, the AND gate circuit 452 is enabled upon generation of a key data AKD at the note timing of E, and the output of the AND gate circuit 452 becomes "1" corresponding to the note timing of E to obtain an arpeggio note key data KA corresponding to the note timing of E. The output of the flip-flop circuit 451 applied to the other input of the AND gate circuit 452 is "1" when the counter 427 executes addition and subtraction operations, as shown by 451-Q in FIG. 21. On the other hand, the count value of the counter 427 is further decreased by one according to the key data AKD of E to reach zero.

As a consequence the relation A=B would not be held for the comparator 428 and the signal ArpEQ changes to "0" at the next note timing of D#. Consequently, even when key data AKD are produced thereafter (although not produced in the example shown in FIG. 22, all of such key data are blocked by the AND gate circuit 452.

As above described, among a plurality of chord constituting tone key data AKD, only a single key data KA corresponding to a pitch order designated by an arpeggio pattern key data ArpPT is extracted. In the example shown in FIG. 22, since the pattern data ArpPT is "1", among the chord constituting tones (C, G, E) an arpeggio key data KA would be produced at the note timing of E corresponding to the first tone on the low tone side, that is the lowest tone.

The arpeggio note key data KA is applied to one input of an AND gate circuit 483, in the octave forming circuit 426, the other input of the AND gate circuit 483 being supplied with an arpeggio channel timing signal AchT (FIG. 6) from the timing signal generator 20 (FIG. 2), and the output of the AND gate circuit 486 is applied to one inputs of AND gate circuits 484 through 486, the other inputs thereof being supplied with octave codes B1 through B3 from the code converter 475. Thus, as an arpeggio note key data KA of "1" is produced, octave key data B1 through B3 are selected at an arpeggio channel timing (AchT is "1") and outputted as the octave codes B1″through B3″ of the arpeggio tone. In the case shown in FIG. 22, since the outputs of the stages Q1 and Q2 of the octave counter 463 are "00", octave codes B″through B1′ of values "100" representing the tone range C#2 through C3 are produced, so that an arpeggio note in this case is E2.

In the example shown in FIG. 23, when the count value of the counter 427 is "6", the addition operation is stopped. Accordingly, at the block timings BT0 and BT1, after the count vlue has been respectively decreased by one according to the chord constituting tone key data AKD of C and G, the count value becomes "4" and the output of the AND gate circuit 459 (459(A=B) in FIG. 23) becomes "1". One key time after, the signal ArpEQ becomes "1" and the AND gate circuit 452 becomes "1" when the next code constituting tone key data AKD of E is produced. Accordingly in the same as in the example shown in FIG. 22, an arpeggio note key data KA is produced at the note timing of E. In the example shown in FIG. 23, however, as the outputs Q2 and Q1 of the octave counter 463 are "01", the values of the octave codes B3″, B2″ and B1″ are "011" which show the tone range of C#3 through C4. Hence the arpeggio note produced in this example is E3.

This arpeggio note key data KA is applied to one input of the AND gate circuit 173 (FIG. 10) of the tone production assignment controller 19, the other input of this AND gate circuit 173 being supplied with an arpeggio channel timing signal AchT, and a latter half period signal H2. As above described, when the arpeggio note key data KA becomes "1" at the note timing of a tone to be produced as an arpeggio tone, the AND gate circuit 173 is enabled at a single arpeggio channel timing (see AchT in FIG. 6) in the latter half period (H2 is "1") of that one key time for producing a single load signal LD via the OR gate circuit 174. In response to the load signal LD, the key code memory device 24 (FIG. 9) stores the note codes N1 through N4 from the line 12 (which show a note of the present note timing at which the key data KA are being produced) and the octave codes B1″ through B3″ from the octave code conveter 26 correspondingly to an arpeggio channel. At this time, the arpeggio note octave codes B1″ through B3″ supplied from the octave code forming circuit 426 are respectively applied to OR gate circuits 400 through 402 of the octave code converter 26. The AND gate circuit 487 supplied with a lower key range any key-on signal LKAKO, an arpeggio channel timing signal AchT, and an arpeggio timing signal AT sent from the arpeggio note key data forming circuit 44 produces an output "1" at an arpeggio channel timing (AchT is "1") so long as any key is being depressed in the lower key range and the timing is an arpeggio tone production timing (LKAKO and AT are "1"), and the output "1" of the AND gate circuit 487 enables AND gate circuits 403 through 405 via the OR gate circuit 156. Consequently, the octave codes B1″ through B3″ of an arpeggio note are selected via AND gate circuits 403 through 405 and applied to the key code memory device 24.

Then a key-on signal KO1 is stored (KO1 is "1") in the key-on memory device 178 correspondingly to the arpeggio channel in response to a load signal LD produced at an arpeggio channel timing. Also in the current key-on memory device 177 is stored a signal "1" corresponding to an arpeggio channel but the signal "1" is cleared by the output of the AND gate circuit 196 when a coincidence signal EQ is produced next time. For this reason the current key-on memory device 177 is not utilized for the tone production assignment of an arpeggio tone. The key-on signal KO1 stored in an arpeggio channel is held by the action of an AND gate circuit 488. Similar to the AND gate circuit 487 shown in FIG. 9, the AND gate circuit 488 is supplied with a lower key range any key-on signal LKAKO, an arpeggio timing signal AT and an arpeggio channel timing signal AchT. Accordingly, when the tone production timing of an arpeggio tone is terminated, signal AT becomes "0" so that the key-on signal KO1 of an arpeggio channel which has been held up to that time would be cleared. Further, even when the signal AT is being produced, the signal LKAKO becomes "0" when all keys in the lower key range are released thus clearing the key-on signal KO1 of the arpeggio channel.

At the block timings BT14 and BT15 at which the arpeggio note key data KA is produced, as above described, the octave code converter 27 (FIG. 9) changes the octave codes B1 through B3 of key codes N1 through B3 in respective channels for the purpose of utilizing the output EQ of the comparator 25 for the arpegio processing. To this end a coincidence signal EQ is produced independently of a key data actually produced by the key scanner 11. As above described, this coincidence signal EQ is also utilized by the AND gate circuit 196 (FIG. 10) for clearing the current key-on memory evice 177. Thus, by cleaning the current key-on memory device 177 by a coincidence signal EQ generated at the block timings BT14 and BT15, in order not to release the assignment for the upper and lower key range channels, signal "1" is applied to the OR gate circuit 198 via the OR gate circuit 201 shown in FIG. 10 at the block timings BT14 and BT15 (BT14-15 is "1") so as to make "0" the signal applied to the AND gate circuit 196 from the inverter 197 (in other words a quasi-key-on state is established). As, in the fingered chord mode, above described functions also occur at the block timings BT12 and BT13 (see AND gate circuit 430 shown in FIG. 9), in the fingered chord mode (FC is "1") "1" is inputted to the OR gate circuit 201 via the AND gate circuit 203 shown in FIG. 10 also during an interval between the block timings BT12 and BT13 (BT12-13 is "1").

Multiplexing Circuit 28

The multiplexer 28 shown in FIG. 9 is supplied with key codes (note codes N1 through N4 and octave codes B1 through B3) supplied from the key code memory device 24 on the time division basis at respective channel timings (see FIG. 6), key-on signal KO1 produced by the key-on memory device 178 (FIG. 10) on the time division basis at respective channel timings, an automatic bass/chord mode signal ABC (see FIG. 5) supplied from the mode changing controller 15 (FIG. 4), a lower key range any key-on signal LKAKO sent from the lower key range any key-on memory device 39 (FIG. 14), a signal S1 (FIG. 3) sent from the timing signal generator 20 (FIG. 2), a lower key range channel timing signal LchT, a scanning cycle pulse 4.5 M sent from the key scanner 11 (FIG. 7), a chord production timing pattern pulse CT and a rhythm stop signal RSTP which are supplied from the automatic rhythm device 45 (FIG. 1). A signal formed by inverting the lower key range channel timing signal LchT with an inverter 495 is applied to one input of an AND gate circuit 489, so that key-on signals KO1 of the channels other than the lower key range channels pass through the AND gate circuit 489 as they are and then applied to an AND gate circuit 494 via an OR gate circuit 490.

In the case of the normal mode (the automatic bass/chord performance is not made), all channels belong to the upper key range so that no signal LchT is produced. Thus, the key-on signals KO1 of all channels pass through the AND gate circuit 489 as they are. On the other hand, the key-on signals KO1 regarding the lower key range channels are gated by the chord production timing pattern pulse CT to be changed into key-on signals KO1′ which become "1" only when the pattern pulse CT is generated. When the automatic bass/chord mode (ABC is "1") and when the automatic rythm is stopped (RSTP is "1"), a normal gate signal NG is generated.

Figures 25, 27:
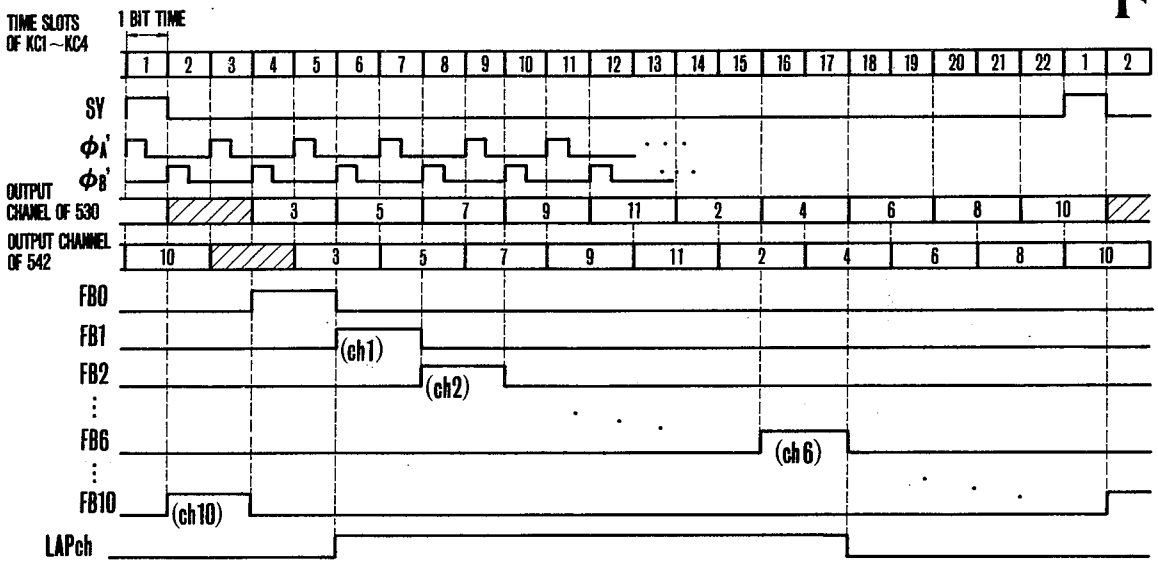
FIG. 25 is a chart showing one example of the states of the multiplex key codes outputted from the multiplexer shown in FIG. 9 for each time division time slot.
FIG. 27 is a timing chart showing one example of the output signals produced by various elements shown in FIG. 26.

The multiplexer 28 functions to multiplex, on the time division basis, into 4 bit data KC1 through KC4 shown in FIG. 25, the note codes N1 through N4 and, octave codes B1 through B3 and key-on signals KO1 (KO1′) of the tones assigned to respective channels, the normal gate signal NG, the automatic bass/chord mode signal ABC and the scanning cycle pulse 4.5 M. Data KC1 through KC4 are time division multiplex data in which one cycle is made up of 22 time slots, and in the column of time slot shown in FIG. 25, numbers "1" to "22" are assigned in the order of generation of the time slots. The width of one time slot corresponds to one bit time of a system clock pulse $\phi$. Thus one repetition cycle of the data KC1 through KC4 corresponds to one key time (22 bit times). In the channel column shown in FIG. 25 are shown time division channels "1" through "11" (respective channel timings of the tone production assignment circuit 18 and of the key code memory device 24). For example, channel of the time slots "3" and "4" is channel "3". This shows that the key codes N1 through N3 and the key-on signals KO1 (KO1′) assigned to the channel "3" are sent out as the data KC1 through KC4. Symbols, U, L, P and A shown in the column of the key range in FIG. 25 show that, in the case of the automatic bass/chord mode, whether respective channels "1" through "11" correspond to the upper key range channels (U), lower key channels (L), bass channels (P) or arpeggio channels A. In the normal mode all channels are changed to (U), that is the upper key range channels as has been described above.

In the time slot "1" of the channel "1" not corresponding to an actually tone production channel, the data KC1 through KC4 are all "1". This is made for the purpose of showing a reference timing that is the time slot "1" of the data KC1 through KC4. Control signals NG, ABC and 4.5 M are sent to the time slot "2" as the data KC1, KC2 and KC3. In the time slots "3" through "22" corresponding to the tone production channels, two time slots are assigned to each channel, and in the time slots "3", "5", . . . , "21" octave codes B1 through B3 and key-on signals KO1 (KO1′) are sent out as the data KC1 through KC4, and in the next time slots "4", "6", . . . , "22" note codes N1 through N4 are sent out as the data KC1 through KC4. Although in FIG. 25 data KC1 through KC4 are shown on the assumption that all 10 tone production channels are utilized (when $\overline{10}/7$ is "0"), in the 7 channel mode ($\overline{10}/7$ is "1") there are time slots not sending out data N1 through B3, KO1.

In the multiplexer circuit 28 shown in FIG. 9, an AND gate circuit 496 is supplied with the output of an OR gate circuit 497 supplied with the chord production timing pattern pulse CT and the rhythm stop signal RSTP, a lower key range any key-on signal LKAKO and a lower key range channel timing signal LchT, and the output of the AND gate circuit 496 is supplied to one input of an AND gate circuit 498. When the automatic rythm is running, a pattern pulse CT is intermittently produced according to the chord production pattern so that the rythm stop signal RSTP is always "0". Accordingly, when the automatic rythm is running (capable of generating a pattern pulse CT), among the key-on signals KO1 applied to the other input of the AND gate circuit 498, the signal KO1 regarding a lower key range channel (which is generated when LchT is "1") is selected by the AND gate circuit 498 only when a pattern pulse CT is being generated that is only at a predetermined chord production timing and then applied to one input of the AND gate circuit 494 via the OR gate circuit 490 as a key-on signal KO1′. The tones (chord constituting tones) assigned to lower key range channels according to this key-on signal KO1′ are simultaneously and intermittently produced as a musical tone (that is, the rhythmic chord performance automatically is performed). When the automatic rhythm is stopped, pattern pulse CT is not produced. Instead, the rhythm stop signal RSTP is continuously maintained at "1", so that the lower key range key-on signal KO1 passes through the AND gate circuit 498 without being interrupted.

When the automatic bass/chord mode (signal ABC is "1"), when the automatic rythm is stopped (signal RSTP is "1") and when any key is being depressed in the lower key range (signal LKAKO is "1"), an AND gate circuit 499 is enabled, a signal "1" is applied to a delay flip-flop circuit 501 via an OR gate circuit 500 and this signal "1" is self-held through an AND gate circuit 502. The output "1" of the delay flip-flop circuit 501 is applied to one input of an AND gate circuit 503 as a normal gate signal NG which is used to control the tone production of the automatic performance tones (chord, bass and arpeggio tones) when the automatic rhythm stops. When all keys in the lower key range are released (LKAKO is "0") or changed to the normal mode (ABC is "0"), the AND gate circuit 502 is disabled to remove the normal gate signal NG.

When a signal S1 (see FIG. 3) is produced at the beginning of one key time, signal "1" is applied to OR gate circuits 507 through 510 via OR gate circuits 504 through 506 and the data KC1 through KC4 produced by the OR gate circuits 507 through 510 become all "1". This time is the reference timing, that is the time slot "1" shown in FIG. 25. In the next time slot "2", the output of a delay flip-flop circuit 511 that delay the signal S1 by one bit time becomes "1", and a normal gate signal NG, an automatic bass chord mode signal ABC and a scanning cycle pulse 4.5 M are selected through AND gate circuits 503, 512 and 513, and then respectively supplied to the OR gate circuits 507 through 509 via the OR gate circuits 504 through 506. Thus signals NG, ABC and 4.5 M are sent out as the data KC1, KC2 and KC3 as shown in FIG. 25.

The signal S1 is also applied to a delay flip-flop circuit 515 via an OR gate circuit 514. The output of the delay flip-flop circuit 515 is applied to one inputs of AND gate circuits 517 through 520 and after being inverted by an inverter 516 fed back to the OR gate circuit 514. The output of the OR gate circuit 514 is applied to one inputs of AND gate circuits 491 through 494, the other inputs thereof being supplied with the octave codes B1 through B3 of respective channels which are outputted from the key code memory device 24 on the time division basis. The other input of the AND gate circuit 494 is supplied with the key-on signals KO1 (KO1' in the lower key range channel) via OR gate circuit 490 on the time division basis. One inputs of the AND gate circuits 517 through 520 are supplied with a signal obtained by delaying one bit time the note codes N1 through N4 of respective channels outputted, on the time division basis, from the key code memory device 24 with delay flip-flop circuits 521 through 524. The outputs of the AND gate circuits 517 through 520 and 491 through 494 are applied to OR gate circuits 507 through 510 respectively through OR gate circuits 525 through 528 to be outputted as data KC1 through KC4.

When the signal S1 is produced (in time slot "1"), the AND gate circuits 491 through 494 are enabled by the output "1" of the OR gate circuit 514. Since, this time is the timing of the not used channel "1", the signals B1 through B3 and KO1 are all "0". One bit time later (in time slot "2"), the output of the delay flip-flop circuit 515 becomes "1" so that the AND gate circuits 517 through 520 are enabled. The note codes N1 through N4 corresponding to not used channel "1" (that is data of all "0") are delayed one bit time and then outputted from the delay flip-flop circuits 521 through 524. Accordingly, no effect is applied to the sending out of the signals NG, ABC and 4.5 M from the time slot "2". Furthermore, at this time slot "2" is given to the OR gate circuit 514 a signal "0" obtained by inverting the output "1" of the delay flip-flop circuit 515 with the inverter 516 thus disabling the AND gate circuits 491 through 494. Consequently, the octave codes B1 through B3 and key-on signal KO1 of the channel "2" (FIG. 6) applied to one inputs of the AND gate circuits 491 through 494 are not selected. The output "0" of the OR gate circuit 514 is delayed and outputted from the delay flip-flop circuit 515 in the next time slot "3".

When the time slot is "3", a signal "0" outputted from the delay flip-flop circuit 515 is inverted with an inverter 516 whereby the output of the OR gate circuit 514 becomes "1". As a consequence, the octave codes B1 through B3 and the key-on signal KO1 (KO1') of the channel "3" (FIG. 6) applied to AND gate circuits 491 through 494 are outputted as data KC1 through KC4 as shown in FIG. 25.

In the next time slot "4", the output of the delay flip-flop circuit 515 becomes "1" and the output of the OR gate circuit 514 becomes "0". Accordingly, the note codes N1 through N4 of the channel "3" delayed one bit time by the delay flip-flop circuits 521 through 524 are outputted as key data KC1 through KC4 as shown in FIG. 25. At this time, since the AND gate circuits 491 through 494 are not enabled, the octave codes B1 through B3 and the key-on signal KO1 of the channel "4" are blocked.

In this manner, the outputs of the OR gate circuit 514 and the delay flip-flop circuit 515 alternately become "1" so that the octave codes B1 through B3 and, the key-on signal KO1 (KO1') and the note codes N1 through N4 of the same channel are sequentially selected and outputted as key data KC1 through KC4 at alternate channels. Since 11 (odd number) channel times cycles twice in one key time, the octave codes B1 through B3, key-on signal KO1 (KO1') and note codes of N1 through N4 the odd numbered channels "1", "3", "5", "7", "9" and "11" are selected in the fore half period of one key time, whereas in the latter half period, the octave codes B1 through B3, the note codes N1 through N4 and key-on signal KO1(KO1') of the even numbered channels "2", "4", "6", "8" and "10" are selected. Thus as shown in FIG. 25 the key codes N1 through N4, B1 through B3 and key-on signals KO1 (KO1') of respective channels are multiplexed to obtain data KC1 through KC4. Although in FIG. 25, a portion of the key codes N1 through N4, B1 through B4 and key-on signals KO1(KO1') is not shown, B1 through B3 and KO1 (or KO1') are sent out in the first time slots and N1 through N4 are sent out in the next time slot.

Demodulation of Multiplexed Data and Musical Tone Production

Figure 26:
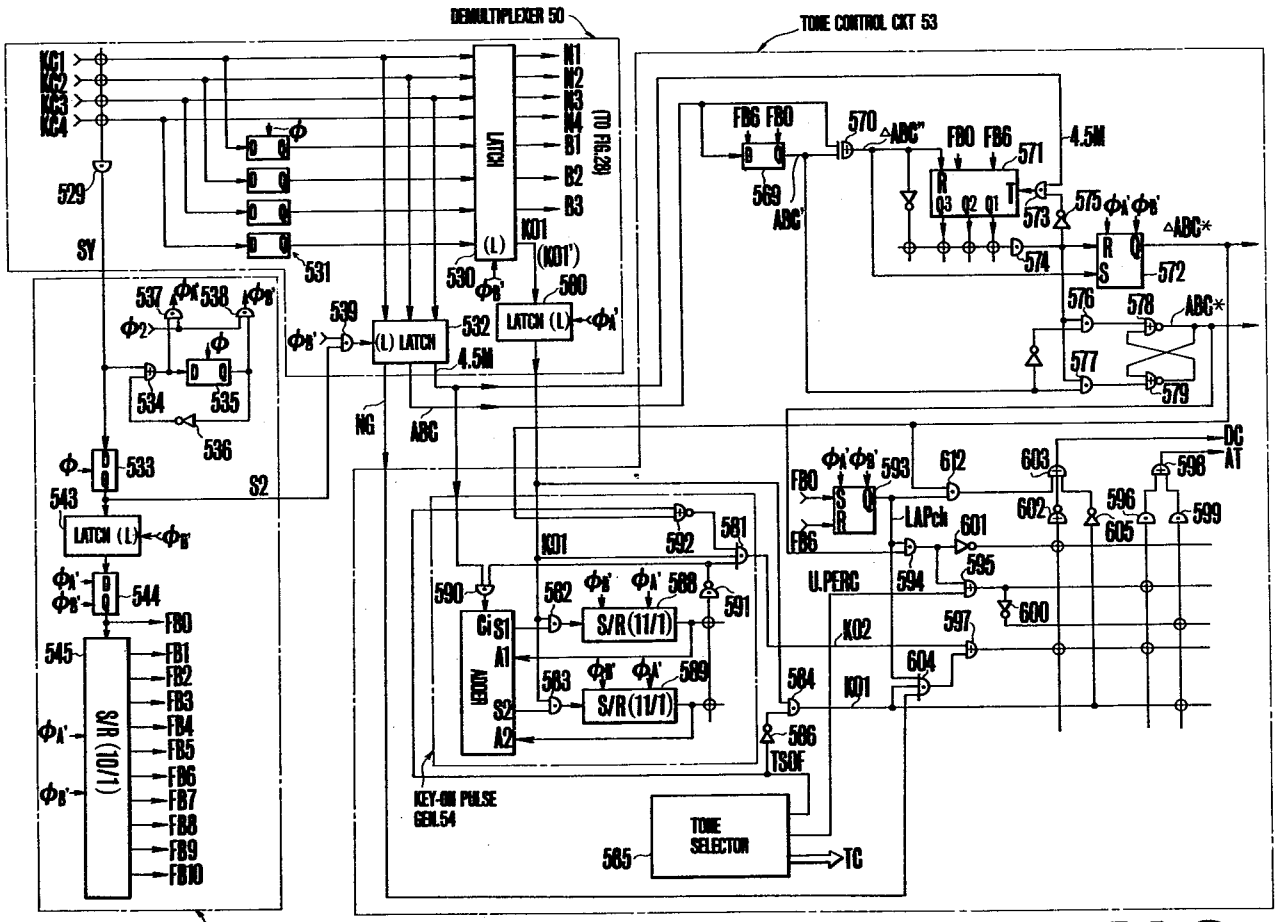
FIG. 26 is a connection diagram showing the detail of the demodulator, timing signal generator and musical tone control circuit shown in FIG. 1.

The detail of the demultiplexer 50, timing signal generator 52 and musical tone control circuit 53 is shown in FIG. 26. In FIG. 26, the data KC1 through KC4 supplied from the multiplexer 28 shown in FIG. 9 are applied to a latch circuit 530 of the demultiplexer 50 and are delayed by one bit time by a delay flip-flop group 531 and then applied to the other inputs of the latch circuit 530. This latch circuit 530 is provided for the purpose of latching the note codes N1 through N4, the octave codes B1 through B3 and the key-on signal KO1 (KO1') and has 8 latch positions corresponding thereto. The data KC1, KC2 and KC3 are also applied to another latch circuit 532 which latches signals NG, ABC and 4.5 M. In the demultiplexer 50, all bits of the data KC1 through KC4 are inputted to an AND gate circuit 529.

When data KC1 through KC4 all become "1" in the time slot "1" shown in FIG. 25, the output of the AND gate circuit 529 becomes "1" which is applied to one input of an OR gate circuit 534 and a delay flip-flop circuit 533 of the timing signal generator 52 to act as a reference signal SY showing the time slot "1". The output of the OR gate circuit 534 is applied to a delay flip-flop circuit 535 and its output is fed back to the other input of the OR gate circuit 534 after being inverted by an inverter 536. Thus, similar to the OR gate circuit 514 and the delay flip-flop circuit 515 of the multiplexer 28 shown in FIG. 9, the OR gate circuit 534 and the delay flip-flop circuit 535 alternately produce "1" at each one bit time. The output of the OR gate circuit 534 is applied to one input of an AND gate circuit 537, while the output of the delay flip-flop circuit 535 is applied to one input of an AND gate circuit 538. The other inputs of the AND gate circuits 537 and 538 are supplied with a clock pulse $\phi 2$ (one of the two phase system clock pulse $\phi$ as shown in FIG. 3) which is generated in the fore half period of one bit time. As a consequence the AND gate circuits 537 and 538 produce clock pulses $\phi A'$ and $\phi B'$ as shown in FIG. 27 which also shows the time slots "1" to "22" (see FIG. 25) of the data KC1 through KC4 and the reference pulse SY.

The delay flip-flop circuit 533 produces a pulse S2 formed by delaying one bit time the reference pulse SY. The pulse S2 corresponds to the time slot "2" of data KC1 through KC4 and is supplied to one input of an AND gate circuit 539 with its other inputs connected to receive a clock pulse $\phi B$ produced by the AND gate circuit 538. As a consequence the output of the AND gate circuit 539 becomes "1" in the fore half of the time slot "1" and this output is applied to the control input L of the latch circuit 532. Thus the normal gate signal NG, automatic bass/chord mode signal ABC and the scanning cycle pulse 4.5 M sent out at the time slot 2 as data KC1 through KC3 are latched by the latch circuit 532.

The clock pulse $\phi B'$ produced by the AND gate circuit 538 is applied to the control input L of the latch circuit 530, so that it receives and latches the input data at each one of the even numbered time slots "2", "4", "6", . . . , "22". The data NG, ABC, 4.5 M etc. latched at the time of the time slot "2" have no meaning to the latch circuit 530 so that they are not used and are erased at the next latch timing (time slot "4"). By latching the data at each one of the even numbered time slots "4", "6" . . . "22", the note codes N1 through N4 sent out at that time as the data KC1 through KC4, the octave codes B1 through B3 and the key-on signal KO1(KO1') which are delayed by the delay flip-flop group 531 of the same channel as the channel one slot time before are simultaneously latched by the latch circuit 530. Since the content of the latch circuit 530 is renewed at every 2 bit times, the time width of the data N1 through N4, B1 through B3 and KO1(KO1') of the same channel which are outputted from the latch circuit 530 is two bit times. The channels of the data N1 through N4, B1 through B3 and KO1 (KO1') outputted from the latch circuit 530 are shown at 530 in FIG. 27.

Figure 28:
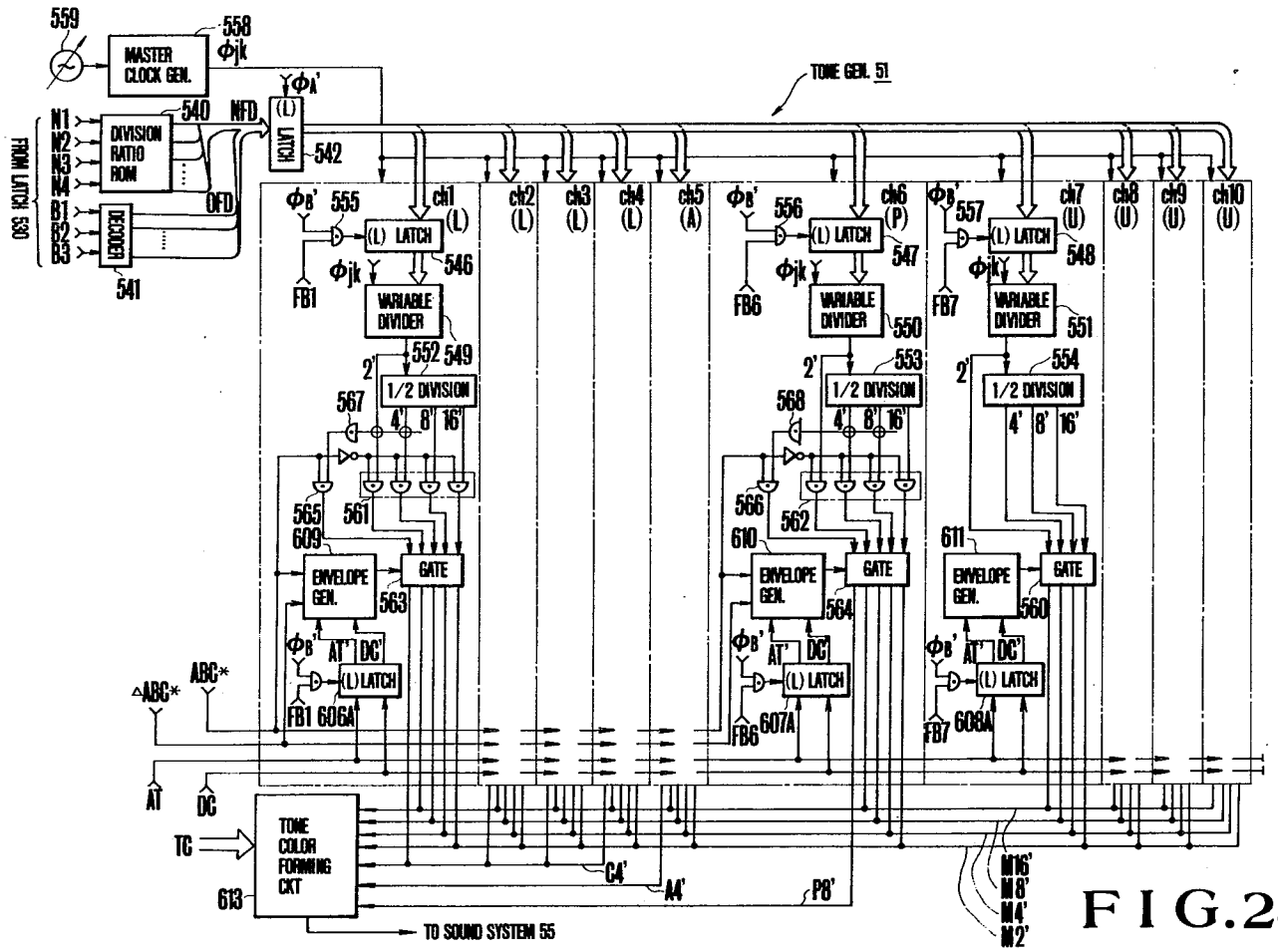
FIG. 28 is a block diagram showing one example of the tone signal generator shown in FIG. 1.

The note codes N1 through N4 and the octave codes B1 through B3 outputted from the latch circuit 530 are supplied to a frequency division ratio ROM 540 (that is a read only memory device), and a decoder 541 in the musical tone signal generator 51 shown in FIG. 28. The frequency division ratio ROM 540 prestores a frequency division ratio data necessary to obtain a predetermined tone pitch frequency corresponding to respective ones of 12 notes C through C# for producing a predetermined frequency division data (note frequency division ratio data NFD) according to the notes shown by note codes N1 through N4 supplied from the latch circuit 530 shown in FIG. 26. The decoder 541 decodes the values of the octave code B1 through B3 supplied from the latch circuit 530 to obtain octave frequency division ratio data OFD representing the frequency division ratio of an octave unit, that is the frequency division ratio $2^n$. The note frequency ratio data NFD and the octave frequency ratio data OFD respectively outputted from the frequency division ratio ROM 540 and the decoder 541 are applied to a latch circuit 542, the control input L thereof being supplied with the clock pulse $\phi_A$ (see FIG. 27) outputted from the AND gate circuit 537 shown in FIG. 26.

Consequently, the channels of the note frequency division ratio data and the octave frequency division ratio data produced by the latch circuit 542 are shown in FIG. 27.

In the timing signal generator 52 shown in FIG. 26 a signal "1" outputted from the delay flip-flop circuit 533 at the time slot "2" is applied to a latch circuit 543. The clock pulse $\phi B'$ is applied to the latch control input L of the latch circuit 543 and the data "1" received at the time slot "2" is held and outputted for 2 bit times of time slots "2" and "3" until a time immediately before the time slot "4". The output of the latch circuit 543 is delayed by 2 bit times by a delay flip-flop circuit 544, the output FBO thereof becoming "1" at time slots "4" and "5" as shown in FIG. 27. The delay flip-flop circuit 544 is driven by the clock pulses $\phi A'$ and $\phi B'$ respectively produced by the AND gate circuits 537 and 538. Thus, the input signal received by the timing action of the clock pulse $\phi_A'$ is set as the output state by the timing action of the clock pulses $\phi B'$, thus delaying 2 bit times corresponding to the periods of the clock pulses $\phi A'$ and $\phi B'$.

The output FBO of the delay flip-flop circuit 544 is applied to a shift register 545 of the 10 stage/one bit type to be sequentially delayed by 2 bit times according to the 2 phase clock pulses $\phi A'$ and $\phi B'$. Respective stages of the shift register 545 sequentially produce pulses FB1 through FB10, each having 2 bit time width as shown in FIG. 27. These pulses are applied to the musical tone signal generator 51 shown in FIG. 28 for distributing among respective channels the frequency division ratio data supplied from the latch circuit 542, on the time division basis, as shown in FIG. 27.

The musical tone signal generator 51 shown in FIG. 28 comprises 10 musical tone signal generating systems ch1 through ch10 respectively corresponding to time division channels "2" through "11" formed by the tone production assignment circuit 18. The musical tone signal generating systems ch1 through ch6 respectively correspond to time divisioned channels "3", "5", "7", "9", "11" and "2" and also correspond to the lower key range channel L, arpeggio channel A and bass channel P (that is the tone production channel group in the second musical tone production manner), in the case of the automatic bass/chord mode (ABC is "1") (see FIGS. 6 and 25). The musical tone signal generating systems ch7, ch8, ch9 and ch10 respectively correspond to time divisioned channels "4", "6", "8" and "10" and further correspond to the upper key range channel U (that is the tone production channel group for the first musical tone production manner) (see FIGS. 6 and 25). Of course, in the case of the normal mode (ABC is "0"), all musical tone signal generating systems ch1 through ch10 are switched to the upper key range channel U, that is the channel group for the first musical tone production manner (see FIG. 6) respectively correspond to time divisioned channels "3", "5", "7", "9", "11" and "2" and also correspond to the lower key range channel L, arpeggio channel A and bass channel P (that is the tone production channel group in the second musical tone production manner), in the case of the automatic bass/chord mode (ABC is "1") (see FIGS. 6 and 25). The musical tone signal generating systems ch7, ch8, ch9 and ch10 respectively correspond to time divisioned channels "4", "6", "8" and "10" and further correspond to the upper key range channel U(that is the tone production channel group for the first musical tone production manner) (see FIGS. 6 and 25). Of course, in the case of the normal mode (ABC is "0"), all musical tone signal generating systems ch1 through ch10 are switched to the upper key range channel U, that is the channel group for the first musical tone production manner (see FIG. 6).

Although the musical tone signal generating systems ch1, ch6 and ch7 are shown in detail, their construction is the same construction of ch1 as systems ch2 through ch4 for the lower key range channel, and system ch5 and ch1 for the arpeggio channel. The systems ch8 through ch10 for the upper key range channel have the same construction as that of the system ch7. Although the musical tone signal generator system ch6 for the bass channel have substantially the same construction as the system ch1 for the lower key range channel, the number of feet of a signal derived out as a bass tone source is different from that of the lower key range tone (chord tone).

Each of the musical tone signal generation systems ch1 through ch10 comprises one of the latch circuits 546, 547, 548 . . . , variable frequency dividers 549, 550, 551 . . . , three stage ½ frequency dividers 552, 553, 554 . . . .

The latch circuits 546, 547, 548 . . . of respective systems ch1 through ch16 are supplied with frequency division ratio data (NFD, OFD) outputted from the latch circuit 542 on the time division basis, AND gate circuits 555, 556, 557 . . . of respective systems ch1 through ch10 are independenty supplied with pulses FB1 through FB10 produced by the shift register 545 (FIG. 26) and commonly supplied with the clock pulse $\phi$B′ (see FIG. 27). The outputs of the AND gate circuits 555, 556, 557 . . . are respectively applied to the latch control inputs L of the latch circuits 546, 547 and 548.

Thus, in the musical tone signal generating system ch1, the AND gate circuit 555 is enabled when both pulse FB1 and the clock pulse $\phi$B′ become "1" and the frequency division ratio data of the time division channel "3" outputted from the latch circuit 542 at that time is latched in the latch circuit 546 (see FIG. 27). In the same manner, in the system ch2, the frequency division ratio data for the time division channel "5" is latched, in the system ch3 the data for the channel "7", in the system ch4, the data for the channel 9, in the system ch5, the data for the channel "11" (that is the arpeggio channel A), in the system ch6, the data for the channel "2" (that is the bass channel P), and in the systems ch7, ch8, ch9, ch10, the frequency division data of the channels "4", "6", "8", and "10" (that is the upper key range channel U) are respectively latched. In this manner, the time division frequency division ratio data according to the key codes, N1 through B3 of respective time division channels are distributed among predetermined musical tone signal generating systems ch1 through ch10 corresponding to respective time division channels and converted into direct currents.

The variable frequency dividers 549, 550, 551 . . . divide the frequency of the tone source clock pulse $\phi$jk at ratios corresponding to the frequency division ratio data supplied from the latch circuits 546, 547, 548 . . . respectively so as to produce a 2 feet type (2′) tone source signal corresponding to the pitch of a tone assigned to a given channel. The tone source clock pulse $\phi$jk is produced by a tone source master clock oscillator 558. The frequency of the tone source clock pulse $\phi$jk can be periodically varied in accordance with the vibrato frequency generated by a vibrato signal generator 559.

The frequencies of 2 feet type tone source signals (2′) outputted from the variable frequency dividers 549, 550, 551 . . . are sequentially reduced to ½ by 3 stage ½ frequency dividers 552, 553, 554 . . . . Consequently, respective stages of the frequency dividers 552, 553, 554 . . . produces tone source signals of 4 feet type (4′), 8 feet type (8′) and 16 feet type (16′) respectively. In the musical tone signal generating systems ch7 through ch10 exclusively used for the upper key range channel (exclusively used for the first musical tone production manner), the tone source signals of respective feet (2′, 4′, 8′, 16′) are controlled by switch circuits 563, 564 . . . and then respectively supplied to melody tone source signal M2′, M4′, M8′ and M16′ for respective feet types. In the musical tone signal generating systems ch1 through ch6 in which musical tone production manners are selectively used, the tone source signals of respective feet types 2′, 4′, 8′, 16′, are applied to switch circuits 563, 564 . . . via gate circuits 561, 562 . . . each comprising 4 AND gate circuits, and after being controlled by the switch circuits 563, 564 . . . are applied to respective melody tone source signal lines M2′, M4′, M8′ and M16′ respectively of different feet type. The gate circuits 561, 562 . . . are enabled by the musical tone signal controller 53 (FIG. 26) when the automatic bass/chord mode signal ABC* is "0", that is in the normal mode as will be described later for feeding the tone source signals of respective feet types (2′to 16′) to the switch circuits 563, 564 . . . In this case, the musical tone signal generating systems ch1 through ch6 are used for producing the upper key range channel tone, that is the melody tone so that melody tone signals are applied to the melody tone source signal lines M2′ through M16′.

In the automatic bass/chord mode (ABC* is "1"), the gate circuits 561, 562 . . . are disabled by a signal obtained by inverting ABC* to block the tone source signals 2′ through 16′ of respective feet types, whereby no source tone signal from the systems ch1 through ch6 is not applied to the melody tone source signal lines M2′ through M16′. But instead, the AND gate circuits 565, 566 . . . of the systems ch1 through ch6 are enabled by the automatic bass/chord node signal ABC* which is now "1". The other inputs of the AND gate circuits 565, 566 . . . of the systems ch1 through ch5 (the lower key range channel L and the arpeggio channel A) are supplied with a signal formed by synthesizing with AND gate circuits 567, 568 . . . the frequency divider output signals of the 2 feet type (2′) and 4 feet type (4′). By the synthesis of the two feet and 4 feet types tone source signals having a frequency of the 4 feet type, (although the waveform is different from that of the divider output) are outputted from the AND gate circuits 567 . . . of respective systems ch1 through ch6 and applied to the switch circuits 563 . . . via AND gate circuits 565 . . . To the other input of the AND gate circuit 566 of the system ch6 (bass channel P) is applied a signal formed by synthesizing the divider output signals of the 4 and 8 feet types (4' and 8') with and the AND gate circuit 568, whereby the AND gate circuit 566 produces a tone source signal having a frequency of the 8 feet type (although the waveform is different from that of the frequency divider outputs, and this tone signal is applied to the switch circuit 564. The 4 feet type tone source signals outputted from the AND gate circuits 565 . . . of the systems ch1 through ch4 (the lower key range channel L) via the switch circuits 563 . . . are applied to a chord tone source signal line C4'. In the systems ch5 (arpeggio channel A) the tone source signal of the 4 feet type outputted in the automatic bass/chord mode (ABC* is "1") is applied to an arpeggio tone source signal line A4'. A 8 feet type tone source signal outputted from the AND gate circuit 566 in the system ch6 (bass channel P) via the switch circuit 564 is supplied to a bass tone source signal line P8'.

Figure 29:
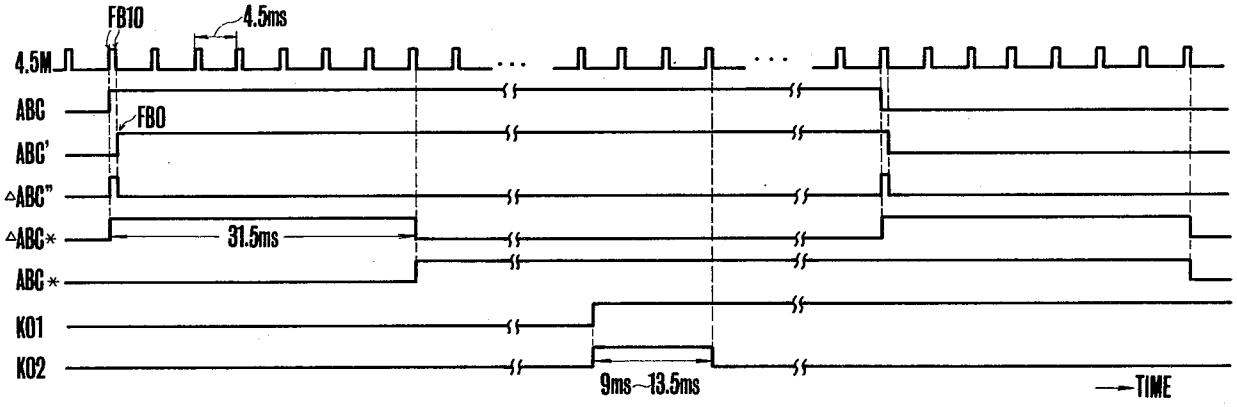
FIG. 29 is a timing chart showing examples of the generation of the mode switching pulse, etc. and the key-on pulse produced by the circuits shown in FIG. 26.

In the musical tone control circuit 53 shown in FIG. 26, includes a circuit which regenerates the automatic bass/chord mode signal ABC* and mode changing pulse ΔABC* based on the automatic bass/chord mode signal ABC given from the latch circuit 532 and the scanning cycle pulse 4.5 M. One examples of the scanning cycle pulse 4.5 M produced by the latch circuit 532 and the automatic bass/chord mode signal ABC* are shown in FIG. 29. Since the latch circuit 532 controls the latching operation at the timing of the time slot "2" (FIG. 27) of the date KC1 through KC4, the timing of producing the pulse 4.5 M or ABC* is synchronous with the timing of the time slots "2", that is the pulse FB10 (FIG. 27). The width of the scanning cycle pulse 4.5 M is one key time and the period thereof is 4.5 ms as already has been pointed out. The repetition period of the pulses FB0 through FB10 is equal to 22 bit times, that is one key time. As a consequence, the pulse 4.5 M produced from the latch circuit 532 change to "1" at the timing of the pulse FB10 and then one key time later to "0" at the timing of the same pulse FB10.

The signal ABC produced by the latch circuit 532 is applied to a delay flip-flop circuit 569 and an exclusive OR gate circuit 570, the former receiving input signal at the timing of the pulse FB6 (FIG. 27) for producing an output corresponding to the input signal at the timing of the pulse FB0 (FIG. 27). As a consequence, as the output signal ABC of the latch circuit 532 becomes "1" at the timing of the pulse FB10, as shown in FIG. 29, the output signal ABC' of the delay flip-flop circuit 569 becomes "1" about one key time later (correctly 24 bit times) at the timing of the pulse FB0. The other input of the exclusive OR gate circuit 570 is supplied with the output ABC' of the delay flip-flop circuit 569 and its output ΔABC" becomes "1" during about one key time (correctly, 24 bit times between pulse FB10 and FB0) immediately after appearance and disappearance of the signal ABC produced by the latch circuit 532 as shown in FIG. 29. This means that when the signal ΔABC" is "1" the mode has changed from the normal mode to the automatic bass/chord mode or vice versa. This mode changing detection signal ΔABC" resets a counter 571 for setting a flip-flop circuit 572. The set output Q thereof is outputted as a mode changing pulse ΔABC*.

The count input T of a counter 571 is supplied via an AND gate circuit 573 with a scanning cycle pulse 4.5 M outputted from the latch circuit 532. The counter 571 receives a signal applied to its count input T at the timing of the pulse FB0 and produces a count value corresponding to the received signal "1" or "0" at the timing of the signal FB6. When the cycle pulse 4.5 M are produced after the resetting of the counter 571 by the signal ΔABC" become 7, the outputs Q1 through Q3 of the counter become "111", while the output of an AND gate circuit 574 becomes "1", which resets a flip-flop circuit 572. Thus, the mode changing pulse ΔABC* outputted from this flip-flop circuit 572 becomes "1" during about 31.5 ms (corresponds to 7 periods of the pulse 4.5 M) at the time of mode change as shown in FIG. 29. When the output of the AND gate circuit 574 becomes "1", the output of the inverter 575 becomes "0", so that the pulse 4.5 M is blocked by the AND gate circuit 573, thus inhibiting succeeding counting operation.

The output of the AND gate circuit 574 is applied to one inputs of AND gate circuits 576 and 577. The other input of the AND gate circuit 577 is supplied with a signal ABC' from the delay flip-flop circuit 569, while that of the AND gate circuit 576 with a signal formed by inverting the signal ABC'. The outputs of the AND gate circuits 576 and 577 are applied respectively to NOR gate circuits 578 and 579 which constitutes a flip-flop circuit. Consequently, as shown in FIG. 29, the automatic bass/chord mode signal ABC* produced by the NOR gate circuit 578 is produced about 31.5 ms later than the production of the signal ABC and disappears about 31.5 ms later than the disappearance of the signal ABC.

The key-on signal KO1 (KO1') latched in the latch circuit 530 of the demultiplexer 50 is inputted to a latch circuit 580, the latch control input L thereof being connected to receive a clock pulse $\phi$A' (FIG. 27). The purpose of the latch circuit 580 is to match the channel timing of the key-on signal KO1 with the channel timing (see the output channel timing of 542 in FIG. 27) of the frequency division data of each channel outputted from the latch circuit 542 (FIG. 28).

A key-on signal KO1 outputted, on the time division bases, from the latch circuit 580 at the same timing of the output channel timing of the output channel timing as the latch circuit 542 is applied to one inputs of AND gate circuits 581, 582 and 583 of a key-on pulse generator 54 and also to one input of an AND gate circuit 584. Where any tone color is selected by a tone color selector 585, the output of an inverter 586 applied to the other input of an AND gate circuit 584 is always "1" so that usually this AND gate circuit 584 passes the key-on signal KO1 produced by the latch circuit 580.

In the key-on pulse generator 54, a two bit adder 587 and two 11 stage/one bit shift registers 588 and 589 constitute a counter capable of counting on the time division basis. The shift registers 588 and 589 are shift-controlled by 2 phase clock pulses $\phi$B' and $\phi$A' having a 2 bits time period and produced by the AND gate circuits 538 and 537, so as to receive input signals at respective stages at the timing action of the pulse $\phi$B' and to set the output states of respective stages by the timing action of the pulse $\phi$A'. The outputs of the shift registers 588 and 589 are applied to an adder 587 to be added to a signal supplied from an AND gate circuit 590. The output of the adder 587 is applied to shift registers 588 and 589 via the AND gate circuits 582 and 583. The AND gate circuit 590 is supplied with a scanning cycle pulse 4.5 M sent from the latch circuit 532 and the output of an NAND gate circuit 591 which is supplied with the outputs of the shift registers 588 and 589.

The key-on signal KO1 applied to the AND gate circuits 582 and 583 from a latch circuit 580 is "0" at a channel timing at which no key is depressed, while the signals outputted from the shift registers 588 and 589 at the same channel timing delayed 11 stages by the pulse $\phi B'$ and $\phi A'$ after one key time (two bit time period) are "0" and the output of the NAND gate circuit 591 is "1". The channel timing of the outputs of the shift registers 588 and 589 is the same as that of the output of the latch circuit 542 shown in FIG. 27. In response to the output "1" of the NAND gate circuit 591 the AND gate circuit 590 passes the scanning cycle pulse 4.5 M to apply it to the adder 587. However, so long as the key-on signal KO1 is "0", the output of the adder 587 is blocked by the AND gate circuits 582 and 583 so that it is not applied to the AND gate circuits 588 and 589.

When a key is newly depressed and the tone production thereof is assigned to a given channel, the key-on signal KO1 becomes "1" at the channel timing thereof. Then at that channel timing AND gate circuits 582 and 583 are enabled to commence counting the number of the scanning cycle pulse 4.5 M. When 3 scanning cycle pulses 4.5 M are produced after the key-on signal KO1 of a given channel has become "1", the outputs of both shift registers 586 and 589 become "1" at that channel timing, whereas the output of the NAND gate circuit 591 becomes "0". This stopping the counting the number of the pulses 4.5 M with reference to that channel timing, and thereafter so long as the key-on signal KO1 of the channel is being produced a count value "11" is circulated and held by the shift resisters 588 and 589.

The output of the NAND gate circuit 591 is applied to one input of the AND gate circuit 581, the other input thereof being connected to receive the output of an NOR gate circuit 592 which is normally "1". Considering a single channel, as shown in FIG. 29, during 9 ms ($2\times4.5$ ms) to 13.5 ms ($3\times4.5$ ms) between the generation of the key-on signal KO1 of "1" of the channel (when the key is depressed) and a time at which the output of the NAND gate circuit 591 becomes "0", the output of the AND gate circuit 581 becomes "1", which is used as a key-on pulse KO2 utilized to form an envelope of the percussive type. This key-on pulse KO2 is produced on the time division base for each channel during about 9 to 13.5 ms subsequent to the production of the key-on signal KO1 of each channel. The channel timing of the key-on pulse KO2 corresponds to the channel timing of the output of the latch circuit 542 (FIG. 28), just like the key-on signal KO1 outputted from the latch circuit 580.

The pulse FB0 outputted from the delay flip-flop circuit 544 of the timing signal generator 52 is applied to the set inputs of a flip-flop circuit 593, while pulse FB6 outputted from the shift register 545 is applied to the reset input R of the flip-flop circuit 593 driven by clock pulse $\phi A'$ and $\phi B'$.

When the pulse FB0 is being produced, "1" is applied to the set input by the timing action of the pulse $\phi A'$ and the output Q is set to the set state ("1") by the action of the next pulse $\phi B'$. Further, when the pulse FB6 is being produced, "1" is applied to the reset input R by the timing action of pulse $\phi A'$, and at the next pulse $\phi B'$ the output Q is set to the reset state ("0"). Thus the output signal LAPch of the flip-flop circuit 593 is "1" between the pulses FB1 and FB6 as shown in FIG. 27. The interval in which this signal LAPch is "1" is interval in which time division data are latched in the systems ch1 through ch6 utilized for the second musical tone production manner (lower key range channel L, arpeggio channel A and bass channel P), in other words, the data regarding time division channels "3", "5", "7", "9", "11" and "2" corresponding to the channels (L, A P) appear as the key-on signal KO1 from the AND gate circuit 584 and as the pulse KO2 from the AND gate circuit 581 (see output channel of 542 shown in FIG. 27).

In the tone color selector 585, it is possible to select the tone colors as follows corresponding to the upper key range (melody), the lower key range (chord, arpeggio and bass)

Upper key range (melody):
piano, harpsichord, organ, strings, brass
Lower key range (chord) and arpeggio:
piano, guitar
Bass:
string bass There are provided a plurality of preset buttons for selecting the tone colors so that by depressing a desired preset button, a tone color selection signal TC can be produced by combining predetermined tone colors. For example, when a preset button is depressed, a tone color selection signal TC is produced which selects a piano as a upper key range melody tone color, a piano as the lower key range (chord) and arpeggio tone colors and a string bass as the bass tone color.

In the tone color selector 585, where a percussive envelope type tone color (for example a piano) is selected as the upper key range (melody) tone color, an upper key range percussive signal U.PERC is produced. On the other hand where no tone color selection switch, that is preset button, is operates, a tone select off signal TSOF is produced which becomes "1" when no tone color is selected. By being inverted by an inverter 586, this signal TSOF disables the AND gate circuit 584 and by being inverted by an NOR gate circuit 592 the signal TSOF disables AND gate 581. Consequently, no tone color is selected, generation of the key-on signal KO1 and key-on pulse KO2 is inhibited.

The tone production control circuit 53 icludes a logic circuit which produces an attack signal AT and a decay signal DC based on a key-on signal KO1 outputted from the AND gate circuit 584, a key-on pulse KO2 outputted from the AND gate circuit 581, a signal LAPch produced by the flip-flop circuit 593, a normal gate signal NG outputted from the latch circuit 532 and a upper key range percussive signal U.PERC. As shown in the following table X, as the attack signal AT and decay signal DC are selected the key-on signal KO1, key-on pulse KO2, KO1 or KO2, KO1 and KO2 being inverted signal KO1 and KO2 respectively.

TABLE X

| | AT | DC |
|---|---|---|
| U | KO1 | $\overline{KO1}$ |
| U.PERC | KO2 | $\overline{KO2}$ |
| L,A,P | KO2 | $\overline{KO2}$ |

TABLE X-continued

| | AT | DC |
|---|---|---|
| NG | KO1 | $\overline{KO1}$ |

In this Table X, U represents a upper key range channel and, U.PERC shows the time that a upper key range percussive signal U.PERC is generated. L, A and P show a lower key range channel, an arpeggio channel and a bass channel respectively. NG shows the time that a normal gate signal NG is produced. When a key-on pulse KO2 is used as the attack signal AT, the amplitude envelope of the musical tone becomes of the percussive type.

In the automatic bass/chord mode, the automatic bass/chord mode signal ABC* applied to an AND gate circuit 594 from the NOR gate circuit 578 is "1" and when the signal LAPch becomes "1" correspondingly to the timings of the lower key range channel L, arpeggio channel A and the bass channel P, the output of the AND gate circuit 594 becomes "1", which is applied to one input of and an AND gate circuit 596 via an OR gate circuit 595. The other input of the AND gate circuit 596 is supplied with a key-on pulse KO2 via an OR gate circuit 597. Accordingly, at the timings of the lower key range channel L, the arpeggio channel A and the bass channel P, the key-on pulse KO2 is selected by the AND gate circuit 596 and outputted as an attack signal AT via an OR gate circuit 598. At this time a signal "0" obtained by inverting the output of the OR gate circuit 595 with an inverter 600 is applied to one input of an AND gate circuit 599 note to be selected the key-on signal KO1. Further, at the timings of the channels L, A and P, the output "1" of the AND gate circuit 594 is inverted by an inverter 601 to apply a signal "0" to one input of an NOR gate circuit 602 so that its output is determined by the state of the key-on pulse KO2 applied to the other input thereof. Although, while the key-on pulse KO2 is "1", the output of the NOR gate circuit 602 is "0", and when the key-on pulse KO2 changes to "0", the output of the NOR gate circuit 602 becomes "1" which is used to produce a decay signal DC via an OR gate circuit 603.

In the automatic bass/chord mode when the automatic rhythm steps and a normal gate signal NG is produced, an AND gate circuit 604 is enabled by the signal LAPch to give a key-on signal KO1 to the OR gate circuit 597. The output thereof corresponds to a combination of a key-on pulse KO2 and a key-on signal KO1 thus substituting pulse KO2 with the signal KO1. Accordingly, the AND gate circuit 596 and the NOR gate circuit 602 are enabled by the key-on signal KO1 so that also at the timings of channels L, A and P, an attack signal AT corresponding to the key-on signal KO1 and a decay signal DC corresponding to the inverted key-on signal $\overline{KO1}$ can be obtained.

The output of the AND gate circuit 594 is "0" at the timing of the upper key range channel, that is the timing of all channels in the normal mode or a timing of predetermined ones of the channels in the automatic bass/chord mode. Because the signal ABC* or LAPch is "0". Thus, the output of an inverter 600 becomes "1" thus enabling the AND gate circuit 599, with the result that the key-on signal KO1 is selected by the AND gate circuit 599 via the OR gate circuit 598 and outputted as an attack signal AT. At this time, since the output of the OR gate circuit 595 is "0", the key-on pulse KO2 is not selected by the AND gate circuit 596. Due to the output "0" of the AND gate circuit 594, the output of the inverter 601 becomes "1", thus fixing the output of the NOR gate circuit 602 to "0". As a consequence, a decay signal DC corresponding to an inverted signal $\overline{KO2}$ of the key-on pulse KO2 would not be produced. As the key-on signal KO1 changes to "0", the output of the inverter 605 becomes "1" so as to produce a decay signal DC corresponding to the inverted signal KO1 via the OR gate circuit 603.

So long as the upper key range percussive signal U.PERC is "1", the output of the OR gate circuit 595 is always "1" so that at the timing of the upper key range channel too, the key-on pulse KO2 is selected as an attack signal AT via the AND gate circuit 596. On the other hand, since the output of the AND gate circuit 594 is always "0", at the timing of the upper key range timing the inverted signal $\overline{KO2}$ of the key-on pulse KO2 will not be produced by the NOR gate circuit 602. Accordingly, the inverted signal $\overline{KO1}$ of the key-on signal KO1 is used as the decay signal DC.

At the same timing as those of the key-on signal KO1 and key-on pulse KO2, that is at the same channel timing as the frequency division ratio data outputted from the latch circuit 542 (FIG. 28), the attack signal AT and the decay signal DC which are produced on the time division bases are supplied to latch circuits 606, 607, 608 . . . of respective musical tone signal generating systems ch1 through ch10 (FIG. 28). Like the latch circuits 546, 547, 548 . . . , to the latch control inputs L of the latch circuits 606, 607, 608 . . . are applied the output of AND gate circuits 606A, 607A and 608A . . . respectively supplied with pulses FB1 through FB10 corresponding to respective systems ch1 through ch10 and the clock pulse $\phi B'$. Thus, like the latch circuits 546, 547, 548 . . . , the latch circuits 606, 607, 608 . . . of the systems ch1 through ch10 latch only the attack signals AT and the decay signals DC supplied at corresponding channel timings.

In this manner, the attack signals AT and the decay signals DC of respective channels are distributed among predetermined systems ch1 through ch10 and converted into direct current signal by the latch circuits 606, 607, 608 . . . .

Figure 30:
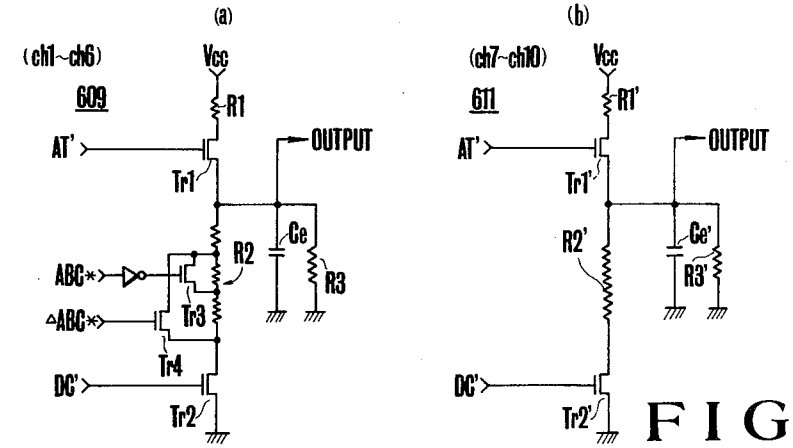
FIGS. 30(*a*) and 30(*b*) are connection diagrams showing envelope generators shown in FIG. 28.

The attach signals AT' and decay signals DC' thus converted into direct current signals are supplied to envelope generators 609, 610, 611 . . . . One example of these envelope generators utilized in the systems ch1 through ch6 is shown in FIG. 30(*a*), while one example of the envelope generator 611 utilized in the systems ch7 through ch10 is shown in FIG. 30(*b*). In these figures, when the attack signal AT' is "1", a capacitor Ce or Ce' is charged through an attack resistor R1 or R1' and a transistor Tr1 or Tr1'. As the decay signal Dc' becomes "1", the capacitor Ce or Ce' is discharged through a decay resistor R2 or R2' and a transistor TR2 or TR2'. The charge-discharge waveform of the capacitor Ce or Ce' is applied to the switch circuit 563, 564, 560 . . . as an envelope control signal. The capacitor Ce and Ce' are provided with discharge circuits in the form of resistor R3 and R3' in parallel therewith respectively. These discharge circuits are provided for the purpose of gradually discharging the capacitors through the resistor R3 and R3' when the decay signal DC' does not immediately change to "1" after the decay signal AT' has changed to "0". For example, generation of the upper keyrange percussive signal U.PERC corresponds to above mention (see Table X).

The composite value of all decay resistors R2 of the envelope generators (FIG. 30(*a*)) of the musical tone signal generating systems ch1 through ch6 is larger than that of the decay resistors R2′ of the systems ch7 through ch10. (See FIG. 30(*b*)). The automatic bass/-chord mode signal ABC* produced by the NOR gate circuit 578 shown in FIG. 26 is applied to the envelope generators 609, 610 . . . of the systems ch1 through ch6, and when this signal ABC* is "1", the transistors Tr3 (FIG. 30(*a*)) of the envelope generators 609, 610 . . . are turned off to maximize the value of the decay resistors R2. More particularly, in the case of the automatic bass/chord mode, since the inverted signal $\overline{KO2}$ of a short pulse KO2 becomes a decay signal DC′, a discharge state would be established immediately after the tone production. For this reason, the discharge time is extended to obtain a percusive type envelope which decreases slowly. When the signal ABC* is "0", transistors Tr3 are turned ON so that the value of the decay resistors R2 will be the same as those of the decay resistors R2′ of the systems ch7 through ch10, because when the signal ABC* is "0", that is in the normal mode, systems ch1 through ch6 are used as the upper key range channels like systems ch7 through ch10.

The mode changing pulse ΔABC* outputted from the flip-flop circuit 572 shown in FIG. 26 is applied to the envelope generators 609, 610 . . . of the systems ch1 through ch6. When the mode changing pulse ΔABC* is produced, transistors Tr4 of the envelope generators 609, 610 . . . (FIG. 30(*a*) are turned ON so as to minimize the values of the decay resistor R2. This mode changing pulse ΔABC* is also applied to an AND gate circuit 612 so that the output thereof becomes "1" when the channel is changed from an upper key range channel U to a lower key range channel L, arpeggio channel A or bass channel P or vice versa, at the timings of the channels "3", "5", "7", "9", "11" and "2" corresponding to the systems ch1 through ch6 in which mode of musical tone production is changed. The output "1" of the AND gate circuit 612 is outputted as a decay signal DC via the OR gate circuit 603. Consequently, upon generation of a mode change pulse ΔABC*, the transistors Tr4 (FIG. 30(*a*) of the envelope generators 609, 610 . . . of the systems ch1 through ch6 are turned ON to apply a decay signal DC to the systems ch1 through ch6 to turn ON decay transistors Tr2. Thus the capacitors Ce are quickly dischanged so that the musical tone that has been produced by the systems ch1 through ch6 up to that instant is rapidly terminated.

Also in the tone production assignment circuit 18 (FIG. 1.), the mode changing pulse ΔABC produced by the mode changing control circuit 15 (FIG. 4) at the time of mode change causes the timing signal generator 20 (FIG. 20) to generate an off channel timing signal OFchT to clear the memory (key-on signal KO1) of the key-on memory device 178 (FIG. 10) regarding the channel timings "3", "5", "7", "9", "11" and "2" corresponding to the systems ch1 through ch6. However, only clearance of the key-on signal KO1 (that is decay signal DC generated interlocked therewith), the tone does not decay immediately due to the presence of the decay resistor R2. Accordingly, the value of the decay resistor R2 is decreased by the mode changing pulse ΔABC* so as to immediately terminate the tone at the time of mode change. With such two staged processing (signal OFchT and rapid discharge), a temporary termination cotrol of the tone of the tone production channel whose musical tone production mode is changed at the time of mode change can be effected accurately thus positively preventing production of unwanted tone at the time of mode change.

As shown in FIG. 26, the mode changing pulse ΔABC* is also applied to the NOR gate circuit 592 of the key-on pulse generator 54. Owing to the generation of the mode changing pulse ΔABC*, the output of the NOR gate circuit 592 becomes "0" thus disabling the AND gate circuit 581 thereby the generatio of the key-on pulse KO2 is inhibited for about 31.5 ms in which the mode changing pulse ΔABC* is produced. This is made for preventing the following problems.

Suppose now that while a key in the upper key range (never change to the lower key range) is being depressed, the mode is changed from the normal mode to the automatic bass/chord mode, and that the tone of the key has been assigned to a channel to be changed to a lower key range channel, for example channel "3". Then the assignment is cleared by an off channel timing signal OFchT generated as a result of the mode change (treated as if the key was released by clearing the key-on signal). Actually, however, as the upper key range key is depressed continuously, the tone of that key is reassigned to any of the channels "4", "6", "8" and "10" which are exclusively used for the upper key range. As a result of this new assignment, the newly assigned channel produces a key-on signal "1" irrespective of the fact that the key is continuously depressed, so that the key-on pulse generator 54 (FIG. 26) produces a key-on pulse KO2. At this time, where a percussive type tone color (for example) is selected as the upper key range tone, the key-on pulse KO2 of the upper key range channel is selected as an attack signal AT by a signal U.PERC generated by a tone color selector 585. Thus, irrespective of the fact that an upper key range key is continuously depressed, an attack signal AT is produced twice based on the key-on pulse KO2 before (at the time of the normal mode) and after the mode change. If this state is permitted to continue, there is a problem of producing twice the percussive type envelope tone despite of the fact that the number of the depressed key was only once. For this reason the mode changing pulse. ΔABC* is used to inhibit key-on pulse KO2 generated immediately after mode change (especially the key-on pulse KO2 of the upper key range channel. Because the lower key range channels are cleared by a signal OFchT at the time of mode change so that no key-on pulse KO2 as well as the key-on signal KO1 is generated) so to prevent generation of an attack signal AT based on the second key-on pulse KO2.

By taking into consideration above described facts, the width of the mode changing pulse ΔABC* or ΔABC is set to be longer than the sum of the time 4.5 ms required for reassignment, that is one key scanning cycle, and the width 9 ms to 13.5 ms of the key-on plse KO2, for example 31.5 ms to positively eliminate the generation of a false key-on pulse KO2 at the time of mode change.

Tone source signals generated by the musical tone signal generating systems ch1 through ch10 are applied to a tone color forming circuit 613 via the lines M2′ to M16, C4′, A4′ and P8′. In response to a tone color selection signal TC sent from the tone color selector 585 (FIG. 26), the tone color forming circuit 613 imparts a melody tone color for the tone source signals on the melody tone source signal lines M2′ through M16′, a chord tone color for the tone source signal on the chord tone source signal line C4′ and the arpeggio tone source signal line A4′ and a bass tone color for the tone source signal an the bass tone source signal line P8′. Accordingly, where the systems ch1 through ch6 are used for the upper key range (melody) (at the time of the normal mode), a melody tone color is imparted to the output tone source signal (M2′ to M16′) of the systems ch1 to ch6 whereas when these systems are utilized for an accompainment tone (at the automatic bass/chode mode), a predetermined accompainment color is imparted to the tone source signals C4′, A4′ and P8′ of these systems.

Processing According to Mode Change

The form of processing in which the mode is switched from normal mode to automatic bass/chord mode (fingered chord mode or single finger mode) can be classified in the following four forms.

(1-a) When, in the normal mode, keys in the key range C7 to G3 have been subjected to the tone production assignment in the musical tone production group ch7 to ch10 (corresponding to channels "4", "6", "8", and "10" in FIG. 6).

In this case, no processing is made in reference to the mode change. The tone production assignment status remains the same even after changing to the automatic bass/chord mode, because these key range C7 and G3 and the group ch7 to ch10 (channel) are the upper key range and upper key range channels both in the normal and automatic bass/chord modes.

(1-b) When, in the normal mode, keys in the key part C7 to G3 have been subjected to the tone production assignment in the musical tone production group ch1 to ch6 (corresponding to channels "3", "5", "7", "9", "11" and "2" in FIG. 6).

In this case, off-channel timing signal OFchT (FIG. 2) is generated according to the channel timing of the above group ch1 to ch6 based on about 31.5 ms mode changing pulse ΔABC (FIG. 5) as shown in FIG. 6. This signal OFchT clears key-on signals KON′ and KO1 in the current key-on memory 177 and key-on memory 178 (FIG. 10). Concurrently generated mode changing pulse ΔABC* (FIGS. 26 and 29) causes the above group ch1 and ch6 to be decayed rapidly, and keys C7 to G3 assigned to said group ch1 to ch6 are taken to be released so that the musical tone is rapidly decayed.

Actually, however, keys C7 to G3 are kept depressed. Accordingly, these keys C7 to G3 are reassigned to the upper key range channels "4", "6", "8" and "10" (FIG. 6), i.e., tone production group ch7 to ch10, which are not cleared by signal OFchT. There is at least one scan cycle (4.5 ms) delay from when the tones of key range C7 to G3 so far assigned to group ch1 to ch6 have been cleared by pulses ΔABC and ΔABC* to when the same tones are reassigned to the group ch7 to ch10.

In this case, if the tone color of continuous tone group is assumed to have been selected as the upper key range tone color, the tones which were continuously produced before the mode change are continuously produced in group ch7 to ch10 even after the mode change. Accordingly, the performer who keeps depressing key range C7 to G3 is entirely free from the effect due to mode change, and the tones can be heard as if the tone production were continued according to the depression of keys. Actually, the continuous tone is momentarily interrupted due to about 4.5 ms delay before reassignment. Such a short interruption, however, cannot be perceived by the human ear.

On the other hand, when the percussive group tone lcolor is selected as the upper key range tone color (when U.PERC is "1"), key-on signal KO1 is generated correspondingly to the upper key range musical tone production group ch7 through ch10 as a result of said reassignment, and key-on pulse KO2 is generated accordingly (FIGS. 26 and 29). As previously described, pulse KO2 is inhibited by pulse ΔABC*. Therefore, there is no reoccurrence of percussive tone due to reassignment after mode change. In other words, percussive tone is not produced again as long as the key is not kept depressed, since percussive tone has already been produced before the mode change.

(1-c) When, in the normal mode, keyboard of F♯3 to C2 have been subjected to the tone production assignment in the upper key range musical tone production group ch7 to ch10.

In this case, key data KD of the lower keyboard, i.e., F♯3 to C2, is temporarily stopped by the mode changing pulse ΔABC generated at mode change. (Refer to AND circuit 142 in FIG. 7). Accordingly, at the upper keyboard channels "4", "6", "8" and "10" corresponding to the group ch7 to ch10, processing is made assuming that keys F♯3 to C2 so far assigned have been released, and the tone of the melody tone color being produced at the group ch7 to ch10 corresponding to the depression of keys F♯3 to C2 is cleared.

As pulse ΔABC disappears, key KD of the lower key range F♯3 to C2 starts being outputted from the key scanner 11. At this time, signal ABC has already turned to be "1" (Refer to FIG. 5), and the tone of depressed lower key range F♯3 to C2 (or single finger mode chord component tone, automatic bass tone, or automatic arpeggio tone) is assigned to any of the lower key range channels, bass channels, or arpeggio channels. Accordingly, even if keys F♯3 to C2 have been kept depressed from before the mode change, when change to the ABC mode takes place, tone assignment is newly made to any of the lower key range channels, arpeggio channels, and bass channels, i.e., musical tone production group ch1 to ch6, as if the lower key range keys F♯3 to C2 were newly depressed.

(1-d) When, in the normal mode, key range of F♯3 to C2 have been production-assigned to the musical tone production group ch1 to ch6.

In this case, the key data KD of the lower key range F♯3 to C2 are stopped by the mode changing pulse ΔABC, the assignment of the group ch1 to ch6 is cleared by the action of off-channel signal OFchT and pulse ΔABC* based on the pulse ΔABC, and the tone of the melody tone color so far produced is disappeared.

As pulse ΔABC disappears, similar to case (1-c), any of chord constituting tones, arpeggio tones, and bass tones based on the tone of depressed lower key range F♯3 to C2 is production-assigned to the group ch1 to ch6.

When changing from automatic bass/chord mode to the normal mode has occured while a lower keyboard key in a lower key range is being depressed (including the case when the key is assumed being depressed by the memory mode), the processing can be classified in the following two forms.

(2-a) The key is actually being depressed in the lower key range.

Automatic accompaniment tone (chord, bass tone, and arpeggio tone) assigned to the channel (group ch1 to ch6) for automatic bass/chord mode is cleared by the mode changing pulses ΔABC and ΔABC*. On the other hand, key data KD of the lower key range F#3 to C2 is temporarily stopped by pulse ΔABC. As the pulse ΔABC disappears, key data of the key range F#3 to C2 starts being fed to the tone production assignment circuit 18, the tones of depressed keys in the key range F#3 to C2 are reassigned to any of all channels (group ch1 to ch10) already changed to the upper key range channel, and tones are newly produced as melody tones.

(2-b) When keys are not depressed in the lower keyboard, and accompaniment tone is produced by the memory mode.

The channels (group ch1 to ch6) for the automatic bass/chord mode are cleared by the mode changing pulses ΔABC and ΔABC*, and chords, bass tones, and arpeggio tones stop. Since keys have not been depressed in the lower key range, reassignment is not made after pulse ΔABC has disappeared. When change from the single finger mode to the fingered chord mode or from the fingered chord mode to the single finger mode has been made while the keys in the lower key range are being depressed (including the case when the keys are taken to be depressed by the memory mode), the processing may be classified in the following 2 forms.

(3-a) When the keys are actually depressed in the lower key range.

In this case, signal ΔF becomes "0" for the period of one key scan cycle (4.5 ms) during the mode change (FIGS. 4 and 5). Correspondingly to the signal ΔF, short pulse ΔABC equivalent to one key scan cycle is generated. During the period of one key scan cycle when the short pulse ΔABC is generated, the assignment of the channels (group ch1 to ch6) for the automatic bass/chord mode is cleared. In the next scan cycle, key data of chord constituting tones, bass tone, and arpeggio tones for the new mode after the mode change or shift (fingered chord mode or single finger mode) are formed, tone production assignment is performed, and new accompaniment tones (chord constituting tones, bass tones, and arpeggio tones) are assigned to the channels (group ch1 to ch6) for the automatic bass/chord mode. Since chords generally differ between the single finger mode and the fingered chord mode even if the keys depressed in the lower key range are the same, the chords, bass tones, and arpeggio tones produced differ from before and after the mode change.

In case of change from the fingered chord mode to single finger mode, the chord memory in the delay flip-flop 289 (FIG. 12), stored during the fingered chord mode, is cleared by the signal ΔF, and "1" is stored in the chord change memory delay flip-flop 299 (FIG. 12) by the inverse signal ΔF of ΔF through the OR gate circuit 410 and AND gate circuit 411 thereby clearing the chord type memories 36 and 37 (FIG. 12). This is for making ready for new chord detection necessitated by the mode change.

(3-b) When tone production is maintained in the memory mode with keys in the lower key range not actually depressed.

In this case, the memory of memory mode signal M in the delay flip-flop 107 in the mode changing controller circuit 15 (FIG. 4) is cleared by the signal ΔF that becomes "0" during the mode change. Turning of the memory mode signal M to "0" causes the lower key range any key-on signal LKAKO (FIG. 14) to become "0", and the bass note key data KP or single finger chord key data SFKL (FIG. 15) is no longer produced. Accordingly, when the channel for the automatic bass/chord mode has once been cleared by ΔABC corresponding to ΔF during the mode change, no reassignment is made thereafter.

Off-channel timing signal OFchT generated based on the mode change pulse ΔABC is also fed to the truncate circuit 22 shown in FIG. 11 with the resultant forced re-setting of count value of the applicable channel in the released key counter composed of the shift registers 217 to 220 and the adder 216 to "0001". Since when key-on signal KO1 is cleared by the signal OFchT, new key-off signal NKOF is not generated, processing similar to that when NKOF is generated is performed, i.e., the count value is reset to "0001". This makes possible the truncation of the channel cleared by the signal OFchT.

Mode changing pulse ΔABC is also used for resetting RUN memory 47 of the automatic rhythm device 45 (FIG. 1). This is for the following reason. When the automatic rhythm is turned to be in the synchro start mode by turning ON the synchro start switch SYNC (FIG. 1) during the memory mode of the automatic bass/chord mode, the lower key range any key-on signal LKAKO continues to be "1" after the lower key range key has once been depressed (by memory mode signal M as shown in FIG. 14). RUN memory 47 is kept set. For this reason, upon changing to the normal mode, the RUN memory 47 is reset by pulse ΔABC, and the automatic rhythm is returned to the waiting status.

Though the above embodiment shows the present invention applied to an electronic musical instrument of the single keyboard type, the invention may also be applied to electronic musical instruments of plural keyboard type. For example, the operation is almost the same as the operation described in the example if the upper keyboard takes the place of the upper key range, and the lower keyboard the place of the lower key range. The tone production assignment circuit may be of the type making non-time division assignment instead of the type making time division assignment as shown in the example. Essential is the circuit performing tone production assignment based on the time division multiplex key data which becomes "1" or "0" in the time slot corresponding to each key according to ON/OFF status of that key.

As described above, according to the present invention, since the musical tone production manner in the tone production channel can be changed according to the performance mode (normal mode or automatic bass/chord mode), the limited number of tone production channels can be used effectively. For example, in the normal mode in which only melody tones are produced, all 10 channels (in the case of 10 channel mode) become the upper key range channels, i.e., melody tone channels and a maximum of 10 melody tones can be produced simultaneously by the use of the whole keyboard. This means that even when keys are depressed by all ten fingers, the melody tone corresponding to the depressed key is produced. Accordingly, free melody performance can be made independently. On the other hand, in the automatic bass/chord mode when melody tones are performed together with accompaniment tones, the number of upper key range channels, i.e., melody tone color channels, and the number of accompaniment channels are changed to 4 and 6 respectively (for the latter, 4 out of 6 channels are for the lower key range chord). Accordingly, the maximum number of tones (4) sufficient for operating keys by the fingers of one hand can be obtained. Therefore, the limited number of production channels can be effectively utilized according to the performance mode. Accordingly, the reduction of total number of production channels may result in cost reduction. Availability of sufficient number of production channels as required eliminates the inability of performance due to the shortage of production channels.

Through the application of time division multiplex one-bit key data KD which identifies each key by the time position (generation timing) from the scan standard time (4.5 M generation time), as the information indicating the depressed key, processing circuits utilizing depressed key information, such as those for identification of the key range to which the depressed key belongs and the formation of automatic tone data based on the depressed key tone, become very simple. The window circuit 21 identifying the key range the depressed key belongs to according to the performance mode finds the key range from the generation timing of key data KD (KU or KL), and it consists only of very simple AND and OR gate circuits. This is far simpler in construction than ROM and the comparator which detects the key range after several comparisons or inquiries. Accordingly, in a system like this invention in which the relationship between the key range and production channel varies according to the performance mode, using one-bit key data multiplexed on the time division basis by the key scan is significant from the aspect of simplification of the circuit composition.

According to the present invention, as the second musical tone production manner, not only the one-kind musical tone production manner (the lower key range depressed key tone is produced in a chord tone color when the key range division has been made) corresponding to the key depression but also the musical tone production manners (automatic bass and automatic arpeggio) for the automatic tone not directly corresponding to actual key depression (indirectly relates via the chord) can be set. Therefore, utilization of the limited number of production channels is further promoted. As the specified production channel is shifted to the second musical tone production manner (accompaniment performance) by mode change, key data of the automatic bass tone or single finger chord is formed based on the key data (data indicating the note name or tone color according to the generation timing). At this time, since the note timing data of the subordinate note can be obtained only by sequential delaying of the root note timing data in the root note shift register 41, no circuit such as the calculation circuit for note value addition is required. Accordingly, the circuit forming the automatic tone data not directly corresponding to the keyboard in the second musical tone production manner can be simplified to a great extent by the use of time division multiplex key data (or note timing data) corresponding to the time position.

What is claimed is:

1. An electronic musical instrument comprises:

a plurality of keys;

means for forming time division multiplex first key data determined by the depressed status of all keys;

means for generating key codes corresponding to all keys synchronized with said key data;

key code memory means having a plurality of channels less than the total number of keys and receiving outputs of said key code generating means;

tone generating means having a plurality of musical tone production channels corresponding to individual channels of said key code memory means;

means for selecting one of plural performance modes;

assign channel setting means for storing said key codes from said key code generating means in selecting subsets of the channels of said key code memory means in different manners according to the selected performance mode and in response to supplied multiplex key data.

2. An electronic musical instrument according to claim 1, wherein said key code generating means comprises:

first and second counters of plural bits, each of said counters counting at predetermined timings and sending key codes formed by combining parallel outputs of said counters; and said key data forming means comprises:

a first decoder and a second decoder for respectively decoding parallel outputs of said first and second counters;

a multiplexer for receiving the output of said second decoder as one of its inputs;

means for sequentially scanning keys based on the output of said first decoder; and means for applying to said multiplexer as another input key data relative to key depression status obtained by said scanning operation so that time division multiplex key data is outputted from said multiplexer.

3. An electronic musical instrument according to claim 1, wherein said assign channel setting means comprises:

window means for designating a key data path from a plurality of key data paths through which an output from said key data forming means is to be distributed in a different manner according to an output of said performance mode selecting means;

means for designating respective subsets of channels of said key code memory with which each designated key data path is to be coupled in a different manner according to said selected performance mode; and means for storing said key code in said key code memory means based on the outputs of said window means and said memory channel couple designating means.

4. An electronic musical instrument according to claim 1 wherein said mode selecting means comprises:

means for selecting a first mode which causes all musical tone production channels to correspond with a first musical tone production manner and a second mode which causes a predetermined part of said musical tone production channels to correspond with a second musical tone production manner and the remaining part with said first musical tone production manner.

5. An electronic musical instrument according to claim 4, wherein said assign channel setting means comprises:

window means which designates one of a plurality of key data paths through which an output of said key data forming means is to be distributed in a different manner according to an output of said performance mode selecting means;

memory channel couple designating means for designating a channel of the key code memory means with which said key data path is to be coupled in a different manner according to said selected performance mode; and means for storing said key code in said key code memory means based on the outputs of said window means and said memory channel couple designating means, the number of said key data paths being two;

said window means distributing all key data from said key data forming means to the first path in the first mode and distributing said key data to the first and second paths according to its generation timing in the second mode; and wherein said couple designating means relates all channels to said first path in the first mode and relates part of the channels to the second path in the second mode while relating different channels to the first path.

6. An electronic musical instrument according to claim 4, wherein said electronic musical instrument further comprises:

means for forming time division multiplex second key data based on said first key data from said key data forming means but different therefrom, and wherein said assign channel setting means stores said key code in certain of the channels of the key code memory means taking into account the second key data from said second key data forming means.

7. An electronic musical instrument according to claim 6, wherein said assign channel setting means comprises:

means for designating a channel of the key code memory means with which outputs of said first and second key data forming means are to be coupled in a different manner according to the selected performance mode; and means for storing the key code in the key code memory means according to said outputs of said first and second key data forming means and said memory channel couple designating specifying means.

8. An electronic musical instrument according to claim 7 wherein said assign channel setting means comprises:

window means for distributing the outputs of said first and second key data forming means to two key data paths in different manners according to said performance mode selecting means, said window means, in the first mode, distributing all key data from said key data forming means, said window means, in the second mode, inhibiting a distribution of a part of said output of said first key data forming means so as to distribute said output of said second key data forming means, and distributing the remaining output of said first key data forming means to the first path; and said couple designating means comprises:

means for coupling all channels with the first path in the first mode, and in the second mode, coupling a predetermined part of said channels with the second path and also coupling a channel different from said predetermined path of said channels with the first path.

9. An electronic musical instrument according to claim 8, wherein said mode selecting means further includes means for selecting a third mode in which a predetermined part of said musical tone production channels are caused to correspond with the second musical tone production manner and the remaining part is caused to correspond with said first musical tone production manner;

said window means comprises means for, in the third mode, distributing a part of said first key data to the first path and distributing the remaining part of said first key data to the second path; and said second key data forming means comprises means for forming a plurality of key data composing a chord based on said first key data.

10. An electronic musical instrument according to claim 8, wherein said second key data forming means comprises means for forming a plurality of key data composing a chord based on said first key data.

11. An electronic musical instrument according to claim 8, wherein said second key data forming means includes means for forming a plurality of key data composing bass based on said first key data.

12. An electronic musical instrument according to claim 8, wherein said second key data forming means comprises means for forming a plurality of key data composing arpeggio based on said first key data.

13. An electronic musical instrument according to claim 1, wherein said electronic musical instrument further comprises;

a second and third means for respectively forming time division multiplexed second and third key data different from said first key data but based thereon; and wherein said second key data forming means comprises means for forming a plurality of key data representing a chord;

said third key data forming means comprises means for forming a key data which forms an accompaniment tone different from said chord;

said assign channel setting means further comprises window means which designates one of three key data paths to which the outputs of said first and second key data forming means are to be distributed in a different mode according to the performance mode selected by said performance mode selecting means, means for designating a channel of said key code memory means with which said key data route is to be coupled in a different mode according to the selected performance mode, means for causing a key code to be stored in the key code memory means according to the channel and path respectively designated by said memory channel couple designating means and said window means;

said mode selecting means comprises means for selecting either a first mode in which all musical tone production channels are caused to correspond with a first musical tone production manner or a second mode in which a part of the tone production channels are caused to correspond with second and third musical tone production manners, and the remaining part of said tone production channels is caused to correspond with said first musical tone production manner;

said couple designating means comprises means for, in the first mode coupling all channels with the first path, and in the second mode coupling a predetermined part of the channels with the second path, coupling a channel different from said predetermined channel with the third path and coupling the remainder with the first path; and said window means comprises means for, in the first mode distributing all key data from said key data forming means to the first path, in the second mode distributing the first key data from said key data forming means to the first path, and the second and third key data to the second and third path.

14. An electronic musical instrument according to claim 1 wherein said electronic musical instrument further comprises means for forming time division multiplex second key data different from the first key data but based on the output of said key data forming means; and wherein said second key data forming means comprises means for forming a key data representing an accompaniment tone;

said assign channel setting means further comprises window means for designating a key data path out of three key data paths to which said outputs of said first and second key data forming means are to be distributed in a different manner according to the performance mode selected by said performance mode selecting means, means for designating a channel of said key code memory means with which said key data path is to be coupled in a different manner according to the selected performance mode and means for causing a key code to be stored in said key code memory means according to said memory channel couple designating means;

said mode selecting means comprises means for selecting either a first mode in which all tone production channels are caused to correspond with a first musical tone production manner or a second mode in which a part of the tone production channels are caused to correspond with second and third musical tone production manners with the remainder caused to correspond with said first musical tone production manner;

said couple designating means comprises means, in the first mode coupling all channels with the first path, in the second mode coupling a predetermined part of said tone production channels with the second path, coupling a channel different from said predetermined part with the third path and coupling the remainder with the first path; and said window means comprises means for, in the first mode, distributing all key data from said key data forming means to the first path and, in the second mode, distributing first key data to the first and second paths and the second key data to the third path.

15. An electronic musical instrument according to claim 13 or 14 wherein said accompaniment tone is bass.

16. An electronic musical instrument according to claim 13 or 14 wherein said accompaniment tone is arpeggio.

17. An electronic musical instrument according to claim 1 wherein said musical tone production means comprises means for generating signals corresponding with plural musical tones based on key data from the key code memory means provided for each channel, and a circuit for selecting the tone production manner for each channel according to said mode selecting means.

18. In an electronic musical instrument of the type having a channel assignor which stores the key codes of musical tones to be produced and repetitively provides these key codes to tone generation means having plural tone generation channels, and in which a time division multiplex first key data signal is generated which indicates depressed keys on at least one keyboard, and having at least one selectable automatic performance mode capability, the improvement for providing different channel assignment allocations depending on the selected performance mode, comprising:

tone production assignment circuit means, receiving said first key data signal and responsive to performance mode selection, for assigning key codes corresponding to all depressed keys to any of said channels in a normal playing mode, and, in an automatic performance mode, for assigning key codes corresponding to depressed keys in only a certain region of said keyboard to a first group of tone generation channels and assigning key codes for an automatic performance to another group of tone generation channels, said key codes for automatic performance being designated in response to that portion of said first key data signal relating to keys in the remaining region of said keyboard, and means for selecting the manner of tone production differently for said first and other groups of channels when an automatic performance mode is selected.

19. A keyboard electronic musical instrument having normal and automatic performance playing modes, and having a key data converter means which stores the key codes of musical notes to be produced and supplies these in time shared order to a tone generation means having plural tone production channels, the improvement wherein:

the keyboard of said instrument is divided into an upper region and a lower region, said instrument having:

tone production assignment circuit means, operative in the normal playing mode to assign key codes for any depressed key on said keyboard to any tone production channel, and operative in an automatic performance mode to assign key codes for depressed keys in said upper region only to a first group of said tone production channels, and to assign key codes based on depressed keys in said lower region only to a second group of tone production channels different from said first set.

20. An electronic musical instrument according to claim 19 wherein depressed keys in said keyboard are designated by a time division multiplex first key data signal of which certain portions refer to keys in said upper region and other portions refer to keys in said lower region, and wherein said tone production assignment circuit means is responsive to said first key data signal.

21. A keyboard electronic musical instrument according to claim 20 further comprising:

automatic performance mode key data forming circuit means, operative during an automatic performance mode, for producing one or more separate time division multiplex key data signals, based on the portion of said first key data designating depressed keys in said lower region only of said keyboard, and representing tones to be produced for automatic performance, and wherein said tone production assignment circuit means selectively assigns key codes corresponding to said one or more separate key data signals only to certain subgroups of said tone production channels in said second group when an automatic performance mode is selected.

22. A keyboard electronic musical instrument according to claim 19 wherein said tone production assignment circuit means comprises:

a timing signal generator for producing separate signals which designate, in correspondence with said time shared order, which tone production channels are included in each of certain subgroups allocated to tone production for different selectable performance modes, and a tone production assignment controller, cooperating with said timing signal generator, for directing storage in said key data converter means, in a normal production mode, of key codes for any depressed key in any tone production channel, and for directing storage, in an automatic performance mode, of key codes for automatic performance only in channels corresponding to those designated by the separate channel designating signal which corresponds to the subgroup of tone production channels allocated to tone production for the selected automatic performance mode.

23. a keyboard electronic musical instrument according to claim 19 further comprising:

key scanner means for providing a time division multiplex first key data signal which indicates depressed keys, and wherein said tone production assignment circuit means includes:

a window circuit means for separating said first key data signal, on a time basis, into portions respectively representing separate upper and lower regions of said keyboard, and for providing the separated key data signals for separate assignment to different channel groups in accordance with the selected performance mode.

* * * * *